US005484673A

United States Patent [19]

Kikuchi et al.

[11] Patent Number: 5,484,673

[45] Date of Patent: Jan. 16, 1996

[54] ELECTROPHOTOGRAPHIC PHOTOSENSITIVE MEMBER

[75] Inventors: Toshihiro Kikuchi, Yokohama; Akio Maruyama, Kawasaki; Noriko Ohtani; Shin Nagahara, both of Tokyo; Hisami Tanaka, Yokohama; Teigo Sakakibara, Tokyo; Takakazu Tanaka, Machida, all of Japan

[73] Assignee: Canon Kabushiki Kaisha, Tokyo, Japan

[21] Appl. No.: 393,038

[22] Filed: Feb. 23, 1995

Related U.S. Application Data

[63] Continuation of Ser. No. 93,135, Jul. 19, 1993, abandoned, which is a continuation of Ser. No. 727,521, Jul. 9, 1991, abandoned.

[30] Foreign Application Priority Data

| | | | |
|---|---|---|---|
| Jul. 10, 1990 | [JP] | Japan | 2-180577 |
| Jul. 10, 1990 | [JP] | Japan | 2-180578 |
| Jul. 10, 1990 | [JP] | Japan | 2-180579 |
| Jul. 11, 1990 | [JP] | Japan | 2-181627 |
| Jul. 11, 1990 | [JP] | Japan | 2-181628 |
| Jul. 11, 1990 | [JP] | Japan | 2-181629 |
| Jul. 11, 1990 | [JP] | Japan | 2-181630 |
| Jul. 12, 1990 | [JP] | Japan | 2-182687 |
| Jul. 12, 1990 | [JP] | Japan | 2-182688 |
| Jul. 12, 1990 | [JP] | Japan | 2-182689 |
| Jul. 13, 1990 | [JP] | Japan | 2-184185 |
| Jul. 13, 1990 | [JP] | Japan | 2-184186 |
| Jul. 13, 1990 | [JP] | Japan | 2-184187 |
| Jul. 25, 1990 | [JP] | Japan | 2-195053 |
| Sep. 10, 1990 | [JP] | Japan | 2-236998 |
| Oct. 11, 1990 | [JP] | Japan | 2-273584 |

[51] Int. Cl.[6] ..... G03G 15/02

[52] U.S. Cl. ..... 430/58; 430/60; 430/72; 430/73; 430/78

[58] Field of Search ..... 430/58, 60, 72, 430/73, 78, 83

[56] References Cited

U.S. PATENT DOCUMENTS

| | | | |
|---|---|---|---|
| 4,066,454 | 1/1978 | Hashimoto | 96/1.5 R |
| 4,072,519 | 2/1978 | Pearson et al. | 96/1.5 R |
| 4,184,871 | 1/1980 | Oba et al. | 430/90 |
| 4,390,608 | 6/1983 | Hashimoto et al. | 430/57 |
| 4,599,287 | 7/1986 | Fujimaki et al. | 430/59 |
| 4,798,777 | 1/1989 | Takiguchi et al. | 430/59 |
| 4,861,692 | 8/1989 | Kuroda et al. | 430/59 |
| 5,034,294 | 7/1991 | Go et al. | 430/58 |
| 5,153,085 | 10/1992 | Akasaki et al. | 430/58 |

FOREIGN PATENT DOCUMENTS

| | | |
|---|---|---|
| 144791 | 6/1985 | European Pat. Off. . |
| 2265720 | 10/1975 | France . |
| 54-58445 | 5/1979 | Japan . |
| 54-151955 | 11/1979 | Japan . |

(List continued on next page.)

OTHER PUBLICATIONS

Patent Abstracts of Japan, vol.6, No.22 (P-101) [900] Feb. 9, 1982, JPA-56-144432.

(List continued on next page.)

*Primary Examiner*—S. Rosasco

*Attorney, Agent, or Firm*—Fitzpatrick, Cella, Harper & Scinto

[57] ABSTRACT

An electrophotographic photosensitive member of the present invention has a photosensitive lazer containing a compound represented by the formula (1):

(1)

The electrophotographic photosensitive member has a high sensitivity and can maintain stable and excellent electrophotographic characteristics even when repeatedly used.

7 Claims, 1 Drawing Sheet

FOREIGN PATENT DOCUMENTS

| | | |
|---|---|---|
| 55-52063 | 4/1980 | Japan . |
| 58-198043 | 11/1983 | Japan . |
| 61-75355 | 4/1986 | Japan . |
| 61-132955 | 6/1986 | Japan . |
| 61-148159 | 7/1986 | Japan . |
| 61-239248 | 10/1986 | Japan . |
| 63-70257 | 3/1988 | Japan . |
| 63-72664 | 4/1988 | Japan . |
| 63-85749 | 4/1988 | Japan . |
| 63-104061 | 5/1988 | Japan . |
| 63-174993 | 7/1988 | Japan . |

OTHER PUBLICATIONS

Patent Abstracts of Japan, vol.14, No.369 (P–1090) [4312] Aug. 9, 1990, JPA–02–136860.

Patent Abstracts of Japan, vol.14, No.169 (P–1032) [4112] Mar. 30, 1990, JPA–02–024664.

Database WPIL, Section Ch, Week 8930, Derwent, Class A89, An 89–215906 [30] JP 1152461.

Patent Abstracts of Japan, vol.13, No.85 (P–834) [3433], Feb. 27, 1989 JP 63–267948.

Database WPIL, Section Ch, Week 9030, Derwent Public, Class A89, AN 221832 (30) JP 2156247.

Patent Abstracts of Japan. vol.12, No.427 (P–784) [3274], Nov. 11, 1988, JP63–158559.

Patent Abstracts of Japan, vol.12, No.427 (P–784) [3274], Nov. 11, 1988, JP63–158556.

ELECTROPHOTOGRAPHIC PHOTOSENSITIVE MEMBER

This application is a continuation of application Ser. No. 08/093,135 filed Jul. 19, 1993, now abandoned, which is a continuation of application Ser. No. 07/727,521, filed Jul. 9, 1991, now abandoned.

BACKGROUND OF THE INVENTION

1. Field of the Invention

The present invention relates to an electrophotographic photosensitive member having improved electrophotographic characteristics, and more specifically it relates to an electrophotographic photosensitive member having a photosensitive layer containing a compound with a specific structure.

2. Related Background Art

An organic electrophotographic photosensitive member containing an organic photoconductive compound as the main component has many advantages, and for example, it is free from drawbacks of an inorganic photosensitive member regarding film-forming properties, plasticity and manufacturing cost. Therefore, in recent years, much attention has been paid to the organic electrophotographic photosensitive member, and many techniques concerning the same have been suggested and some of them have been put into practice.

As such an organic photosensitive member, there has been suggested an electrophotographic photosensitive member mainly comprising a photoconductive polymer typified by poly(N-vinylcarbazole) or a charge transfer complex made from a Lewis acid such as 2,4,7-trinitro-9-fluorenone.

This kind of organic photoconductive polymer is better in lightweight properties and film-forming properties as compared with an inorganic photoconductive polymer, but the former is inferior to the latter in sensitivity, durability and stability to environmental change. For this reason, the organic photoconductive polymer is not always satisfactory.

Later, the electrophotographic photosensitive member of a separate-function type, which comprises different substances each bearing a charge-generating function or a charge-transporting function, has brought about improvements in sensitivity and durability which has made conventional organic photosensitive members disadvantageous. Such a separate-function type of photosensitive member is advantageous because the substances for the charge-generating substance and the charge-transporting substance can be selected respectively from a wide range of substances, which allows easier production of the electrophotographic photosensitive member having desired properties.

As the charge-generating substance, there have been known azo pigments, polycyclic quinone pigments, cyanine dyes, squaric acid dyes and pyrylium salt dyes. Above all, the azo pigments are preferable because of strong light resistance, high charge-generating ability and the relatively easy synthesis of materials and the like, and many kinds thereof have been suggested and put into practice.

Examples of the known charge-transporting substances include pyrazolines in Japanese Patent Publication No. 52-4188, hydrazones in Japanese Patent Publication No. 55-42380 and Japanese Patent Application Laid-open No. 55-52063, triphenylamines in Japanese Patent Publication No. 58-32372 and Japanese Patent Application Laid-open No. 61-132955, and stilbenes in Japanese Patent Application Laid-open Nos. 54-151955 and 58-198043.

The charge-transporting substance can be classified into a hole-transporting type and an electron-transporting type, but the above-mentioned charge-transporting substances and most of charge-transporting substances used in the organic electrophotographic photosensitive members which have been put into practice so far are of the hole-transporting type. In many cases of the photosensitive members each comprising the charge-transporting substance with hole-transporting ability, each photosensitive member has a conductive support, a charge-generating layer and a charge-transporting layer in this order, and in this case, the polarity of the charge which moves to the photosensitive member is negative. When the polarity of the charge is negative, ozone is generated at the time of charging and causes the photosensitive member to be chemically modified inconveniently. Thus, this kind of photosensitive member is inferior to inorganic photosensitive members such as a-Se and a-Si in durability.

As a measures against the deterioration of the photosensitive member with ozone generated at the time of charging, it has been suggested an electrophotographic photosensitive member having a conductive support, a charge-transporting layer and a charge-generating layer in this order, and an electrophotographic photosensitive member in which a protective layer is disposed on a photosensitive layer, for example, in Japanese Patent Application Laid-open Nos. 61-75355 and 54-58445.

However, in the electrophotographic photosensitive member having such a layer constitution, the relatively thin charge-generating layer is used as an upper layer, and when the member is repeatedly used, the surface of the photosensitive member is severely damaged by abrasion. In the photosensitive member provided with the protective layer for the purpose of solving this problem, this protective layer is an insulating layer, and therefore when the protective layer is repeatedly used, its potential is not stable, so that stable characteristics of the member cannot be maintained.

In view of the foregoing, it is desired to invent an organic electrophotographic photosensitive member which has a conductive support, a charge-generating layer and a charge-transporting layer in this order and which can be used in a condition that a positive pole is charged. However, in order to realize this expectation, a charge-transporting substance having electron-transporting ability is required. Suggested examples of the charge-transporting substance having the electron-transporting ability include 2,4,7-trinitro-9-fluorenone (TNF), dicyanomethylenefluorene carboxylate in Japanese Patent Application Laid-open No. 61-148159, anthraquinodimethane in Japanese Patent Application Laid-open Nos. 63-70257, 63-72664 and 63-104061, 1,4-naphthoquinone in Japanese Patent Application Laid-open No. 63-85749, and diphenyldicyanoethylene in Japanese Patent Application Laid-open Nos. 63-174993. Japanese Patent Application Laid-Open No. Hei 2-97953 suggests an electrophotographic photosensitive member having a charge-generating layer comprising a positive hole-transporting charge-generating material and a small amount of dicyanovinyl compound having a specific constitution.

However, to fill the present demand of a high-quality image, an electrophotographic photosensitive member has been investigated which can sufficiently meet requirements such as sensitivity, potential properties, cost and the compatibility of the charge-transporting substance with an organic solvent or a binder.

SUMMARY OF THE INVENTION

An object of the present invention is to provide an electrophotographic photosensitive member having a photosensitive layer containing a charge-transporting substance with a novel structure.

Another object of the present invention is to provide an electrophotographic photosensitive member which has a high sensitivity and which can maintain stable and excellent electrophotographic characteristics, even when repeatedly used.

That is, the first aspect of the present invention is directed to an electrophotographic photosensitive member comprising an electroconductive support and a photosensitive layer on the electroconductive support, and the photosensitive layer contains, as a charge-transporting substance, a compound represented by the formula (1)

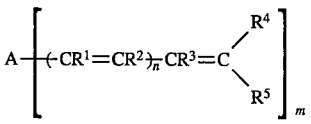

(1)

wherein A is an aromatic ring group derived from an aromatic compound having an reduction potential of −1.05 V or more; each of $R^1$, $R^2$, $R^3$, $R^4$ and $R^5$ is a hydrogen atom, a substituted or unsubstituted alkyl group, a substituted or unsubstituted aralkyl group, or a substituted or unsubstituted aromatic ring group, and $R^1$, $R^2$, $R^3$, $R^4$ and $R^5$ may be different or identical, provided that $R^4$ and $R^5$ are not hydrogen atoms at the same time; n is an integer of 0 or 1; and m is an integer of 1 or 2.

The second aspect of the present invention is directed to an electrophotographic photosensitive member comprising an electroconductive support and a photosensitive layer on the electroconductive support, and the photosensitive layer contains a compound selected from the group consisting of a compound having a partial structure represented by the formula

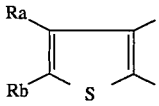

wherein each of $R_a$ and $R_b$ is a hydrogen atom, a halogen atom, a substituted or unsubstituted alkyl group, a substituted or unsubstituted aralkyl group, or a substituted or unsubstituted aromatic ring group, $$-(CH{=}CH)_p-NO_2,\ -(CH{=}CH)_q-R_c$$

$$\text{or } -(CH{=}CH)_r-CH{=}\overset{\overset{R_d}{|}}{C}-R_e;$$

each of $R_c$ and $R_d$ is an aromatic ring group having a nitro group or a heterocyclic ring group having the nitro group; $R_e$ is a substituted or unsubstituted alkyl group, a substituted or unsubstituted aralkyl group, a substituted or unsubstituted aromatic ring group, or a substituted or unsubstituted heterocyclic ring group; and $R_d$ and $R_e$ may be bonded to form a ring directly or with the interposition of a saturated hydrocarbon, an unsaturated hydrocarbon, an oxygen atom or a sulfur atom; each of p and q is an integer of 0, 1 or 2; and r is an integer of 0 or 1, and having at least one group selected from the group consisting of $-(CH{=}CH)_p-NO_2$, $-(CH{=}CH)_q-R_c$ and $$-(CH{=}CH)_r-CH{=}\overset{\overset{R_e}{|}}{C}-R_d;$$

a compound represented by the formula (4)

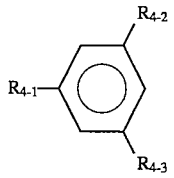

(4)

wherein $R_{4-1}$ is a thiophene ring group having a nitro group; each of $R_{4-2}$ and $R_{4-3}$ is a hydrogen atom, a halogen atom, a substituted or unsubstituted alkyl group, a substituted or unsubstituted aralkyl group, a substituted or unsubstituted aromatic ring group, a nitro group, a cyano group, $-(CH{=}CH)_f-NO_2$, $-(CH{=}CH)_g-R_{4-4}$ or $$-(CH{=}CH)_h-CH{=}\overset{\overset{R_{4-5}}{|}}{C}-R_{4-6},$$

at least either of $R_{4-2}$ and $R_{4-3}$ is $$-(CH{=}\underset{\underset{R_{4-5}}{|}}{CH})_f-NO_2,$$

$-(CH{=}CH)_g-R_{4-4}$ or $-(CH{=}CH)_h-CH{=}C\text{-}R_{4-6}$; each of $R_{4-4}$ and $R_{4-5}$ is an aromatic ring group having a nitro group or a heterocyclic ring group having a nitro group; and $R_{4-6}$ is a substituted or unsubstituted alkyl group, a substituted or unsubstituted aralkyl group, a substituted or unsubstituted aromatic ring group, or a substituted or unsubstituted heterocyclic ring group; and each of f and g is an integer of 1 or 2; h is an integer of 0 or 1; each of $R_{4-5}$ and $R_{4-6}$ may be bonded to form a ring directly or with the interposition of a saturated hydrocarbon, an unsaturated hydrocarbon, an oxygen atom or a sulfur atom; a compound represented by the formula (15)

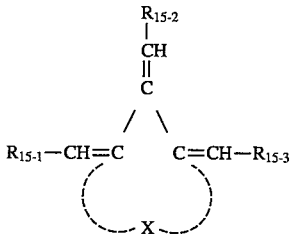

(15)

wherein each of $R_{15-1}$, $R_{15-2}$ and $R_{15-3}$ is $-(CH{=}CH)_s-NO_2$, $-(CH{=}CH)_t-R_{15-4}$ or $$-(CH{=}CH)_u-CH{=}\overset{\overset{R_{15-5}}{|}}{C}-R_{15-6};$$

s is an integer of 0 or 1; each of t and u is an integer of 0 or 1; each of $R_{15-4}$ and $R_{15-5}$ is an aromatic ring group having a nitro group or a heterocyclic ring group having a nitro group; $R_{15-6}$ is a substituted or unsubstituted alkyl group, a substituted or unsubstituted aralkyl group, a substituted or unsubstituted aromatic hydrocarbon group, or a substituted or unsubstituted heterocyclic ring group; X is a substituted or unsubstituted divalent aromatic hydrocarbon ring group or a residue necessary to form a saturated hydrocarbon ring together with an adjacent carbon atom; and a compound represented by the formula (16)

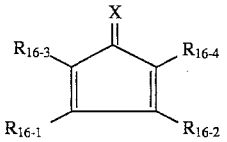

(16)

wherein each of $R_{16-1}$ and $R_{16-2}$ is a substituted or unsubstituted alkyl group or a substituted or unsubstituted aromatic ring group; each of $R_{16-3}$ and $R_{16-4}$ is a hydrogen atom, a halogen atom, a substituted or unsubstituted alkyl group, a substituted or unsubstituted aralkyl group or a substituted or unsubstituted aromatic ring group; X is an oxygen atom, a sulfur atom, $=C(CN)_2$, $$=\overset{R_{16-5}}{\overset{|}{C}}-R_{16-6} \text{ or } =CH-CH=\overset{R_{16-7}}{\overset{|}{C}}-R_{16-8};$$

each of $R_{16-5}$ and $R_{16-6}$ is a halogen atom, a substituted or unsubstituted alkyl group, a substituted or unsubstituted aromatic ring group or a substituted or unsubstituted heterocyclic ring group; each of $R_{16-7}$ and $R_{16-8}$ is a hydrogen atom, a cyano group, a substituted or unsubstituted alkyl group, a substituted or unsubstituted aromatic ring group or a substituted or unsubstituted heterocyclic ring group except that $R_{16-5}$ and $R_{16-6}$ as well as $R_{16-7}$ and $R_{16-8}$ are not hydrogen atoms at the same time.

DETAILED DESCRIPTION OF THE PREFERRED EMBODIMENTS

Figure 1:
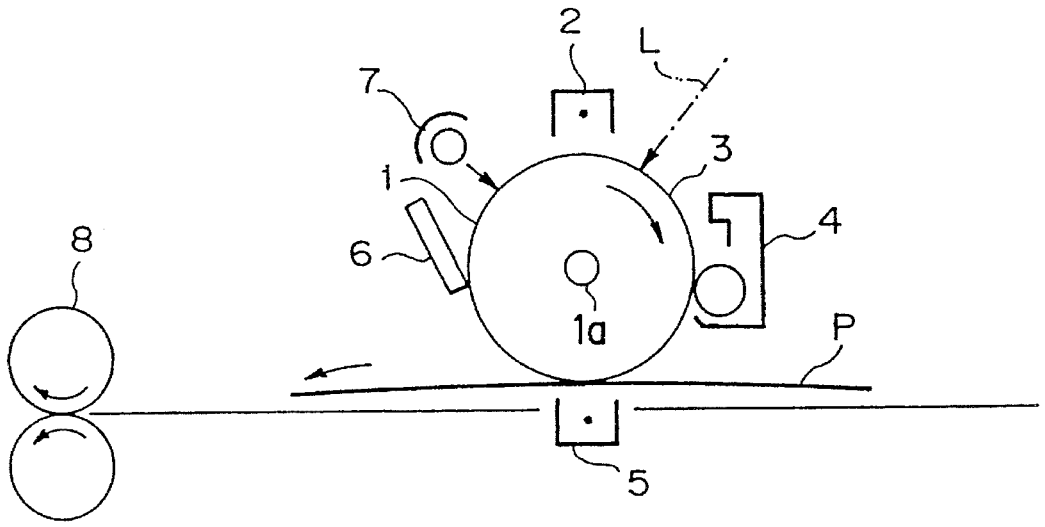
FIG. 1 illustrates an outline of the constitution of an electrophotographic photosensitive apparatus employing an electrophotographic photosensitive member of the present invention.

An electrophotographic photosensitive member of the present invention has a photosensitive layer containing a compound represented by the formula (1), (4) or (15) and a compound having a partial structure represented by the formula

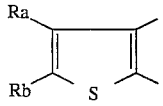

wherein each of $R_a$ and $R_b$ is a hydrogen atom, a halogen atom, a substituted or unsubstituted alkyl group, a substituted or unsubstituted aralkyl group, or a substituted or unsubstituted aromatic ring group, $-(CH=CH)_p-NO_2$, $-(CH=CH)_q-R_c$ or $$-(CH=CH)_r-CH=\overset{R_d}{\overset{|}{C}}-R_e;$$

each of $R_c$ and $R_d$ is an aromatic ring group having a nitro group or a heterocyclic ring group having the nitro group; $R_e$ is a substituted or unsubstituted alkyl group, a substituted or unsubstituted aralkyl group, a substituted or unsubstituted aromatic ring group, or a substituted or unsubstituted heterocyclic ring group; and $R_d$ and $R_e$ may be bonded to form a ring directly or with the interposition of a saturated hydrocarbon, an unsaturated hydrocarbon, an oxygen atom or a sulfur atom; each of p and q is an integer of 0, 1 or 2; and r is an integer of 0 or 1.

Preferable examples of a compound from which A in the formula (1) is derived will be enumerated together with reduction potentials (Ered), but they are not restrictive.

| | Compound | Ered (V) |
|---|---|---|
| a | 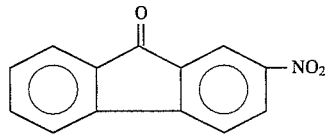 | −0.95 |
| b | 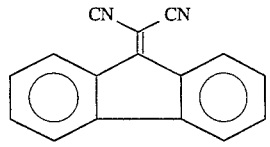 | −0.73 |
| c | 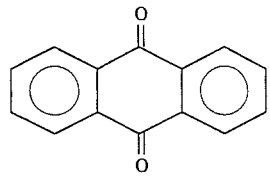 | −0.94 |
| d | 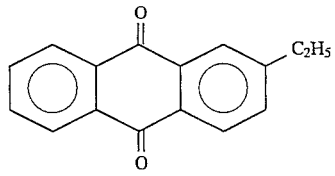 | −0.97 |
| e | 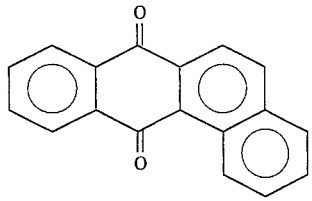 | −0.92 |
| f | 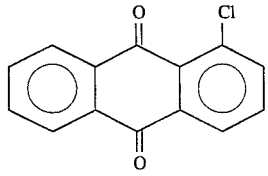 | −0.93 |
| g | 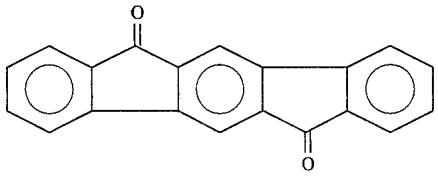 | −0.91 |
| h | 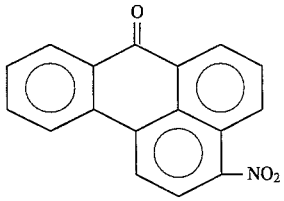 | −0.98 |

-continued

| | Compound | Ered (V) |
|---|---|---|
| i | 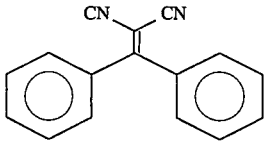 | −1.05 |
| j | 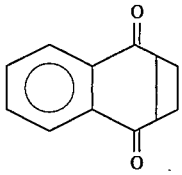 | −0.47 |
| k | 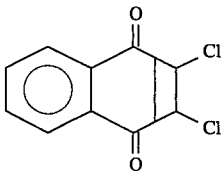 | −0.71 |
| l | 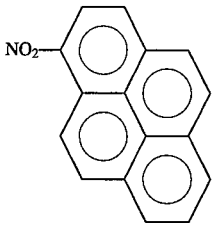 | −0.96 |
| m | 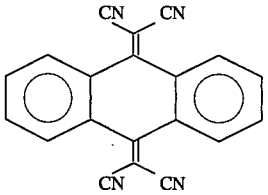 | −0.43 |
| n | 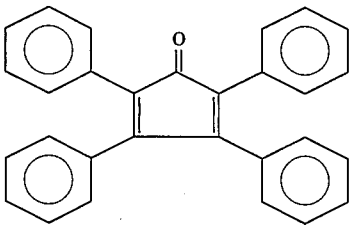 | −0.88 |
| o | 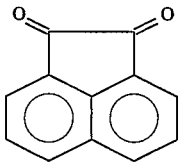 | −0.93 |

The reduction potentials can be measured by the following procedure.

(Measurement of Reduction Potentials)

A saturated calomel electrode is selected as a reference electrode, and a 0.1N—$(n\text{-}Bu)_4N^+$+$ClO_4$-acetonitrile solution is used. A potential at a working electrode is swept by a potential sweeper, and a peak position on the resultant current-potential curve is regarded as a value of reduction potential.

Specifically, a sample is dissolved in the electrolyte of the 0.1N—$(n\text{-}Bu)_4N^+$+$ClO_4$-acetonitrile solution so as to be a concentration of about 5–10 mmol %. Afterward, voltage is applied to this sample solution and is then changed linearly from a higher potential (0 V) to a lower potential (−1.5 V), and at this time, current changes are measured to obtain a current-voltage curve. The value of a potential at the peak (the maximum potential) of current values on this current-voltage curve is regarded as the reduction potential in the present invention.

Preferable examples of compounds which can be used in the present invention include compounds having structures represented by the following formulae (2), (3), (5), (6), (7), (8), (9), (10), (11), (12), (13) and (14), but they are not restrictive.

Formula (2)

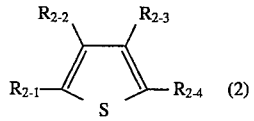

(2)

wherein each of $R_{2\text{-}1}$, $R_{2\text{-}2}$, $R_{2\text{-}3}$ and $R_{2\text{-}4}$ is a hydrogen atom, a halogen atom, a substituted or unsubstituted alkyl group, a substituted or unsubstituted aralkyl group, or a substituted or unsubstituted aromatic ring group, $—(CH{=}CH)_p—NO_2$, $—(CH{=}CH)_q—R_{2\text{-}5}$ or $$—(CH{=}CH)_r—CH{=}\overset{\overset{R_{2\text{-}6}}{|}}{C}—R_{2\text{-}7},$$

and each of at least two of $R_{2\text{-}1}$ to $R_{2\text{-}4}$ is $—(CH{=}CH)_p—NO_2$, $—(CH{=}CH)_q—R_{2\text{-}5}$ or $$—(CH{=}CH)_r—CH{=}\overset{\overset{R_{2\text{-}6}}{|}}{C}—R_{2\text{-}7};$$

each of $R_{2\text{-}5}$ and $R_{2\text{-}6}$ is an aromatic ring group having a nitro group or a heterocyclic ring group having the nitro group; $R_{2\text{-}7}$ is a substituted or unsubstituted alkyl group, a substituted or unsubstituted aralkyl group, a substituted or unsubstituted aromatic ring group, or a substituted or unsubstituted heterocyclic ring group; each of p and q is an integer of 0, 1 or 2; and r is an integer of 0 or 1; $R_{2\text{-}6}$ and $R_{2\text{-}7}$ may be mutually bonded to form a ring directly or with the interposition of a saturated hydrocarbon, an unsaturated hydrocarbon, an oxygen atom or a sulfur atom.

Formula (3)

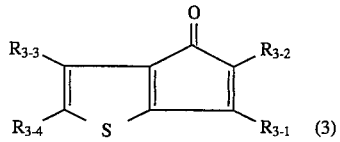

(3)

wherein each of $R_{3\text{-}1}$, $R_{3\text{-}2}$, $R_{3\text{-}3}$ and $R_{3\text{-}4}$ is a hydrogen atom, a halogen atom, a substituted or unsubstituted alkyl group, a substituted or unsubstituted aralkyl group, or a substituted or unsubstituted aromatic ring group, $—(CH{=}CH)_p—NO_2$, $—(CH{=}CH)_q—R_{3\text{-}5}$ or $$—(CH{=}CH)_r—CH{=}\overset{\overset{R_{3\text{-}6}}{|}}{C}—R_{3\text{-}7};$$

each of at least two of $R_{3\text{-}1}$ to $R_{3\text{-}4}$ is $—(CH{=}CH)_p—NO_2$, $—(CH{=}CH)_q—R_{3\text{-}5}$ or $$—(CH{=}CH)_r—CH{=}\overset{\overset{R_{3\text{-}6}}{|}}{C}—R_{3\text{-}7};$$

each of $R_{3\text{-}5}$ and $R_{3\text{-}6}$ is an aromatic ring group having a nitro group or a heterocyclic ring group having the nitro group; $R_{3-7}$ is a substituted or unsubstituted alkyl group, a substituted or unsubstituted aralkyl group, a substituted or unsubstituted aromatic ring group, or a substituted or unsubstituted heterocyclic ring group; each of p and q is an integer of 0, 1 or 2; and r is an integer of 0 or 1; $R_{3-6}$ and $R_{3-7}$ may be mutually bonded to form a ring directly or with the interposition of a saturated hydrocarbon, an unsaturated hydrocarbon, an oxygen atom or a sulfur atom.

Formula (5)

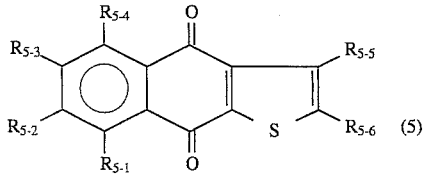

(5)

wherein each of $R_{5-1}$, $R_{5-2}$, $R_{5-3}$, $R_{5-4}$, $R_{5-5}$ and $R_{5-6}$ is a hydrogen atom, a halogen atom, a substituted or unsubstituted alkyl group, a substituted or unsubstituted aralkyl group, or a substituted or unsubstituted aromatic ring group, $-(CH{=}CH)_p-NO_2$, $-(CH{=}CH)_q-R_{5-7}$ or $$-(CH{=}CH)_r-CH{=}\overset{\overset{R_{5-8}}{|}}{C}-R_{5-9};$$

each of at least two of $R_{5-1}$ to $R_{5-6}$ are $-(CH{=}CH)_p-NO_2$, $-(CH{=}CH)_q-R_{5-7}$ or $$-(CH{=}CH)_r-CH{=}\overset{\overset{R_{5-8}}{|}}{C}-R_{5-9};$$

each of at least two of $R_{5-1}$ to $R_{5-6}$ are $-(CH{=}CH)_p-NO_2$, $-(CH{=}CH)_q-R_{5-7}$ or $$-(CH{=}CH)_r-CH{=}\overset{\overset{R_{5-8}}{|}}{C}-R_{5-9};$$

each of $R_{5-7}$ and $R_{5-8}$ is an aromatic ring group having a nitro group or a heterocyclic ring group having the nitro group; $R_{5-9}$ is a substituted or unsubstituted alkyl group, a substituted or unsubstituted aralkyl group, a substituted or unsubstituted aromatic ring group, or a substituted or unsubstituted-heterocyclic ring group; each of p and q is an integer of 0, 1 or 2; and r is an integer of 0 or 1; $R_{5-8}$ and $R_{5-9}$ may be mutually bonded to form a ring directly or with the interposition of a saturated hydrocarbon, an unsaturated hydrocarbon, an oxygen atom or a sulfur atom.

Formula (6)

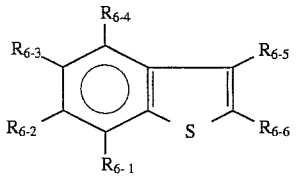

(6)

wherein each of $R_{6-1}$, $R_{6-2}$, $R_{6-3}$, $R_{6-4}$, $R_{6-5}$ and $R_{6-6}$ is a hydrogen atom, a halogen atom, a substituted or unsubstituted alkyl group, a substituted or unsubstituted aralkyl group, or a substituted or unsubstituted aromatic ring group, $-(CH{=}CH)_p-NO_2$, $-(CH{=}CH)_q-R_{6-7}$ or $$-(CH{=}CH)_r-CH{=}\overset{\overset{R_{6-8}}{|}}{C}-R_{6-9};$$

each of at least two of $R_{6-1}$ to $R_{6-6}$ is $-(CH{=}CH)_p-NO_2$, $-(CH{=}CH)_q-R_{6-7}$ or $$-(CH{=}CH)_r-CH{=}\overset{\overset{R_{6-8}}{|}}{C}-R_{6-9};$$

each of $R_{6-7}$ and $R_{6-8}$ is an aromatic ring group having a nitro group or a heterocyclic ring group having the nitro group; $R_{6-9}$ is a substituted or unsubstituted alkyl group, a substituted or unsubstituted aralkyl group, a substituted or unsubstituted aromatic ring group, or a substituted or unsubstituted heterocyclic ring group; each of p and q is an integer of 0, 1 or 2; and r is an integer of 0 or 1; $R_{6-8}$ and $R_{6-9}$ may be mutually bonded to form a ring directly or with the interposition of a saturated hydrocarbon, an unsaturated hydrocarbon, an oxygen atom or a sulfur atom.

Formula (7)

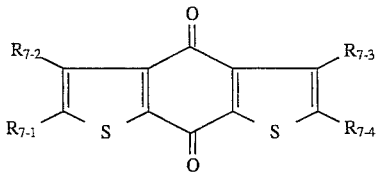

(7)

wherein each of $R_{7-1}$, $R_{7-2}$, $R_{7-3}$ and $R_{7-4}$ is a hydrogen atom, a halogen atom, an alkyl group, an aralkyl group, or an aromatic ring group, $-(CH{=}CH)_p-NO_2$, $-(CH{=}CH)_q-R_{7-5}$ or $$-(CH{=}CH)_r-CH{=}\overset{\overset{R_{7-6}}{|}}{C}-R_{7-7};$$

each of at least two of $R_{7-1}$ to $R_{7-4}$ is $-(CH{=}CH)_p-NO_2$, $-(CH{=}CH)_q-R_{7-1}$ or $$-(CH{=}CH)_r-CH{=}\overset{\overset{R_{7-6}}{|}}{C}-R_{7-7};$$

each of $R_{7-5}$ and $R_{7-6}$ is an aromatic ring group having a nitro group or a heterocyclic ring group having the nitro group; $R_{7-7}$ is an alkyl group, an aralkyl group, an aromatic ring group, or a heterocyclic ring group; each of p and q is an integer of 0, 1 or 2; and r is an integer of 0 or 1; $R_{7-6}$ and $R_{7-7}$ may be mutually bonded to form a ring directly or with the interposition of a saturated hydrocarbon, an unsaturated hydrocarbon, an oxygen atom or a sulfur atom.

Formula (8)

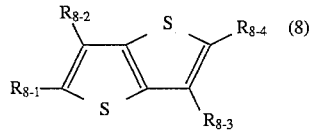

(8)

wherein each of $R_{8-1}$, $R_{8-2}$, $R_{8-3}$ and $R_{8-4}$ is a hydrogen atom, a halogen atom, a substituted or unsubstituted alkyl group, a substituted or unsubstituted aralkyl group, or a substituted or unsubstituted aromatic ring group, $-(CH{=}CH)_p-NO_2$, $-(CH{=}CH)_q-R_{8-5}$ or $$-(CH{=}CH)_r-CH{=}\overset{\overset{R_{8-6}}{|}}{C}-R_{8-7};$$

each of at least two of $R_{8-1}$ to $R_{8-4}$ is $-(CH{=}CH)_p-NO_2$, $-(CH{=}CH)_q-R_{8-5}$ or $$-(CH{=}CH)_r-CH{=}\overset{\overset{R_{8-6}}{|}}{C}-R_{8-7};$$

each of $R_{8-5}$ and $R_{8-6}$ is an aromatic ring group having a nitro group or a heterocyclic ring group having the nitro group; $R_{8-7}$ is a substituted or unsubstituted alkyl group, a substituted or unsubstituted aralkyl group, a substituted or unsubstituted aromatic ring group, or a substituted or unsubstituted heterocyclic ring group; each of p and q is an integer of 0, 1 or 2; and r is an integer of 0 or 1; $R_{8-6}$ and $R_{8-7}$ may be mutually bonded to form a ring directly or with the interposition of a saturated hydrocarbon, an unsaturated hydrocarbon, an oxygen atom or a sulfur atom.

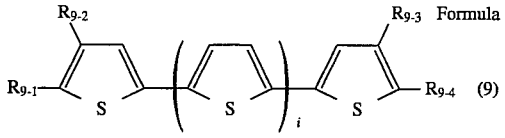
Formula (9)

wherein each of $R_{9-1}$, $R_{9-2}$, $R_{9-3}$ and $R_{9-4}$ is a hydrogen atom, a halogen atom, a substituted or unsubstituted alkyl group, a substituted or unsubstituted aralkyl group, or a substituted or unsubstituted aromatic ring group, $-(CH{=}CH)_f-NO_2$, $-(CH{=}CH)_g-R_{9-5}$ or $$-(CH{=}CH)_h-CH{=}\overset{\overset{R_{9-6}}{|}}{C}-R_{9-7};$$

each of at least two of $R_{9-1}$ to $R_{9-4}$ is $-(CH{=}CH)_f-NO_2$, $-(CH{=}CH)_g-R_{9-5}$ or $$-(CH{=}CH)_h-CH{=}\overset{\overset{R_{9-6}}{|}}{C}-R_{9-7};$$

each of $R_{9-5}$ and $R_{9-6}$ is an aromatic ring group having a nitro group or a heterocyclic ring group having the nitro group; $R_{9-7}$ is a substituted or unsubstituted alkyl group, a substituted or unsubstituted aralkyl group, a substituted or unsubstituted aromatic ring group, or a substituted or unsubstituted heterocyclic ring group; each of i, f and g is an integer of 1 or 2; and h is an integer of 0 or 1; $R_{9-6}$ and $R_{9-7}$ may be mutually bonded to form a ring directly or with the interposition of a saturated hydrocarbon, an unsaturated hydrocarbon, an oxygen atom or a sulfur atom.

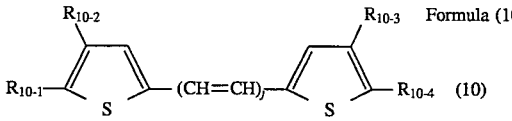
Formula (10)

wherein each of $R_{10-1}$, $R_{10-2}$, $R_{10-3}$ and $R_{10-4}$ is a hydrogen atom, a halogen atom, a substituted or unsubstituted alkyl group, a substituted or unsubstituted aralkyl group, or a substituted or unsubstituted aromatic ring group, $-(CH{=}CH)_f-NO_2$, $-(CH{=}CH)_g-R_{10-5}$ or $$-(CH{=}CH)_h-CH{=}\overset{\overset{R_{10-6}}{|}}{C}-R_{10-7};$$

each of at least two of $R_{10-1}$ to $R_{10-4}$ is $-(CH{=}CH)_f-NO_2$, $-(CH{=}CH)_g-R_{10-5}$ or $$-(CH{=}CH)_h-CH{=}\overset{\overset{R_{10-6}}{|}}{C}-R_{10-7};$$

each of $R_{10-5}$ and $R_{10-6}$ is an aromatic ring group having a nitro group or a heterocyclic ring group having the nitro group; $R_{10-7}$ is a substituted or unsubstituted alkyl group, a substituted or unsubstituted aralkyl group, a substituted or unsubstituted aromatic ring group, or a substituted or unsubstituted heterocyclic ring group; each of i, f and g is an integer of 1 or 2; and h is an integer of 0 or 1; $R_{10-6}$ and $R_{10-7}$ may be mutually bonded to form a ring directly or with the interposition of a saturated hydrocarbon, an unsaturated hydrocarbon, an oxygen atom or a sulfur atom.

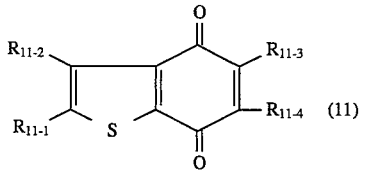
Formula (11)

wherein each of $R_{11-1}$ and $R_{11-2}$ is a hydrogen atom, a halogen atom, a substituted or unsubstituted alkyl group, a substituted or unsubstituted aralkyl group, or a substituted or unsubstituted aromatic ring group, $-(CH{=}CH)_p-NO_2$, $-(CH{=}CH)_q-R_{11-5}$ or $$-(CH{=}CH)_r-CH{=}\overset{\overset{R_{11-6}}{|}}{C}-R_{11-7};$$

at least either of $R_{11-1}$ and $R_{11-2}$ is $-(CH{=}CH)_p-NO_2$, $-(CH{=}CH)_q-R_{11-5}$ or $$-(CH{=}CH)_r-CH{=}\overset{\overset{R_{11-6}}{|}}{C}-R_{11-7};$$

each of $R_{11-5}$ and $R_{11-6}$ is an aromatic ring group having a nitro group or a heterocyclic ring group having the nitro group; $R_{11-7}$ is a substituted or unsubstituted alkyl group, a substituted or unsubstituted aralkyl group, a substituted or unsubstituted aromatic ring group, or a substituted or unsubstituted heterocyclic ring group; $R_{11-6}$ and $R_{11-7}$ may be mutually bonded to form a ring directly or with the interposition of a saturated hydrocarbon, an unsaturated hydrocarbon, an oxygen atom or a sulfur atom; each of $R_{11-3}$ and $R_{11-4}$ is a halogen atom, a substituted or unsubstituted alkyl group, a substituted or unsubstituted aralkyl group, a substituted or unsubstituted aromatic ring group, a substituted or unsubstituted heterocyclic ring group, a nitro group or a cyano group; each of p and q is an integer of 0, 1 or 2; and r is an integer of 0 or 1.

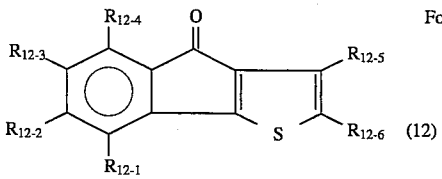
Formula (12)

wherein each of $R_{12-1}$,$R_{12-2}$,$R_{12-3}$,$R_{12-4}$, $R_{12-5}$ and $R_{12-5}$ is a hydrogen atom, a halogen atom, a substituted or unsubstituted alkyl group, a substituted or unsubstituted aralkyl group, or a substituted or unsubstituted aromatic ring group, $-(CH{=}CH)_p-NO_2$, $-(CH{=}CH)_q-R_{12-7}$ or $$-(CH{=}CH)_r-CH{=}\overset{\overset{R_{12-8}}{|}}{C}-R_{12-9};$$

each of at least two of $R_{12-1}$ to $R_{12-6}$ is $-(CH{=}CH)_p-NO_2$, $-(CH{=}CH)_q-R_{12-7}$ or $$-(CH{=}CH)_r-CH{=}\overset{\overset{R_{12-8}}{|}}{C}-R_{12-9};$$

each of $R_{12-7}$ and $R_{12-8}$ is an aromatic ring group having a nitro group or a heterocyclic ring group having the nitro group; $R_{12-9}$ is a substituted or unsubstituted alkyl group, a substituted or unsubstituted aralkyl group, a substituted or unsubstituted aromatic ring group, or a substituted or unsubstituted heterocyclic ring group; each of p and q is an integer of 0, 1 or 2; and r is an integer of 0 or 1; $R_{12-8}$ and $R_{12-9}$ may be mutually bonded to form a ring directly or with the interposition of a saturated hydrocarbon, an unsaturated hydrocarbon, an oxygen atom or a sulfur atom.

Formula (13)

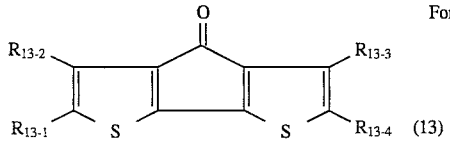

(13)

wherein each of $R_{13-1}$, $R_{13-2}$, $R_{13-3}$ and $R_{13-4}$ is a hydrogen atom, a halogen atom, a substituted or unsubstituted alkyl group, a substituted or unsubstituted aralkyl group, or a substituted or unsubstituted aromatic ring group, $—(CH{=}CH)_p—NO_2$, $—(CH{=}CH)_q—R_{13-5}$ or $$—(CH{=}CH)_r—CH{=}\overset{\overset{R_{13-6}}{|}}{C}—R_{13-7};$$

each of at least two of $R_{13-1}$ to $R_{13-4}$ is $—(CH{=}CH)_p—NO_2$, $—(CH{=}CH)_q—R_{13-5}$ or $$—(CH{=}CH)_r—CH{=}\overset{\overset{R_{13-6}}{|}}{C}—R_{13-7};$$

each of $R_{13-5}$ and $R_{13-6}$ is an aromatic ring group having a nitro group or a heterocyclic ring group having the nitro group; $R_{13-7}$ is a substituted or unsubstituted alkyl group, a substituted or unsubstituted aralkyl group, a substituted or unsubstituted aromatic ring group, or a substituted or unsubstituted heterocyclic ring group; each of p and q is an integer of 0, 1 or 2; and r is an integer of 0 or 1; $R_{13-6}$ and $R_{13-7}$ may be mutually bonded to form a ring directly or with the interposition of a saturated hydrocarbon, an unsaturated hydrocarbon, an oxygen atom or a sulfur atom.

Formula (14)

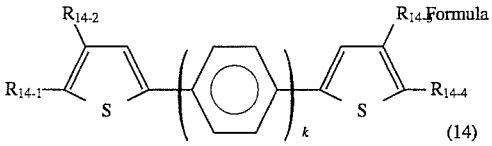

(14)

wherein each of $R_{14-1}$, $R_{14-2}$, $R_{14-3}$ and $R_{14-4}$ is a hydrogen atom, a halogen atom, a substituted or unsubstituted alkyl group, a substituted or unsubstituted aralkyl group, or a substituted or unsubstituted aromatic ring group, $—(CH{=}CH)_f—NO_2$, $—(CH{=}CH)_g—R_{14-5}$ or $$—(CH{=}CH)_h—CH{=}\overset{\overset{R_{14-6}}{|}}{C}—R_{14-7};$$

each of at least two of $R_{14-1}$ to $R_{14-4}$ is $—(CH{=}CH)_f—NO_2$, $—(CH{=}CH)_g—R_{14-5}$ or $$—(CH{=}CH)_h—CH{=}\overset{\overset{R_{14-6}}{|}}{C}—R_{14-7};$$

each of $R_{14-5}$ and $R_{14-6}$ is an aromatic ring group having a nitro group or a heterocyclic ring group having the nitro group; $R_{14-7}$ is a substituted or unsubstituted alkyl group, a substituted or unsubstituted aralkyl group, a substituted or unsubstituted aromatic ring group, or a substituted or unsubstituted heterocyclic ring group; each of k, f and g is an integer of 1 or 2; and h is an integer of 0 or 1; $R_{14-6}$ and $R_{14-7}$ may be mutually bonded to form a ring directly or with the interposition of a saturated hydrocarbon, an unsaturated hydrocarbon, an oxygen atom or a sulfur atom.

In the compounds which can be used in the present invention, examples of the halogen atom include a fluorine atom, a chlorine atom and a bromine atom; examples of the alkyl group include methyl, ethyl, propyl and butyl groups; examples of the aralkyl group include benzyl, phenethyl and naphthylmethyl groups; examples of the aromatic ring group include phenyl and naphthyl groups; and examples of the heterocyclic ring group include thienyl, pyridyl and furyl groups.

Furthermore, examples of the substituents which the above-mentioned compounds may have include alkyl groups such as methyl and ethyl groups, halogen atoms such as fluorine and chlorine atoms, a cyano group and a nitro group.

The Compounds represented by Formula (1) are specifically exemplified below, which are intended to be illustrative and not limiting.

Compound 1-(1)

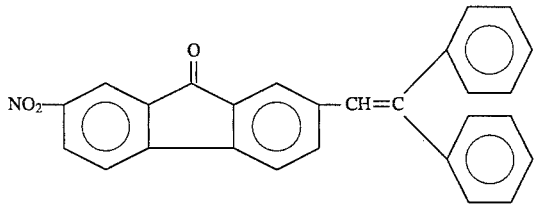

Compound 1-(2)

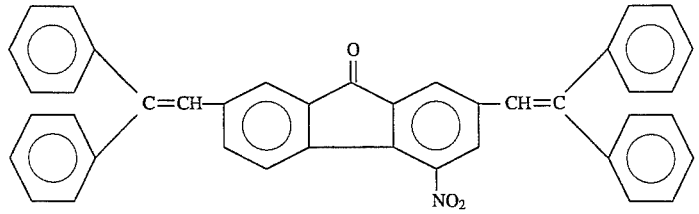

-continued
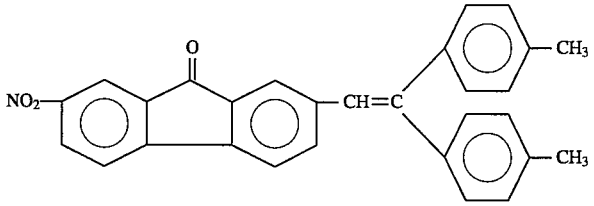
Compound 1-(3)
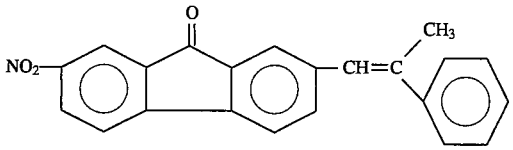
Compound 1-(4)
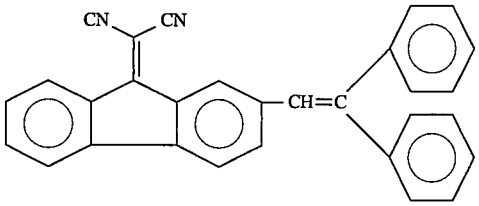
Compound 1-(5)
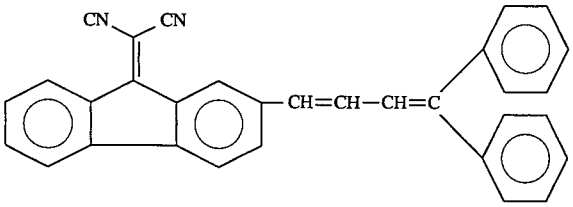
Compound 1-(6)
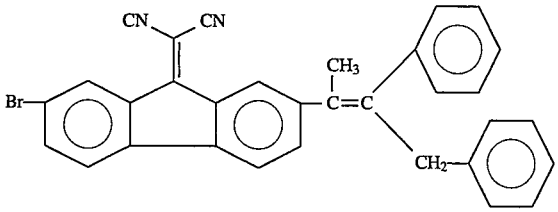
Compound 1-(7)
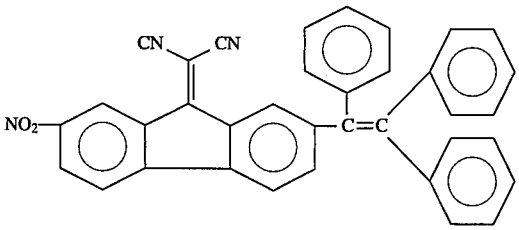
Compound 1-(8)
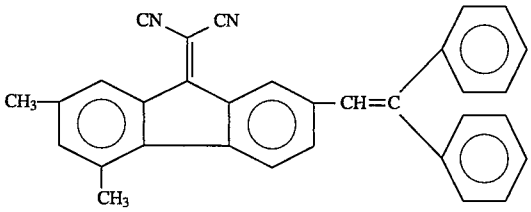
Compound 1-(9)
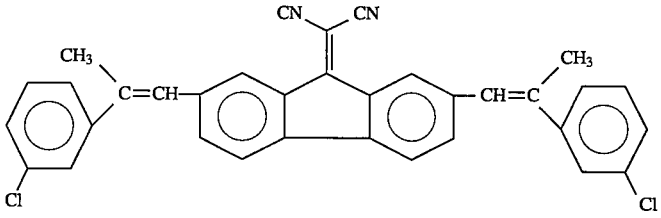
Compound 1-(10)

-continued
Compound 1-(11)
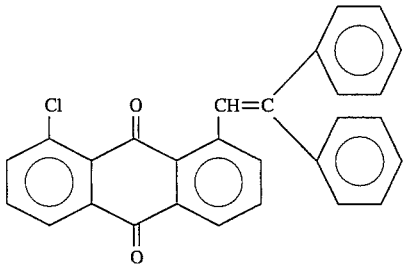
Compound 1-(12)
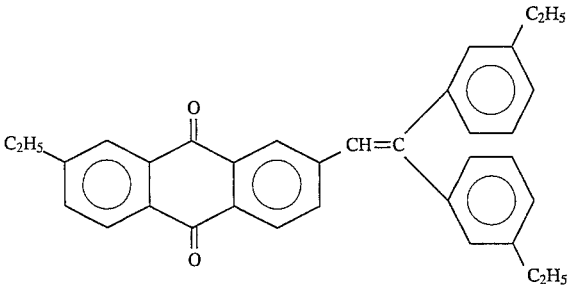
Compound 1-(13)
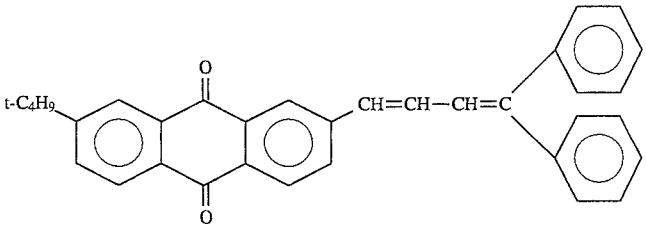
Compound 1-(14)
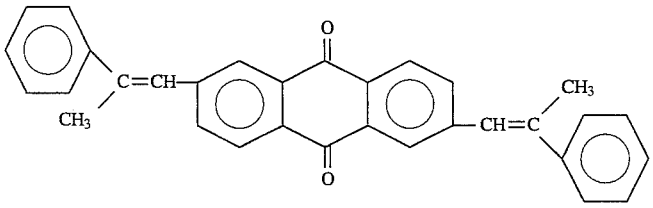
Compound 1-(15)
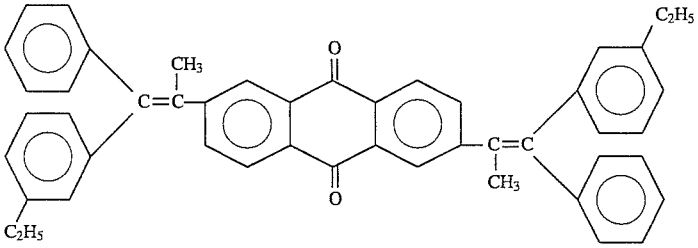
Compound 1-(16)
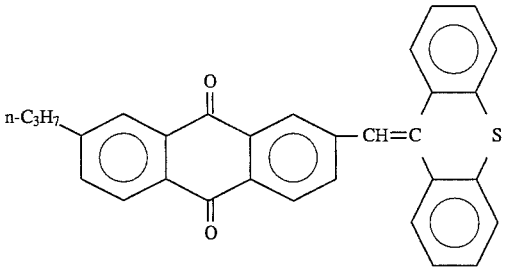

-continued
Compound 1-(17)
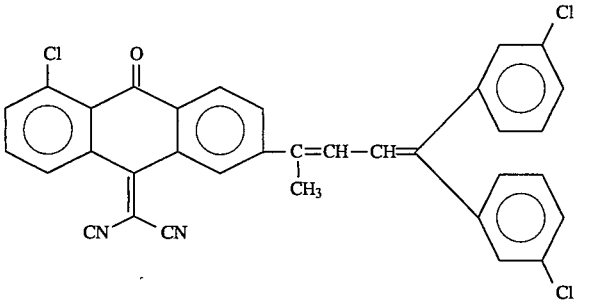
Compound 1-(18)
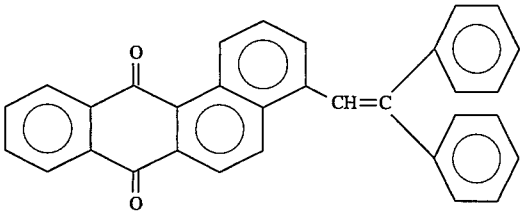
Compound 1-(19)
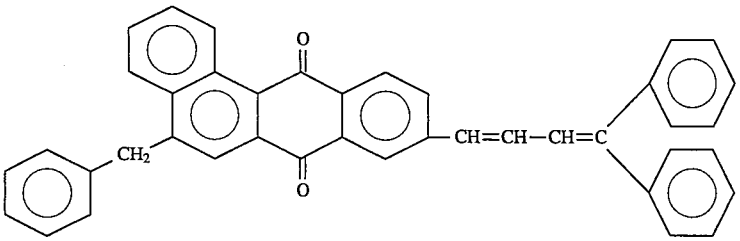
Compound 1-(20)
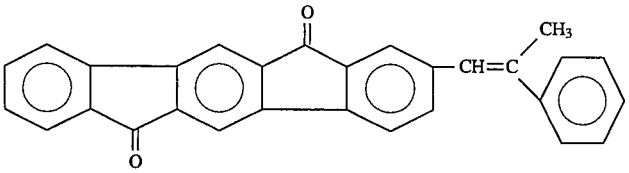
Compound 1-(21)
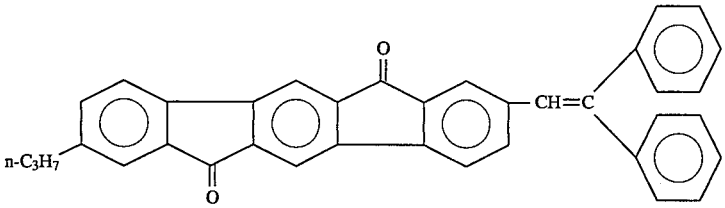
Compound 1-(22)
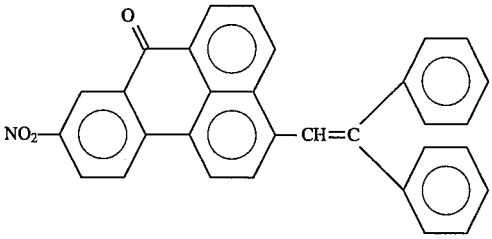
Compound 1-(23)
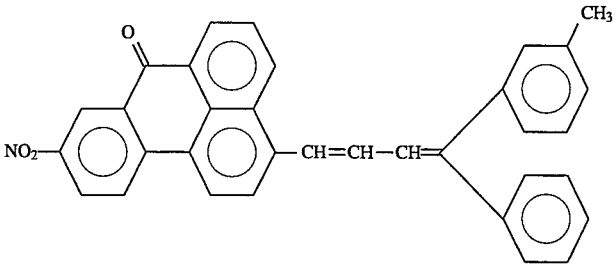

-continued
Compound 1-(24)
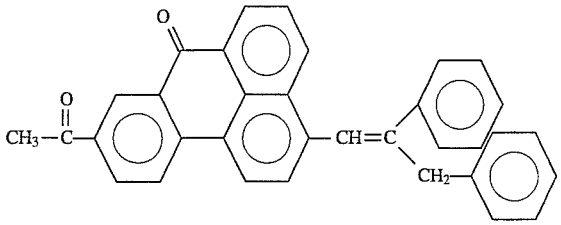
Compound 1-(25)
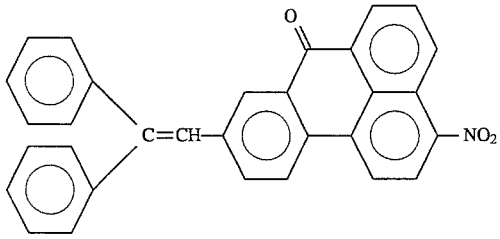
Compound 1-(26)
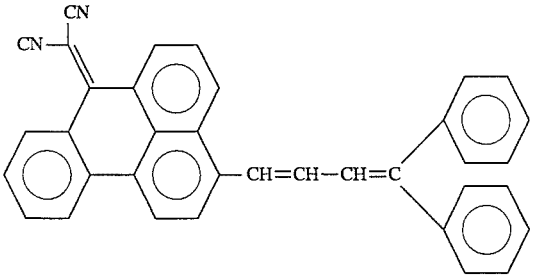
Compound 1-(27)
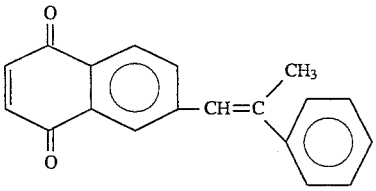
Compound 1-(28)
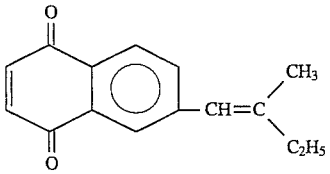
Compound 1-(29)
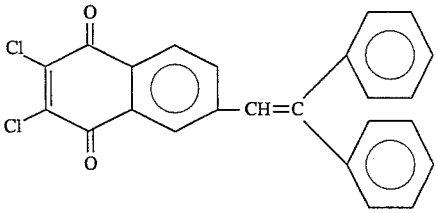
Compound 1-(30)
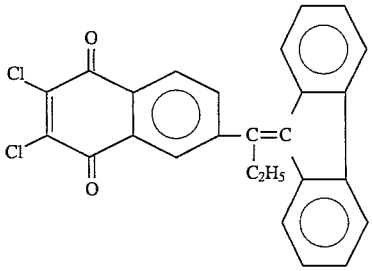

-continued
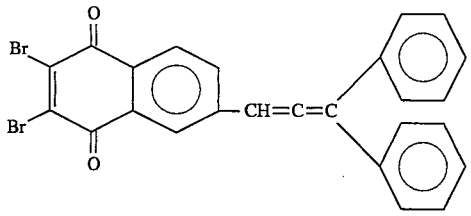
Compound 1-(31)
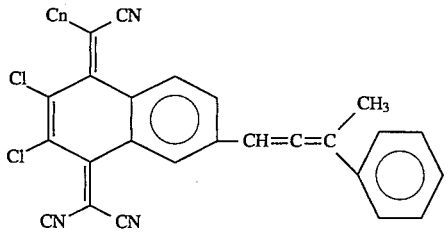
Compound 1-(32)
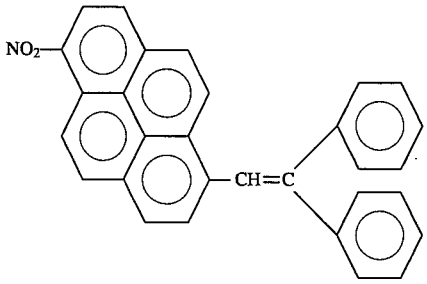
Compound 1-(33)
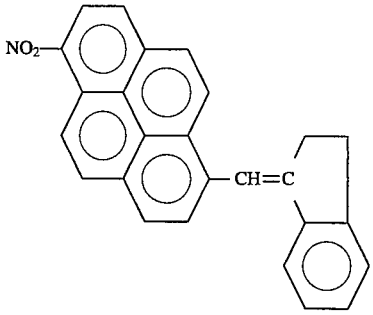
Compound 1-(34)
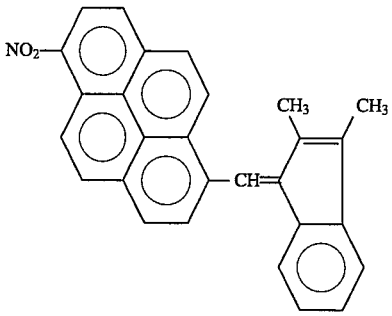
Compound 1-(35)
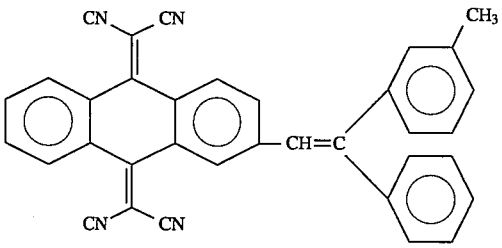
Compound 1-(36)

-continued
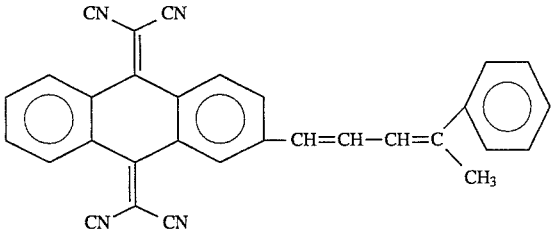
Compound 1-(37)
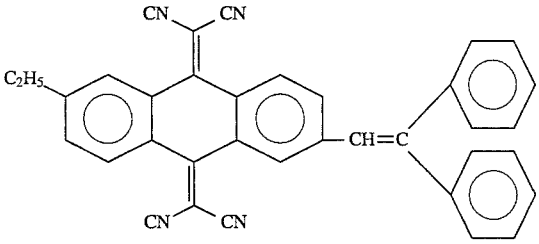
Compound 1-(38)
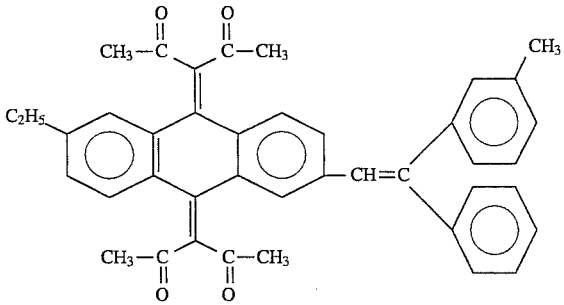
Compound 1-(39)
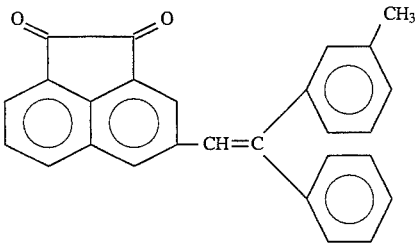
Compound 1-(40)
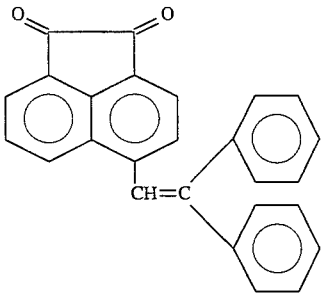
Compound 1-(41)
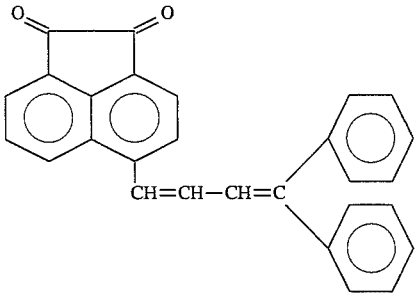
Compound 1-(42)

-continued

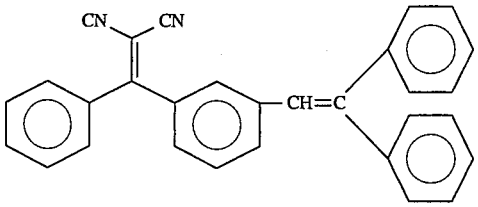

Compound 1-(43)

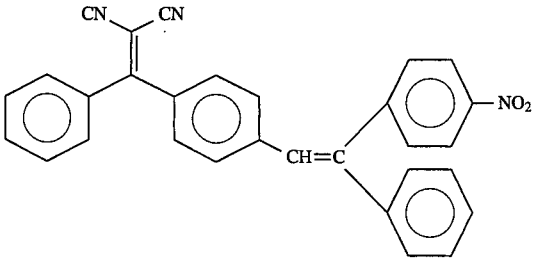

Compound 1-(44)

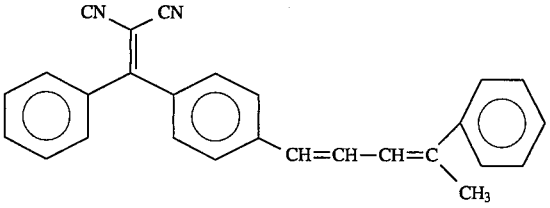

Compound 1-(45)

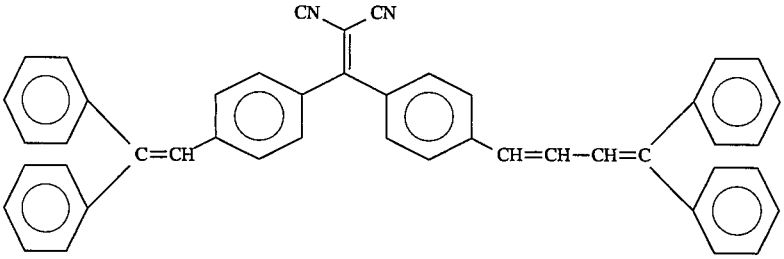

Compound 1-(46)

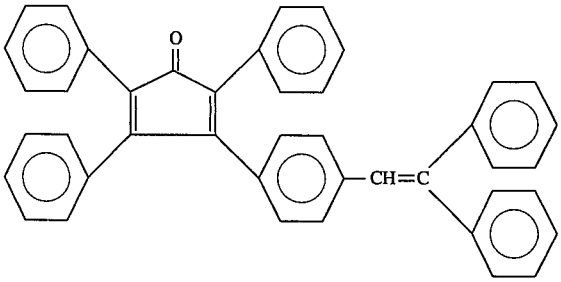

Compound 1-(47)

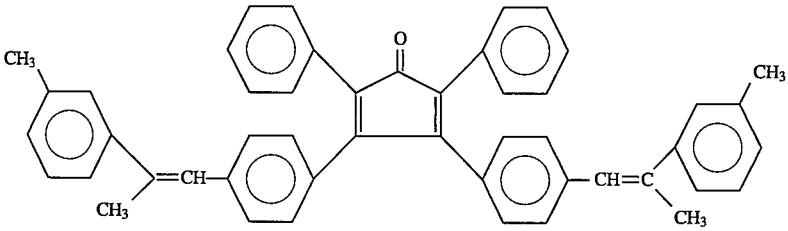

Compound 1-(48)

The Compounds represented by Formulas (2)–(16) are specifically exemplified below, but they are not limited thereto.

Referring to a way of showing specific compounds, a basic constitution common to those specific compounds is first indicated and then they are defined by specifying variable portions in the basic constitution.

Basic constitution

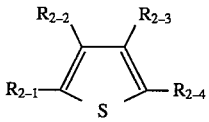

(Formula (2))

Compound 2-(1)
$R_{2\text{-}1}$: $-NO_2$
$R_{2\text{-}2}$: $-H$
$R_{2\text{-}3}$: $-H$
$R_{2\text{-}4}$: $-NO_2$ Compound 2-(2)
$R_{2\text{-}1}$: $-NO_2$
$R_{2\text{-}2}$: $-H$
$R_{2\text{-}3}$: $-H$
$R_{2\text{-}4}$: $-CH=CH-NO_2$ Compound 2-(3)
$R_{2\text{-}1}$: $-NO_2$
$R_{2\text{-}2}$: $-H$
$R_{2\text{-}3}$: $-H$ $R_{2\text{-}4}$:

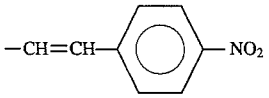

Compound 2-(4)
$R_{2\text{-}1}$: $-NO_2$
$R_{2\text{-}2}$: $-H$
$R_{2\text{-}3}$: $-H$ $R_{2\text{-}4}$:

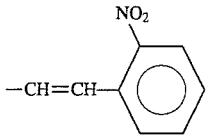

Compound 2-(5)
$R_{2\text{-}1}$: $-NO_2$
$R_{2\text{-}2}$: $-H$
$R_{2\text{-}3}$: $-H$ $R_{2\text{-}4}$:

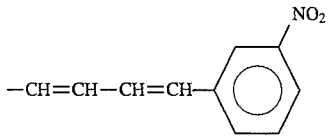

Compound 2-(6)
$R_{2\text{-}1}$: $-NO_2$
$R_{2\text{-}2}$: $-H$
$R_{2\text{-}3}$: $-H$ $R_{2\text{-}4}$:

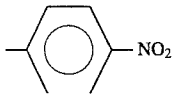

Compound 2-(7)
$R_{2\text{-}1}$: $-NO_2$
$R_{2\text{-}2}$: $-H$
$R_{2\text{-}3}$: $-H$ $R_{2\text{-}4}$:

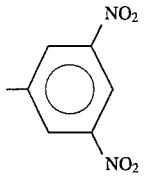

Compound 2-(8)
$R_{2\text{-}1}$: $-NO_2$
$R_{2\text{-}2}$: $-H$
$R_{2\text{-}3}$: $-H$ $R_{2\text{-}4}$:

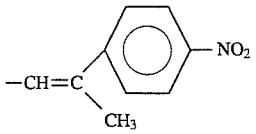

Compound 2-(9)
$R_{2\text{-}1}$: $-NO_2$
$R_{2\text{-}2}$: $-H$
$R_{2\text{-}3}$: $-H$ $R_{2\text{-}4}$:

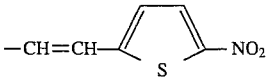

Compound 2-(10)
$R_{2\text{-}1}$: $-NO_2$
$R_{2\text{-}2}$: $-H$
$R_{2\text{-}3}$: $-H$ $R_{2\text{-}4}$:

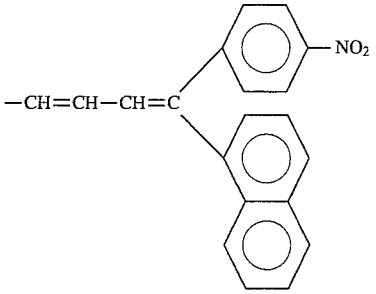

Compound 2-(11)
$R_{2\text{-}1}$: $-NO_2$
$R_{2\text{-}2}$: $-H$
$R_{2\text{-}3}$: $-H$ $R_{2\text{-}4}$:

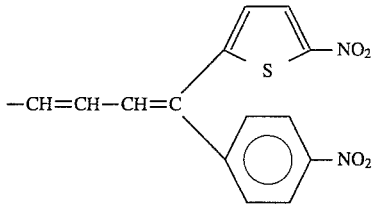

Compound 2-(12)
$R_{2\text{-}1}$: $-CH=CH-NO_2$
$R_{2\text{-}2}$: $-H$
$R_{2\text{-}3}$: $-H$
$R_{2\text{-}4}$: $-CH=CH-NO_2$ Compound 2-(13)
$R_{2\text{-}1}$: $-CH=CH-NO_2$
$R_{2\text{-}2}$: $-H$
$R_{2\text{-}3}$: $-H$ $R_{2\text{-}4}$:

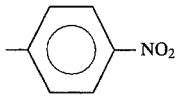

Compound 2-(14)
$R_{2\text{-}1}$: $\text{-}(CH=CH)_7NO_2$ $R_{2\text{-}2}$: $-H$
$R_{2\text{-}3}$: $-H$ $R_{2\text{-}4}$:

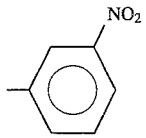

Compound 2-(15)
$R_{2\text{-}1}$: $-CH=CH-NO_2$
$R_{2\text{-}2}$: $-H$
$R_{2\text{-}3}$: $-H$ $R_{2\text{-}4}$:

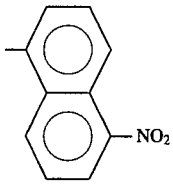

Compound 2-(16)

$R_{2\text{-}1}$: $-CH=CH-NO_2$
$R_{2\text{-}2}$: $-H$
$R_{2\text{-}3}$: $-H$ $R_{2\text{-}4}$:

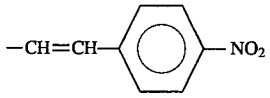

Compound 2-(17)

$R_{2\text{-}1}$: $-CH=CH-NO_2$
$R_{2\text{-}2}$: $-H$
$R_{2\text{-}3}$: $-H$ $R_{2\text{-}4}$:

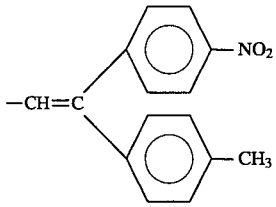

Compound 2-(18)

$R_{2\text{-}1}$: $-CH=CH-NO_2$
$R_{2\text{-}2}$: $-H$
$R_{2\text{-}3}$: $-H$ $R_{2\text{-}4}$:

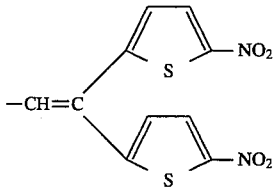

Compound 2-(19)

$R_{2\text{-}1}$: $-CH=CH-NO_2$
$R_{2\text{-}2}$: $-H$
$R_{2\text{-}3}$: $-H$ $R_{2\text{-}4}$:

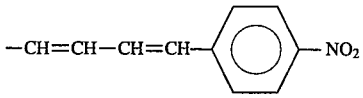

Compound 2-(20)

$R_{2\text{-}1}$:

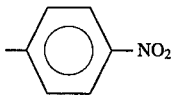

$R_{2\text{-}2}$: $-H$
$R_{2\text{-}3}$: $-H$ $R_{2\text{-}4}$:

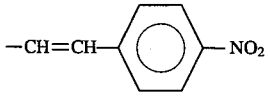

Compound 2-(21)

$R_{2\text{-}1}$:

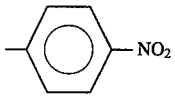

$R_{2\text{-}2}$: $-H$
$R_{2\text{-}3}$: $-H$ $R_{2\text{-}4}$:

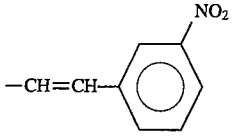

Compound 2-(22)

$R_{2\text{-}1}$:

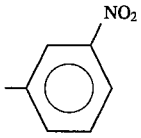

$R_{2\text{-}2}$: $-H$
$R_{2\text{-}3}$: $-H$ $R_{2\text{-}4}$:

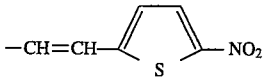

Compound 2-(23)

$R_{2\text{-}1}$:

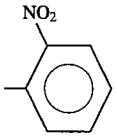

$R_{2\text{-}2}$: $-H$
$R_{2\text{-}3}$: $-H$ $R_{2\text{-}4}$:

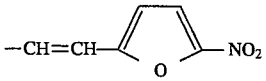

Compound 2-(24)

$R_{2\text{-}1}$:

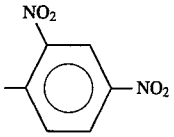

$R_{2\text{-}2}$: $-H$
$R_{2\text{-}3}$: $-H$ $R_{2\text{-}4}$:

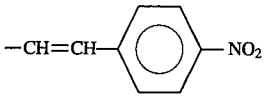

Compound 2-(25)

$R_{2\text{-}1}$:

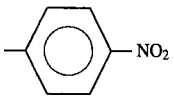

$R_{2\text{-}2}$: $-H$
$R_{2\text{-}3}$: $-H$ $R_{2\text{-}4}$:

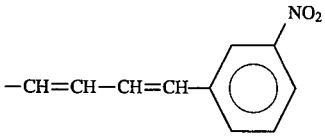

Compound 2-(26)

$R_{2\text{-}1}$:

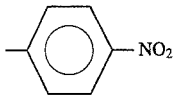

$R_{2\text{-}2}$: —H
$R_{2\text{-}3}$: —H $R_{2\text{-}4}$:

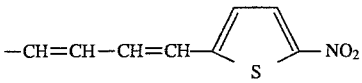

Compound 2-(27)

$R_{2\text{-}1}$:

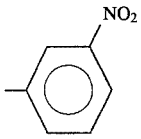

$R_{2\text{-}2}$: —H
$R_{2\text{-}3}$: —H $R_{2\text{-}4}$:

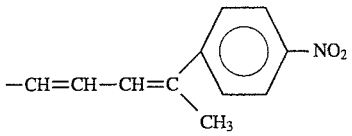

Compound 2-(28)

$R_{2\text{-}1}$:

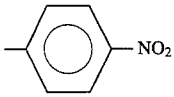

$R_{2\text{-}2}$: —H
$R_{2\text{-}3}$: —H $R_{2\text{-}4}$:

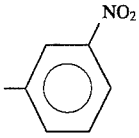

Compound 2-(29)

$R_{2\text{-}1}$:

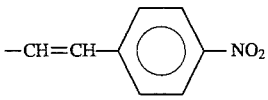

$R_{2\text{-}2}$: —H
$R_{2\text{-}3}$: —H $R_{2\text{-}4}$:

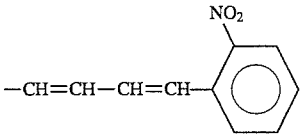

Compound 2-(30)

$R_{2\text{-}1}$:

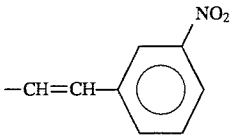

$R_{2\text{-}2}$: —H
$R_{2\text{-}3}$: —H $R_{2\text{-}4}$:

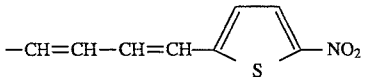

Compound 2-(31)

$R_{2\text{-}1}$:

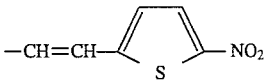

$R_{2\text{-}2}$: —H
$R_{2\text{-}3}$: —H $R_{2\text{-}4}$:

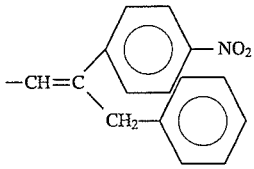

Compound 2-(32)

$R_{2\text{-}1}$:

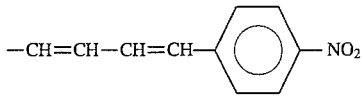

$R_{2\text{-}2}$: —H
$R_{2\text{-}3}$: —H $R_{2\text{-}4}$:

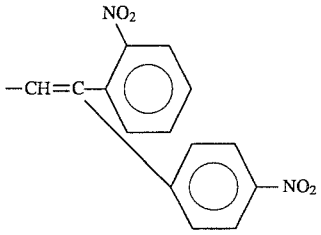

Compound 2-(33)

$R_{2\text{-}1}$:

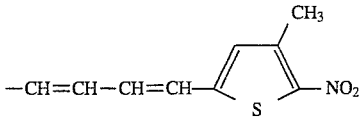

$R_{2\text{-}2}$: —H
$R_{2\text{-}3}$: —H $R_{2\text{-}4}$:

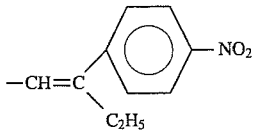

Compound 2-(34)

$R_{2\text{-}1}$:

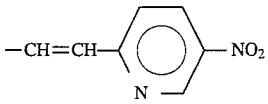

$R_{2\text{-}2}$: —H
$R_{2\text{-}3}$: —H $R_{2\text{-}4}$:

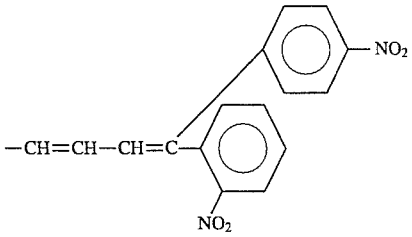

Compound 2-(35)

$R_{2\text{-}1}$:

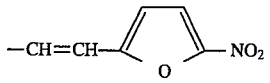

$R_{2\text{-}2}$: —H
$R_{2\text{-}3}$: —H $R_{2\text{-}4}$:

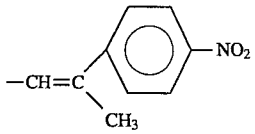

Compound 2-(36)

$R_{2\text{-}1}$:

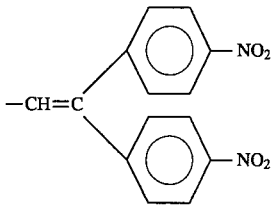

$R_{2\text{-}2}$: —H
$R_{2\text{-}3}$: —H $R_{2\text{-}4}$:

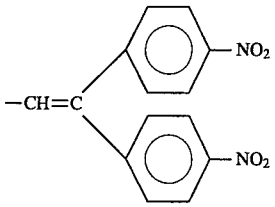

Compound 2-(37)

$R_{2\text{-}1}$:

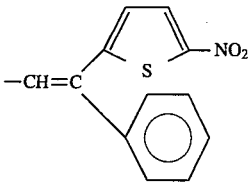

$R_{2\text{-}2}$: —H
$R_{2\text{-}3}$: —H $R_{2\text{-}4}$:

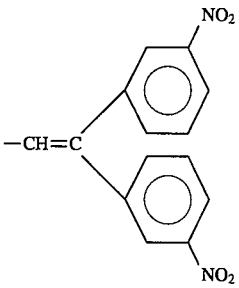

Compound 2-(38)

$R_{2\text{-}1}$:

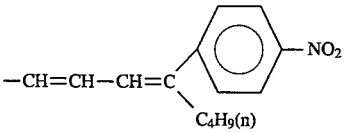

$R_{2\text{-}2}$: —H
$R_{2\text{-}3}$: —H $R_{2\text{-}4}$:

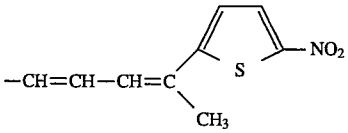

Compound 2-(39)

$R_{2\text{-}1}$:

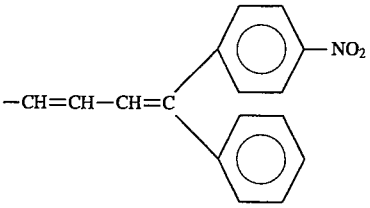

$R_{2\text{-}2}$: —H
$R_{2\text{-}3}$: —H $R_{2\text{-}4}$

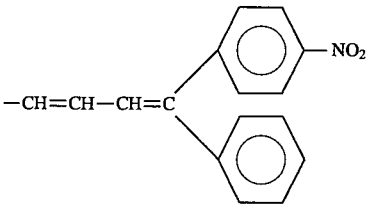

Compound 2-(40)

$R_{2\text{-}1}$:

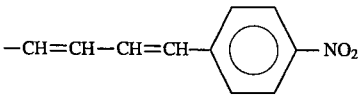

$R_{2\text{-}2}$: —H
$R_{2\text{-}3}$: —H $R_{2\text{-}4}$

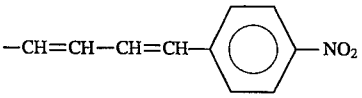

Compound 2-(41)
—$R_{2\text{-}1}$: —$NO_2$
$R_{2\text{-}2}$: —Cl
$R_{2\text{-}3}$: —H $R_{2\text{-}4}$:

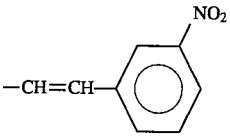

Compound 2-(42)
$R_{2\text{-}1}$: —$NO_2$
$R_{2\text{-}2}$: —Cl
$R_{2\text{-}3}$: —H $R_{2\text{-}4}$:

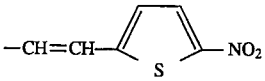

Compound 2-(43)

$R_{2\text{-}1}$:

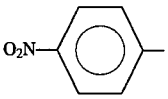

$R_{2\text{-}2}$: —Cl
$R_{2\text{-}3}$: —H $R_{2\text{-}4}$:

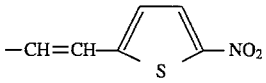

Compound 2-(44)

$R_{2\text{-}1}$:

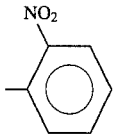

$R_{2\text{-}2}$: —Br
$R_{2\text{-}3}$: —H $R_{2\text{-}4}$:

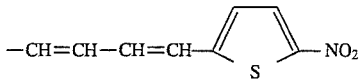

Compound 2-(45)

$R_{2\text{-}1}$:

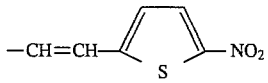

$R_{2\text{-}2}$: —Br
$R_{2\text{-}3}$: —H $R_{2\text{-}4}$:

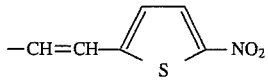

Compound 2-(46)
$R_{2\text{-}1}$: $-NO_2$
$R_{2\text{-}2}$: —Cl
$R_{2\text{-}3}$: —Cl $R_{2\text{-}4}$:

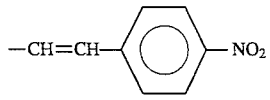

Compound 2-(47)
$R_{2\text{-}1}$: $-NO_2$
$R_{2\text{-}2}$: —Cl
$R_{2\text{-}3}$: —Cl $R_{2\text{-}4}$:

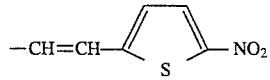

Compound 2-(48)
$R_{2\text{-}1}$:

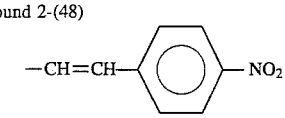

$R_{2\text{-}2}$: $-C_2H_5$
$R_{2\text{-}3}$: —H $R_{2\text{-}4}$:

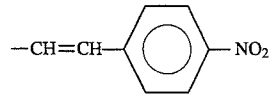

Compound 2-(49)

$R_{2\text{-}1}$:

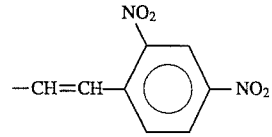

$R_{2\text{-}2}$: $-CH_3$
$R_{2\text{-}3}$: $-CH_3$ $R_{2\text{-}4}$:

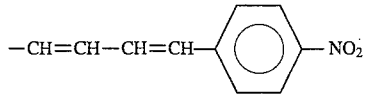

Compound 2-(50)
$R_{2\text{-}1}$: $-CH=CH-NO_2$
$R_{2\text{-}2}$: $-C_4H_9(t)$
$R_{2\text{-}3}$: —H
$R_{2\text{-}4}$: $-CH=CH-NO_2$
Compound 2-(51)

$R_{2\text{-}1}$:

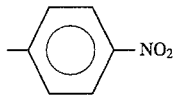

$R_{2\text{-}2}$: $-NO_2$
$R_{2\text{-}3}$: —H $R_{2\text{-}4}$

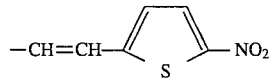

Compound 2-(52)

$R_{2\text{-}1}$:

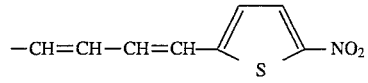

$R_{2\text{-}2}$:

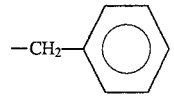

$R_{2\text{-}3}$: —H $R_{2\text{-}4}$:

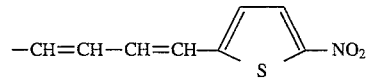

Compound 2-(53)

$R_{2\text{-}1}$:

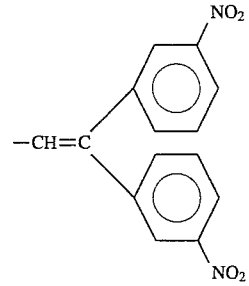

$R_{2\text{-}2}$: $-CH_2$
$R_{2\text{-}3}$: $-CH_2$ $R_{2\text{-}4}$:

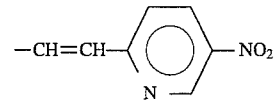

Compound 2-(54)
$R_{2\text{-}1}$: —H $R_{2\text{-}2}$:

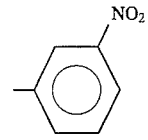

$R_{2\text{-}3}$: —H $R_{2\text{-}4}$:

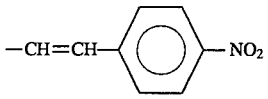

Compound 2-(55)

$R_{2\text{-}1}$: $-NO_2$ $R_{2\text{-}2}$:

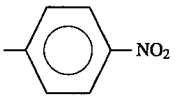

$R_{2\text{-}3}$: $-H$ $R_{2\text{-}4}$:

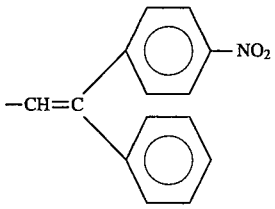

Compound 2-(56)

$R_{2\text{-}1}$:

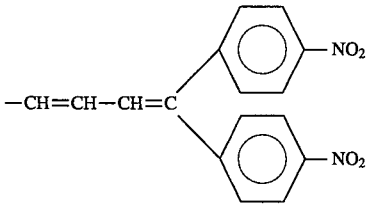

$R_{2\text{-}2}$:

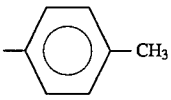

$R_{2\text{-}3}$: $-CH_3$ $R_{2\text{-}4}$:

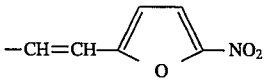

Compound 2-(57)

$R_{2\text{-}1}$:

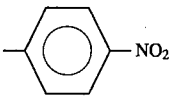

$R_{2\text{-}2}$:

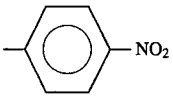

$R_{2\text{-}3}$: $-Cl$ $R_{2\text{-}4}$:

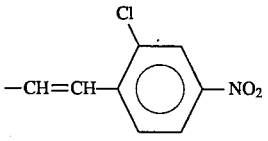

Compound 2-(58)

$R_{2\text{-}1}$:

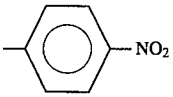

$R_{2\text{-}2}$:

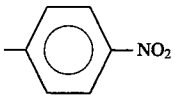

$R_{2\text{-}3}$: $-H$ $R_{2\text{-}4}$: $-H$

Compound 2-(59)

$R_{2\text{-}1}$: $-NO_2$ $R_{2\text{-}2}$:

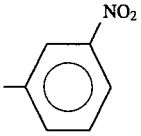

$R_{2\text{-}3}$: $-H$ $R_{2\text{-}4}$: $-H$

Compound 2-(60)

$R_{2\text{-}1}$: $-NO_2$ $R_{2\text{-}2}$:

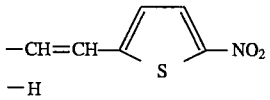

$R_{2\text{-}3}$: $-H$ $R_{2\text{-}4}$: $-H$

Compound 2-(61)

$R_{2\text{-}1}$:

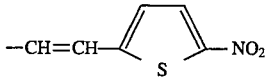

$R_{2\text{-}2}$:

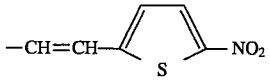

$R_{2\text{-}3}$: $-H$ $R_{2\text{-}4}$: $-H$

Compound 2-(62)

$R_{2\text{-}1}$: $-H$ $R_{2\text{-}2}$: $-NO_2$ $R_{2\text{-}3}$: $-CH=CH-NO_2$ $R_{2\text{-}4}$: $-H$ Compound 2-(63)

$R_{2\text{-}1}$: $-H$ $R_{2\text{-}2}$:

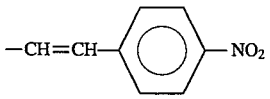

$R_{2\text{-}3}$:

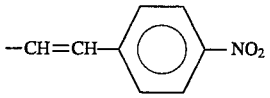

$R_{2\text{-}4}$: $-H$

Compound 2-(64)

$R_{2\text{-}1}$: $-H$ $R_{2\text{-}2}$: $-NO_2$ $R_{2\text{-}3}$:

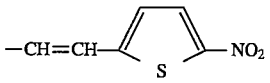

$R_{2\text{-}4}$: $-H$

Compound 2-(65)

$R_{2\text{-}1}$: $-H$ $R_{2\text{-}2}$:

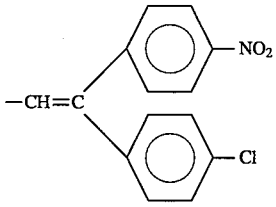

$R_{2\text{-}3}$:

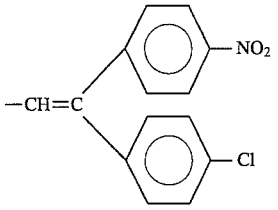

$R_{2\text{-}4}$: —H

Compound 2-(66)

$R_{2\text{-}1}$: $-NO_2$ $R_{2\text{-}2}$: $-CH=CH-NO_2$ $R_{2\text{-}3}$: —H $R_{2\text{-}4}$:

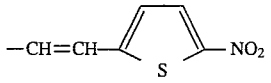

Compound 2-(67)

$R_{2\text{-}1}$:

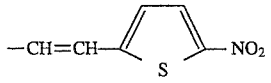

$R_{2\text{-}2}$: $-NO_2$ $R_{2\text{-}3}$: —H $R_{2\text{-}4}$:

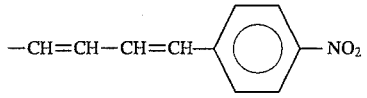

Compound 2-(68)

$R_{2\text{-}1}$:

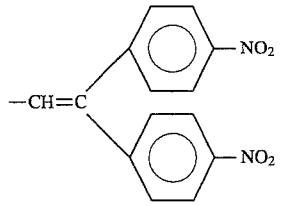

$R_{2\text{-}2}$: $-CH=CH-NO_2$ $R_{2\text{-}3}$: —H $R_{2\text{-}4}$:

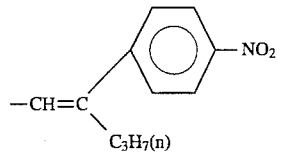

Compound 2-(69)

$R_{2\text{-}1}$:

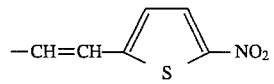

$R_{2\text{-}2}$:

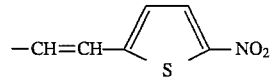

$R_{2\text{-}3}$: —H $R_{2\text{-}4}$: $-NO_2$

Compound 2-(70)

$R_{2\text{-}1}$: $-NO_2$ $R_{2\text{-}2}$:

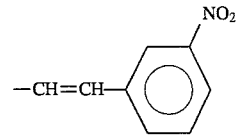

$R_{2\text{-}3}$:

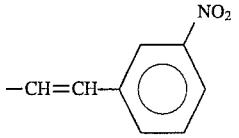

$R_{2\text{-}4}$: $-NO_2$

Compound 2-(71)

$R_{2\text{-}1}$:

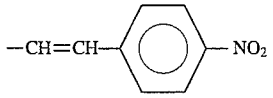

$R_{2\text{-}2}$:

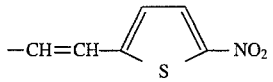

$R_{2\text{-}3}$:

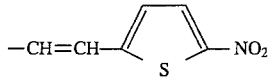

$R_{2\text{-}4}$:

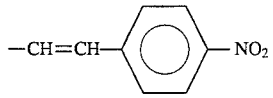

Compound 2-(72)

$R_{2\text{-}1}$: —H $R_{2\text{-}2}$: $-NO_2$ $R_{2\text{-}3}$: —H $R_{2\text{-}4}$:

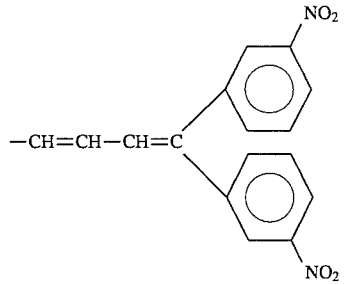

Compound 2-(73)

$R_{2\text{-}1}$: —H $R_{2\text{-}2}$:

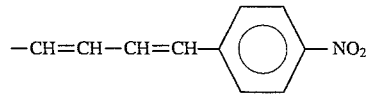

$R_{2\text{-}3}$: —H $R_{2\text{-}4}$:

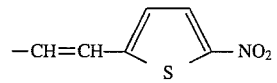

Compound 2-(74)

$R_{2\text{-}1}$: —H $R_{2\text{-}2}$:

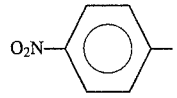

$R_{2\text{-}3}$: —H $R_{2\text{-}4}$: $-NO_2$

Compound 2-(75)

$R_{2\text{-}1}$: $-NO_2$ $R_{2\text{-}2}$: —H $R_{2\text{-}3}$: —H $R_{2\text{-}4}$:

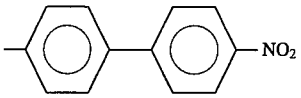

Compound 2-(76)
$R_{2\text{-}1}$: $-NO_2$
$R_{2\text{-}2}$: $-H$
$R_{2\text{-}3}$: $-H$ $R_{2\text{-}4}$:

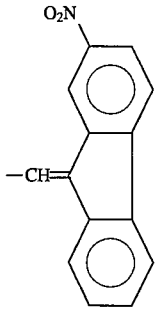

Compound 2-(77)

$R_{2\text{-}1}$:

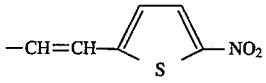

$R_{2\text{-}2}$: $-H$
$R_{2\text{-}3}$: $-H$ $R_{2\text{-}4}$:

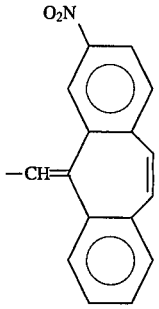

Compound 2-(78)
$R_{2\text{-}1}$: $-CH=CH-NO_2$
$R_{2\text{-}2}$: $-H$
$R_{2\text{-}3}$: $-H$ $R_{2\text{-}4}$:

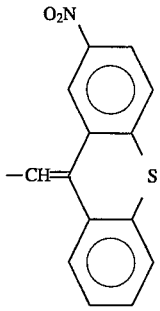

Compound 2-(79)
$R_{2\text{-}1}$: $-CH_3$ $R_{2\text{-}2}$:

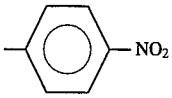

$R_{2\text{-}3}$:

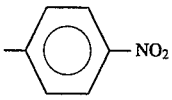

$R_{2\text{-}4}$: $-CH_3$
Compound 2-(80)
$R_{2\text{-}1}$: $-C_2H_5$ $R_{2\text{-}2}$:

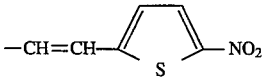

$R_{2\text{-}3}$:

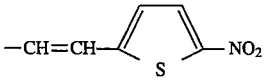

$R_{2\text{-}4}$: $-C_2H_5$
Compound 2-(81)
$R_{2\text{-}1}$:

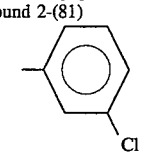

$R_{2\text{-}2}$:

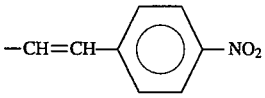

$R_{2\text{-}3}$:

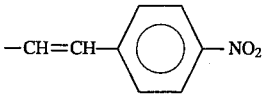

$R_{2\text{-}4}$:

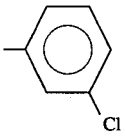

Compound 2-(82)

$R_{2\text{-}1}$:

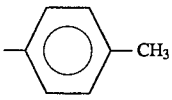

$R_{2\text{-}2}$:

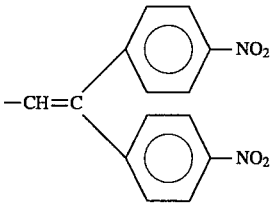

$R_{2\text{-}3}$:

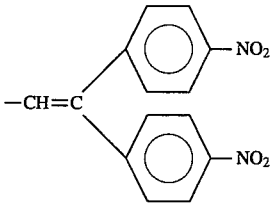

$R_{2\text{-}4}$:

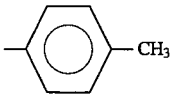

Compound 2-(83)

$R_{2\text{-}1}$:

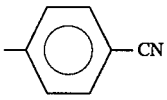

$R_{2\text{-}2}$:

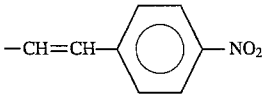

$R_{2\text{-}3}$:

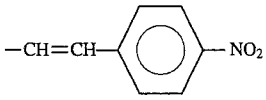

$R_{2\text{-}4}$:

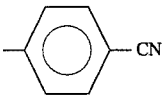

Compound 2-(84)
$R_{2\text{-}1}$: $-NO_2$
$R_{2\text{-}2}$: $-H$ $R_{2\text{-}3}$:

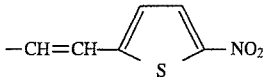

$R_{2\text{-}4}$: $-H$

Basic constitution (Formula (3))

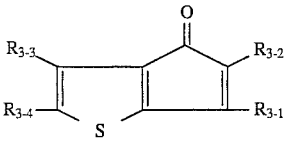

Compound 3-(1)
$R_{3\text{-}1}$: $-NO_2$
$R_{3\text{-}2}$: $-H$
$R_{3\text{-}3}$: $-H$
$R_{3\text{-}4}$: $-NO_2$ Compound 3-(2)
$R_{3\text{-}1}$: $-NO_2$
$R_{3\text{-}2}$: $-H$
$R_{3\text{-}3}$: $-H$
$R_{3\text{-}4}$: $-CH=CH-NO_2$ Compound 3-(3)
$R_{3\text{-}1}$: $-NO_2$
$R_{3\text{-}2}$: $-H$
$R_{3\text{-}3}$: $-H$ $R_{3\text{-}4}$:

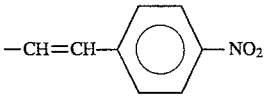

Compound 3-(4)
$R_{3\text{-}1}$: $-NO_2$
$R_{3\text{-}2}$: $-H$
$R_{3\text{-}3}$: $-H$ $R_{3\text{-}4}$:

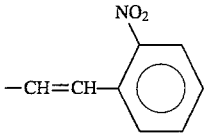

Compound 3-(5)
$R_{3\text{-}1}$: $-NO_2$
$R_{3\text{-}2}$: $-H$
$R_{3\text{-}3}$: $-H$ $R_{3\text{-}4}$:

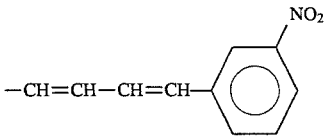

-continued

Basic constitution (Formula (3))

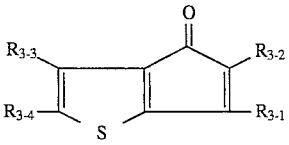

Compound 3-(6)
$R_{3\text{-}1}$: $-NO_2$
$R_{3\text{-}2}$: $-H$
$R_{3\text{-}3}$: $-H$ $R_{3\text{-}4}$:

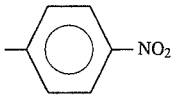

Compound 3-(7)
$R_{3\text{-}1}$: $-NO_2$
$R_{3\text{-}2}$: $-H$
$R_{3\text{-}3}$: $-H$ $R_{3\text{-}4}$:

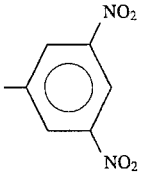

Compound 3-(8)
$R_{3\text{-}1}$: $-NO_2$
$R_{3\text{-}2}$: $-H$
$R_{3\text{-}3}$: $-H$ $R_{3\text{-}4}$:

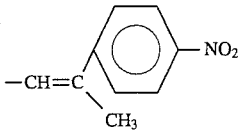

Compound 3-(9)
$R_{3\text{-}1}$: $-NO_2$
$R_{3\text{-}2}$: $-H$
$R_{3\text{-}3}$: $-H$ $R_{3\text{-}4}$:

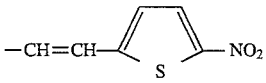

Compound 3-(10)
$R_{3\text{-}1}$: $-NO_2$
$R_{3\text{-}2}$: $-H$
$R_{3\text{-}3}$: $-H$ $R_{3\text{-}4}$:

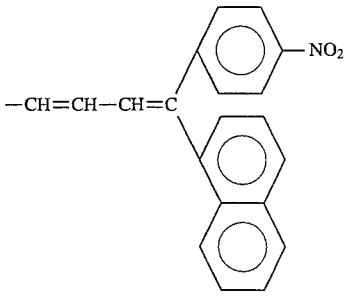

Compound 3-(11)
$R_{3\text{-}1}$: $-NO_2$
$R_{3\text{-}2}$: $-H$
$R_{3\text{-}3}$: $-H$ Basic constitution

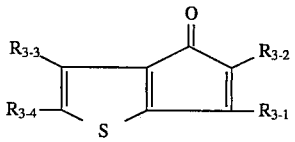

(Formula (3))

$R_{3-4}$:

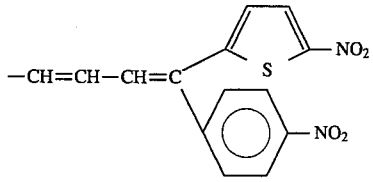

Compound 3-(12)

$R_{3-1}$: $-CH=CH-NO_2$
$R_{3-2}$: $-H$
$R_{3-3}$: $-H$
$R_{3-4}$: $-CH=CH-NO_2$

Compound 3-(13)

$R_{3-1}$: $-CH=CH-NO_2$
$R_{3-2}$: $-H$
$R_{3-3}$: $-H$ $R_{3-4}$:

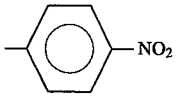

Compound 3-(14)

$R_{3-1}$: $\leftarrow CH=CH\rangle_2 NO_2$ $R_{3-2}$: $-H$
$R_{3-3}$: $-H$ $R_{3-4}$:

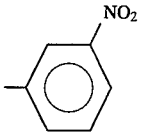

Compound 3-(15)

$R_{3-1}$: $-CH=CH-NO_2$
$R_{3-2}$: $-H$
$R_{3-3}$: $-H$ $R_{3-4}$:

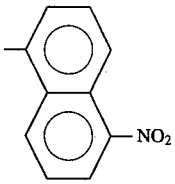

Compound 3-(16)

$R_{3-1}$: $-CH=CH-NO_2$
$R_{3-2}$: $-H$
$R_{3-3}$: $-H$ $R_{3-4}$:

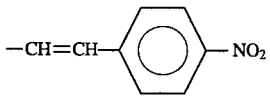

Compound 3-(17)

$R_{3-1}$: $-CH=CH-NO_2$
$R_{3-2}$: $-H$
$R_{3-3}$: $-H$

Basic constitution

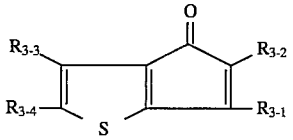

(Formula (3))

$R_{3-4}$:

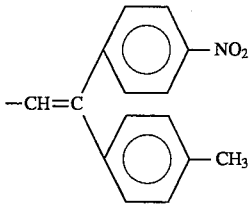

Compound 3-(18)

$R_{3-1}$: $-CH=CH-NO_2$
$R_{3-2}$: $-H$
$R_{3-3}$: $-H$ $R_{3-4}$:

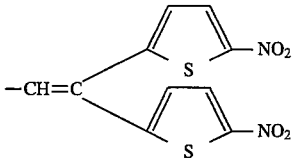

Compound 3-(19)

$R_{3-1}$: $-CH=CH-NO_2$
$R_{3-2}$: $-H$
$R_{3-3}$: $-H$ $R_{3-4}$:

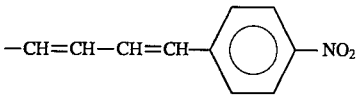

Compound 3-(20)

$R_{3-1}$:

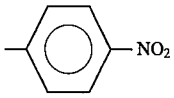

$R_{3-2}$: $-H$
$R_{3-3}$: $-H$
$R_{3-4}$:

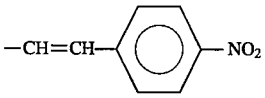

Compound 3-(21)

$R_{3-1}$:

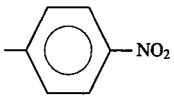

$R_{3-2}$: $-H$
$R_{3-3}$: $-H$ $R_{3-4}$:

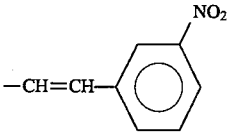

Compound 3-(22)

Basic constitution (Formula (3))

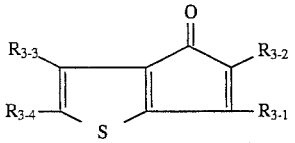

$R_{3\text{-}1}$:

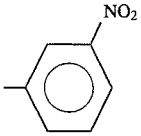

$R_{3\text{-}2}$: —H $R_{3\text{-}3}$: —H $R_{3\text{-}4}$:

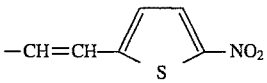

Compound 3-(23)

$R_{3\text{-}1}$:

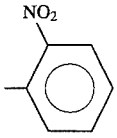

$R_{3\text{-}2}$: —H $R_{3\text{-}3}$: —H $R_{3\text{-}4}$:

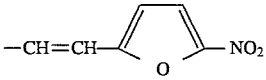

Compound 3-(24)

$R_{3\text{-}1}$:

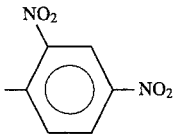

$R_{3\text{-}2}$: —H $R_{3\text{-}3}$: —H $R_{3\text{-}4}$:

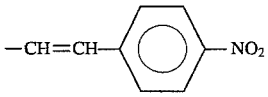

Compound 3-(25)

$R_{3\text{-}1}$:

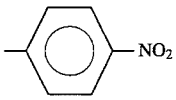

$R_{3\text{-}2}$: —H $R_{3\text{-}3}$: —H $R_{3\text{-}4}$:

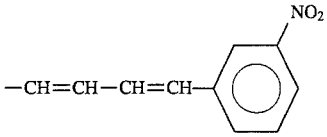

Compound 3-(26)

Basic constitution (Formula (3))

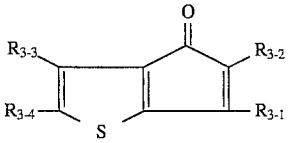

$R_{3\text{-}1}$:

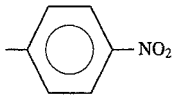

$R_{3\text{-}2}$: —H $R_{3\text{-}3}$: —H $R_{3\text{-}4}$:

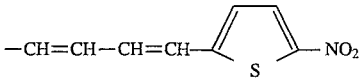

Compound 3-(27)

$R_{3\text{-}1}$:

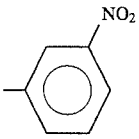

$R_{3\text{-}2}$: —H $R_{3\text{-}3}$: —H $R_{3\text{-}4}$:

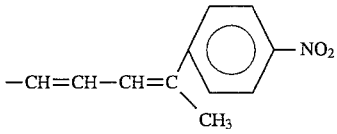

Compound 3-(28)

$R_{3\text{-}1}$:

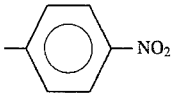

$R_{3\text{-}2}$: —H $R_{3\text{-}3}$: —H $R_{3\text{-}4}$:

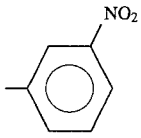

Compound 3-(29)

$R_{3\text{-}1}$:

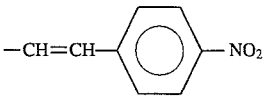

$R_{3\text{-}2}$: —H $R_{3\text{-}3}$: —H $R_{3\text{-}4}$:

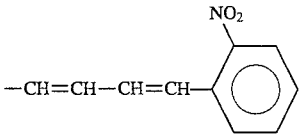

Compound 3-(30)

-continued

Basic constitution

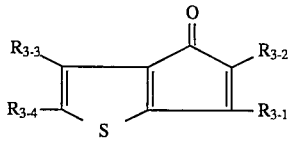

(Formula (3))

$R_{3\text{-}1}$:

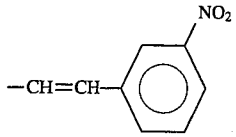

$R_{3\text{-}2}$: —H $R_{3\text{-}3}$: —H $R_{3\text{-}4}$:

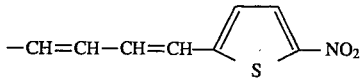

Compound 3-(31)

$R_{3\text{-}1}$:

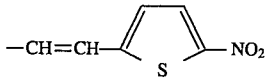

$R_{3\text{-}2}$: —H $R_{3\text{-}3}$: —H $R_{3\text{-}4}$:

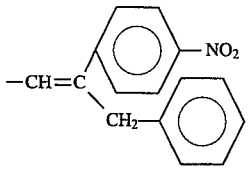

Compound 3-(32)

$R_{3\text{-}1}$:

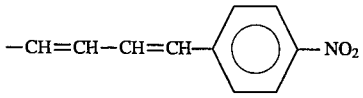

$R_{3\text{-}2}$: —H $R_{3\text{-}3}$: —H $R_{3\text{-}4}$:

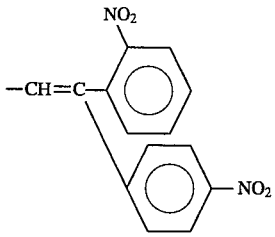

Compound 3-(33)

$R_{3\text{-}1}$:

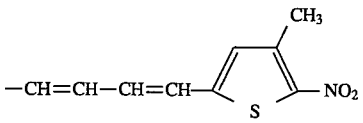

$R_{3\text{-}2}$: —H $R_{3\text{-}3}$: —H

-continued

Basic constitution

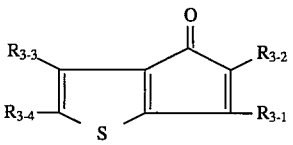

(Formula (3))

$R_{3\text{-}4}$:

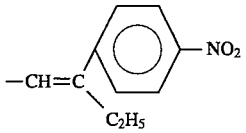

Compound 3-(34)

$R_{3\text{-}1}$:

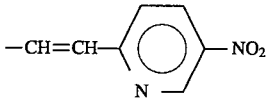

$R_{3\text{-}2}$: —H $R_{3\text{-}3}$: —H $R_{3\text{-}4}$:

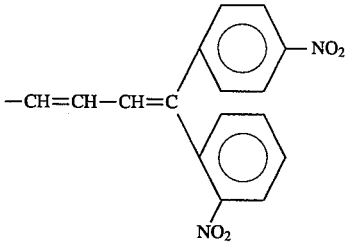

Compound 3-(35)

$R_{3\text{-}1}$:

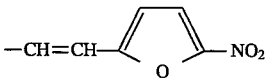

$R_{3\text{-}2}$: —H $R_{3\text{-}3}$: —H $R_{3\text{-}4}$:

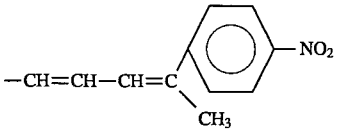

Compound 3-(36)

$R_{3\text{-}1}$:

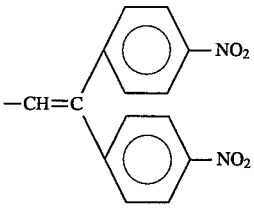

$R_{3\text{-}2}$: —H $R_{3\text{-}3}$: —H $R_{3\text{-}4}$:

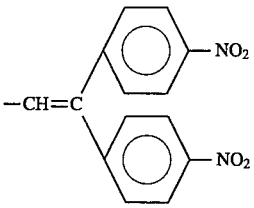

Basic constitution
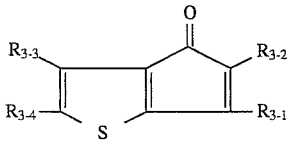
(Formula (3))
Compound 3-(37)
$R_{3-1}$:
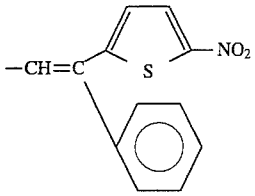
$R_{3-2}$: —H
$R_{3-3}$: —H
$R_{3-4}$:
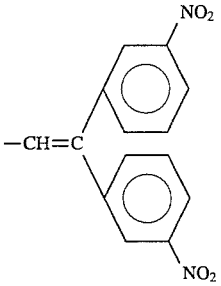
Compound 3-(38)
$R_{3-1}$:
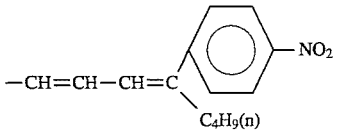
$R_{3-2}$: —H
$R_{3-3}$: —H
$R_{3-4}$:
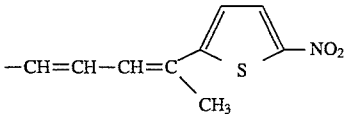
Compound 3-(39)
$R_{3-1}$:
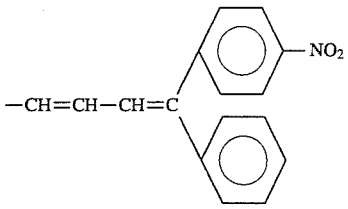
$R_{3-2}$: —H
$R_{3-3}$: —H
$R_{3-4}$:
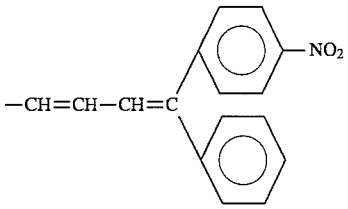
Basic constitution
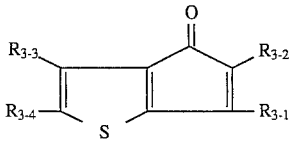
(Formula (3))
Compound 3-(40)
$R_{3-1}$:
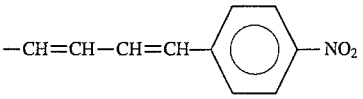
$R_{3-2}$: —H
$R_{3-3}$: —H
$R_{3-4}$:
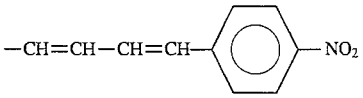
Compound 3-(41)
$R_{3-1}$: $-NO_2$
$R_{3-2}$: —Cl
$R_{3-3}$: —H
$R_{3-4}$:
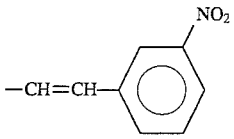
Compound 3-(42)
$R_{3-1}$: $-NO_2$
$R_{3-2}$: —Cl
$R_{3-3}$: —H
$R_{3-4}$:
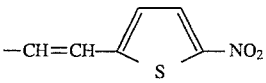
Compound 3-(43)
$R_{3-1}$:
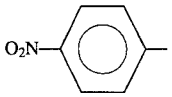
$R_{3-2}$: —Cl
$R_{3-3}$: —H
$R_{3-4}$:
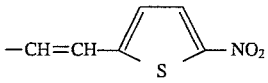
Compound 3-(44)
$R_{3-1}$:
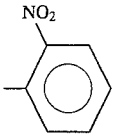
$R_{3-2}$: —Br
$R_{3-3}$: —H
$R_{3-4}$:
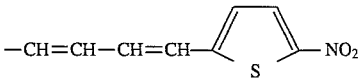
Compound 3-(45)

Basic constitution

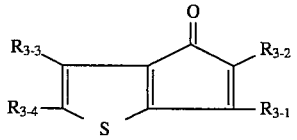

(Formula (3))

$R_{3-1}$:

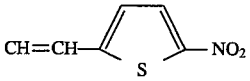

$R_{3-2}$: —Br
$R_{3-3}$: —H $R_{3-4}$:

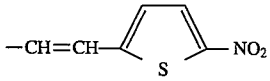

Compound 3-(46)
$R_{3-1}$: $-NO_2$
$R_{3-2}$: —Cl
$R_{3-3}$: —Cl $R_{3-4}$:

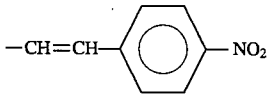

Compound 3-(47)
$R_{3-1}$: $-NO_2$
$R_{3-2}$: —Cl
$R_{3-3}$: —Cl $R_{3-4}$:

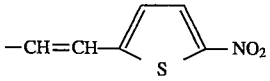

Compound 3-(48)

$R_{3-1}$:

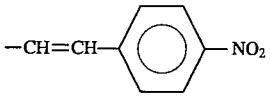

$R_{3-2}$: $-C_2H_5$
$R_{3-3}$: —H $R_{3-4}$:

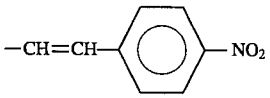

Compound 3-(49)

$R_{3-1}$:

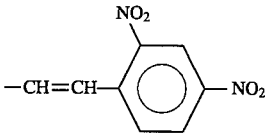

$R_{3-2}$: $-CH_3$
$R_{3-3}$: $-CH_3$ $R_{3-4}$:

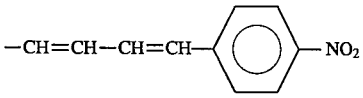

Compound 3-(50)
$R_{3-1}$: $-CH=CH-NO_2$
$R_{3-2}$: $-C_4H_9(t)$
$R_{3-3}$: —H
$R_{3-4}$: $-CH=CH-NO_2$ Basic constitution

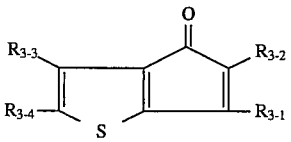

(Formula (3))

Compound 3-(51)

$R_{3-1}$:

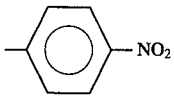

$R_{3-2}$: $-NO_2$
$R_{3-3}$: —H $R_{3-4}$:

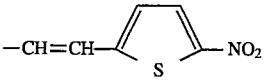

Compound 3-(52)

$R_{3-1}$:

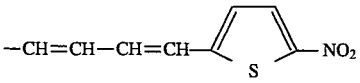

$R_{3-2}$: $-CH_2$
$R_{3-3}$: —H $R_{3-4}$:

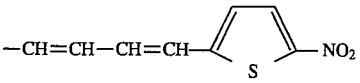

Compound 3-(53)

$R_{3-1}$:

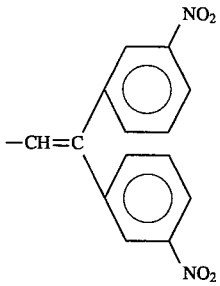

$R_{3-2}$: $-CH_2$
$R_{3-3}$: $-CH_2$ $R_{3-4}$:

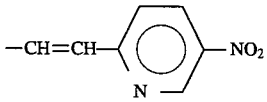

Compound 3-(54)
$R_{3-1}$: —H $R_{3-2}$:

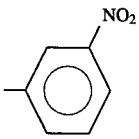

$R_{3-3}$: —H $R_{3-4}$:

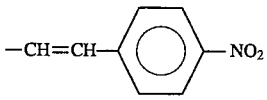

Basic constitution

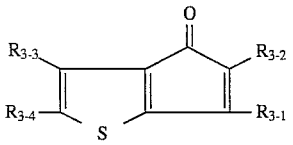

(Formula (3))

Compound 3-(55)

$R_{3-1}$: $-NO_2$ $R_{3-2}$:

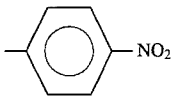

$R_{3-3}$: $-H$ $R_{3-4}$:

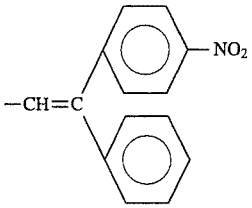

Compound 3-(56)

$R_{3-1}$:

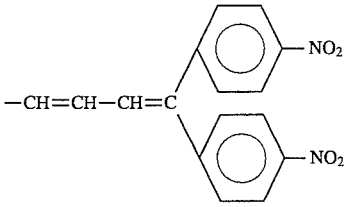

$R_{3-2}$:

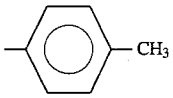

$R_{3-3}$: $-CH_3$ $R_{3-4}$:

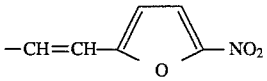

Compound 3-(57)

$R_{3-1}$:

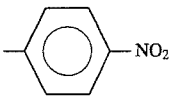

$R_{3-2}$:

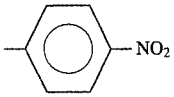

$R_{3-3}$: $-Cl$ $R_{3-4}$:

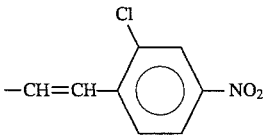

Compound 3-(58)

Basic constitution

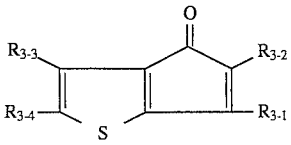

(Formula (3))

$R_{3-1}$:

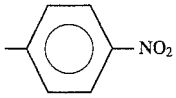

$R_{3-2}$:

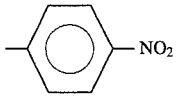

$R_{3-3}$: $-H$ $R_{3-4}$: $-H$

Compound 3-(59)

$R_{3-1}$: $-NO_2$ $R_{3-2}$:

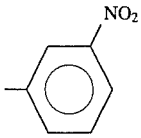

$R_{3-3}$: $-H$ $R_{3-4}$: $-H$

Compound 3-(60)

$R_{3-1}$: $-NO_2$ $R_{3-2}$:

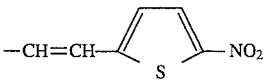

$R_{3-3}$: $-H$ $R_{3-4}$: $-H$

Compound 3-(61)

$R_{3-1}$:

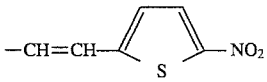

$R_{3-2}$:

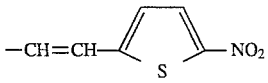

$R_{3-3}$: $-H$ $R_{3-4}$: $-H$

Compound 3-(62)

$R_{3-1}$: $-H$ $R_{3-2}$: $-NO_2$ $R_{3-3}$: $-CH=CH-NO_2$ $R_{3-4}$: $-H$

Compound 3-(63)

$R_{3-1}$: $-H$ $R_{3-2}$:

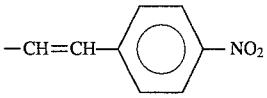

$R_{3-3}$:

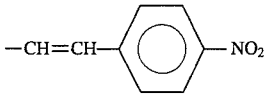

$R_{3-4}$: $-H$

Compound 3-(64)

$R_{3-1}$: $-H$ $R_{3-2}$: $-NO_2$

Basic constitution

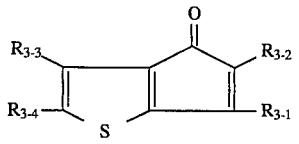

(Formula (3))

$R_{3\text{-}3}$:

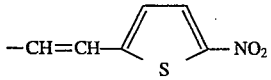

$R_{3\text{-}4}$: —H

Compound 3-(65)

$R_{3\text{-}1}$: —H $R_{3\text{-}2}$:

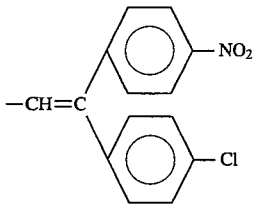

$R_{3\text{-}3}$:

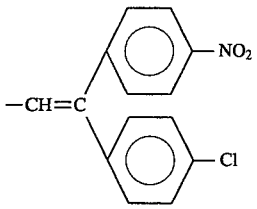

$R_{3\text{-}4}$: —H

Compound 3-(66)

$R_{3\text{-}1}$: $-NO_2$ $R_{3\text{-}2}$: $-CH=CH-NO_2$ $R_{3\text{-}3}$: —H $R_{3\text{-}4}$:

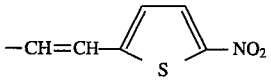

Compound 3-(67)

$R_{3\text{-}1}$:

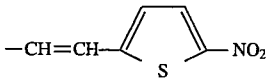

$R_{3\text{-}2}$: $-NO_2$ $R_{3\text{-}3}$: —H $R_{3\text{-}4}$:

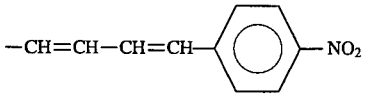

Compound 3-(68)

$R_{3\text{-}1}$:

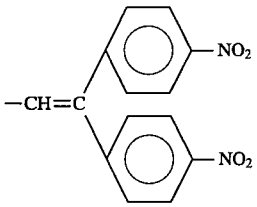

$R_{3\text{-}2}$: $-CH=CH-NO_2$

Basic constitution

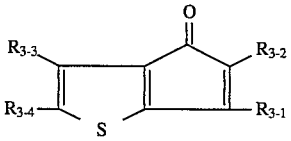

(Formula (3))

$R_{3\text{-}3}$: —H $R_{3\text{-}4}$:

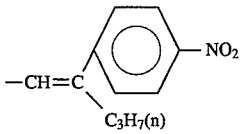

Compound 3-(69)

$R_{3\text{-}1}$:

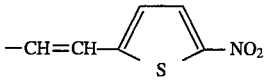

$R_{3\text{-}2}$:

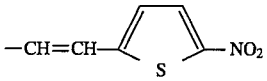

$R_{3\text{-}3}$: —H $R_{3\text{-}4}$: $-NO_2$

Compound 3-(70)

$R_{3\text{-}1}$: $-NO_2$ $R_{3\text{-}2}$:

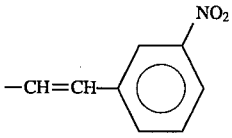

$R_{3\text{-}3}$:

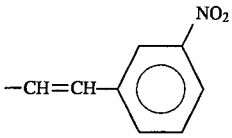

$R_{3\text{-}4}$: $-NO_2$

Compound 3-(71)

$R_{3\text{-}1}$:

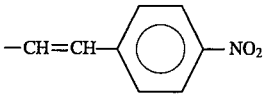

$R_{3\text{-}2}$:

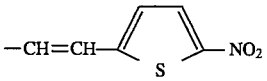

$R_{3\text{-}3}$:

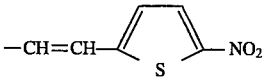

$R_{3\text{-}4}$:

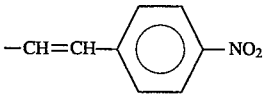

Compound 3-(72)

$R_{3\text{-}1}$: —H $R_{3\text{-}2}$: $-NO_2$ $R_{3\text{-}3}$: —H

Basic constitution
(Formula (3))
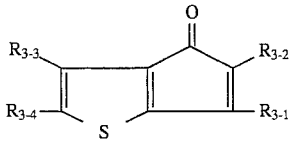
$R_{3-4}$:
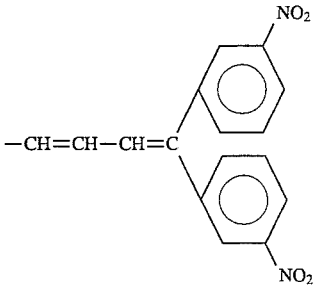
Compound 3-(73)
$R_{3-1}$: —H
$R_{3-2}$:
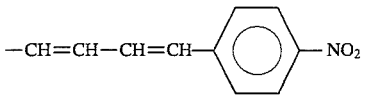
$R_{3-3}$: —H
$R_{3-4}$:
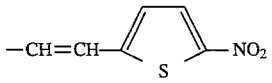
Compound 3-(74)
$R_{3-1}$: —H
$R_{3-2}$:
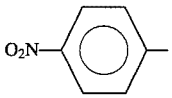
$R_{3-3}$: —H
$R_{3-4}$: $—NO_2$
Compound 3-(75)
$R_{3-1}$: $—NO_2$
$R_{3-2}$: —H
$R_{3-3}$: —H
$R_{3-4}$:
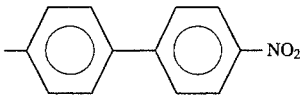
Compound 3-(76)
$R_{3-1}$: $—NO_2$
$R_{3-2}$: —H
$R_{3-3}$: —H
$R_{3-4}$:
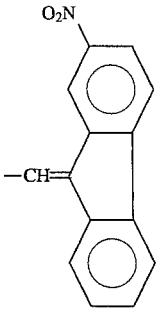
Compound 3-(77)
Basic constitution
(Formula (3))
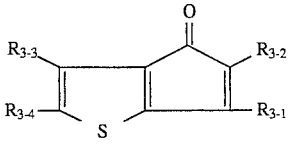
$R_{3-1}$:
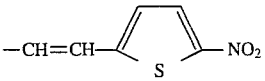
$R_{3-2}$: —H
$R_{3-3}$: —H
$R_{3-4}$:
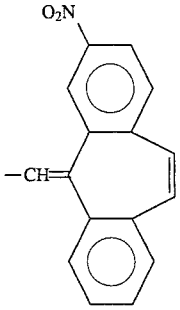
Compound 3-(78)
$R_{3-1}$: $—CH=CH—NO_2$
$R_{3-2}$: —H
$R_{3-3}$: —H
$R_{3-4}$:
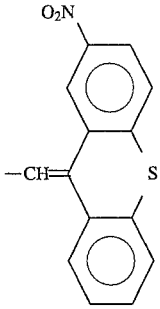
Compound 3-(79)
$R_{3-1}$: $—CH_3$
$R_{3-2}$:
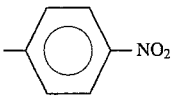
$R_{3-3}$:
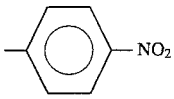
$R_{3-4}$: $—CH_3$
Compound 3-(80)
$R_{3-1}$: $—C_2H_5$
$R_{3-2}$:
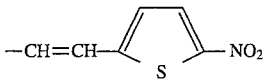
$R_{3-3}$:
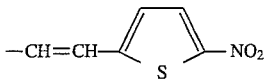
$R_{3-4}$: $—C_2H_5$
Compound 3-(81)

Basic constitution
(Formula (3))
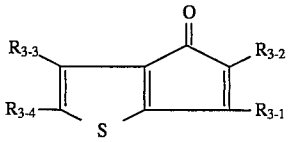
$R_{3-1}$:
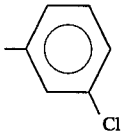
$R_{3-2}$:
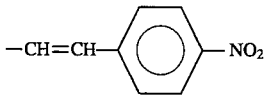
$R_{3-3}$:
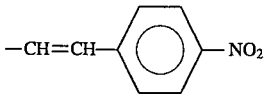
$R_{3-4}$:
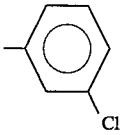
Compound 3-(82)
$R_{3-1}$:
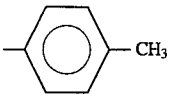
$R_{3-2}$:
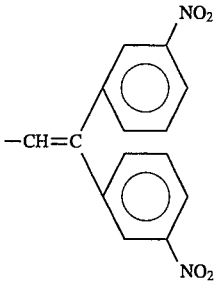
$R_{3-3}$:
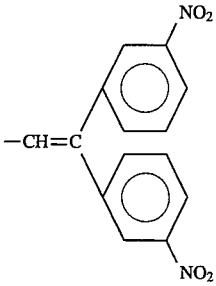
$R_{3-4}$:
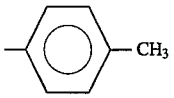
Compound 3-(83)
Basic constitution
(Formula (3))
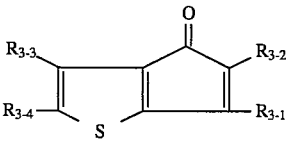
$R_{3-1}$:
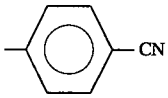
$R_{3-2}$:
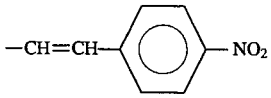
$R_{3-3}$:
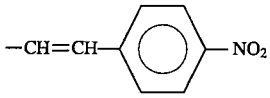
$R_{3-4}$:
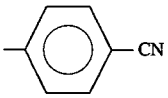
Compound 3-(84)
$R_{3-1}$: $-NO_2$
$R_{3-2}$: $-H$
$R_{3-3}$:
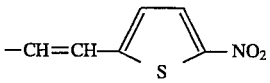
$R_{3-4}$: $-H$
Basic constitution
(Formula (4))
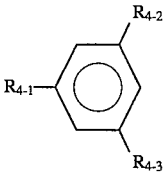
Compound 4-(1)
$R_{4-1}$:
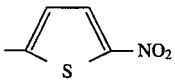
$R_{4-2}$: $-CH=CH-NO_2$
$R_{4-3}$: $-H$
Compound 4-(2)
$R_{4-1}$:
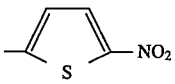
$R_{4-2}$: $\text{-}(CH=CH)_2\text{-}NO_2$
$R_{4-3}$: $-H$
Compound 4-(3)
$R_{4-1}$:
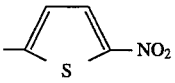

Basic constitution
(Formula (4))
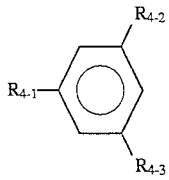
$R_{4-2}$: $-CH=CH-NO_2$
$R_{4-3}$: $-Cl$
Compound 4-(4)
$R_{4-1}$:
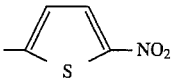
$R_{4-2}$:
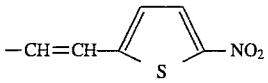
$R_{4-3}$: $-H$
Compound 4-(5)
$R_{4-1}$:
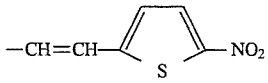
$R_{4-2}$:
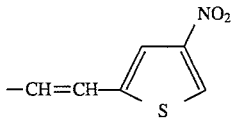
$R_{4-3}$: $-H$
Compound 4-(6)
$R_{4-1}$:
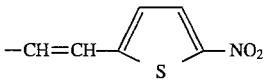
$R_{4-2}$:
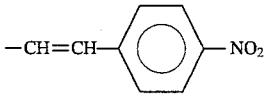
$R_{4-3}$: $-H$
Compound 4-(7)
$R_{4-1}$:
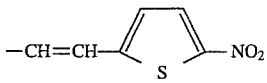
$R_{4-2}$:
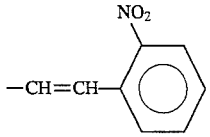
$R_{4-3}$: $-H$
Compound 4-(8)
$R_{4-1}$:
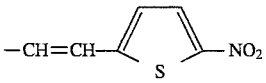
Basic constitution
(Formula (4))
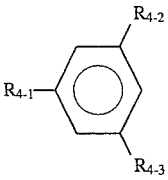
$R_{4-2}$:
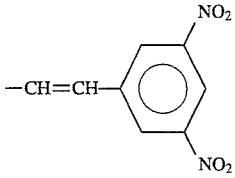
$R_{4-3}$: $-H$
Compound 4-(9)
$R_{4-1}$:
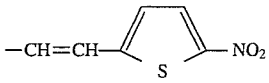
$R_{4-2}$:
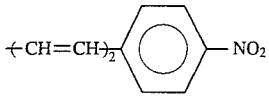
$R_{4-3}$: $-H$
Compound 4-(10)
$R_{4-1}$:
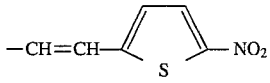
$R_{4-2}$:
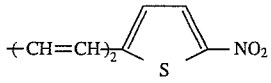
$R_{4-3}$: $-H$
Compound 4-(11)
$R_{4-1}$:
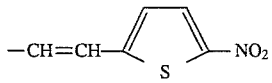
$R_{4-2}$:
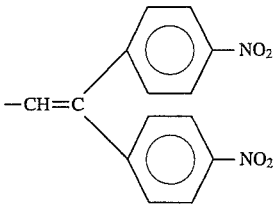
$R_{4-3}$: $-H$
Compound 4-(12)
$R_{4-1}$:
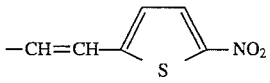
$R_{4-2}$:
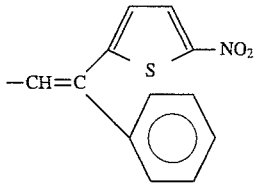

Basic constitution
(Formula (4))
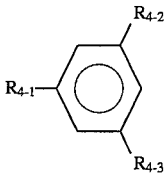
$R_{4-3}$: —H
Compound 4-(13)
$R_{4-1}$:
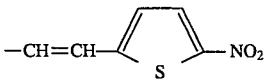
$R_{4-2}$:
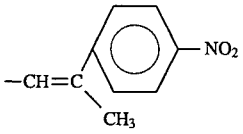
$R_{4-3}$: —H
Compound 4-(14)
$R_{4-1}$:
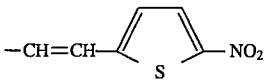
$R_{4-2}$:
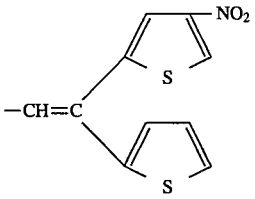
$R_{4-3}$: —H
Compound 4-(15)
$R_{4-1}$:
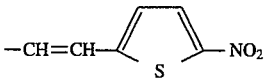
$R_{4-2}$:
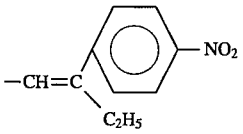
$R_{4-3}$: —H
Compound 4-(16)
$R_{4-1}$:
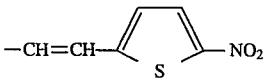
$R_{4-2}$: —CH=CH—$NO_2$
$R_{4-3}$: —$CH_3$
Compound 4-(17)
$R_{4-1}$:
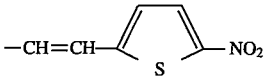
$R_{4-2}$: —(CH=CH)$_2$—$NO_2$
$R_{4-3}$: —$C_4H_9$ (t)
Basic constitution
(Formula (4))
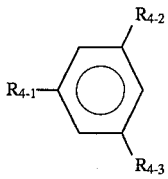
Compound 4-(18)
$R_{4-1}$:
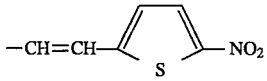
$R_{4-2}$:
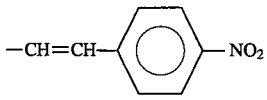
$R_{4-3}$:
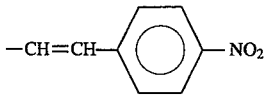
Compound 4-(19)
$R_{4-1}$:
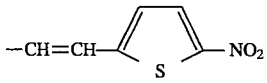
$R_{4-2}$:
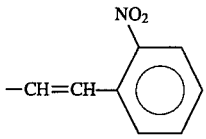
$R_{4-3}$: —Br
Compound 4-(20)
$R_{4-1}$:
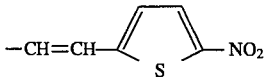
$R_{4-2}$: —CH=CH—$NO_2$
$R_{4-3}$: —CN
Compound 4-(21)
$R_{4-1}$:
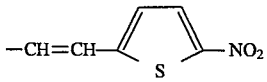
$R_{4-2}$:
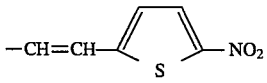
$R_{4-3}$:
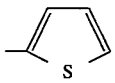
Compound 4-(22)
$R_{4-1}$:
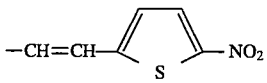

Basic constitution
(Formula (4))

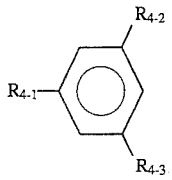

$R_{4\text{-}2}$:

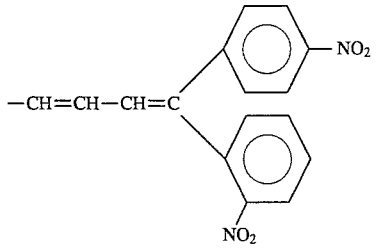

$R_{4\text{-}3}$: $-CH=CH-NO_2$

Compound 4-(23)

$R_{4\text{-}1}$:

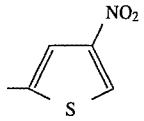

$R_{4\text{-}2}$: $-CH=CH-NO_2$ $R_{4\text{-}3}$: $-H$

Compound 4-(24)

$R_{4\text{-}1}$:

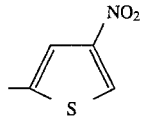

$R_{4\text{-}2}$:

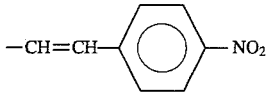

$R_{4\text{-}3}$: $-H$

Compound 4-(25)

$R_{4\text{-}1}$:

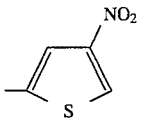

$R_{4\text{-}2}$:

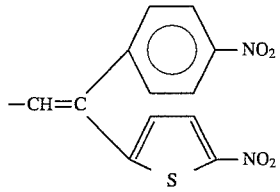

$R_{4\text{-}3}$: $-H$

Compound 4-(26)

$R_{4\text{-}1}$:

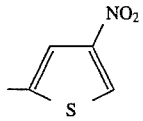

$R_{4\text{-}2}$: $-(CH=CH)_2-NO_2$ $R_{4\text{-}3}$: $-NO_2$

Basic constitution
(Formula (4))

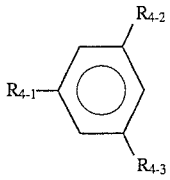

Compound 4-(27)

$R_{4\text{-}1}$:

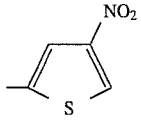

$R_{4\text{-}2}$:

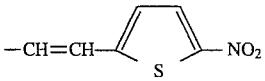

$R_{4\text{-}3}$: $-CH=CH-NO_2$

Compound 4-(28)

$R_{4\text{-}1}$:

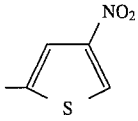

$R_{4\text{-}2}$: $-CH=CH-NO_2$ $R_{4\text{-}3}$: $-CH=CH-NO_2$

Compound 2-(29)

$R_{4\text{-}1}$:

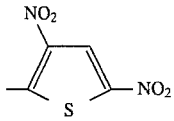

$R_{4\text{-}2}$:

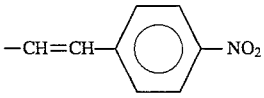

$R_{4\text{-}3}$: $-NO_2$

Compound 4-(30)

$R_{4\text{-}1}$:

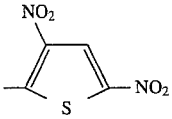

$R_{4\text{-}2}$: $-CH=CH-NO_2$ $R_{4\text{-}3}$: $-H$

Compound 4-(31)

$R_{4\text{-}1}$:

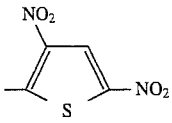

$R_{4\text{-}2}$: $-CH=CH-NO_2$ $R_{4\text{-}3}$:

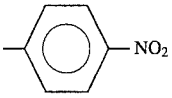

Compound 4-(32)

Basic constitution
(Formula (4))
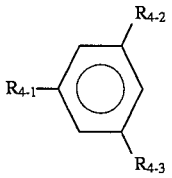
$R_{4-1}$:
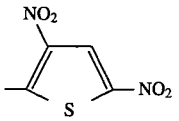
$R_{4-2}$: $-CH=CH-NO_2$
$R_{4-3}$:
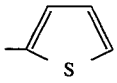
Compound 4-(33)
$R_{4-1}$:
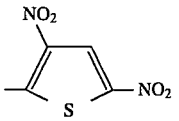
$R_{4-2}$:
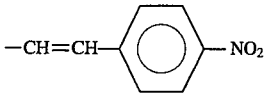
$R_{4-3}$: $-CN$
Compound 4-(34)
$R_{4-1}$:
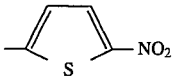
$R_{4-2}$: $-CH=CH-NO_2$
$R_{4-3}$:
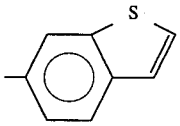
Compound 4-(35)
$R_{4-1}$:
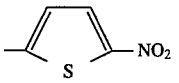
$R_{4-2}$: $-CH=CH-NO_2$
$R_{4-3}$:
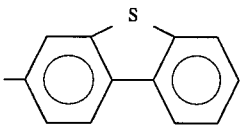
Compound 4-(36)
$R_{4-1}$:
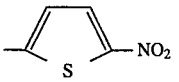
$R_{4-2}$: $-CH=CH-NO_2$
Basic constitution
(Formula (4))
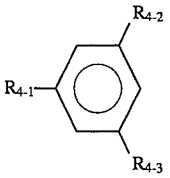
$R_{4-3}$:
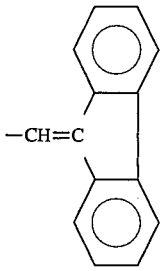
Compound 4-(37)
$R_{4-1}$:
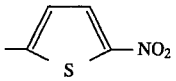
$R_{4-2}$:
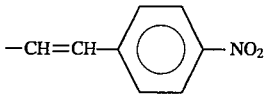
$R_{4-3}$:
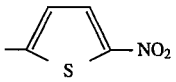
Compound 4-(38)
$R_{4-1}$:
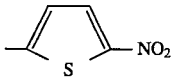
$R_{4-2}$:
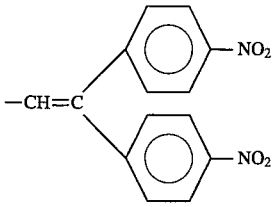
$R_{4-3}$:
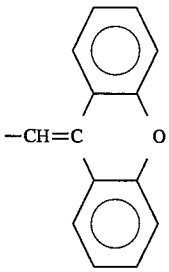
Compound 4-(39)
$R_{4-1}$:
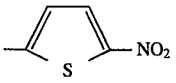

Basic constitution
(Formula (4))

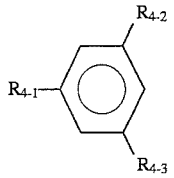

$R_{4-2}$:

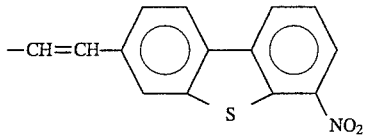

$R_{4-3}$: —H

Basis constitution
(Formula (5))

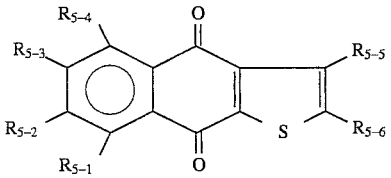

Compound 5-(1)

$R_{5-1}$: —H
$R_{5-2}$: —$NO_2$
$R_{5-3}$–$R_{5-5}$: —H
$R_{5-6}$: —$NO_2$

Compound 5-(2)

$R_{5-1}$: —H
$R_{5-2}$: —$NO_2$
$R_{5-3}$–$R_{5-5}$: —H
$R_{5-6}$: —CH=CH—$NO_2$

Compound 5-(3)

$R_{5-1}$: —H
$R_{5-2}$: —$NO_2$
$R_{5-3}$–$R_{5-5}$: —H $R_{5-6}$:

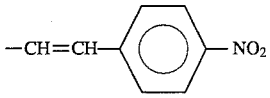

Compound 5-(4)

$R_{5-1}$: —H
$R_{5-2}$: —$NO_2$
$R_{5-3}$–$R_{5-5}$: —H $R_{5-6}$:

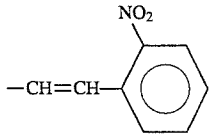

Compound 5-(5)

$R_{5-1}$: —H
$R_{5-2}$: —$NO_2$
$R_{5-3}$–$R_{5-5}$: —H
$R_{5-6}$: $-(CH=CH)_2-NO_2$

Basis constitution
(Formula (5))

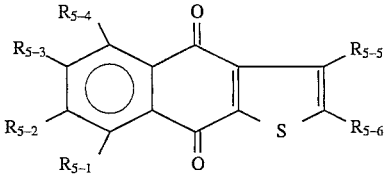

Compound 5-(6)

$R_{5-1}$: —H
$R_{5-2}$: —$NO_2$
$R_{5-3}$–$R_{5-5}$: —H $R_{5-6}$:

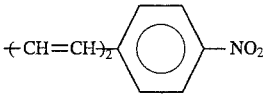

Compound 5-(7)

$R_{5-1}$: —H
$R_{5-2}$: —$NO_2$
$R_{5-3}$–$R_{5-5}$: —H $R_{5-6}$:

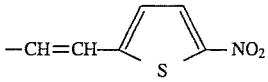

Compound 5-(8)

$R_{5-1}$: —H
$R_{5-2}$: —$NO_2$
$R_{5-3}$–$R_{5-5}$: —H $R_{5-6}$:

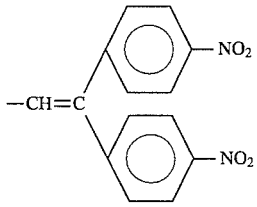

Compound 5-(9)

$R_{5-1}$: —H
$R_{5-2}$: —$NO_2$
$R_{5-3}$–$R_{5-5}$: —H $R_{5-6}$:

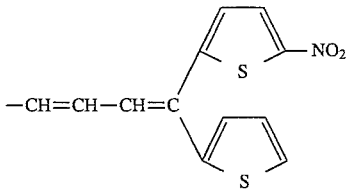

Compound 5-(10)

$R_{5-1}$: —H
$R_{5-2}$: —$NO_2$
$R_{5-3}$–$R_{5-5}$: —H $R_{5-6}$:

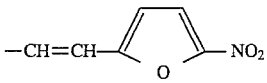

Compound 5-(11)

$R_{5-1}$: —H
$R_{5-2}$: —$NO_2$

Basis constitution
(Formula (5))

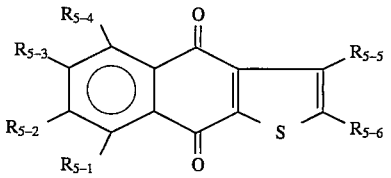

$R_{5-3}$–$R_{5-5}$: —H $R_{5-6}$:

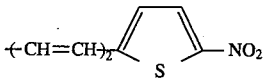

Compound 5-(12)

$R_{5-1}$: —H
$R_{5-2}$: —$NO_2$
$R_{5-3}$–$R_{5-5}$: —H $R_{5-6}$:

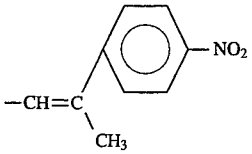

Compound 5-(13)

$R_{5-1}$: —H
$R_{5-2}$: —$NO_2$
$R_{5-3}$–$R_{5-5}$: —H $R_{5-6}$:

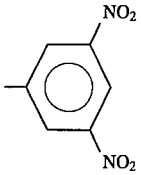

Compound 5-(14)

$R_{5-1}$: —$NO_2$
$R_{5-2}$–$R_{5-5}$: —H
$R_{5-6}$: —$NO_2$

Compound 5-(15)

$R_{5-1}$: —$NO_2$
$R_{5-2}$: —H
$R_{5-3}$: —Cl
$R_{5-4}$, $R_{5-5}$: —H $R_{5-6}$:

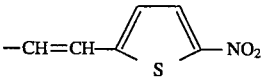

Compound 5-(16)

$R_{5-1}$: —$NO_2$
$R_{5-2}$: —H
$R_{5-3}$: —Br
$R_{5-4}$: —H
$R_{5-5}$: —CH=CH—$NO_2$
$R_{5-6}$: —H

Compound 5-(17)

$R_{5-1}$: —$NO_2$
$R_{5-2}$–$R_{5-4}$: —H

Basis constitution
(Formula (5))

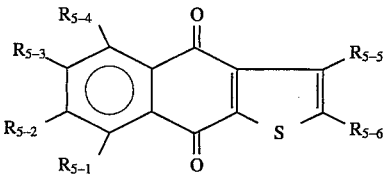

$R_{5-5}$:

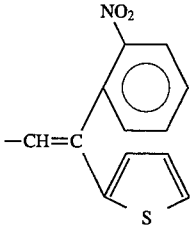

$R_{5-6}$: —H

Compound 5-(18)

$R_{5-1}$: —$NO_2$
$R_{5-2}$, $R_{5-3}$: —H
$R_{5-4}$: —(CH=CH)$_2$—$NO_2$ $R_{5-5}$: —H
$R_{5-6}$: —$C_4H_9$(t)

Compound 5-(19)

$R_{5-1}$: —$NO_2$
$R_{5-2}$: —H $R_{5-3}$:

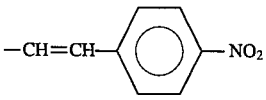

$R_{5-4}$: —H
$R_{5-5}$: —$CH_3$
$R_{5-6}$: —H

Compound 5-(20)

$R_{5-1}$: —$NO_2$
$R_{5-2}$: —H $R_{5-3}$:

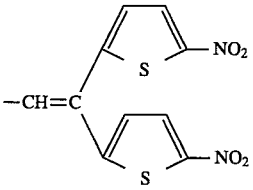

$R_{5-4}$–$R_{5-6}$: —H

Compound 5-(21)

$R_{5-1}$: —$NO_2$
$R_{5-2}$: —H
$R_{5-3}$: —$NO_2$
$R_{5-4}$, $R_{5-5}$: —H
$R_{5-6}$: —$C_2H_5$

Compound 5-(22)

$R_{5-1}$, $R_{5-2}$: —H
$R_{5-3}$: —$NO_2$
$R_{5-4}$, $R_{5-5}$: —H
$R_{5-6}$: —CH=CH—$NO_2$

Compound 5-(23)

$R_{5-1}$, $R_{5-2}$: H
$R_{5-3}$: —$NO_2$
$R_{5-4}$, $R_{5-5}$: —H

Basis constitution
(Formula (5))

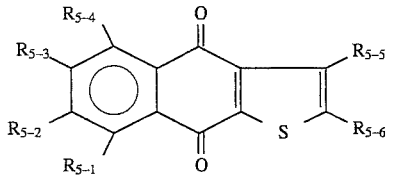

$R_{5-6}$:

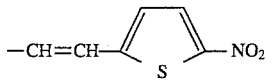

Compound 5-(24)

$R_{5-1}$, $R_{5-2}$: —H
$R_{5-3}$: —$NO_2$
$R_{5-4}$, $R_{5-5}$: —H $R_{5-6}$:

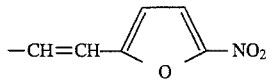

Compound 5-(25)

$R_{5-1}$: —Br
$R_{5-2}$: —H
$R_{5-3}$: —$NO_2$
$R_{5-4}$, $R_{5-5}$: —H
$R_{5-6}$: $-(CH=CH)_2-NO_2$

Compound 5-(26)

$R_{5-1}$: —Cl
$R_{5-2}$: —H
$R_{5-3}$: —$NO_2$
$R_{5-4}$, $R_{5-5}$: —H $R_{5-6}$:

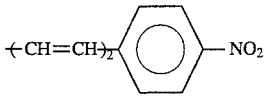

Compound 5-(27)

$R_{5-1}$, $R_{5-2}$: —H
$R_{5-3}$: —$NO_2$
$R_{5-4}$, $R_{5-5}$: —H $R_{5-6}$:

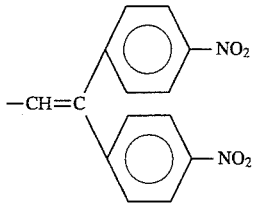

Compound 5-(28)

$R_{5-1}$, $R_{5-2}$: —H
$R_{5-3}$: —$NO_2$
$R_{5-4}$: —H
$R_{5-5}$: —CH=CH—$NO_2$
$R_{5-6}$: —H

Compound 5-(29)

$R_{5-1}$: —H
$R_{5-2}$: —$NO_2$
$R_{5-3}$, $R_{5-4}$: —H $R_{5-5}$:

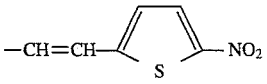

Basis constitution
(Formula (5))

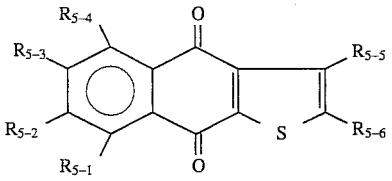

$R_{5-6}$: —H

Compound 5-(30)

$R_{5-1}$: —H
$R_{5-2}$: —$NO_2$
$R_{5-3}$, $R_{5-4}$: —H $R_{5-5}$:

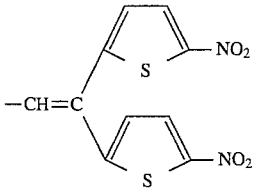

$R_{5-6}$: —H

Compound 5-(31)

$R_{5-1}$–$R_{5-3}$: —H
$R_{5-4}$: —$NO_2$
$R_{5-5}$: —H $R_{5-6}$:

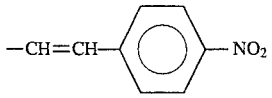

Compound 5-(32)

$R_{5-1}$–$R_{5-3}$: —H
$R_{5-4}$: —$NO_2$
$R_{5-5}$: —H
$R_{5-6}$: $-(CH=CH)_2-NO_2$

Compound 5-(33)

$R_{5-1}$: —H
$R_{5-2}$: —CH=CH—$NO_2$
$R_{5-3}$–$R_{5-5}$: —H
$R_{5-6}$: —CH=CH—$NO_2$

Compound 5-(34)

$R_{5-1}$: —H
$R_{5-2}$: —CH=CH—$NO_2$
$R_{5-3}$: —H
$R_{5-4}$: —Cl
$R_{5-5}$: —H $R_{5-6}$:

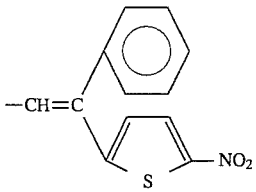

Compound 5-(35)

$R_{5-1}$: —H
$R_{5-2}$: —CH=CH—$NO_2$
$R_{5-3}$–$R_{5-5}$: —H

Basis constitution
(Formula (5))

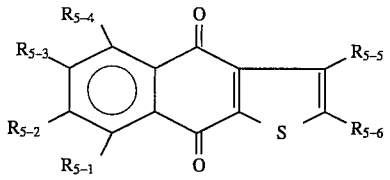

$R_{5-6}$:

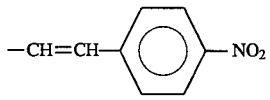

Compound 5-(36)

$R_{5-1}$: —H
$R_{5-2}$: —CH=CH—$NO_2$
$R_{5-3}$–$R_{5-5}$: —H $R_{5-6}$:

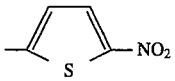

Compound 5-(37)

$R_{5-1}$: —H
$R_{5-2}$: —$NO_2$
$R_{5-3}$–$R_{5-5}$: —H $R_{5-6}$:

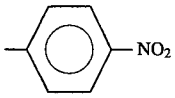

Compound 5-(38)

$R_{5-1}$: —H
$R_{5-2}$: —$NO_2$
$R_{5-3}$–$R_{5-5}$: —H $R_{5-6}$:

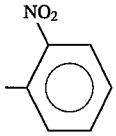

Compound 5-(39)

$R_{5-1}$: —H
$R_{5-2}$: —CH=CH—$NO_2$
$R_{5-3}$–$R_{5-4}$: —H
$R_{5-5}$: —CH=CH—$NO_2$
$R_{5-6}$: —H

Compound 5-(40)

$R_{5-1}$: —H
$R_{5-2}$: —CH=CH—$NO_2$
$R_{5-3}$: —H $R_{5-4}$:

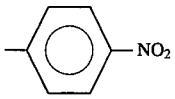

$R_{5-5}$–$R_{5-6}$: —H

Compound 5-(41)

$R_{5-1}$: —H
$R_{5-2}$: —CH=CH—$NO_2$
$R_{5-3}$: —H

Basis constitution
(Formula (5))

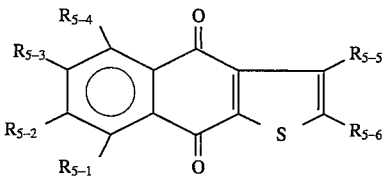

$R_{5-4}$:

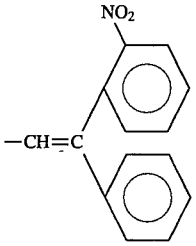

$R_{5-5}$–$R_{5-6}$: —H

Compound 5-(42)

$R_{5-1}$: —H
$R_{5-2}$: —$(CH=CH)_2$—$NO_2$
$R_{5-3}$–$R_{5-5}$: —H $R_{5-6}$:

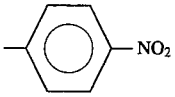

Compound 5-(43)

$R_{5-1}$: —H
$R_{5-2}$: $\text{-}(CH=CH)_2\text{-}NO_2$ $R_{5-3}$: —H
$R_{5-4}$: —Cl $R_{5-5}$:

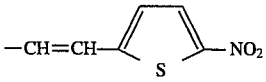

$R_{5-6}$: —H

Compound 5-(44)

$R_{5-1}$: CH=CH—$NO_2$
$R_{5-2}$: —H
$R_{5-3}$: —CH=CH—$NO_2$
$R_{5-4}$–$R_{5-6}$: —H

Compound 5-(45)

$R_{5-1}$: —CH=CH—$NO_2$
$R_{5-2}$–$R_{5-5}$: —H $R_{5-6}$:

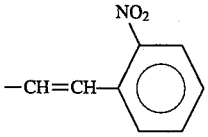

Compound 5-(46)

$R_{5-1}$: $\text{-}(CH=CH)_2\text{-}NO_2$ $R_{5-2}$–$R_{5-4}$: —H

Basis constitution
(Formula (5))

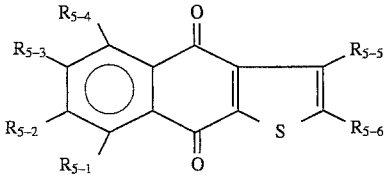

$R_{5-5}$:

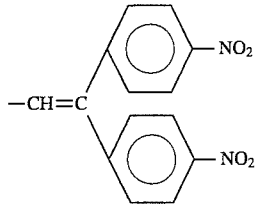

$R_{5-6}$: —H

Compound 5-(47)

$R_{5-1}$, $R_{5-2}$: —H
$R_{5-3}$: —CH=CH—$NO_2$
$R_{5-4}$, $R_{5-5}$: —H
$R_{5-6}$: $\text{-(CH=CH)}_2\text{-NO}_2$ Compound 5-(48)

$R_{5-1}$, $R_{5-2}$: —H
$R_{5-3}$: —CH=CH—$NO_2$
$R_{5-4}$, $R_{5-5}$: —H $R_{5-6}$:

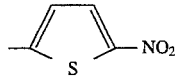

Compound 5-(49)

$R_{5-1}$: —Cl
$R_{5-2}$: —H
$R_{5-3}$: —CH=CH—$NO_2$
$R_{5-4}$, $R_{5-5}$: —H $R_{5-6}$:

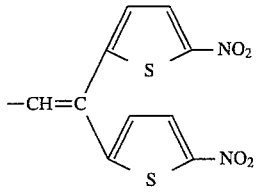

Compound 5-(50)

$R_{5-1}$, $R_{5-2}$: —H
$R_{5-3}$: —CH=CH—$NO_2$
$R_{5-4}$, $R_{5-5}$: H $R_{5-6}$:

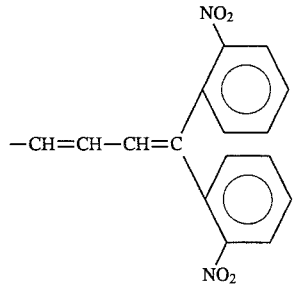

Compound 5-(51)

$R_{5-1}$, $R_{5-2}$: —H

Basis constitution
(Formula (5))

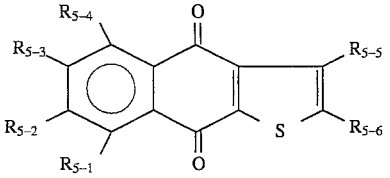

$R_{5-3}$: —CH=CH—$NO_2$
$R_{5-4}$: —H
$R_{5-5}$: $\text{-(CH=CH)}_2\text{-NO}_2$
$R_{5-6}$: —H Compound 5-(52)

$R_{5-1}$: —$CH_3$
$R_{5-2}$: —H
$R_{5-3}$: —CH=CH—$NO_2$
$R_{5-4}$: —H $R_{5-5}$:

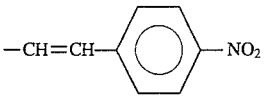

$R_{5-6}$: —H

Compound 5-(53)

$R_{5-1}$, $R_{5-2}$: —H
$R_{5-3}$: —$(CH=CH)_2$—$NO_2$
$R_{5-4}$: —H $R_{5-5}$:

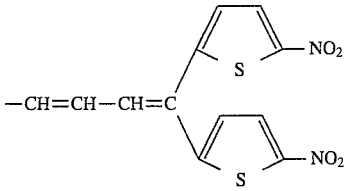

$R_{5-6}$: —H

Compound 5-(54)

$R_{5-1}$–$R_{5-3}$: —H
$R_{5-4}$: —CH=CH—$NO_2$
$R_{5-5}$: —H $R_{5-6}$:

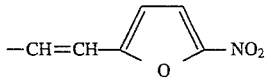

Compound 5-(55)

$R_{5-1}$–$R_{5-3}$: —H
$R_{5-4}$: —CH=CH—$NO_2$
$R_{5-5}$: $\text{-(CH=CH)}_2\text{-NO}_2$
$R_{5-6}$: —H Compound 5-(56)

$R_{5-1}$–$R_{5-3}$: —H
$R_{5-4}$: $\text{-(CH=CH)}_2\text{-NO}_2$
$R_{5-5}$: $\text{-(CH=CH)}_2\text{-NO}_2$
$R_{5-6}$: —H Compound 5-(57)

$R_{5-1}$–$R_{5-4}$: —H
$R_{5-5}$: —CH=CH—$NO_2$
$R_{5-6}$: —CH=CH—$NO_2$

Compound 5-(58)

$R_{5-1}$–$R_{5-4}$: —H
$R_{5-5}$: —CH=CH—$NO_2$

Basis constitution
(Formula (5))

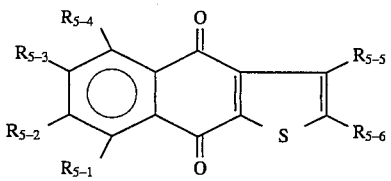

$R_{5-6}$: 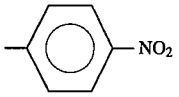

Compound 5-(59)

$R_{5-1}$–$R_{5-4}$: —H
$R_{5-5}$: —$NO_2$
$R_{5-6}$: —CH=CH—$NO_2$

Compound 5-(60)

$R_{5-1}$–$R_{5-4}$: —H
$R_{5-5}$: —$NO_2$
$R_{5-6}$: 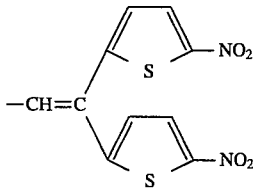

Compound 5-(61)

$R_{5-1}$: —H
$R_{5-2}$: 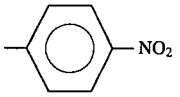

$R_{5-3}$–$R_{5-5}$: —H
$R_{5-6}$: —$NO_2$

Compound 5-(62)

$R_{5-1}$: —H
$R_{5-2}$: —CH=CH—$NO_2$
$R_{5-3}$–$R_{5-5}$: —H
$R_{5-6}$: —$NO_2$

Compound 5-(63)

$R_{5-1}$: —H
$R_{5-2}$: $\text{-(CH=CH)}_2\text{-NO}_2$ $R_{5-3}$, $R_{5-4}$: —H
$R_{5-5}$: —$NO_2$
$R_{5-6}$: —H Compound 5-(64)

$R_{5-1}$–$R_{5-3}$: —H
$R_{5-4}$: —CH=CH—$NO_2$
$R_{5-5}$: —H
$R_{5-6}$: —$NO_2$

Compound 5-(65)

$R_{5-1}$–$R_{5-3}$: —H
$R_{5-4}$: $\text{-(CH=CH)}_2\text{-NO}_2$ $R_{5-5}$: —$NO_2$
$R_{5-6}$: —H Compound 5-(66)

$R_{5-1}$: —H

Basis constitution
(Formula (5))

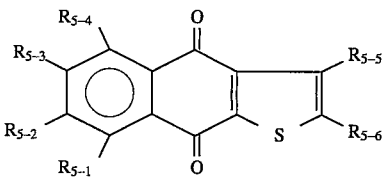

$R_{5-2}$: 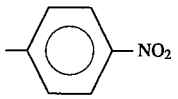

$R_{5-3}$–$R_{5-5}$: —H
$R_{5-6}$: 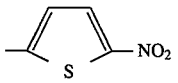

Compound 5-(67)

$R_{5-1}$: —H
$R_{5-2}$: 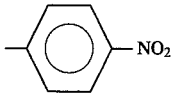

$R_{5-3}$–$R_{5-5}$: —H
$R_{5-6}$: 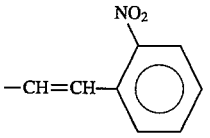

Compound 5-(68)

$R_{5-1}$: —H
$R_{5-2}$: 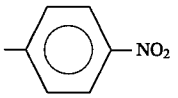

$R_{5-3}$–$R_{5-4}$: —H
$R_{5-5}$: 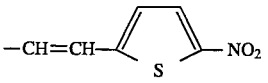

$R_{5-6}$: —H

Compound 5-(69)

$R_{5-1}$: —H
$R_{5-2}$: 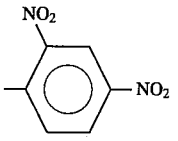

$R_{5-3}$–$R_{5-5}$: —H
$R_{5-6}$: $\text{-(CH=CH)}_2\text{-NO}_2$

Compound 5-(70)

$R_{5-1}$: —H

Basis constitution
(Formula (5))

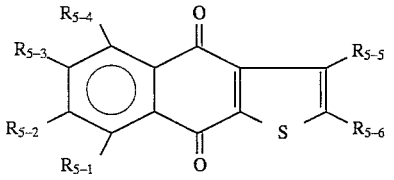

$R_{5-2}$: 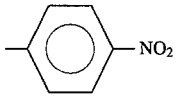

$R_{5-3}$–$R_{5-5}$: —H $R_{5-6}$: 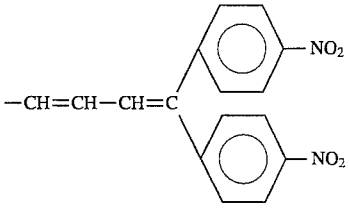

Compound 5-(71)

$R_{5-1}$: —H $R_{5-2}$: 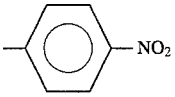

$R_{5-3}$: —H
$R_{5-4}$: —$NO_2$
$R_{5-5}$, $R_{5-6}$: —H

Compound 5-(72)

$R_{5-1}$: —H $R_{5-2}$: 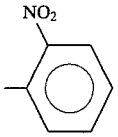

$R_{5-3}$: —H
$R_{5-4}$: —CH=CH—$NO_2$
$R_{5-5}$, $R_{5-6}$: —H

Compound 5-(73)

$R_{5-1}$: —H $R_{5-2}$: 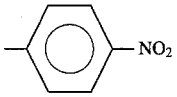

$R_{5-3}$–$R_{5-5}$: —H $R_{5-6}$: 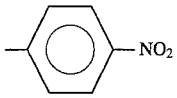

Compound 5-(74)

$R_{5-1}$: 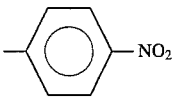

Basis constitution
(Formula (5))

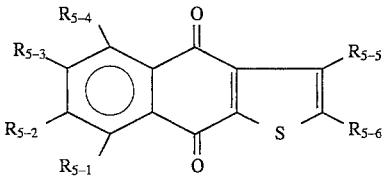

$R_{5-2}$–$R_{5-5}$: —H
$R_{5-6}$: —CH=CH—$NO_2$

Compound 5-(75)

$R_{5-1}$: 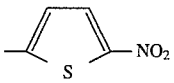

$R_{5-2}$–$R_{5-5}$: —H
$R_{5-6}$: —$NO_2$

Compound 5-(76)

$R_{5-1}$: 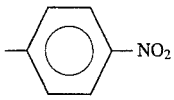

$R_{5-2}$–$R_{5-4}$: —H $R_{5-5}$: 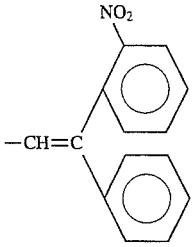

$R_{5-6}$: —H

Compound 5-(77)

$R_{5-1}$: 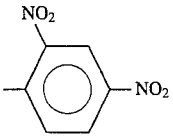

$R_{5-2}$: —H $R_{5-3}$: 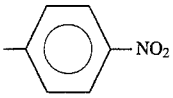

$R_{5-4}$–$R_{5-6}$: —H

Compound 5-(78)

$R_{5-1}$, $R_{5-2}$: —H $R_{5-3}$: 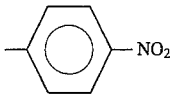

$R_{5-4}$, $R_{5-5}$: —H
$R_{5-6}$: —CH=CH—$NO_2$

Compound 5-(79)

$R_{5-1}$, $R_{5-2}$: —H

Basis constitution
(Formula (5))

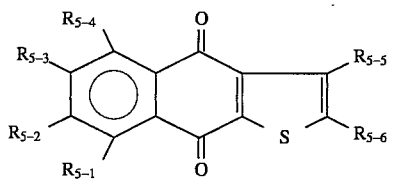

$R_{5-3}$: 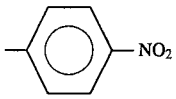

$R_{5-4}$, $R_{5-5}$: —H
$R_{5-6}$: —$NO_2$

Compound 5-(80)

$R_{5-1}$, $R_{5-2}$: —H $R_{5-3}$: 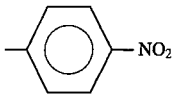

$R_{5-4}$, $R_{5-5}$: —H $R_{5-6}$: 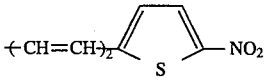

Compound 5-(81)

$R_{5-1}$, $R_{5-2}$: —H $R_{5-3}$: 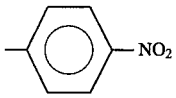

$R_{5-4}$: —H
$R_{5-5}$: $-(CH=CH)_2-NO_2$ $R_{5-6}$: —H

Compound 5-(82)

$R_{5-1}$: —Cl
$R_{5-2}$: —H $R_{5-3}$: 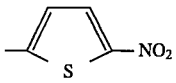

$R_{5-4}$, $R_{5-5}$: —H $R_{5-6}$: 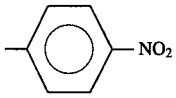

Compound 5-(83)

$R_{5-1}$, $R_{5-2}$: —H $R_{5-3}$: 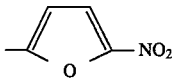

$R_{5-4}$: —H

Basis constitution
(Formula (5))

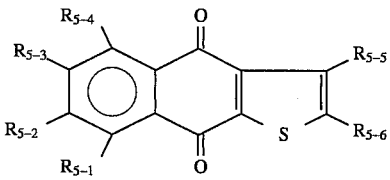

$R_{5-5}$: 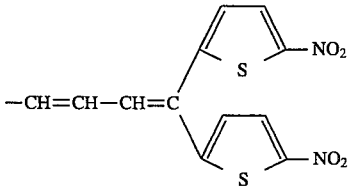

$R_{5-6}$: —H

Compound 5-(84)

$R_{5-1}$–$R_{5-3}$: —H $R_{5-4}$: 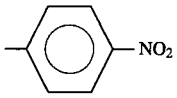

$R_{5-5}$: —H
$R_{5-6}$: —$NO_2$

Compound 5-(85)

$R_{5-1}$: —H
$R_{5-2}$: —$CH_3$
$R_{5-3}$: —H $R_{5-4}$: 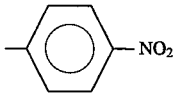

$R_{5-5}$: —CH=CH—$NO_2$
$R_{5-6}$: —H

Compound 5-(86)

$R_{5-1}$–$R_{5-4}$: —H $R_{5-5}$: 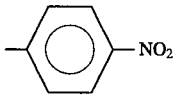

$R_{5-6}$: —$NO_2$

Compound 5-(87)

$R_{5-1}$–$R_{5-4}$: —H $R_{5-5}$: 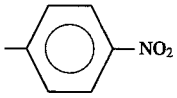

$R_{5-6}$: —CH=CH—$NO_2$

Compound 5-(88)

$R_{5-1}$: —H $R_{5-2}$: 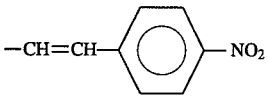

$R_{5-3}$–$R_{5-5}$: —H
$R_{5-6}$: —CH=CH—$NO_2$

Basis constitution
(Formula (5))

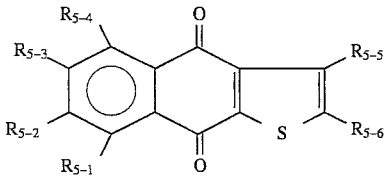

Compound 5-(89)

$R_{5-1}$: —H $R_{5-2}$:

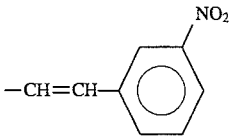

$R_{5-3}$–$R_{5-5}$: —H
$R_{5-6}$: —$NO_2$

Compound 5-(90)

$R_{5-1}$: —H $R_{5-2}$:

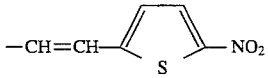

$R_{5-3}$–$R_{5-4}$: —H
$R_{5-5}$: —$NO_2$
$R_{5-6}$: —H

Compound 5-(91)

$R_{5-1}$: —H $R_{5-2}$:

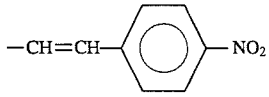

$R_{5-3}$–$R_{5-5}$: —H $R_{5-6}$:

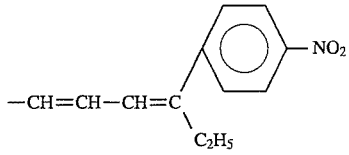

Compound 5-(92)

$R_{5-1}$: —H $R_{5-2}$:

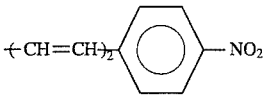

$R_{5-3}$–$R_{5-5}$: —H
$R_{5-6}$: —$NO_2$

Compound 5-(93)

$R_{5-1}$: —H $R_{5-2}$:

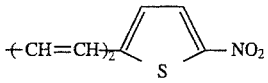

$R_{5-3}$: —H
$R_{5-4}$: —$NO_2$
$R_{5-5}$, $R_{5-6}$: —H

Compound 5-(94)

Basis constitution
(Formula (5))

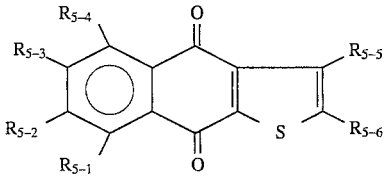

$R_{5-1}$: —H $R_{5-2}$:

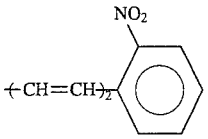

$R_{5-3}$–$R_{5-5}$: —H $R_{5-6}$:

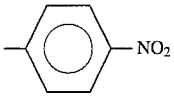

Compound 5-(95)

$R_{5-1}$:

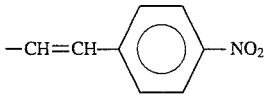

$R_{5-2}$–$R_{5-5}$: —H
$R_{5-6}$: —CH=CH—$NO_2$

Compound 5-(96)

$R_{5-1}$:

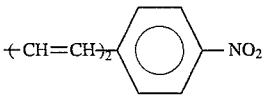

$R_{5-2}$–$R_{5-5}$: —H $R_{5-6}$:

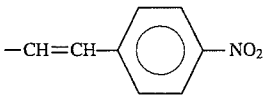

Compound 5-(97)

$R_{5-1}$, $R_{5-2}$: —H $R_{5-3}$:

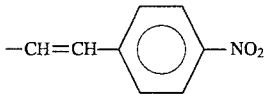

$R_{5-4}$–$R_{5-5}$: —H $R_{5-6}$:

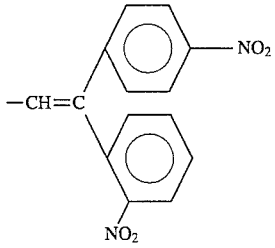

Compound 5-(98)

$R_{5-1}$, $R_{5-2}$: —H

Basis constitution
(Formula (5))
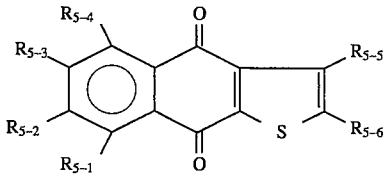
$R_{5-3}$:
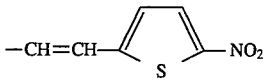
$R_{5-4}$–$R_{5-5}$: —H
$R_{5-6}$:
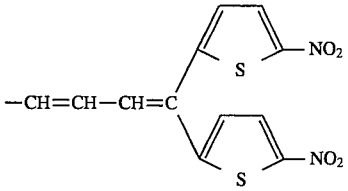
Compound 5-(99)
$R_{5-1}$, $R_{5-2}$: —H
$R_{5-3}$:
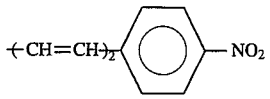
$R_{5-4}$: —H
$R_{5-5}$:
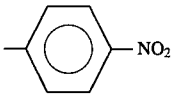
$R_{5-6}$: —H
Compound 5-(100)
$R_{5-1}$–$R_{5-3}$: —H
$R_{5-4}$:
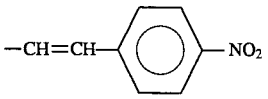
$R_{5-5}$: —H
$R_{5-6}$: —CH=CH—$NO_2$
Compound 5-(101)
$R_{5-1}$–$R_{5-4}$: —H
$R_{5-5}$:
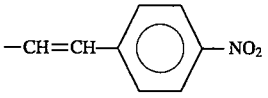
$R_{5-6}$: —$NO_2$
Compound 5-(102)
$R_{5-1}$–$R_{5-4}$: —H
$R_{5-5}$: —$NO_2$
$R_{5-6}$:
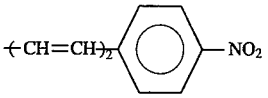
Basis constitution
(Formula (5))
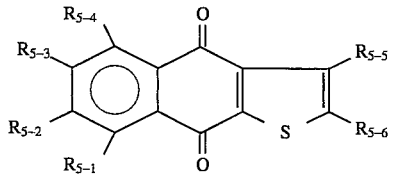
Compound 5-(103)
$R_{5-1}$: —H
$R_{5-2}$:
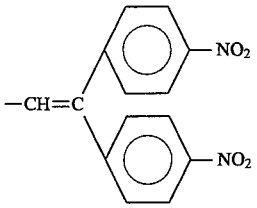
$R_{5-3}$–$R_{5-5}$: —H
$R_{5-6}$: —$NO_2$
Compound 5-(104)
$R_{5-1}$: —H
$R_{5-2}$:
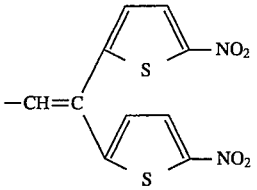
$R_{5-3}$–$R_{5-5}$: —H
$R_{5-6}$:
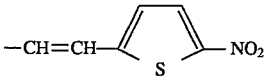
Compound 5-(105)
$R_{5-1}$: —H
$R_{5-2}$:
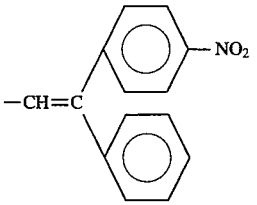
$R_{5-3}$, $R_{5-4}$: —H
$R_{5-5}$: —$NO_2$
$R_{5-6}$: —H
Compound 5-(106)
$R_{5-1}$: —H Basis constitution
(Formula (5))

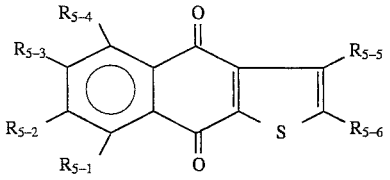

$R_{5-2}$:

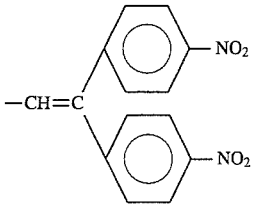

$R_{5-3}$, $R_{5-4}$: —H $R_{5-5}$:

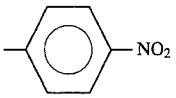

$R_{5-6}$: —H

Compound 5-(107)

$R_{5-1}$:

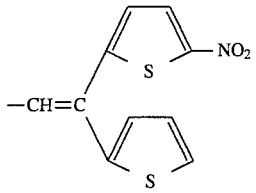

$R_{5-2}$: —H $R_{5-3}$:

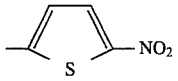

$R_{5-4}$–$R_{5-6}$: —H

Compound 5-(108)

$R_{5-1}$, $R_{5-2}$: —H $R_{5-3}$:

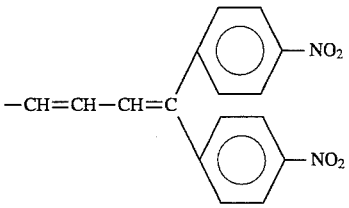

$R_{5-4}$, $R_{5-5}$: —H
$R_{5-6}$: $-NO_2$

Compound 5-(109)

$R_{5-1}$, $R_{5-4}$: —H $R_{5-5}$:

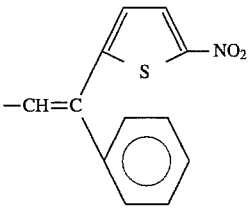

Basis constitution
(Formula (5))

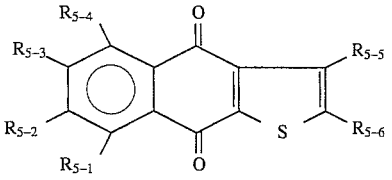

$R_{5-6}$: $-NO_2$

Compound 5-(110)

$R_{5-1}$–$R_{5-4}$: —H
$R_{5-5}$ $-NO_2$ $R_{5-6}$:

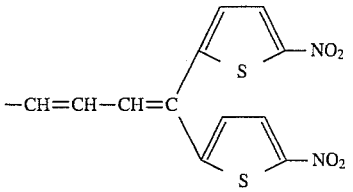

Compound 5-(111)

$R_{5-1}$: $-CH_3$
$R_{5-2}$: $-NO_2$
$R_{5-3}$: —H
$R_{5-4}$: $-C_2H_5$
$R_{5-5}$: —H
$R_{5-6}$: $-NO_2$

Compound 5-(112)

$R_{5-1}$: $-C_4H_9(t)$
$R_{5-2}$: —H $R_{5-3}$:

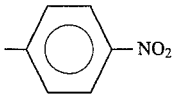

$R_{5-4}$: —H
$R_{5-5}$: $-CH_3$
$R_{5-6}$: $-(CH=CH)_2-NO_2$

Compound 5-(113)

$R_{5-1}$: $-C_2H_5$
$R_{5-2}$: —H
$R_{5-3}$: $-CH=CH-NO_2$
$R_{5-4}$: —H
$R_{5-5}$: $-NO_2$
$R_{5-6}$: $-CH_3$

Compound 5-(114)

$R_{5-1}$: $-CH_3$ $R_{5-2}$:

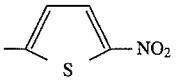

$R_{5-3}$: —H
$R_{5-4}$: $-C_2H_5$
$R_{5-5}$: $-CH_3$
$R_{5-6}$: $-NO_2$

Compound 5-(115)

$R_{5-1}$: —H
$R_{5-2}$: $-NO_2$
$R_{5-3}$: —H $R_{5-4}$:

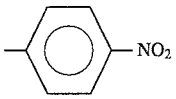

Basis constitution
(Formula (5))

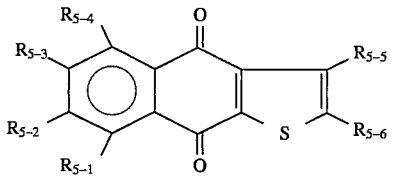

$R_{5-5}$: —H
$R_{5-6}$: —CH=CH—$NO_2$

Compound 5-(116)

$R_{5-1}$: —$NO_2$
$R_{5-2}$: —H
$R_{5-3}$: —$NO_2$
$R_{5-4}$: —H
$R_{5-5}$: —$NO_2$
$R_{5-6}$: —$CH_3$

Compound 5-(117)

$R_{5-1}$: —H
$R_{5-2}$: —$NO_2$
$R_{5-3}$: —H
$R_{5-4}$: —$NO_2$
$R_{5-5}$: —H
$R_{5-6}$:

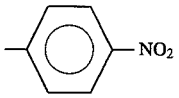

Compound 5-(118)

$R_{5-1}$: —$NO_2$
$R_{5-2}$: —H
$R_{5-3}$: —$NO_2$
$R_{5-4}$: —H
$R_{5-5}$: —$NO_2$
$R_{5-6}$: —CH=CH—$NO_2$

Compound 5-(119)

$R_{5-1}$: —H
$R_{5-2}$:

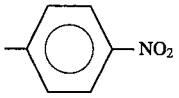

$R_{5-3}$–$R_{5-5}$: —H
$R_{5-6}$:

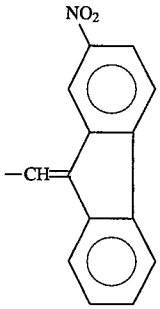

Compound 5-(120)

$R_{5-1}$, $R_{5-2}$: —H
$R_{5-3}$: —$NO_2$
$R_{5-4}$, $R_{5-5}$: —H

Basis constitution
(Formula (5))

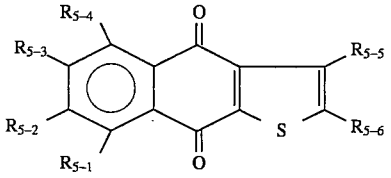

$R_{5-6}$:

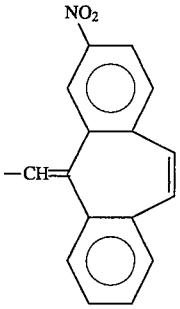

Compound 5-(121)

$R_{5-1}$–$R_{5-3}$: —H
$R_{5-4}$:

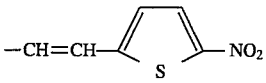

$R_{5-5}$: —H
$R_{5-6}$:

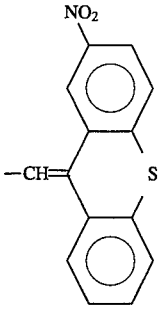

Compound 5-(122)

$R_{5-1}$:

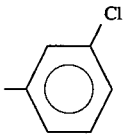

$R_{5-2}$: —H
$R_{5-3}$: —$NO_2$
$R_{5-4}$: —H
$R_{5-5}$:

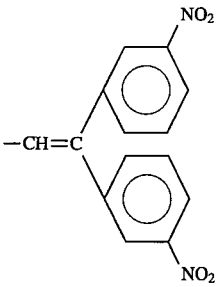

-continued

Basis constitution
(Formula (5))

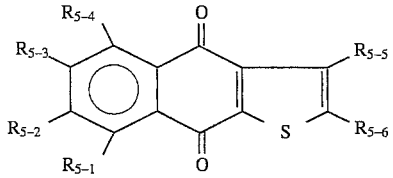

$R_{5-6}$: —H

Compound 5-(123)

$R_{5-1}$: —H $R_{5-2}$:

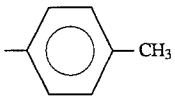

$R_{5-3}$: —H $R_{5-4}$:

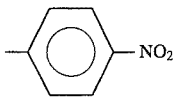

$R_{5-5}$:

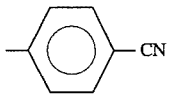

$R_{5-6}$: $-NO_2$

Compound 5-(124)

$R_{5-1}$: —H $R_{5-2}$:

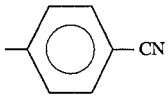

$R_{5-3}$: —H
$R_{5-4}$: $-NO_2$
$R_{5-5}$: $-NO_2$
$R_{5-6}$: $-C_2H_5$

Compound 5-(125)

$R_{5-1}$: —H $R_{5-2}$:

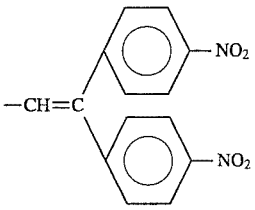

$R_{5-3}$: —H $R_{5-4}$:

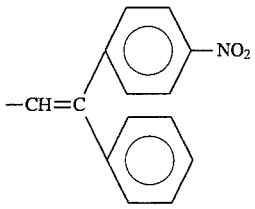

$R_{5-5}$, $R_{5-6}$: —H

Basic constitution
(Formula (6))

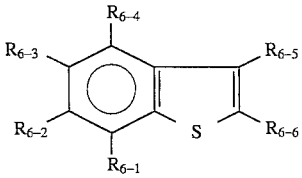

Compound 6-(1)

$R_{6-1}$: —H
$R_{6-2}$: $-NO_2$
$R_{6-3}$–$R_{6-5}$: —H
$R_{6-6}$: $-NO_2$

Compound 6-(2)

$R_{6-1}$: —H
$R_{6-2}$: $-NO_2$
$R_{6-3}$–$R_{6-5}$: —H
$R_{6-6}$: $-CH=CH-NO_2$

Compound 6-(3)

$R_{6-1}$: —H
$R_{6-2}$: $-NO_2$
$R_{6-3}$–$R_{6-5}$: —H $R_{6-6}$:

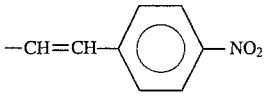

Compound 6-(4)

$R_{6-1}$: —H
$R_{6-2}$: $-NO_2$
$R_{6-3}$–$R_{6-5}$: —H $R_{6-6}$:

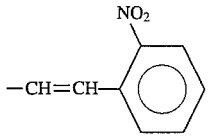

Compound 6-(5)

$R_{6-1}$: —H
$R_{6-2}$: $-NO_2$
$R_{6-3}$–$R_{6-5}$: —H
$R_{6-6}$ $-(CH=CH)_2-NO_2$

Compound 6-(6)

$R_{6-1}$: —H
$R_{6-2}$: $-NO_2$
$R_{6-3}$–$R_{6-5}$: —H $R_{6-6}$:

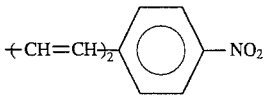

Compound 6-(7)

$R_{6-1}$: —H
$R_{6-2}$: $-NO_2$
$R_{6-3}$–$R_{6-5}$: —H $R_{6-6}$:

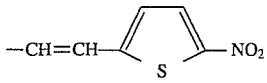

Compound 6-(8)

$R_{6-1}$: —H
$R_{6-2}$: $-NO_2$

-continued

Basic constitution
(Formula (6))

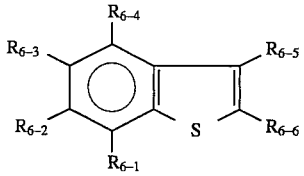

$R_{6-3}$–$R_{6-5}$: —H $R_{6-6}$:

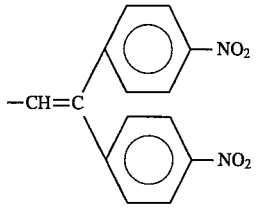

Compound 6-(9)

$R_{6-1}$: —H
$R_{6-2}$: —$NO_2$
$R_{6-3}$–$R_{6-5}$: —H $R_{6-6}$:

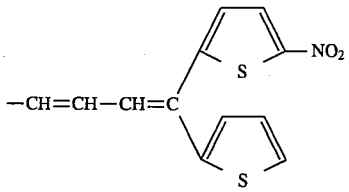

Compound 6-(10)

$R_{6-1}$: —H
$R_{6-2}$: —$NO_2$
$R_{6-3}$–$R_{6-5}$: —H $R_{6-6}$:

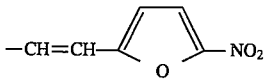

Compound 6-(11)

$R_{6-1}$: —H
$R_{6-2}$: —$NO_2$
$R_{6-3}$–$R_{6-5}$: —H $R_{6-6}$:

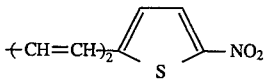

Compound 6-(12)

$R_{6-1}$: —H
$R_{6-2}$: —$NO_2$
$R_{6-3}$–$R_{6-5}$: —H $R_{6-6}$:

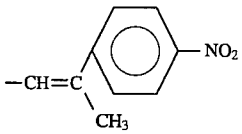

Compound 6-(13)

$R_{6-1}$: —H
$R_{6-2}$: —$NO_2$
$R_{6-3}$–$R_{6-5}$: —H

-continued

Basic constitution
(Formula (6))

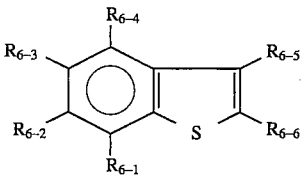

$R_{6-6}$:

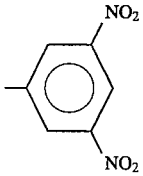

Compound 6-(14)

$R_{6-1}$: —$NO_2$
$R_{6-2}$–$R_{6-5}$: —H
$R_{6-6}$: —$NO_2$

Compound 6-(15)

$R_{6-1}$: —$NO_2$
$R_{6-2}$: —H
$R_{6-3}$: —Cl
$R_{6-4}$, $R_{6-5}$: —H $R_{6-6}$:

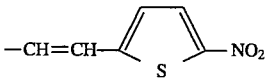

Compound 6-(16)

$R_{6-1}$: —$NO_2$
$R_{6-2}$: —H
$R_{6-3}$: —Br
$R_{6-4}$: —H
$R_{6-5}$: —CH=CH—$NO_2$
$R_{6-6}$: —H

Compound 6-(17)

$R_{6-1}$: —$NO_2$
$R_{6-2}$–$R_{6-4}$: —H $R_{6-5}$:

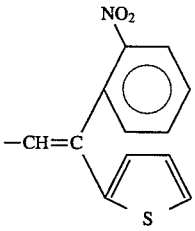

$R_{6-6}$: —H

Compound 6-(18)

$R_{6-1}$: —$NO_2$
$R_{6-2}$, $R_{6-3}$: —H
$R_{6-4}$: —$(CH=CH)_2$—$NO_2$
$R_{6-5}$: —H
$R_{6-6}$: —$C_4H_9$(t)

Compound 6-(19)

$R_{6-1}$: —$NO_2$
$R_{6-2}$: —H $R_{6-3}$:

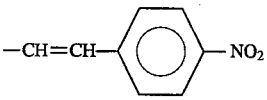

Basic constitution
(Formula (6))

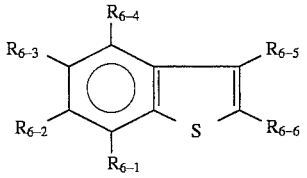

$R_{6-4}$: —H
$R_{6-5}$: —$CH_3$
$R_{6-6}$: —H

Compound 6-(20)

$R_{6-1}$: —$NO_2$
$R_{6-2}$: —H
$R_{6-3}$:

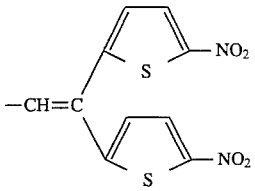

$R_{6-4}$–$R_{6-6}$: —H

Compound 6-(21)

$R_{6-1}$: —$NO_2$
$R_{6-2}$: —H
$R_{6-3}$: —$NO_2$
$R_{6-4}$, $R_{6-5}$: —H
$R_{6-6}$: —$C_2H_5$

Compound 6-(22)

$R_{6-1}$, $R_{6-2}$: —H
$R_{6-3}$: —$NO_2$
$R_{6-4}$, $R_{6-5}$: —H
$R_{6-6}$: —CH=CH—$NO_2$

Compound 6-(23)

$R_{6-1}$, $R_{6-2}$: —H
$R_{6-3}$: —$NO_2$
$R_{6-4}$, $R_{6-5}$: —H
$R_{6-6}$:

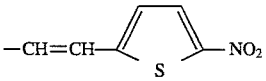

Compound 6-(24)

$R_{6-1}$, $R_{6-2}$: —H
$R_{6-3}$ —$NO_2$
$R_{6-4}$, $R_{6-5}$: —H
$R_{6-6}$:

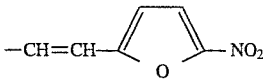

Compound 6-(25)

$R_{6-1}$: —Br
$R_{6-2}$: —H
$R_{6-3}$: —$NO_2$
$R_{6-4}$, $R_{6-5}$: —H
$R_{6-6}$: $\text{-}(CH=CH)_2\text{-}NO_2$ Compound 6-(26)

$R_{6-1}$: —Cl
$R_{6-2}$: —H
$R_{6-3}$: —$NO_2$
$R_{6-4}$, $R_{6-5}$: —H

Basic constitution
(Formula (6))

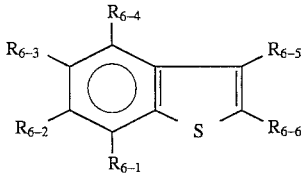

$R_{6-6}$:

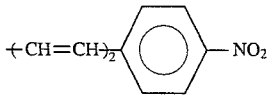

Compound 6-(27)

$R_{6-1}$, $R_{6-2}$: —H
$R_{6-3}$: —$NO_2$
$R_{6-4}$, $R_{6-5}$: —H
$R_{6-6}$:

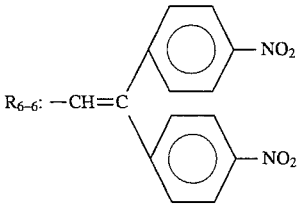

Compound 6-(28)

$R_{6-1}$, $R_{6-2}$: —H
$R_{6-3}$: —$NO_2$
$R_{6-4}$: —H
$R_{6-5}$: —CH=CH—$NO_2$
$R_{6-6}$: —H

Compound 6-(29)

$R_{6-1}$: —H
$R_{6-2}$: —$NO_2$
$R_{6-3}$, $R_{6-4}$: —H
$R_{6-5}$:

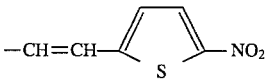

$R_{6-6}$: —H

Compound 6-(30)

$R_{6-1}$: —H
$R_{6-2}$: —$NO_2$
$R_{6-3}$, $R_{6-4}$: —H
$R_{6-5}$:

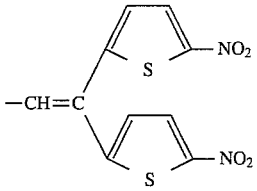

$R_{6-6}$: —H

Compound 6-(31)

$R_{6-1}$–$R_{6-3}$: —H
$R_{6-4}$: —$NO_2$
$R_{6-5}$: —H
$R_{6-6}$:

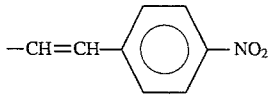

Basic constitution
(Formula (6))

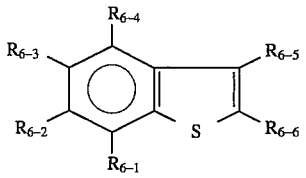

Compound 6-(32)

$R_{6-1}$–$R_{6-3}$: —H
$R_{6-4}$: —$NO_2$
$R_{6-5}$: —H
$R_{6-6}$: $-(CH{=}CH)_2-NO_2$

Compound 6-(33)

$R_{6-1}$: —H
$R_{6-2}$: —CH=CH—$NO_2$
$R_{6-3}$–$R_{6-5}$: —H
$R_{6-6}$: —CH=CH—$NO_2$

Compound 6-(34)

$R_{6-1}$: —H
$R_{6-2}$: —CH=CH—$NO_2$
$R_{6-3}$: —H
$R_{6-4}$: —Cl
$R_{6-5}$: —H
$R_{6-6}$:

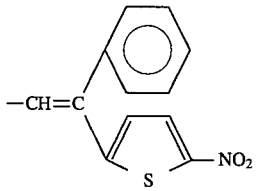

Compound 6-(35)

$R_{6-1}$: —H
$R_{6-2}$: —CH=CH—$NO_2$
$R_{6-3}$–$R_{6-5}$: —H
$R_{6-6}$:

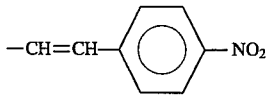

Compound 6-(36)

$R_{6-1}$: —H
$R_{6-2}$: —CH=CH—$NO_2$
$R_{6-3}$–$R_{6-5}$: —H
$R_{6-6}$:

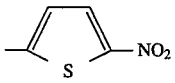

Compound 6-(37)

$R_{6-1}$: —H
$R_{6-2}$: —$NO_2$
$R_{6-3}$–$R_{6-5}$: —H
$R_{6-6}$:

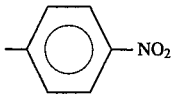

Compound 6-(38)

$R_{6-1}$: —H
$R_{6-2}$: —$NO_2$

Basic constitution
(Formula (6))

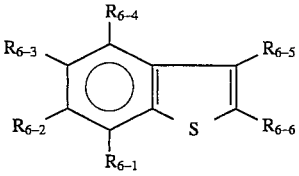

$R_{6-3}$–$R_{6-5}$: —H
$R_{6-6}$:

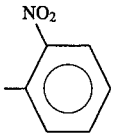

Compound 6-(39)

$R_{6-1}$: —H
$R_{6-2}$: —$NO_2$
$R_{6-3}$, $R_{6-4}$: —H
$R_{6-5}$: —CH=CH—$NO_2$
$R_{6-6}$: —H

Compound 6-(40)

$R_{6-1}$: —H
$R_{6-2}$: —CH=CH—$NO_2$
$R_{6-3}$: —H
$R_{6-4}$:

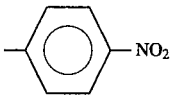

$R_{6-5}$–$R_{6-6}$: —H

Compound 6-(41)

$R_{6-1}$: —H
$R_{6-2}$: —CH=CH—$NO_2$
$R_{6-3}$: —H
$R_{6-4}$:

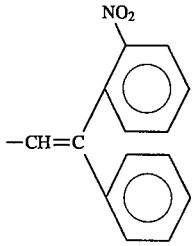

$R_{6-5}$–$R_{6-6}$: —H

Compound 6-(42)

$R_{6-1}$: —H
$R_{6-2}$: $-(CH{=}CH)_2-NO_2$
$R_{6-3}$–$R_{6-5}$: —H
$R_{6-6}$

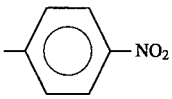

Compound 6-(43)

$R_{6-1}$: —H
$R_{6-2}$: $-(CH{=}CH)_2-NO_2$
$R_{6-3}$: —H
$R_{6-4}$: —Cl

Basic constitution
(Formula (6))

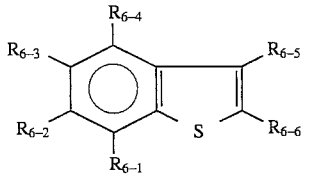

$R_{6-5}$:

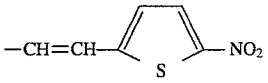

$R_{6-6}$: —H

Compound 6-(44)

$R_{6-1}$: CH=CH—$NO_2$
$R_{6-2}$: —H
$R_{6-3}$: —CH=CH—$NO_2$
$R_{6-4}$–$R_{6-6}$: —H

Compound 6-(45)

$R_{6-1}$: —CH=CH—$NO_2$
$R_{6-2}$–$R_{6-5}$: —H $R_{6-6}$:

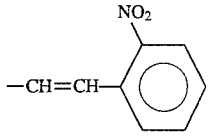

Compound 6-(46)

$R_{6-1}$: —(CH=CH)$_2$—$NO_2$
$R_{6-2}$–$R_{6-4}$: —H $R_{6-5}$:

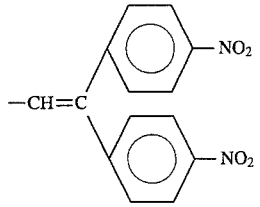

$R_{6-6}$: —H

Compound 6-(47)

$R_{6-1}$, $R_{6-2}$: —H
$R_{6-3}$: —CH=CH—$NO_2$
$R_{6-4}$, $R_{6-5}$: —H
$R_{6-6}$: —(CH=CH)$_2$—$NO_2$

Compound 6-(48)

$R_{6-1}$, $R_{6-2}$: —H
$R_{6-3}$: —CH=CH—$NO_2$
$R_{6-4}$, $R_{6-5}$: —H $R_{6-6}$:

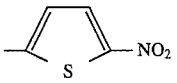

Compound 6-(49)

$R_{6-1}$: —Cl
$R_{6-2}$: —H
$R_{6-3}$: —CH=CH—$NO_2$
$R_{6-4}$, $R_{6-5}$: —H

Basic constitution
(Formula (6))

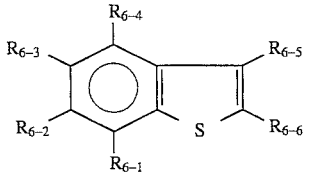

$R_{6-6}$:

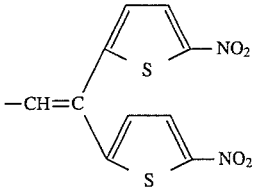

Compound 6-(50)

$R_{6-1}$, $R_{6-2}$: —H
$R_{6-3}$: —CH=CH—$NO_2$
$R_{6-4}$, $R_{6-5}$: —H $R_{6-6}$:

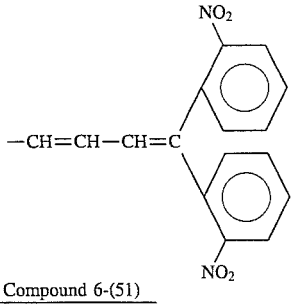

Compound 6-(51)

$R_{6-1}$, $R_{6-2}$: —H
$R_{6-3}$: —CH=CH—$NO_2$
$R_{6-4}$: —H
$R_{6-5}$: —(CH=CH)$_2$—$NO_2$
$R_{6-6}$: —H

Compound 6-(52)

$R_{6-1}$: —$CH_3$
$R_{6-2}$: —H
$R_{6-3}$: —CH=CH—$NO_2$
$R_{6-4}$: —H $R_{6-5}$:

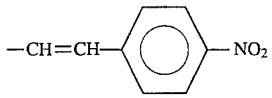

$R_{6-6}$: —H

Compound 6-(53)

$R_{6-1}$, $R_{6-2}$: —H
$R_{6-3}$: —(CH=CH)$_2$—$NO_2$
$R_{6-4}$: —H $R_{6-5}$:

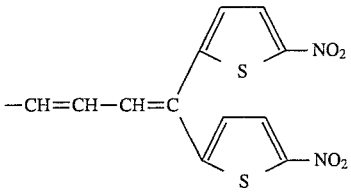

$R_{6-6}$: —H

Compound 6-(54)

$R_{6-1}$–$R_{6-3}$: —H

Basic constitution
(Formula (6))

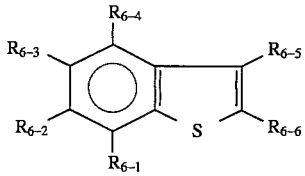

$R_{6-4}$: $-CH=CH-NO_2$
$R_{6-5}$: $-H$ $R_{6-6}$:

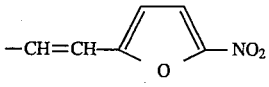

Compound 6-(55)

$R_{6-1}$–$R_{6-3}$: $-H$
$R_{6-4}$: $-CH=CH-NO_2$
$R_{6-5}$: $\text{-}(CH=CH)_2\text{-}NO_2$ $R_{6-6}$: $-H$ Compound 6-(56)

$R_{6-1}$–$R_{6-3}$: $-H$
$R_{6-4}$: $\text{-}(CH=CH)_2\text{-}NO_2$ $R_{6-5}$: $\text{-}(CH=CH)_2\text{-}NO_2$ $R_{6-6}$: $-H$ Compound 6-(57)

$R_{6-1}$–$R_{6-4}$: $-H$
$R_{6-5}$: $-CH=CH-NO_2$
$R_{6-6}$: $-CH=CH-NO_2$

Compound 6-(58)

$R_{6-1}$–$R_{6-4}$: $-H$
$R_{6-5}$: $-CH=CH-NO_2$ $R_{6-6}$:

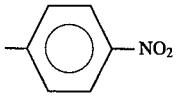

Compound 6-(59)

$R_{6-1}$–$R_{6-4}$: $-H$
$R_{6-5}$: $-NO_2$
$R_{6-6}$: $-CH=CH-NO_2$

Compound 6-(60)

$R_{6-1}$–$R_{6-4}$: $-H$
$R_{6-5}$: $-NO_2$ $R_{6-6}$:

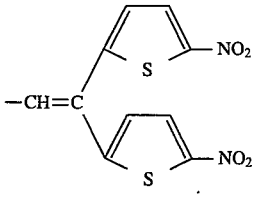

Compound 6-(61)

$R_{6-1}$: $-H$ $R_{6-2}$:

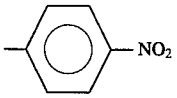

$R_{6-3}$–$R_{6-5}$: $-H$

Basic constitution
(Formula (6))

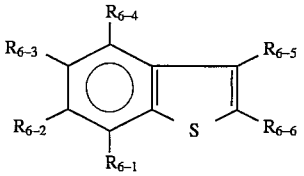

$R_{6-6}$: $-NO_2$

Compound 6-(62)

$R_{6-1}$: $-H$
$R_{6-2}$: $-CH=CH-NO_2$
$R_{6-3}$–$R_{6-5}$: $-H$
$R_{6-6}$: $-NO_2$

Compound 6-(63)

$R_{6-1}$: $-H$
$R_{6-2}$: $\text{-}(CH=CH)_2\text{-}NO_2$ $R_{6-3}$, $R_{6-4}$: $-H$
$R_{6-5}$: $-NO_2$
$R_{6-6}$: $-H$ Compound 6-(64)

$R_{6-1}$–$R_{6-3}$: $-H$
$R_{6-4}$: $-CH=CH-NO_2$
$R_{6-5}$: $-H$
$R_{6-6}$: $-NO_2$

Compound 6-(65)

$R_{6-1}$–$R_{6-3}$ $-H$
$R_{6-4}$: $\text{-}(CH=CH)_2\text{-}NO_2$ $R_{6-5}$: $-NO_2$
$R_{6-6}$: $-H$ Compound 6-(66)

$R_{6-1}$: $-H$ $R_{6-2}$:

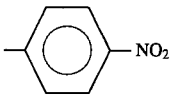

$R_{6-3}$–$R_{6-5}$: $-H$ $R_{6-6}$:

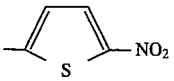

Compound 6-(67)

$R_{6-1}$: $-H$ $R_{6-2}$:

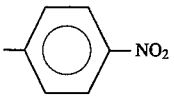

$R_{6-3}$–$R_{6-5}$: $-H$ $R_{6-6}$:

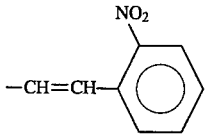

Compound 6-(68)

$R_{6-1}$: $-H$

Basic constitution
(Formula (6))
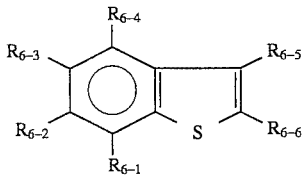
$R_{6-2}$: 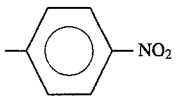
$R_{6-3}$, $R_{6-4}$: —H
$R_{6-5}$: 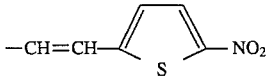
$R_{6-6}$: —H
Compound 6-(69)
$R_{6-1}$: —H
$R_{6-2}$: 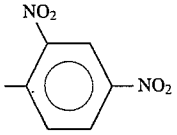
$R_{6-3}$–$R_{6-5}$: —H
$R_{6-6}$: $-(CH=CH)_2-NO_2$
Compound 6-(70)
$R_{6-1}$: —H
$R_{6-2}$: 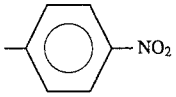
$R_{6-3}$–$R_{6-5}$: —H
$R_{6-6}$: 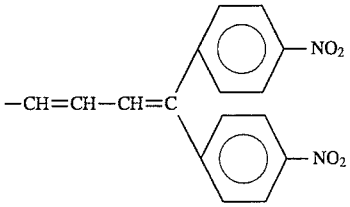
Compound 6-(71)
$R_{6-1}$: —H
$R_{6-2}$: 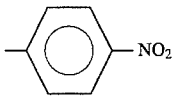
$R_{6-3}$: —H
$R_{6-4}$: $-NO_2$
$R_{6-5}$, $R_{6-6}$: —H
Basic constitution
(Formula (6))
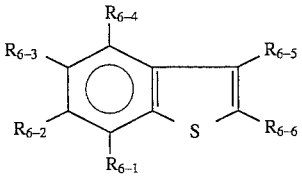
Compound 6-(72)
$R_{6-1}$: —H
$R_{6-2}$: 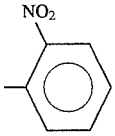
$R_{6-3}$: —H
$R_{6-4}$: $-CH=CH-NO_2$
$R_{6-5}$, $R_{6-6}$: —H
Compound 6-(73)
$R_{6-1}$: —H
$R_{6-2}$: 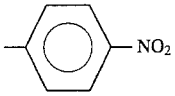
$R_{6-3}$–$R_{6-5}$: —H
$R_{6-6}$: 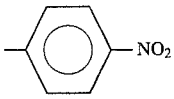
Compound 6-(74)
$R_{6-1}$: 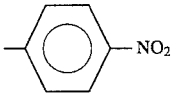
$R_{6-2}$–$R_{6-5}$: —H
$R_{6-6}$: $-CH=CH-NO_2$
Compound 6-(75)
$R_{6-1}$: 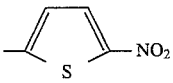
$R_{6-2}$–$R_{6-5}$: —H
$R_{6-6}$: $-NO_2$
Compound 6-(76)
$R_{6-1}$: 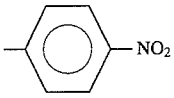
$R_{6-2}$–$R_{6-4}$: —H Basic constitution
(Formula (6))

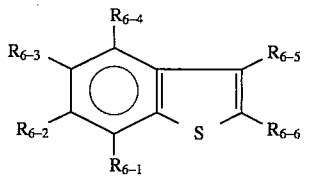

$R_{6-5}$:

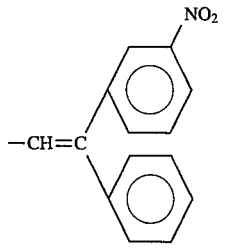

$R_{6-6}$: —H

Compound 6-(77)

$R_{6-1}$:

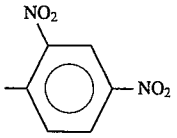

$R_{6-2}$: —H $R_{6-3}$:

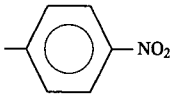

$R_{6-4}$–$R_{6-6}$: —H

Compound 6-(78)

$R_{6-1}$, $R_{6-2}$: —H $R_{6-3}$:

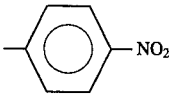

$R_{6-4}$, $R_{6-5}$: —H $R_{6-6}$: —CH=CH—$NO_2$

Compound 6-(79)

$R_{6-1}$, $R_{6-2}$: —H $R_{6-3}$:

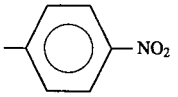

$R_{6-4}$, $R_{6-5}$: —H $R_{6-6}$: —$NO_2$

Compound 6-(80)

$R_{6-1}$, $R_{6-2}$: —H $R_{6-3}$:

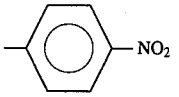

$R_{6-4}$, $R_{6-5}$: —H

Basic constitution
(Formula (6))

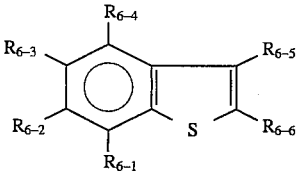

$R_{6-6}$:

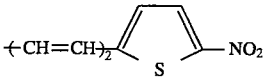

Compound 6-(81)

$R_{6-1}$, $R_{6-2}$: —H $R_{6-3}$:

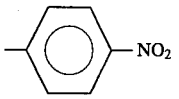

$R_{6-4}$: —H $R_{6-5}$: $\text{-}(\text{CH=CH})_2\text{-}NO_2$ $R_{6-6}$: —H

Compound 6-(82)

$R_{6-1}$: —Cl $R_{6-2}$: —H $R_{6-3}$:

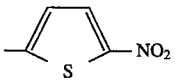

$R_{6-4}$, $R_{6-5}$: —H $R_{6-6}$:

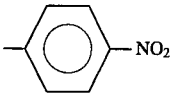

Compound 6-(83)

$R_{6-1}$, $R_{6-2}$: —H $R_{6-3}$:

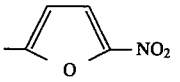

$R_{6-4}$: —H $R_{6-5}$:

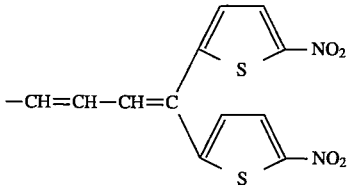

$R_{6-6}$: —H

Compound 6-(84)

$R_{6-1}$–$R_{6-3}$: —H $R_{6-4}$:

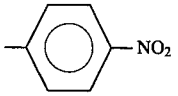

$R_{6-5}$: —H

Basic constitution
(Formula (6))

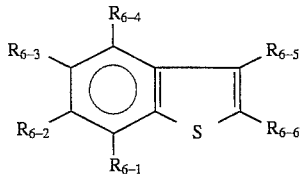

$R_{6-6}$: $-NO_2$

Compound 6-(85)

$R_{6-1}$: $-H$
$R_{6-2}$: $-CH_3$
$R_{6-3}$: $-H$
$R_{6-4}$:

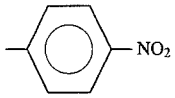

$R_{6-5}$: $-CH=CH-NO_2$
$R_{6-6}$: $-H$

Compound 6-(86)

$R_{6-1}$–$R_{6-4}$: $-H$
$R_{6-5}$:

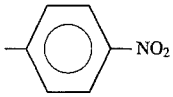

$R_{6-6}$: $-NO_2$

Compound 6-(87)

$R_{6-1}$–$R_{6-4}$: $-H$
$R_{6-5}$:

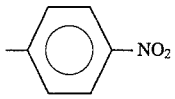

$R_{6-6}$: $-CH=CH-NO_2$

Compound 6-(88)

$R_{6-1}$: $-H$
$R_{6-2}$:

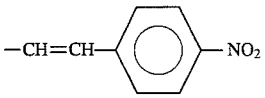

$R_{6-3}$–$R_{6-5}$: $-H$
$R_{6-6}$: $-CH=CH-NO_2$

Compound 6-(89)

$R_{6-1}$: $-H$
$R_{6-2}$:

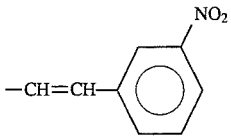

$R_{6-3}$–$R_{6-5}$: $-H$
$R_{6-6}$: $-NO_2$

Compound 6-(90)

$R_{6-1}$: $-H$

Basic constitution
(Formula (6))

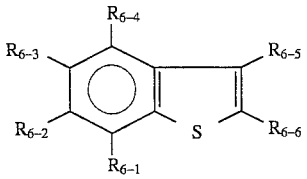

$R_{6-2}$:

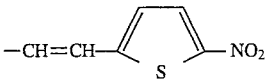

$R_{6-3}$, $R_{6-4}$: $-H$
$R_{6-5}$: $-NO_2$
$R_{6-6}$: $-H$

Compound 6-(91)

$R_{6-1}$: $-H$
$R_{6-2}$:

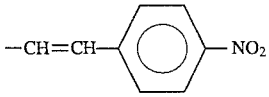

$R_{6-3}$–$R_{6-5}$: $-H$
$R_{6-6}$:

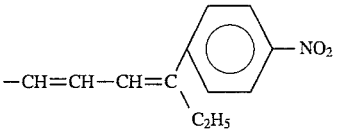

Compound 6-(92)

$R_{6-1}$: $-H$
$R_{6-2}$:

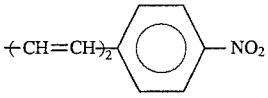

$R_{6-3}$–$R_{6-5}$: $-H$
$R_{6-6}$: $-NO_2$

Compound 6-(93)

$R_{6-1}$: $-H$
$R_{6-2}$:

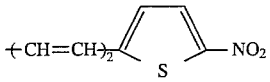

$R_{6-3}$: $-H$
$R_{6-4}$: $-NO_2$
$R_{6-5}$, $R_{6-6}$: $-H$

Compound 6-(94)

$R_{6-1}$: $-H$
$R_{6-2}$:

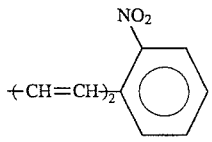

$R_{6-3}$–$R_{6-5}$: $-H$
$R_{6-6}$:

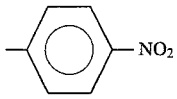

Basic constitution
(Formula (6))
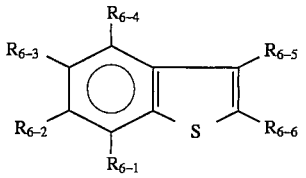
Compound 6-(95)
$R_{6-1}$: 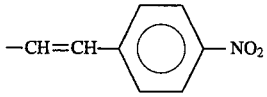
$R_{6-2}$–$R_{6-5}$: —H
$R_{6-6}$: —CH=CH—$NO_2$
Compound 6-(96)
$R_{6-1}$: 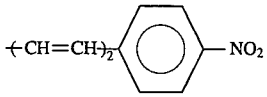
$R_{6-2}$–$R_{6-5}$: —H
$R_{6-6}$: 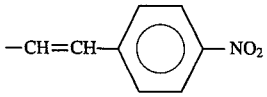
Compound 6-(97)
$R_{6-1}$, $R_{6-2}$: —H
$R_{6-3}$: 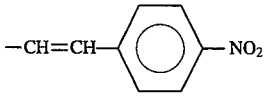
$R_{6-4}$, $R_{6-5}$: —H
$R_{6-6}$: 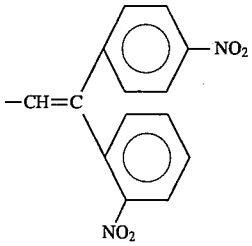
Compound 6-(98)
$R_{6-1}$, $R_{6-2}$: —H
$R_{6-3}$: 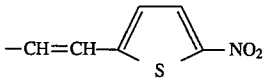
$R_{6-4}$, $R_{6-5}$: —H
$R_{6-6}$: 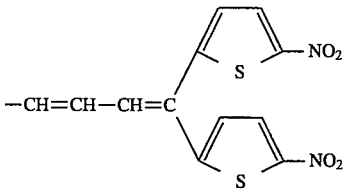
Basic constitution
(Formula (6))
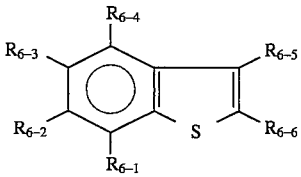
Compound 6-(99)
$R_{6-1}$, $R_{6-2}$: —H
$R_{6-3}$: 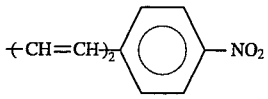
$R_{6-4}$: —H
$R_{6-5}$: 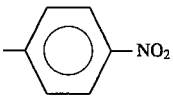
$R_{6-6}$: —H
Compound 6-(100)
$R_{6-1}$–$R_{6-3}$: —H
$R_{6-4}$: 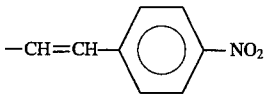
$R_{6-5}$: —H
$R_{6-6}$: —CH=CH—$NO_2$
Compound 6-(101)
$R_{6-1}$–$R_{6-4}$: —H
$R_{6-5}$: 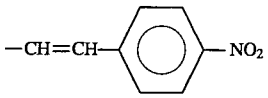
$R_{6-6}$: —$NO_2$
Compound 6-(102)
$R_{6-1}$–$R_{6-4}$: —H
$R_{6-5}$: —$NO_2$
$R_{6-6}$: 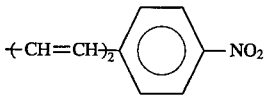
Compound 6-(103)
$R_{6-1}$: —H
$R_{6-2}$: 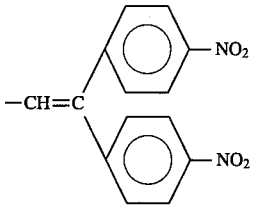
$R_{6-3}$–$R_{6-5}$: —H
$R_{6-6}$: —$NO_2$ Basic constitution
(Formula (6))
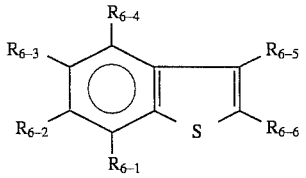
Compound 6-(104)
$R_{6-1}$: —H
$R_{6-2}$:
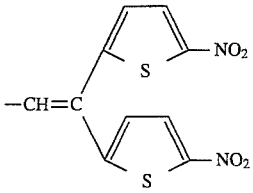
$R_{6-3}$–$R_{6-5}$: —H
$R_{6-6}$:
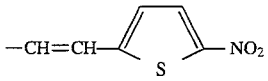
Compound 6-(105)
$R_{6-1}$: —H
$R_{6-2}$:
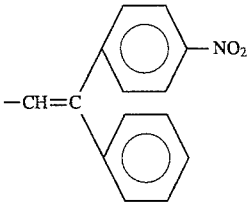
$R_{6-3}$, $R_{6-4}$: —H
$R_{6-5}$: —$NO_2$
$R_{6-6}$: —H
Compound 6-(106)
$R_{6-1}$: —H
$R_{6-2}$:
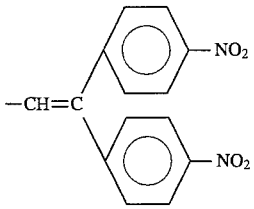
$R_{6-3}$, $R_{6-4}$: —H
$R_{6-5}$:
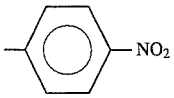
$R_{6-6}$: —H
Compound 6-(107)
Basic constitution
(Formula (6))
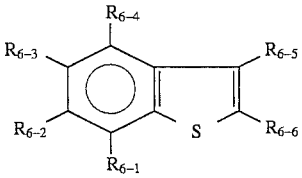
$R_{6-1}$:
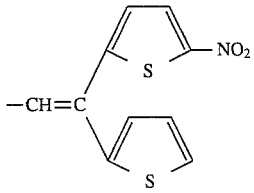
$R_{6-2}$: —H
$R_{6-3}$:
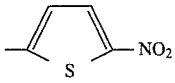
$R_{6-4}$–$R_{6-6}$: —H
Compound 6-(108)
$R_{6-1}$, $R_{6-2}$: —H
$R_{6-3}$:
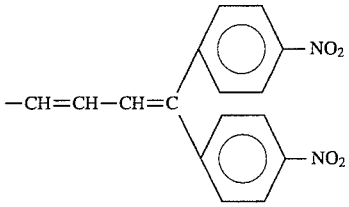
$R_{6-4}$, $R_{6-5}$: —H
$R_{6-6}$: —$NO_2$
Compound 6-(109)
$R_{6-1}$–$R_{6-4}$: —H
$R_{6-5}$:
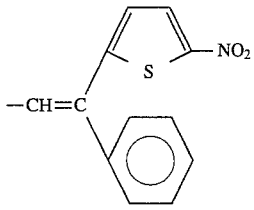
$R_{6-6}$: —$NO_2$
Compound 6-(110)
$R_{6-1}$–$R_{6-4}$: —H
$R_{6-5}$: —$NO_2$
$R_{6-6}$:
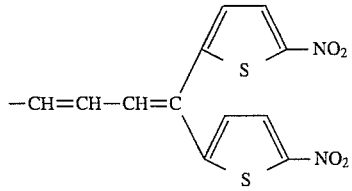
Compound 6-(111)
$R_{6-1}$: —$CH_3$
$R_{6-2}$: —$NO_2$
$R_{6-3}$ —H -continued Basic constitution
(Formula (6))

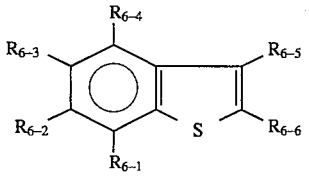

$R_{6-4}$: $-C_2H_5$
$R_{6-5}$: $-H$
$R_{6-6}$: $-NO_2$

Compound 6-(112)

$R_{6-1}$: $-C_4H_9(t)$
$R_{6-2}$: $-H$
$R_{6-3}$:

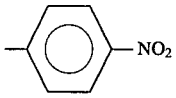

$R_{6-4}$: $-H$
$R_{6-5}$: $-CH_3$
$R_{6-6}$: $-(CH=CH)_2-NO_2$

Compound 6-(113)

$R_{6-1}$: $-C_2H_5$
$R_{6-2}$: $-H$
$R_{6-3}$: $-CH=CH-NO_2$
$R_{6-4}$: $-H$
$R_{6-5}$: $-NO_2$
$R_{6-6}$: $-CH_3$

Compound 6-(114)

$R_{6-1}$: $-CH_3$
$R_{6-2}$:

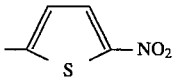

$R_{6-3}$: $-H$
$R_{6-4}$: $-C_2H_5$
$R_{6-5}$: $-CH_3$
$R_{6-6}$: $-NO_2$

Compound 6-(115)

$R_{6-1}$: $-H$
$R_{6-2}$: $-NO_2$
$R_{6-3}$: $-H$
$R_{6-4}$:

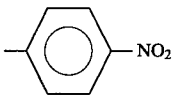

$R_{6-5}$: $-H$
$R_{6-6}$: $-CH=CH-NO_2$

Compound 6-(116)

$R_{6-1}$: $-NO_2$
$R_{6-2}$: $-H$
$R_{6-3}$: $-NO_2$
$R_{6-4}$: $-H$
$R_{6-5}$: $-NO_2$
$R_{6-6}$: $-CH_3$

Compound 6-(117)

$R_{6-1}$: $-H$
$R_{6-2}$: $-NO_2$
$R_{6-3}$: $-H$
$R_{6-4}$: $-NO_2$
$R_{6-5}$: $-H$

-continued

Basic constitution
(Formula (6))

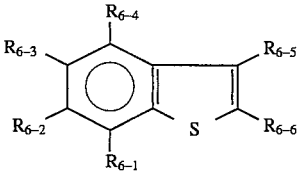

$R_{6-6}$:

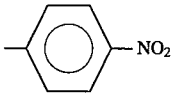

Compound 6-(118)

$R_{6-1}$: $-NO_2$
$R_{6-2}$: $-H$
$R_{6-3}$: $-NO_2$
$R_{6-4}$: $-H$
$R_{6-5}$: $-NO_2$
$R_{6-6}$: $-CH=CH-NO_2$

Compound 6-(119)

$R_{6-1}$: $-H$
$R_{6-2}$:

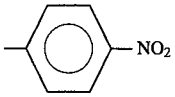

$R_{6-3}$–$R_{6-5}$: $-H$
$R_{6-6}$:

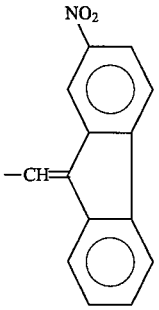

Compound 6-(120)

$R_{6-1}$, $R_{6-2}$: $-H$
$R_{6-3}$: $-NO_2$
$R_{6-4}$, $R_{6-5}$: $-H$
$R_{6-6}$:

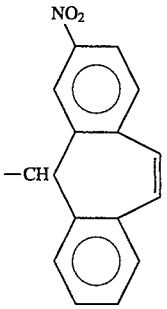

Compound 6-(121)

$R_{6-1}$–$R_{6-3}$: $-H$

Basic constitution
(Formula (6))
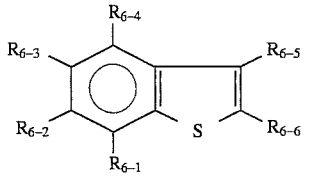
$R_{6-4}$: 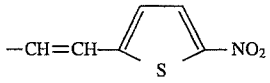
$R_{6-5}$: —H
$R_{6-6}$: 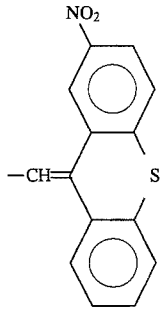
Compound 6-(122)
$R_{6-1}$: 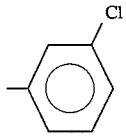
$R_{6-2}$: —H
$R_{6-3}$: $—NO_2$
$R_{6-4}$: —H
$R_{6-5}$: 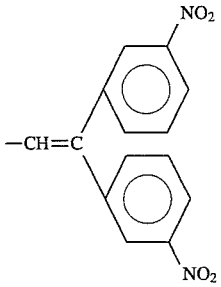
$R_{6-6}$: —H
Compound 6-(123)
$R_{6-1}$: —H
$R_{6-2}$: 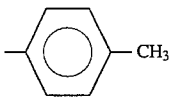
$R_{6-3}$: —H
$R_{6-4}$: 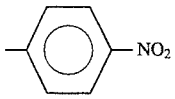
Basic constitution
(Formula (6))
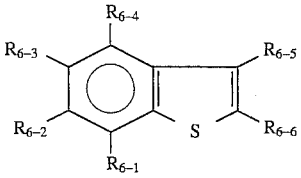
$R_{6-5}$: 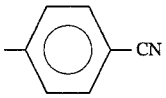
$R_{6-6}$: $—NO_2$
Compound 6-(124)
$R_{6-1}$: —H
$R_{6-2}$: 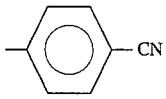
$R_{6-3}$: —H
$R_{6-4}$: $—NO_2$
$R_{6-5}$: $—NO_2$
$R_{6-6}$: $—C_2H_5$
Compound 6-(125)
$R_{6-1}$: —H
$R_{6-2}$: 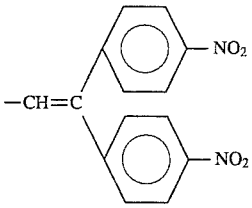
$R_{6-3}$: —H
$R_{6-4}$: 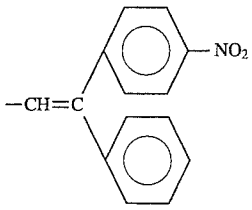
$R_{6-5}$, $R_{6-6}$: —H
Basic constitution
(Formula (7))
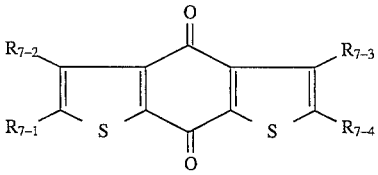
Compound 7-(1)
$R_{7-1}$: $—NO_2$
$R_{7-2}$: —H Basic constitution
(Formula (7))

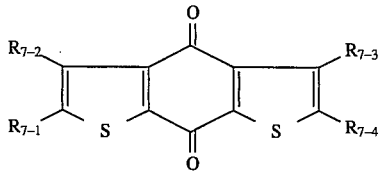

$R_{7-3}$: —H
$R_{7-4}$: —$NO_2$

Compound 7-(2)

$R_{7-1}$: —$NO_2$
$R_{7-2}$: —H
$R_{7-3}$: —H
$R_{7-4}$: —CH=CH—$NO_2$

Compound 7-(3)

$R_{7-1}$: —$NO_2$
$R_{7-2}$: —H
$R_{7-3}$: —H
$R_{7-4}$:

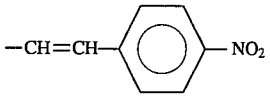

Compound 7-(4)

$R_{7-1}$: —$NO_2$
$R_{7-2}$: —H
$R_{7-3}$: —H
$R_{7-4}$:

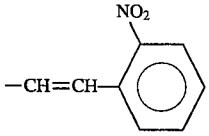

Compound 7-(5)

$R_{7-1}$: —$NO_2$
$R_{7-2}$: —H
$R_{7-3}$: —H
$R_{7-4}$:

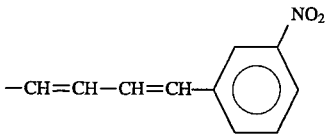

Compound 7-(6)

$R_{7-1}$: —$NO_2$
$R_{7-2}$: —H
$R_{7-3}$: —H
$R_{7-4}$:

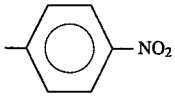

Compound 7-(7)

$R_{7-1}$: —$NO_2$
$R_{7-2}$: —H
$R_{7-3}$: —H

Basic constitution
(Formula (7))

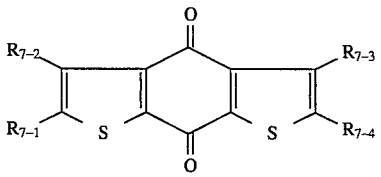

$R_{7-4}$:

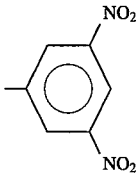

Compound 7-(8)

$R_{7-1}$: —$NO_2$
$R_{7-2}$: —H
$R_{7-3}$: —H
$R_{7-4}$:

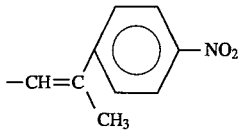

Compound 7-(9)

$R_{7-1}$: —$NO_2$
$R_{7-2}$: —H
$R_{7-3}$: —H
$R_{7-4}$:

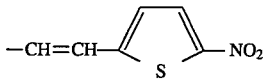

Compound 7-(10)

$R_{7-1}$: —$NO_2$
$R_{7-2}$: —H
$R_{7-3}$: —H
$R_{7-4}$:

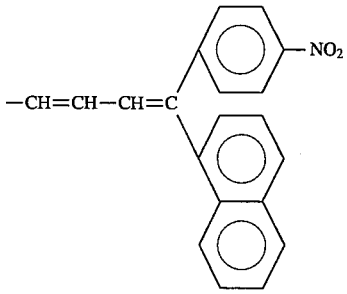

Compound 7-(11)

$R_{7-1}$: —$NO_2$
$R_{7-2}$: —H
$R_{7-3}$: —H
$R_{7-4}$:

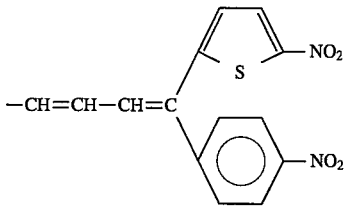

Basic constitution
(Formula (7))

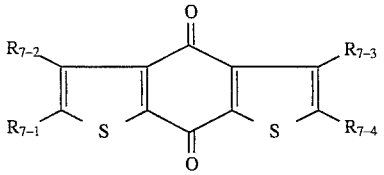

Compound 7-(12)

$R_{7-1}$: $-CH=CH-NO_2$
$R_{7-2}$: $-H$
$R_{7-3}$: $-H$
$R_{7-4}$: $-CH=CH-NO_2$

Compound 7-(13)

$R_{7-1}$: $-CH=CH=NO_2$
$R_{7-2}$: $-H$
$R_{7-3}$: $-H$ $R_{7-4}$:

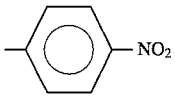

Compound 7-(14)

$R_{7-1}$: $-(CH=CH)_2-NO_2$
$R_{7-2}$: $-H$
$R_{7-3}$: $-H$ $R_{7-4}$:

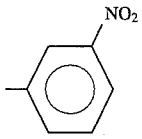

Compound 7-(15)

$R_{7-1}$: $-CH=CH-NO_2$
$R_{7-2}$: $-H$
$R_{7-3}$: $-H$ $R_{7-4}$:

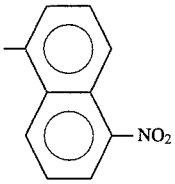

Compound 7-(16)

$R_{7-1}$: $-CH=CH-NO_2$
$R_{7-2}$: $-H$
$R_{7-3}$: $-H$ $R_{7-4}$:

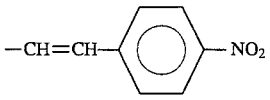

Compound 7-(17)

$R_{7-1}$: $-CH=CH-NO_2$
$R_{7-2}$: $-H$
$R_{7-3}$: $-H$

Basic constitution
(Formula (7))

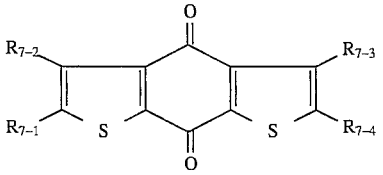

$R_{7-4}$:

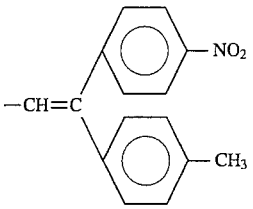

Compound 7-(18)

$R_{7-1}$: $-CH=CH-NO_2$
$R_{7-2}$: $-H$
$R_{7-3}$: $-H$ $R_{7-4}$:

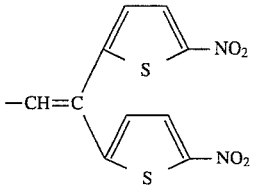

Compound 7-(19)

$R_{7-1}$: $-CH=CH-NO_2$
$R_{7-2}$: $-H$
$R_{7-3}$: $-H$ $R_{7-4}$:

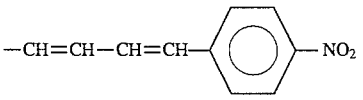

Compound 7-(20)

$R_{7-1}$:

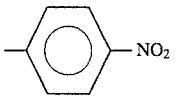

$R_{7-2}$: $-H$
$R_{7-3}$: $-H$ $R_{7-4}$:

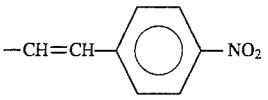

Compound 7-(21)

$R_{7-1}$:

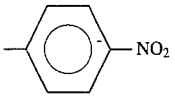

$R_{7-2}$: $-H$
$R_{7-3}$: $-H$

Basic constitution
(Formula (7))
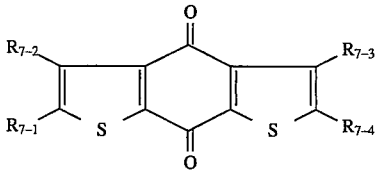
$R_{7-4}$:
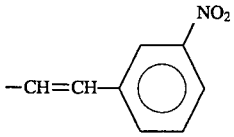
Compound 7-(22)
$R_{7-1}$:
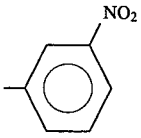
$R_{7-2}$: —H
$R_{7-3}$: —H
$R_{7-4}$:
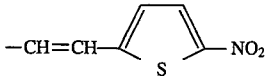
Compound 7-(23)
$R_{7-1}$:
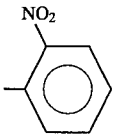
$R_{7-2}$: —H
$R_{7-3}$: —H
$R_{7-4}$:
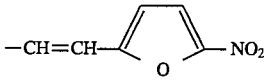
Compound 7-(24)
$R_{7-1}$:
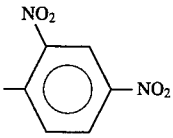
$R_{7-2}$: —H
$R_{7-3}$: —H
$R_{7-4}$:
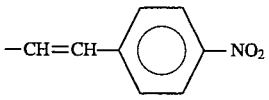
Compound 7-(25)
Basic constitution
(Formula (7))
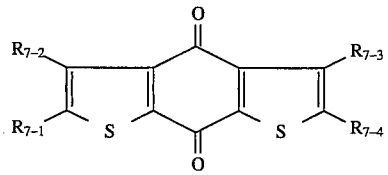
$R_{7-1}$:
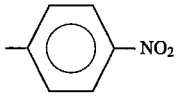
$R_{7-2}$: —H
$R_{7-3}$: —H
$R_{7-4}$:
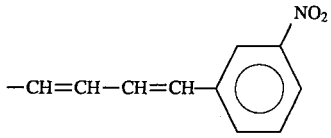
Compound 7-(26)
$R_{7-1}$:
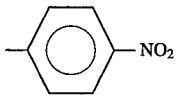
$R_{7-2}$: —H
$R_{7-3}$: —H
$R_{7-4}$:
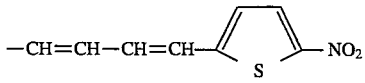
Compound 7-(27)
$R_{7-1}$:
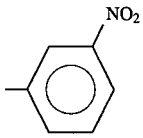
$R_{7-2}$: —H
$R_{7-3}$: —H
$R_{7-4}$:
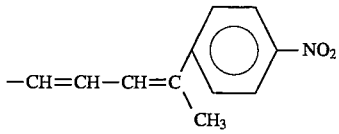
Compound 7-(28)
$R_{7-1}$:
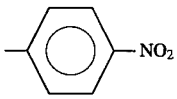
$R_{7-2}$: —H
$R_{7-3}$: —H Basic constitution
(Formula (7))
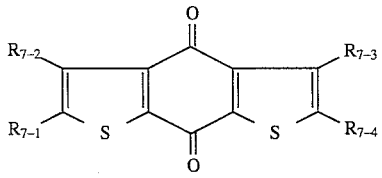
$R_{7-4}$:
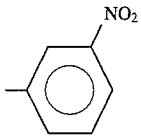
Compound 7-(29)
$R_{7-1}$:
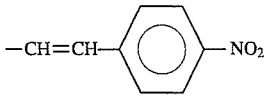
$R_{7-2}$: —H
$R_{7-3}$: —H
$R_{7-4}$:
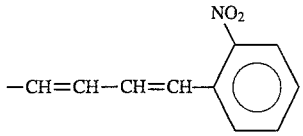
Compound 7-(30)
$R_{7-1}$:
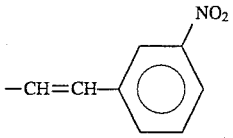
$R_{7-2}$: —H
$R_{7-3}$: —H
$R_{7-4}$:
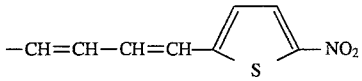
Compound 7-(31)
$R_{7-1}$:
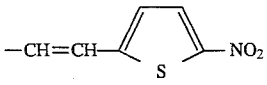
$R_{7-2}$: —H
$R_{7-3}$: —H
$R_{7-4}$:
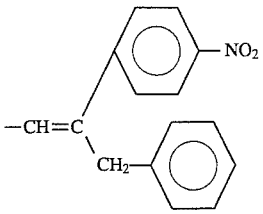
Compound 7-(32)
Basic constitution
(Formula (7))
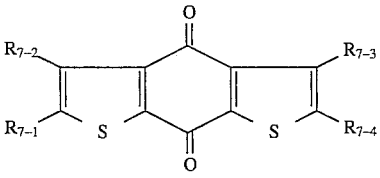
$R_{7-1}$:
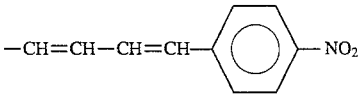
$R_{7-2}$: —H
$R_{7-3}$: —H
$R_{7-4}$:
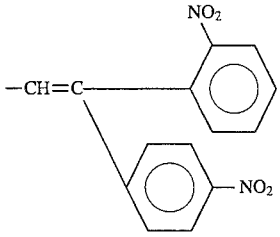
Compound 7-(33)
$R_{7-1}$:
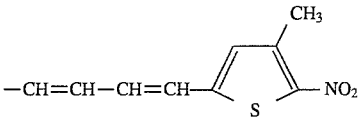
$R_{7-2}$: —H
$R_{7-3}$: —H
$R_{7-4}$:
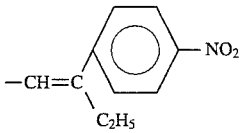
Compound 7-(34)
$R_{7-1}$:
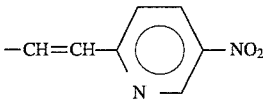
$R_{7-2}$: —H
$R_{7-3}$: —H
$R_{7-4}$:
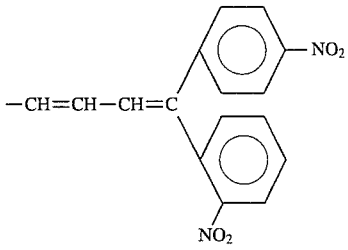
Compound 7-(35)

Basic constitution
(Formula (7))
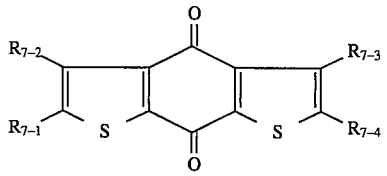
$R_{7-1}$:
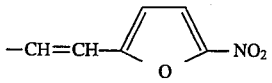
$R_{7-2}$: —H
$R_{7-3}$: —H
$R_{7-4}$:
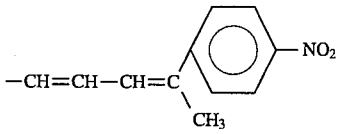
Compound 7-(36)
$R_{7-1}$:
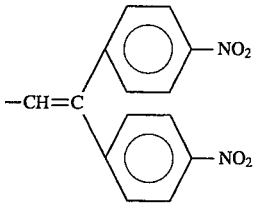
$R_{7-2}$: —H
$R_{7-3}$: —H
$R_{7-4}$:
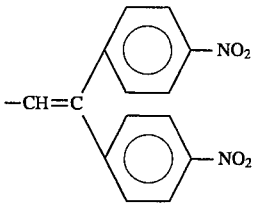
Compound 7-(37)
$R_{7-1}$:
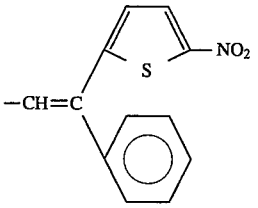
$R_{7-2}$: —H
$R_{7-3}$: —H
Basic constitution
(Formula (7))
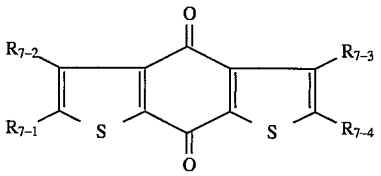
$R_{7-4}$:
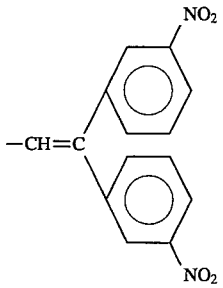
Compound 7-(38)
$R_{7-1}$:
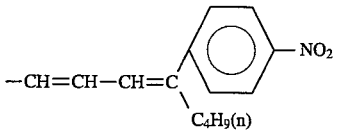
$R_{7-2}$: —H
$R_{7-3}$: —H
$R_{7-4}$:
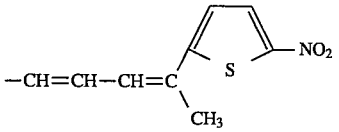
Compound 7-(39)
$R_{7-1}$:
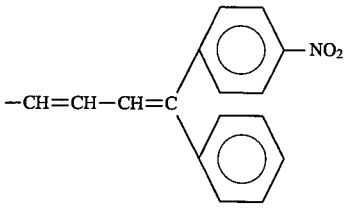
$R_{7-2}$: —H
$R_{7-3}$: —H
$R_{7-4}$:
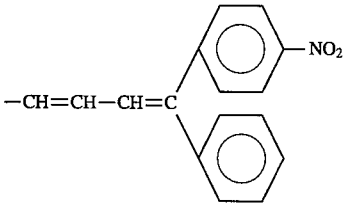
Compound 7-(40)
$R_{7-1}$:
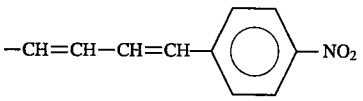

Basic constitution
(Formula (7))
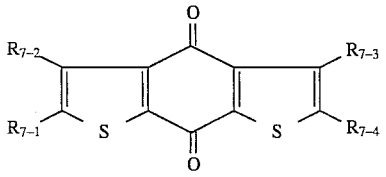
$R_{7-2}$: —H
$R_{7-3}$: —H
$R_{7-4}$:
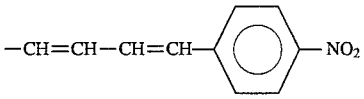
Compound 7-(41)
$R_{7-1}$: $-NO_2$
$R_{7-2}$: —Cl
$R_{7-3}$: —H
$R_{7-4}$:
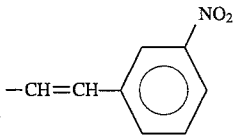
Compound 7-(42)
$R_{7-1}$: $-NO_2$
$R_{7-2}$: —Cl
$R_{7-3}$: —H
$R_{7-4}$:
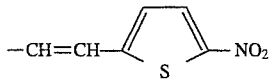
Compound 7-(43)
$R_{7-1}$:
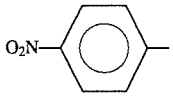
$R_{7-2}$: —Cl
$R_{7-3}$: —H
$R_{7-4}$:
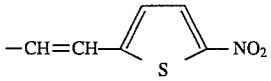
Compound 7-(44)
$R_{7-1}$:
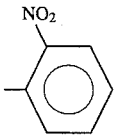
$R_{7-2}$: —Br
$R_{7-3}$: —H
$R_{7-4}$:
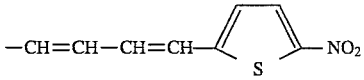
Basic constitution
(Formula (7))
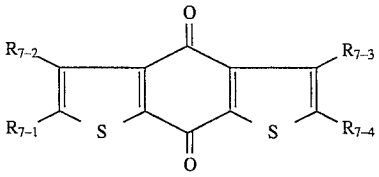
Compound 7-(45)
$R_{7-1}$:
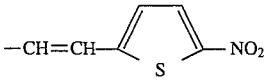
$R_{7-2}$: —Br
$R_{7-3}$: —H
$R_{7-4}$:
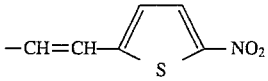
Compound 7-(46)
$R_{7-1}$: $-NO_2$
$R_{7-2}$: —Cl
$R_{7-3}$: —Cl
$R_{7-4}$:
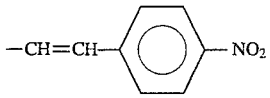
Compound 7-(47)
$R_{7-1}$: $-NO_2$
$R_{7-2}$: —Cl
$R_{7-3}$: —Cl
$R_{7-4}$:
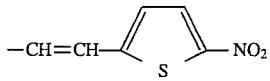
Compound 7-(48)
$R_{7-1}$:
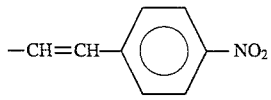
$R_{7-2}$: $-C_2H_5$
$R_{7-3}$: —H
$R_{7-4}$:
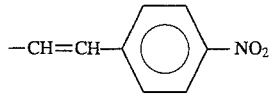
Compound 7-(49)
$R_{7-1}$:
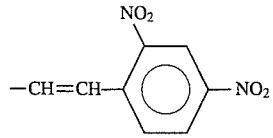
$R_{7-2}$: $-CH_3$
$R_{7-3}$: $-CH_3$ Basic constitution
(Formula (7))
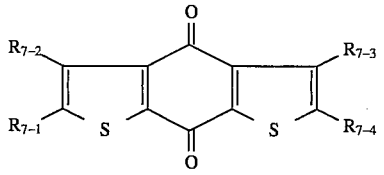
$R_{7-4}$:
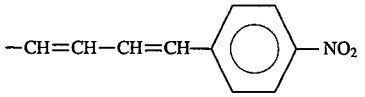
Compound 7-(50)
$R_{7-1}$: $-CH=CH-NO_2$
$R_{7-2}$: $-C_4H_9(t)$
$R_{7-3}$: $-H$
$R_{7-4}$: $-CH=CH-NO_2$
Compound 7-(51)
$R_{7-1}$:
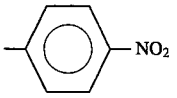
$R_{7-2}$: $-NO_2$
$R_{7-3}$: $-H$
$R_{7-4}$:
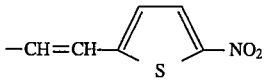
Compound 7-(52)
$R_{7-1}$:
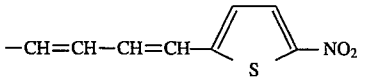
$R_{7-2}$: $-CH_2$
$R_{7-3}$: $-H$
$R_{7-4}$:
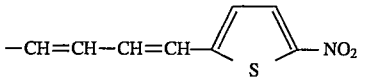
Compound 7-(53)
$R_{7-1}$:
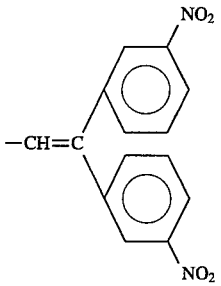
$R_{7-2}$: $-CH_2$
$R_{7-3}$: $-CH_2$
$R_{7-4}$:
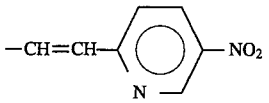
Basic constitution
(Formula (7))
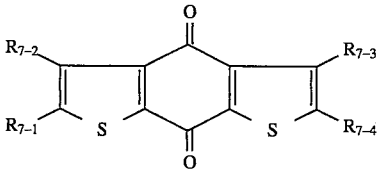
Compound 7-(54)
$R_{7-1}$: $-H$
$R_{7-2}$:
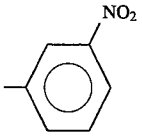
$R_{7-3}$: $-H$
$R_{7-4}$:
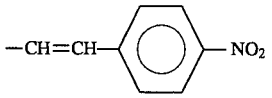
Compound 7-(55)
$R_{7-1}$: $-NO_2$
$R_{7-2}$:
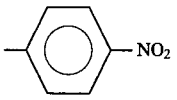
$R_{7-3}$: $-H$
$R_{7-4}$:
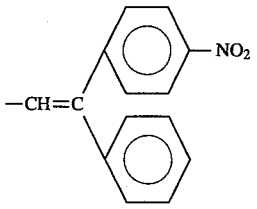
Compound 7-(56)
$R_{7-1}$:
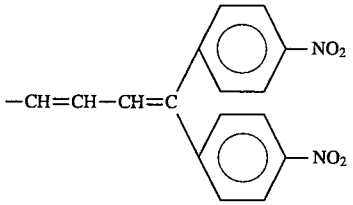
$R_{7-2}$:
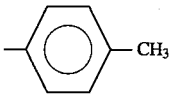
$R_{7-3}$: $-CH_3$
$R_{7-4}$:
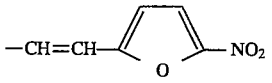
Compound 7-(57)

Basic constitution
(Formula (7))
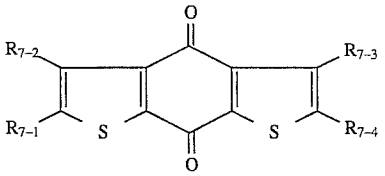
$R_{7-1}$:
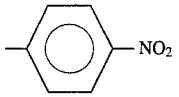
$R_{7-2}$:
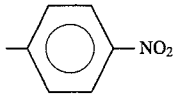
$R_{7-3}$: —Cl
$R_{7-4}$:
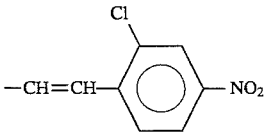
Compound 7-(58)
$R_{7-1}$:
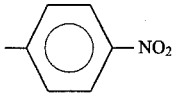
$R_{7-2}$:
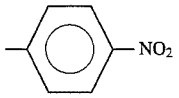
$R_{7-3}$: —H
$R_{7-4}$: —H
Compound 7-(59)
$R_{7-1}$: $-NO_2$
$R_{7-2}$:
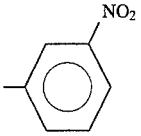
$R_{7-3}$: —H
$R_{7-4}$: —H
Compound 7-(60)
$R_{7-1}$: $-NO_2$
$R_{7-2}$:
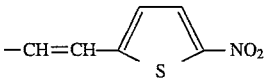
$R_{7-3}$: —H
$R_{7-4}$: —H
Compound 7-(61)
$R_{7-1}$:
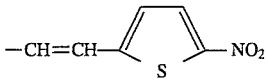
Basic constitution
(Formula (7))
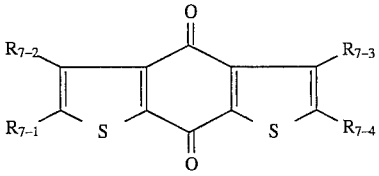
$R_{7-2}$:
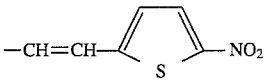
$R_{7-3}$: —H
$R_{7-4}$: —H
Compound 7-(62)
$R_{7-1}$: —H
$R_{7-2}$: $-NO_2$
$R_{7-3}$: $-CH=CH-NO_2$
$R_{7-4}$: —H
Compound 7-(63)
$R_{7-1}$: —H
$R_{7-2}$:
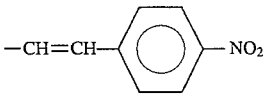
$R_{7-3}$:
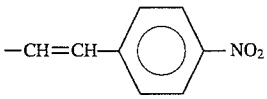
$R_{7-4}$: —H
Compound 7-(64)
$R_{7-1}$: —H
$R_{7-2}$: $-NO_2$
$R_{7-3}$:
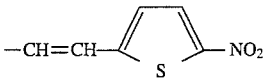
$R_{7-4}$: —H
Compound 7-(65)
$R_{7-1}$: —H
$R_{7-2}$:
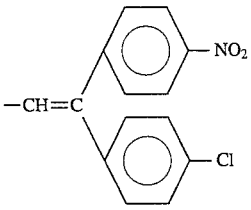
$R_{7-3}$:
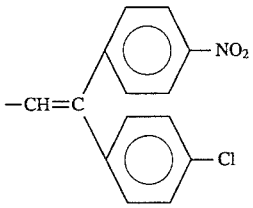
$R_{7-4}$: —H
Compound 7-(66)
$R_{7-1}$: $-NO_2$ Basic constitution
(Formula (7))
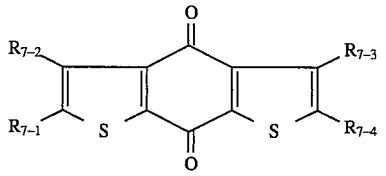
$R_{7-2}$: $-CH=CH-NO_2$
$R_{7-3}$: $-H$
$R_{7-4}$:
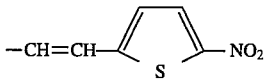
Compound 7-(67)
$R_{7-1}$:
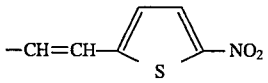
$R_{7-2}$: $-NO_2$
$R_{7-3}$: $-H$
$R_{7-4}$:
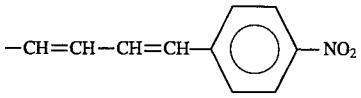
Compound 7-(68)
$R_{7-1}$:
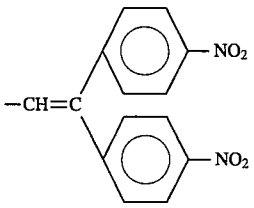
$R_{7-2}$: $-CH=CH-NO_2$
$R_{7-3}$: $-H$
$R_{7-4}$:
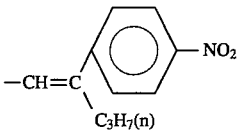
Compound 7-(69)
$R_{7-1}$:
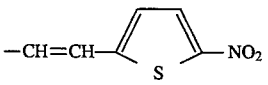
$R_{7-2}$:
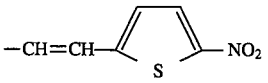
$R_{7-3}$: $-H$
$R_{7-4}$: $-NO_2$
Compound 7-(70)
$R_{7-1}$: $-NO_2$
Basic constitution
(Formula (7))
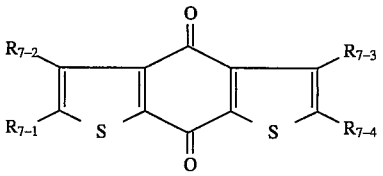
$R_{7-2}$:
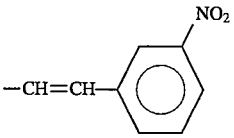
$R_{7-3}$:
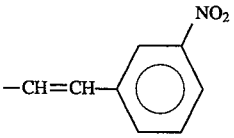
$R_{7-4}$: $-NO_2$
Compound 7-(71)
$R_{7-1}$:
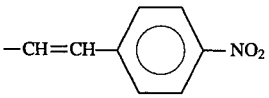
$R_{7-2}$:
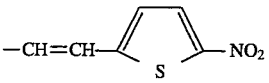
$R_{7-3}$:
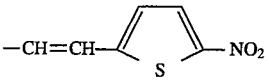
$R_{7-4}$:
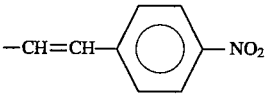
Compound 7-(72)
$R_{7-1}$: $-H$
$R_{7-2}$: $-NO_2$
$R_{7-3}$: $-H$
$R_{7-4}$:
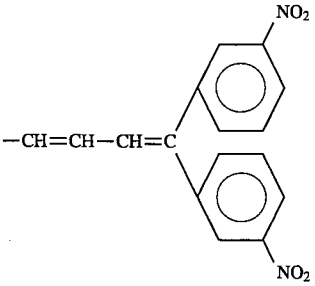
Compound 7-(73)
$R_{7-1}$: $-H$
$R_{7-2}$:
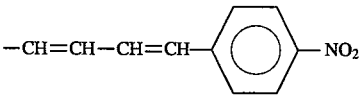

Basic constitution
(Formula (7))
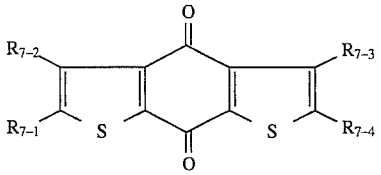
$R_{7-3}$: —H
$R_{7-4}$:
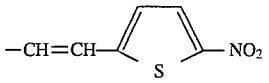
Compound 7-(74)
$R_{7-1}$: —H
$R_{7-2}$:
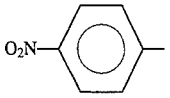
$R_{7-3}$: —H
$R_{7-4}$: $-NO_2$
Compound 7-(75)
$R_{7-1}$: $-NO_2$
$R_{7-2}$: —H
$R_{7-3}$: —H
$R_{7-4}$:
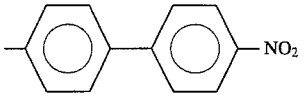
Compound 7-(76)
$R_{7-1}$: $-NO_2$
$R_{7-2}$: —H
$R_{7-3}$: —H
$R_{7-4}$:
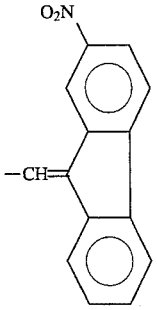
Compound 7-(77)
$R_{7-1}$:
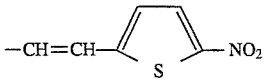
$R_{7-2}$: —H
$R_{7-3}$: —H
Basic constitution
(Formula (7))
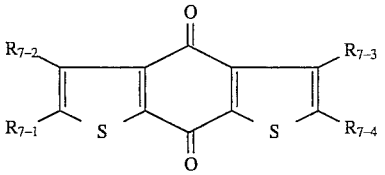
$R_{7-4}$:
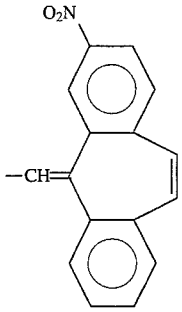
Compound 7-(78)
$R_{7-1}$: —CH=CH—$NO_2$
$R_{7-2}$: —H
$R_{7-3}$: —H
$R_{7-4}$:
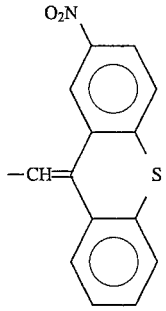
Compound 7-(79)
$R_{7-1}$: $-CH_3$
$R_{7-2}$:
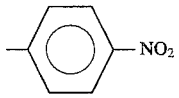
$R_{7-3}$:
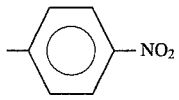
$R_{7-4}$: $-CH_3$
Compound 7-(80)
$R_{7-1}$: $-C_2H_5$
$R_{7-2}$:
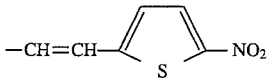
$R_{7-3}$:
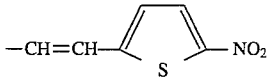
$R_{7-4}$: $-C_2H_5$
Compound 7-(81)

Basic constitution
(Formula (7))
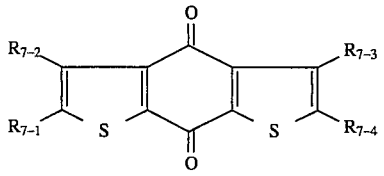
$R_{7-1}$:
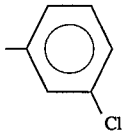
$R_{7-2}$:
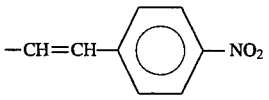
$R_{7-3}$:
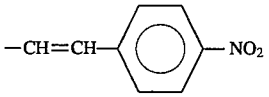
$R_{7-4}$:
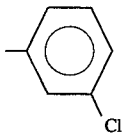
Compound 7-(82)
$R_{7-1}$:
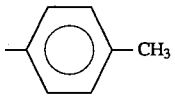
$R_{7-2}$:
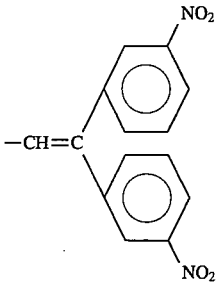
$R_{7-3}$:
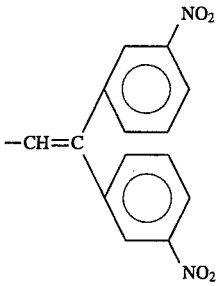
$R_{7-4}$:
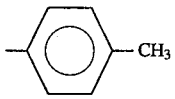
Basic constitution
(Formula (7))
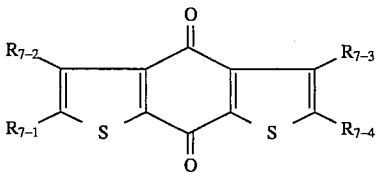
Compound 7-(83)
$R_{7-1}$:
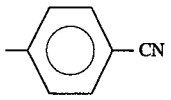
$R_{7-2}$:
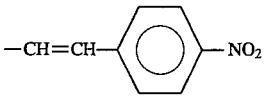
$R_{7-3}$:
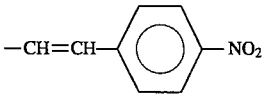
$R_{7-4}$:
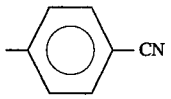
Compound 7-(84)
$R_{7-1}$: $-NO_2$
$R_{7-2}$: $-H$
$R_{7-3}$:
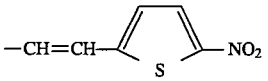
$R_{7-4}$: $-H$
Basic constitution (Formula (8))
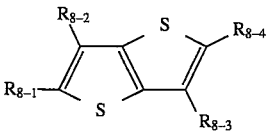
Compound 8-(1)
$R_{8-1}$: $-NO_2$
$R_{8-2}$: $-H$
$R_{8-3}$: $-H$
$R_{8-4}$: $-NO_2$
Compound 8-(2)
$R_{8-1}$: $-NO_2$
$R_{8-2}$: $-H$
$R_{8-3}$: $-H$
$R_{8-4}$: $-CH=CH-NO_2$
Compound 8-(3)
$R_{8-1}$: $-NO_2$
$R_{8-2}$: $-H$
$R_{8-3}$: $-H$ Basic constitution (Formula (8))

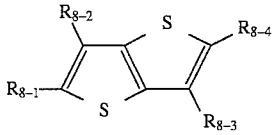

$R_{8-4}$:

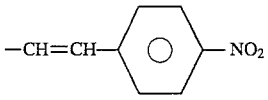

Compound 8-(4)

$R_{8-1}$: $-NO_2$
$R_{8-2}$: $-H$
$R_{8-3}$: $-H$ $R_{8-4}$:

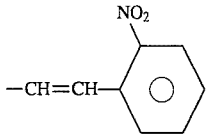

Compound 8-(5)

$R_{8-1}$: $-NO_2$
$R_{8-2}$: $-H$
$R_{8-3}$: $-H$ $R_{8-4}$:

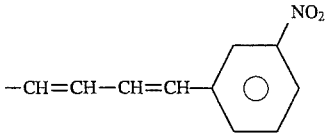

Compound 8-(6)

$R_{8-1}$: $-NO_2$
$R_{8-2}$: $-H$
$R_{8-3}$: $-H$ $R_{8-4}$:

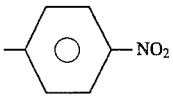

Compound 8-(7)

$R_{8-1}$: $-NO_2$
$R_{8-2}$: $-H$
$R_{8-3}$: $-H$ $R_{8-4}$:

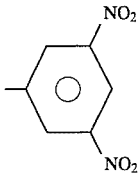

Compound 8-(8)

$R_{8-1}$: $-NO_2$
$R_{8-2}$: $-H$
$R_{8-3}$: $-H$ $R_{8-4}$:

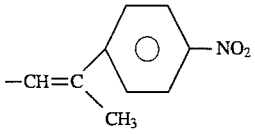

Basic constitution (Formula (8))

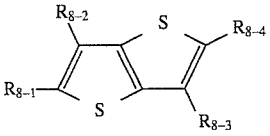

Compound 8-(9)

$R_{8-1}$: $-NO_2$
$R_{8-2}$: $-H$
$R_{8-3}$: $-H$ $R_{8-4}$:

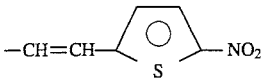

Compound 8-(10)

$R_{8-1}$: $-NO_2$
$R_{8-2}$: $-H$
$R_{8-3}$: $-H$ $R_{8-4}$:

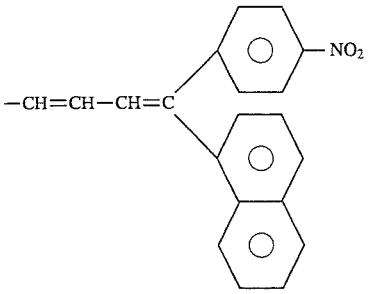

Compound 8-(11)

$R_{8-1}$: $-NO_2$
R8-2 $-H$
R8-3 $-H$ $R_{8-4}$:

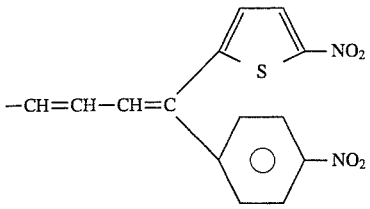

Compound 8-(12)

$R_{8-1}$: $-CH=CH-NO_2$
$R_{8-2}$: $-H$
$R_{8-3}$: $-H$
$R_{8-4}$: $-CH=CH--NO_2$

Compound 8-(13)

$R_{8-1}$: $-CH=CH--NO_2$
$R_{8-2}$: $-H$
$R_{8-3}$: $-H$ $R_{8-4}$:

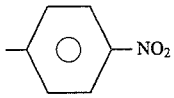

Compound 8-(14)

$R_{8-1}$: $-(CH=CH)_2-NO_2$
$R_{8-2}$: $-H$
$R_{8-3}$: $-H$

Basic constitution (Formula (8))

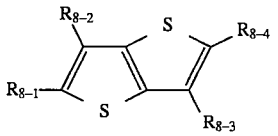

$R_{8-4}$:

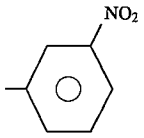

Compound 8-(15)

$R_{8-1}$: $-CH=CH-NO_2$
$R_{8-2}$: $-H$
$R_{8-3}$: $-H$ $R_{8-4}$:

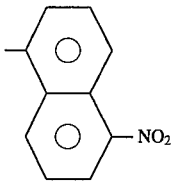

Compound 8-(16)

$R_{8-1}$: $-CH=CH-NO_2$
$R_{8-2}$: $-H$
$R_{8-3}$: $-H$ $R_{8-4}$:

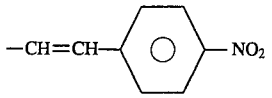

Compound 8-(17)

$R_{8-1}$: $-CH=CH-NO_2$
$R_{8-2}$: $-H$
$R_{8-3}$: $-H$ $R_{8-4}$:

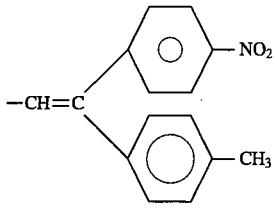

Compound 8-(18)

$R_{8-1}$: $-CH=CH-NO_2$
$R_{8-2}$: $-H$
$R_{8-3}$: $-H$ $R_{8-4}$:

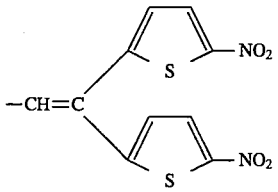

Compound 8-(19)

$R_{8-1}$: $-CH=CH-NO_2$
$R_{8-2}$: $-H$
$R_{8-3}$: $-H$

Basic constitution (Formula (8))

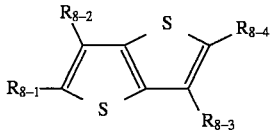

$R_{8-4}$:

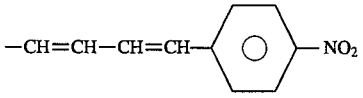

Compound 8-(20)

$R_{8-1}$:

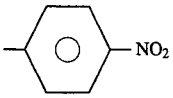

$R_{8-2}$: $-H$
$R_{8-3}$: $-H$ $R_{8-4}$:

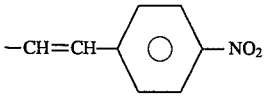

Compound 8-(21)

$R_{8-1}$:

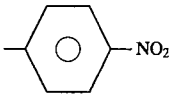

$R_{8-2}$: $-H$
$R_{8-3}$: $-H$ $R_{8-4}$:

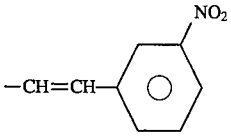

Compound 8-(22)

$R_{8-1}$:

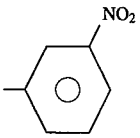

$R_{8-2}$: $-H$
$R_{8-3}$: $-H$ $R_{8-4}$:

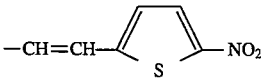

Compound 8-(23)

$R_{8-1}$:

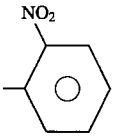

$R_{8-2}$: $-H$
$R_{8-3}$: $-H$

Basic constitution (Formula (8))
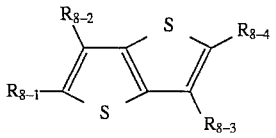
$R_{8-4}$:
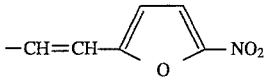
Compound 8-(24)
$R_{8-1}$:
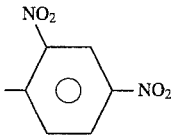
$R_{8-2}$: —H
$R_{8-3}$: —H
$R_{8-4}$:
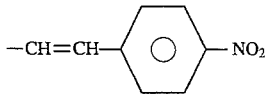
Compound 8-(25)
$R_{8-1}$:
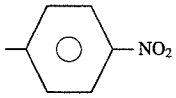
$R_{8-2}$: —H
$R_{8-3}$: —H
$R_{8-4}$:
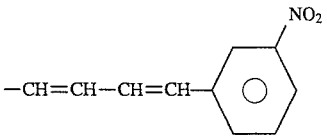
Compound 8-(26)
$R_{8-1}$:
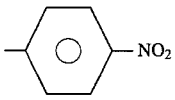
$R_{8-2}$: —H
$R_{8-3}$: —H
$R_{8-4}$:
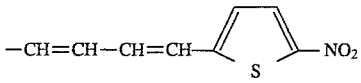
Compound 8-(27)
$R_{8-1}$:
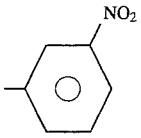
$R_{8-2}$: —H
$R_{8-3}$: —H
Basic constitution (Formula (8))
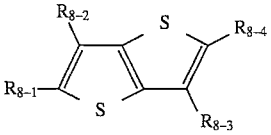
$R_{8-4}$:
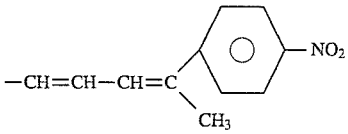
Compound 8-(28)
$R_{8-1}$:
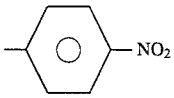
$R_{8-2}$: —H
$R_{8-3}$: —H
$R_{8-4}$:
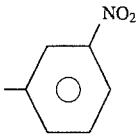
Compound 8-(29)
$R_{8-1}$:
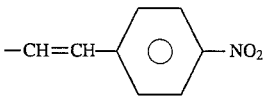
$R_{8-2}$: —H
$R_{8-3}$: —H
$R_{8-4}$:
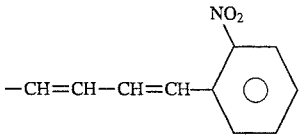
Compound 8-(30)
$R_{8-1}$:
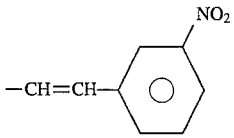
$R_{8-2}$: —H
$R_{8-3}$: —H
$R_{8-4}$:
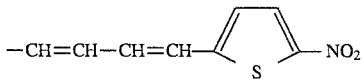
Compound 8-(31)
$R_{8-1}$:
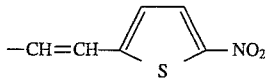
$R_{8-2}$: —H
$R_{8-3}$: —H Basic constitution (Formula (8))
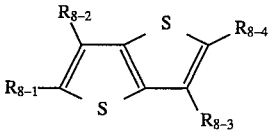
$R_{8-4}$:
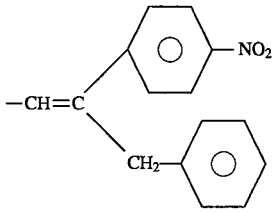
Compound 8-(32)
$R_{8-1}$:
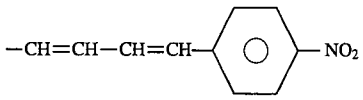
$R_{8-2}$: —H
$R_{8-3}$: —H
$R_{8-4}$:
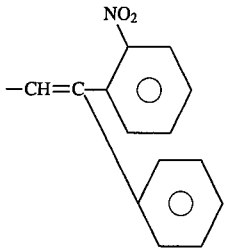
Compound 8-(33)
$R_{8-1}$:
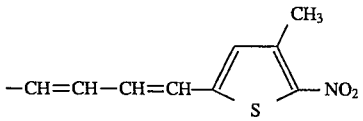
$R_{8-2}$: —H
$R_{8-3}$: —H
$R_{8-4}$:
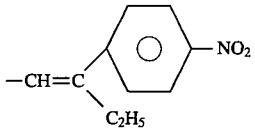
Compound 8-(34)
$R_{8-1}$:
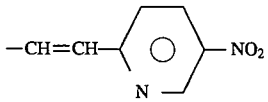
$R_{8-2}$: —H
$R_{8-3}$: —H
Basic constitution (Formula (8))
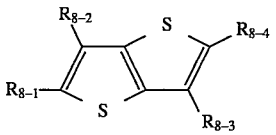
$R_{8-4}$:
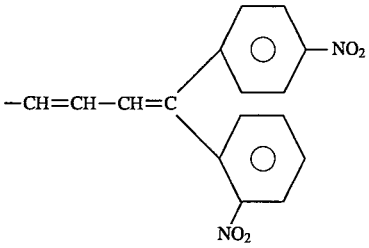
Compound 8-(35)
$R_{8-1}$:
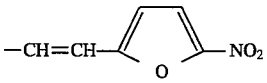
$R_{8-2}$: —H
$R_{8-3}$: —H
$R_{8-4}$:
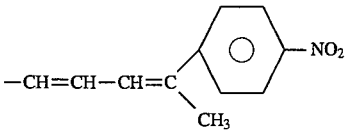
Compound 8-(36)
$R_{8-1}$:
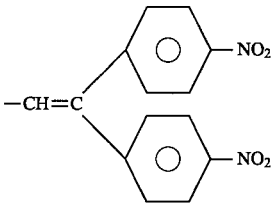
$R_{8-2}$: —H
$R_{8-3}$: —H
$R_{8-4}$:
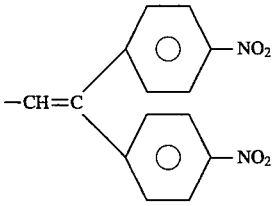
Compound 8-(37)
$R_{8-1}$:
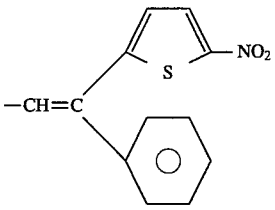
$R_{8-2}$: —H
$R_{8-3}$: —H Basic constitution (Formula (8))
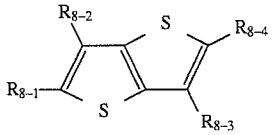
$R_{8-4}$:
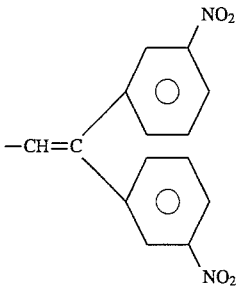
Compound 8-(38)
$R_{8-1}$:
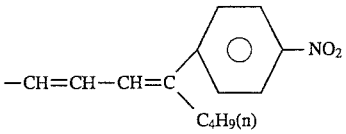
$R_{8-2}$: —H
$R_{8-3}$: —H
$R_{8-4}$:
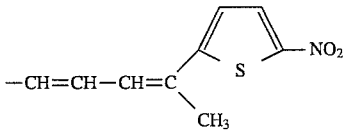
Compound 8-(39)
$R_{8-1}$:
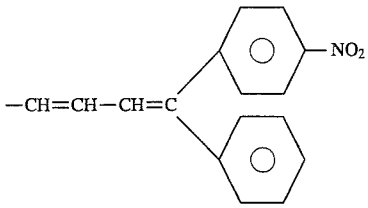
$R_{8-2}$: —H
$R_{8-3}$: —H
$R_{8-4}$:
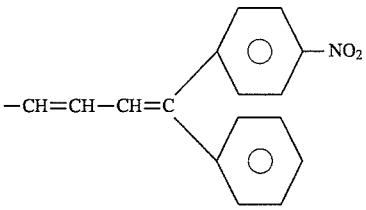
Compound 8-(40)
$R_{8-1}$:
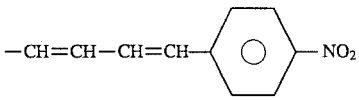
$R_{8-2}$: —H
$R_{8-3}$: —H
Basic constitution (Formula (8))
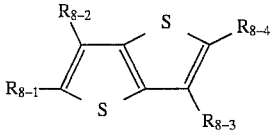
$R_{8-4}$:
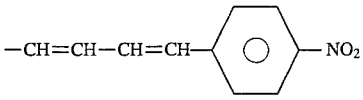
Compound 8-(41)
$R_{8-1}$: $-NO_2$
$R_{8-2}$: —Cl
$R_{8-3}$: —H
$R_{8-4}$:
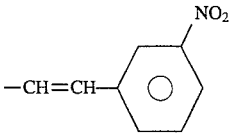
+T1 +HZ
Compound 8-(42)
$R_{8-1}$: $-NO_2$
$R_{8-2}$: —Cl
$R_{8-3}$: —H
$R_{8-4}$:
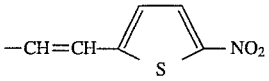
Compound 8-(43)
$R_{8-1}$: $O_2N$
$R_{8-2}$: —Cl
$R_{8-3}$: —H
$R_{8-4}$:
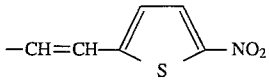
Compound 8-(44)
$R_{8-1}$:
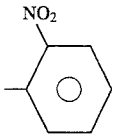
$R_{8-2}$: —Br
$R_{8-3}$: —H
$R_{8-4}$:
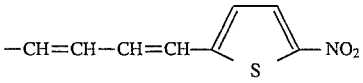
Compound 8-(45)
$R_{8-1}$:
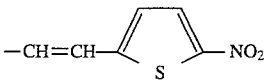
$R_{8-2}$: —Br
$R_{8-3}$: —H Basic constitution (Formula (8))

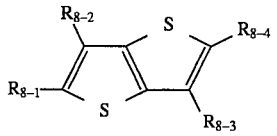

$R_{8-4}$:

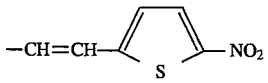

Compound 8-(46)

$R_{8-1}$: $-NO_2$
$R_{8-2}$: $-Cl$
$R_{8-3}$: $-Cl$ $R_{8-4}$:

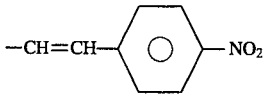

Compound 8-(47)

$R_{8-1}$: $-NO_2$
$R_{8-2}$: $-Cl$
$R_{8-3}$: $-Cl$ $R_{8-4}$:

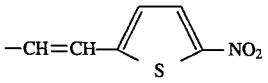

Compound 8-(48)

$R_{8-1}$:

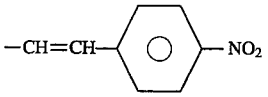

$R_{8-2}$: $-C_2H_5$
$R_{8-3}$: $-H$ $R_{8-4}$:

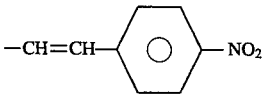

Compound 8-(49)

$R_{8-1}$:

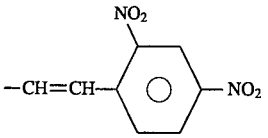

$R_{8-2}$: $-CH_3$
$R_{8-3}$: $-CH_3$ $R_{8-4}$:

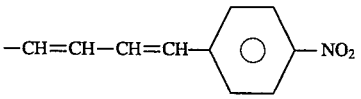

Compound 8-(50)

$R_{8-1}$: $-CH=CH-NO_2$
$R_{8-2}$: $-C_4H_9(t)$
$R_{8-3}$: $-H$
$R_{8-4}$: $-CH=CH-NO_2$

Compound 8-(51)

Basic constitution (Formula (8))

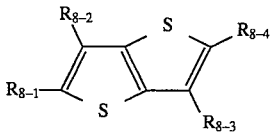

$R_{8-1}$:

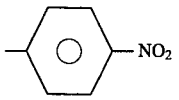

$R_{8-2}$: $-NO_2$
$R_{8-3}$: $-H$ $R_{8-4}$:

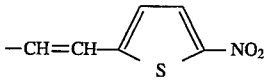

Compound 8-(52)

$R_{8-1}$:

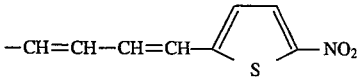

$R_{8-2}$: $-CH_2$
$R_{8-3}$: $-H$ $R_{8-4}$:

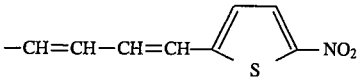

Compound 8-(53)

$R_{8-1}$:

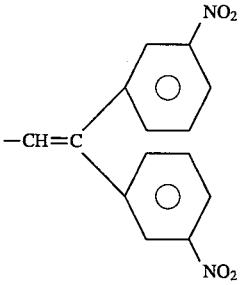

$R_{8-2}$: $-CH_2$
$R_{8-3}$: $-CH_2$ $R_{8-4}$:

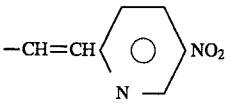

Compound 8-(54)

$R_{8-1}$: $-H$ $R_{8-2}$:

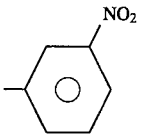

$R_{8-3}$: $-H$ $R_{8-4}$:

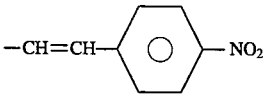

Basic constitution (Formula (8))
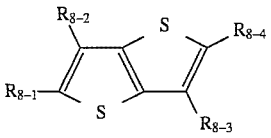
Compound 8-(55)
$R_{8-1}$: $-NO_2$
$R_{8-2}$:
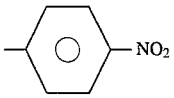
$R_{8-3}$: $-H$
$R_{8-4}$:
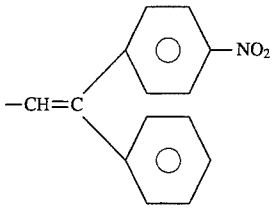
Compound 8-(56)
$R_{8-1}$:
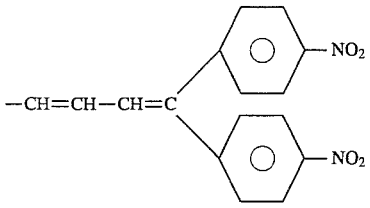
$R_{8-2}$:
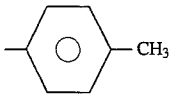
$R_{8-3}$: $-CH_3$
$R_{8-4}$:
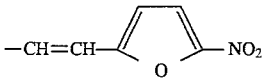
Compound 8-(57)
$R_{8-1}$:
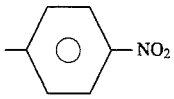
$R_{8-2}$:
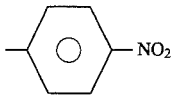
$R_{8-3}$: $-Cl$
$R_{8-4}$:
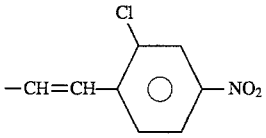
Compound 8-(58)
Basic constitution (Formula (8))
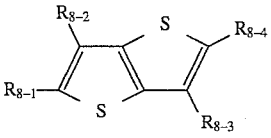
$R_{8-1}$:
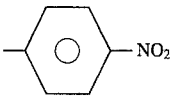
$R_{8-2}$:
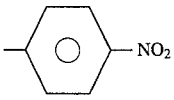
$R_{8-3}$: $-H$
$R_{8-4}$: $-H$
Compound 8-(59)
$R_{8-1}$: $-NO_2$
$R_{8-2}$:
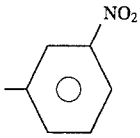
$R_{8-3}$: $-H$
$R_{8-4}$: $-H$
Compound 8-(60)
$R_{8-1}$: $-NO_2$
$R_{8-2}$:
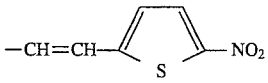
$R_{8-3}$: $-H$
$R_{8-4}$: $-H$
Compound 8-(61)
$R_{8-1}$:
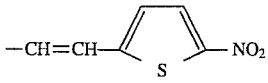
$R_{8-2}$:
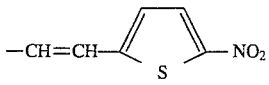
$R_{8-3}$: $-H$
$R_{8-4}$: $-H$
Compound 8-(62)
$R_{8-1}$: $-H$
$R_{8-2}$: $-NO_2$
$R_{8-3}$: $-CH=CH-NO_2$
$R_{8-4}$: $-H$
Compound 8-(63)
$R_{8-1}$: $-H$
$R_{8-2}$:
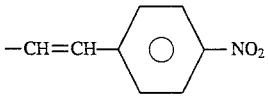
$R_{8-3}$:
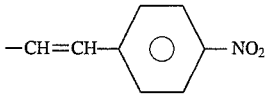

Basic constitution (Formula (8))
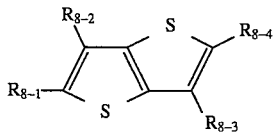
$R_{8-4}$: —H
Compound 8-(64)
$R_{8-1}$: —H
$R_{8-2}$: —$NO_2$
$R_{8-3}$:
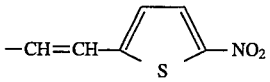
$R_{8-4}$: —H
Compound 8-(65)
$R_{8-1}$: —H
$R_{8-2}$:
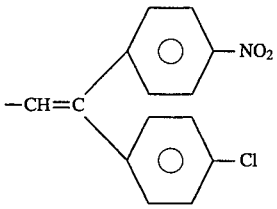
$R_{8-3}$:
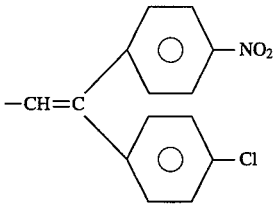
$R_{8-4}$: —H
Compound 8-(66)
$R_{8-1}$: —$NO_2$
$R_{8-2}$: —CH=CH—$NO_2$
$R_{8-3}$: —H
$R_{8-4}$:
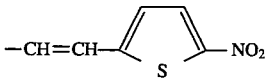
Compound 8-(67)
$R_{8-1}$:
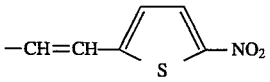
$R_{8-2}$: —$NO_2$
$R_{8-3}$: —H
$R_{8-4}$:
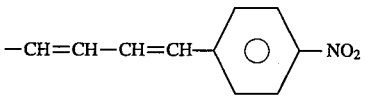
Compound 8-(68)
Basic constitution (Formula (8))
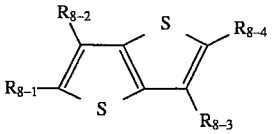
$R_{8-1}$:
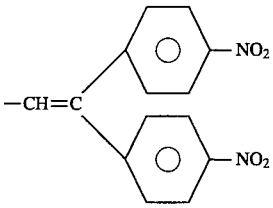
$R_{8-2}$: —CH=CH—$NO_2$
$R_{8-3}$: —H
$R_{8-4}$:
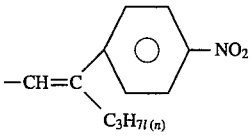
Compound 8-(69)
$R_{8-1}$:
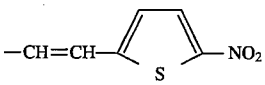
$R_{8-2}$:
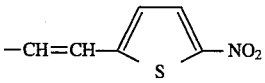
$R_{8-3}$: —H
$R_{8-4}$: —$NO_2$
Compound 8-(70)
$R_{8-1}$: —$NO_2$
$R_{8-2}$:
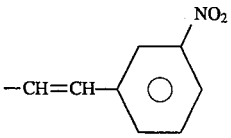
$R_{8-3}$:
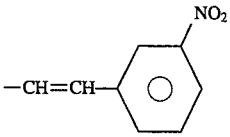
$R_{8-4}$: —$NO_2$
Compound 8-(71)
$R_{8-1}$:
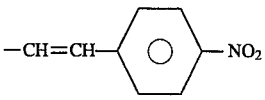
$R_{8-2}$:
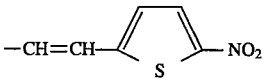
$R_{8-3}$:
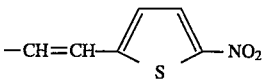

Basic constitution (Formula (8))
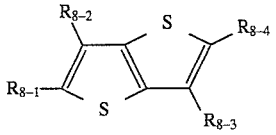
$R_{8-4}$:
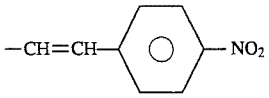
Compound 8-(72)
$R_{8-1}$: —H
$R_{8-2}$: —$NO_2$
$R_{8-3}$: —H
$R_{8-4}$:
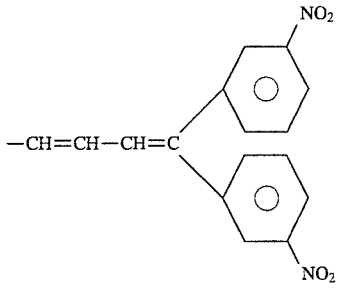
Compound 8-(73)
$R_{8-1}$: —H
$R_{8-2}$:
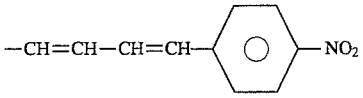
$R_{8-3}$: —H
$R_{8-4}$:
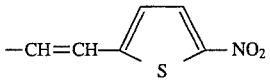
Compound 8-(74)
$R_{8-1}$: —H
$R_{8-2}$:
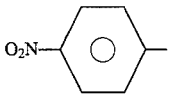
$R_{8-3}$: —H
$R_{8-4}$: —$NO_2$
Compound 8-(75)
$R_{8-1}$: —$NO_2$
$R_{8-2}$: —H
$R_{8-3}$: —H
$R_{8-4}$:
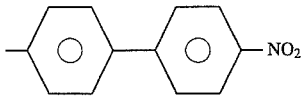
Compound 8-(76)
$R_{8-1}$: —$NO_2$
$R_{8-2}$: —H
$R_{8-3}$: —H
Basic constitution (Formula (8))
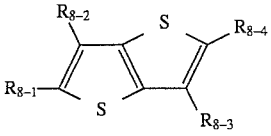
$R_{8-4}$:
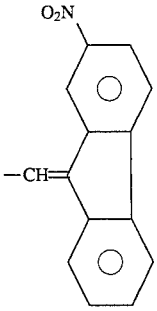
Compound 8-(77)
$R_{8-1}$:
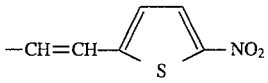
$R_{8-2}$: —H
$R_{8-3}$: —H
$R_{8-4}$:
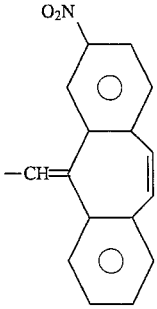
Compound 8-(78)
$R_{8-1}$: —CH=CH—$NO_2$
$R_{8-2}$: —H
$R_{8-3}$: —H
$R_{8-4}$:
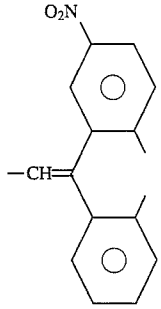
Compound 8-(79)
$R_{8-1}$: —$CH_3$
$R_{8-2}$:
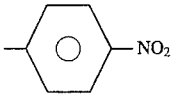

Basic constitution (Formula (8))
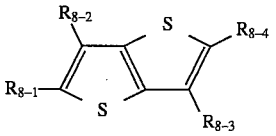
$R_{8-3}$:
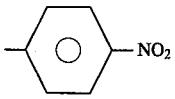
$R_{8-4}$: $-CH_3$
Compound 8-(80)
$R_{8-1}$: $-C_2H_5$
$R_{8-2}$:
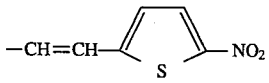
$R_{8-3}$:
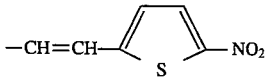
$R_{8-4}$: $-C_2H_5$
Compound 8-(81)
$R_{8-1}$:
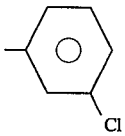
$R_{8-2}$:
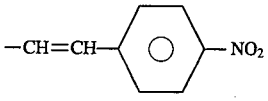
$R_{8-3}$:
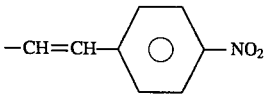
$R_{8-4}$:
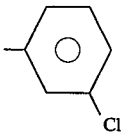
Compound 8-(82)
$R_{8-1}$:
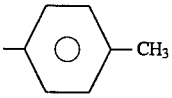
$R_{8-2}$:
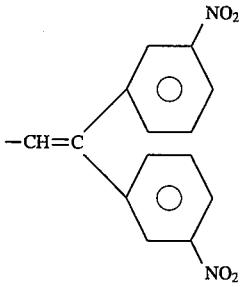
Basic constitution (Formula (8))
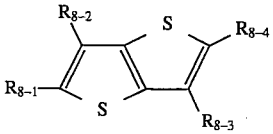
$R_{8-3}$:
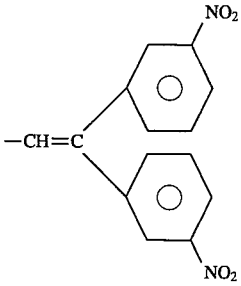
$R_{8-4}$:
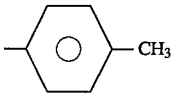
Compound 8-(83)
$R_{8-1}$:
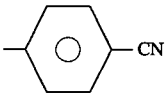
$R_{8-2}$:
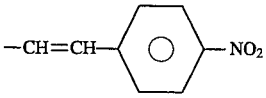
$R_{8-3}$:
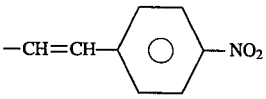
$R_{8-4}$:
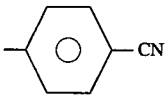
Compound 8-(84)
$R_{8-1}$: $-NO_2$
$R_{8-2}$: $-H$
$R_{8-3}$:
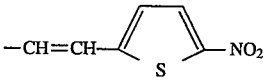
$R_{8-4}$: $-H$
Basic constitution (Formula (9))
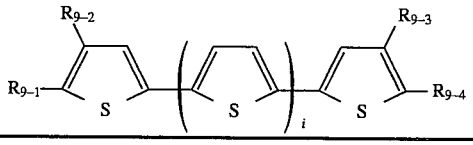
Compound 9-(1)
$R_{9-1}$: $-CH=CH-NO_2$
$R_{9-2}$: $-H$ Basic constitution (Formula (9))

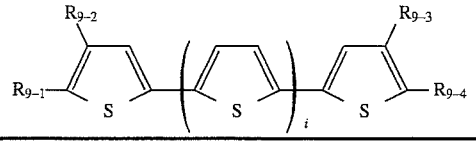

$R_{9-3}$: —H
$R_{9-4}$: —CH—CH=$NO_2$
i: 1

Compound 9-(2)

$R_{9-1}$: —CH=CH=$NO_2$
$R_{9-2}$: —H
$R_{9-3}$: —H $R_{9-4}$:

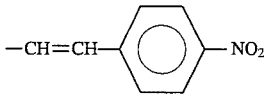

i: 1

Compound 9-(3)

$R_{9-1}$: —CH=CH=$NO_2$
$R_{9-2}$: —H
$R_{9-3}$: —H $R_{9-4}$:

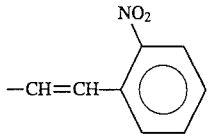

i: 1

Compound 9-(4)

$R_{9-1}$: —CH=CH=$NO_2$
$R_{9-2}$: —H
$R_{9-3}$: —H
$R_{9-4}$: —CH=CH=$NO_2$
i: 1

Compound 9-(5)

$R_{9-1}$: —CH=CH=$NO_2$
$R_{9-2}$: —H
$R_{9-3}$: —H $R_{9-4}$:

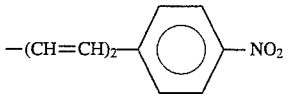

i: 1

Compound 9-(6)

$R_{9-1}$: —CH=CH=$NO_2$
$R_{9-2}$: —H
$R_{9-3}$: —H $R_{9-4}$:

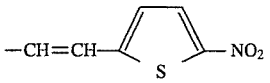

i: 1

Compound 9-(7)

$R_{9-1}$: —CH=CH=$NO_2$
$R_{9-2}$: —H
$R_{9-3}$: —H

Basic constitution (Formula (9))

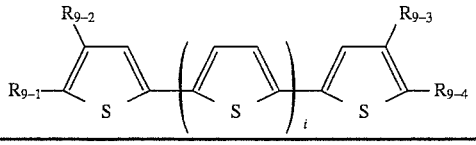

$R_{9-4}$:

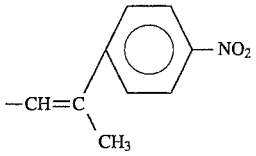

i: 1

Compound 9-(8)

$R_{9-1}$: —CH=CH=$NO_2$
$R_{9-2}$: —H
$R_{9-3}$: —H $R_{9-4}$:

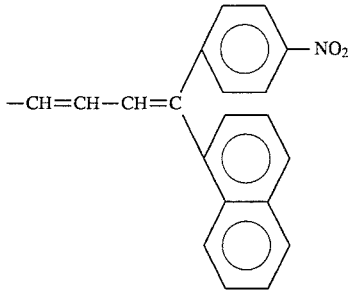

i: 1

Compound 9-(9)

$R_{9-1}$: —CH=CH=$NO_2$
$R_{9-2}$: —H
$R_{9-3}$: —H $R_{9-4}$:

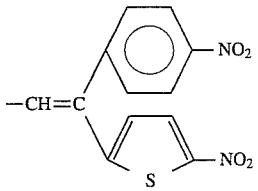

i: 1

Compound 9-(10)

$R_{9-1}$: —CH=CH=$NO_2$
$R_{9-2}$: —H
$R_{9-3}$: —H $R_{9-4}$:

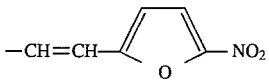

i: 1

Compound 9-(11)

$R_{9-1}$: —CH=CH=$NO_2$
$R_{9-2}$: —H
$R_{9-3}$: —H

Basic constitution (Formula (9))

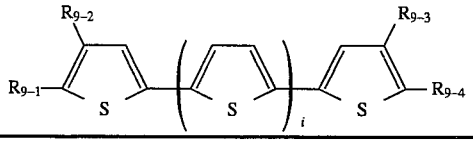

$R_{9-4}$:

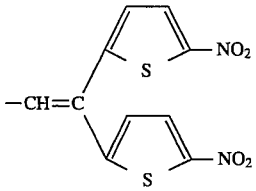

i: 1

Compound 9-(12)

$R_{9-1}$: $-CH=CH=NO_2$
$R_{9-2}$: $-H$
$R_{9-3}$: $-H$ $R_{9-4}$:

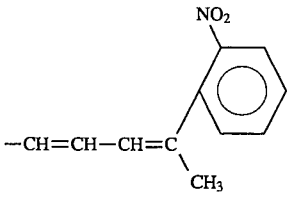

i: 1

Compound 9-(13)

$R_{9-1}$: $-CH=CH=NO_2$
$R_{9-2}$: $-H$
$R_{9-3}$: $-H$ $R_{9-4}$:

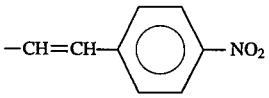

i: 1

Compound 9-(14)

$R_{9-1}$: $-(CH=CH)_2-NO_2$
$R_{9-2}$: $-H$
$R_{9-3}$: $-H$
$R_{9-4}$: $-(CH=CH)_2-NO_2$
i: 1

Compound 9-(15)

$R_{9-1}$: $-(CH=CH)_2-NO_2$
$R_{9-2}$: $-H$
$R_{9-3}$: $-H$ $R_{9-4}$:

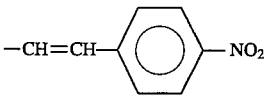

i: 1

Compound 9-(16)

$R_{9-1}$: $-(CH=CH)_2-NO_2$
$R_{9-2}$: $-H$
$R_{9-3}$: $-H$ $R_{9-4}$:

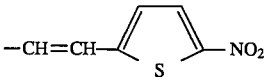

Basic constitution (Formula (9))

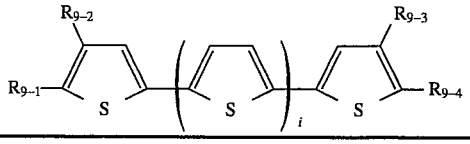

i: 1

Compound 9-(17)

$R_{9-1}$: $-(CH=CH)_2-NO_2$
$R_{9-2}$: $-H$
$R_{9-3}$: $-H$ $R_{9-4}$:

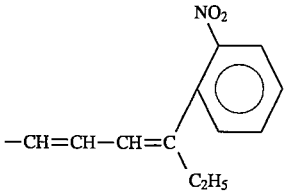

i: 1

Compound 9-(18)

$R_{9-1}$: $-(CH=CH)_2-NO_2$
$R_{9-2}$: $-H$
$R_{9-3}$: $-H$ $R_{9-4}$:

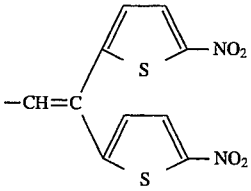

i: 1

Compound 9-(19)

$R_{9-1}$: $-(CH=CH)_2-NO_2$
$R_{9-2}$: $-H$
$R_{9-3}$: $-H$ $R_{9-4}$:

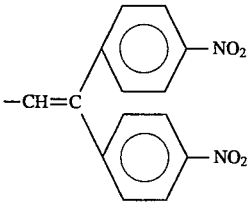

i: 1

Compound 9-(20)

$R_{9-1}$:

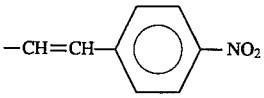

$R_{9-2}$: $-H$
$R_{9-3}$: $-H$ $R_{9-4}$:

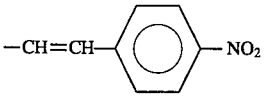

i: 1

Basic constitution (Formula (9))
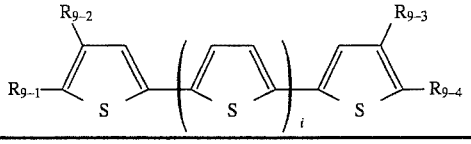
Compound 9-(21)
$R_{9-1}$:
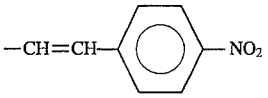
$R_{9-2}$: —H
$R_{9-3}$: —H
$R_{9-4}$:
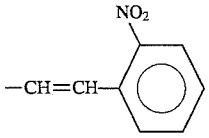
i: 1
Compound 9-(22)
$R_{9-1}$:
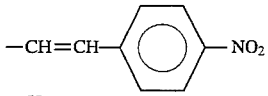
$R_{9-2}$: —H
$R_{9-3}$: —H
$R_{9-4}$:
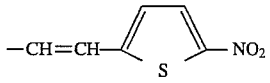
i: 1
Compound 9-(23)
$R_{9-1}$:
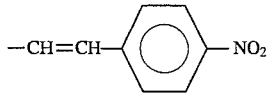
$R_{9-2}$: —H
$R_{9-3}$: —H
$R_{9-4}$:
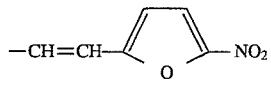
i: 1
Compound 9-(24)
$R_{9-1}$:
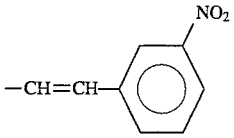
$R_{9-2}$: —H
$R_{9-3}$: —H
$R_{9-4}$:
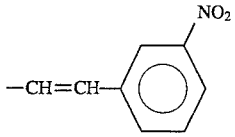
i: 1
Basic constitution (Formula (9))
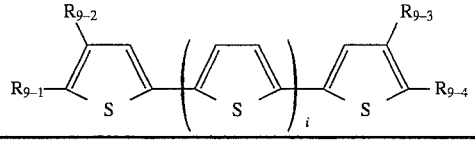
Compound 9-(25)
$R_{9-1}$:
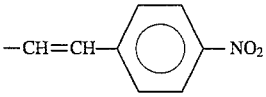
$R_{9-2}$: —H
$R_{9-3}$: —H
$R_{9-4}$:
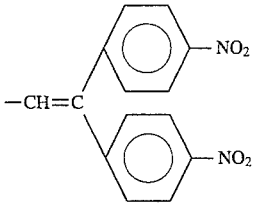
i: 1
Compound 9-(26)
$R_{9-1}$:
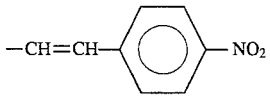
$R_{9-2}$: —H
$R_{9-3}$: —H
$R_{9-4}$:
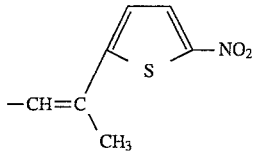
i: 1
Compound 9-(27)
$R_{9-1}$:
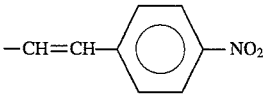
$R_{9-2}$: —H
$R_{9-3}$: —H
$R_{9-4}$:
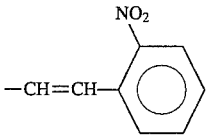
i: 1
Compound 9-(28)
$R_{9-1}$:
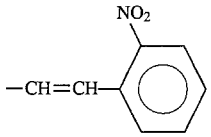
$R_{9-2}$: —H
$R_{9-3}$: —H Basic constitution (Formula (9))
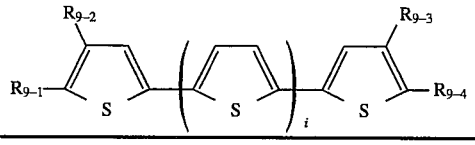
$R_{9-4}$:
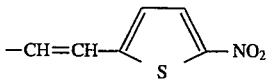
i: 1
Compound 9-(29)
$R_{9-1}$:
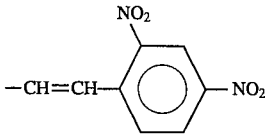
$R_{9-2}$: —H
$R_{9-3}$: —H
$R_{9-4}$: $-(CH=CH)_2-NO_2$
i: 1
Compound 9-(30)
$R_{9-1}$:
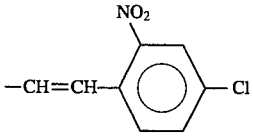
$R_{9-2}$: —H
$R_{9-3}$: —H
$R_{9-4}$:
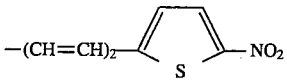
i: 1
Compound 9-(31)
$R_{9-1}$:
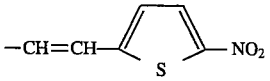
$R_{9-2}$: —H
$R_{9-3}$: —H
$R_{9-4}$:
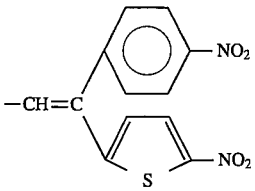
i: 1
Compound 9-(32)
$R_{9-1}$:
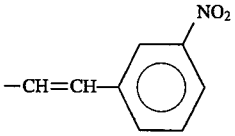
$R_{9-2}$: —H
Basic constitution (Formula (9))
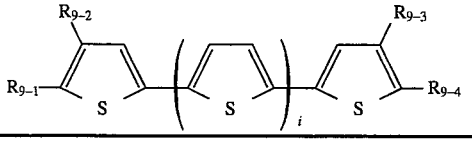
$R_{9-3}$: —H
$R_{9-4}$:
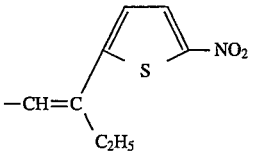
i: 1
Compound 9-(33)
$R_{9-1}$:
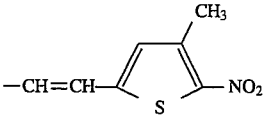
$R_{9-2}$: —H
$R_{9-3}$: —H
$R_{9-4}$:
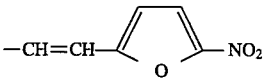
i: 2
Compound 9-(34)
$R_{9-1}$:
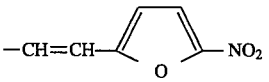
$R_{9-2}$: —H
$R_{9-3}$: —H
$R_{9-4}$:
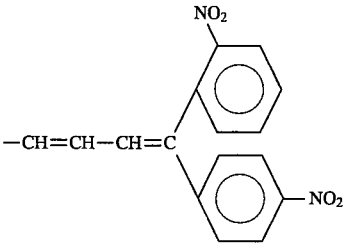
i: 1
Compound 9-(35)
$R_{9-1}$:
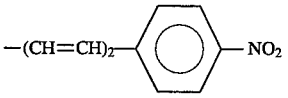
$R_{9-2}$: —H
$R_{9-3}$: —H
$R_{9-4}$:
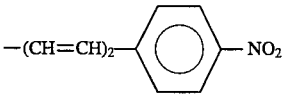
i: 1

Basic constitution (Formula (9))

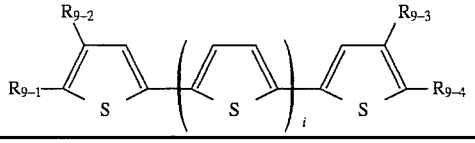

Compound 9-(36)

$R_{9-1}$:

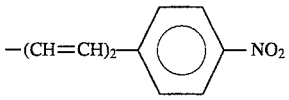

$R_{9-2}$: —H
$R_{9-3}$: —H $R_{9-4}$:

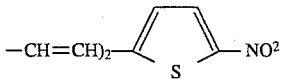

i: 1

Compound 9-(37)

$R_{9-1}$:

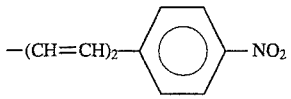

$R_{9-2}$: —H
$R_{9-3}$: —H $R_{9-4}$:

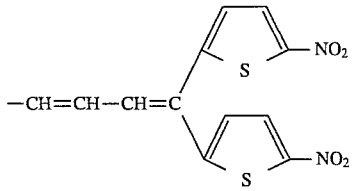

i: 1

Compound 9-(38)

$R_{9-1}$:

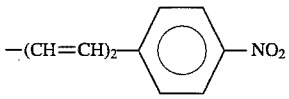

$R_{9-2}$: —H
$R_{9-3}$: —H $R_{9-4}$:

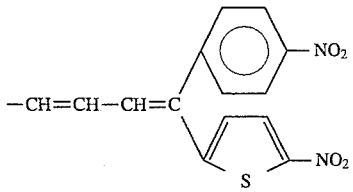

i: 1

Compound 9-(39)

$R_{9-1}$:

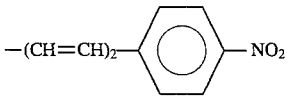

$R_{9-2}$: —H
$R_{9-3}$: —H

Basic constitution (Formula (9))

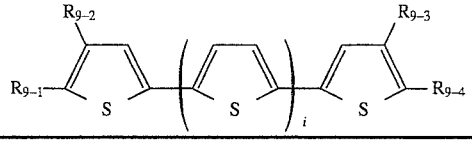

$R_{9-4}$:

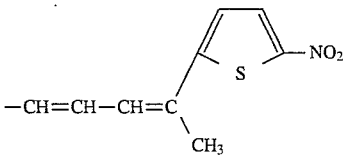

i: 2

Compound 9-(40)

$R_{9-1}$: —CH=CH—$NO_2$
$R_{9-2}$: —H
$R_{9-3}$: —H
$R_{9-4}$: —CH=CH—$NO_2$
i: 2

Compound 9-(41)

$R_{9-1}$: —CH=CH—$NO_2$
$R_{9-2}$: —Cl
$R_{9-3}$: —H
$R_{9-4}$: —CH=CH—$NO_2$
i: 2

Compound 9-(42)

$R_{9-1}$: —CH=CH—$NO_2$
$R_{9-2}$: —Br
$R_{9-3}$: —H $R_{9-4}$:

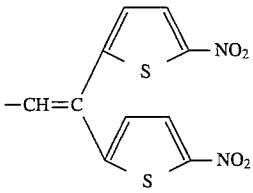

i: 1

Compound 9-(43)

$R_{9-1}$: —CH=CH—$NO_2$
$R_{9-2}$: —Cl
$R_{9-3}$: —Cl $R_{9-4}$:

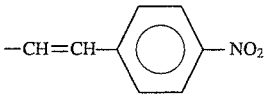

i: 1

Compound 9-(44)

$R_{9-1}$:

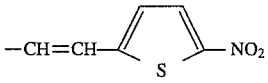

$R_{9-2}$: —Br
$R_{9-3}$: —H $R_{9-4}$:

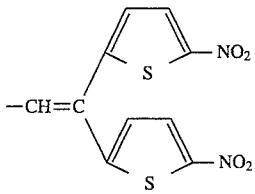

Basic constitution (Formula (9))
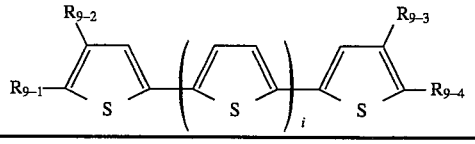
i: 1
Compound 9-(45)
$R_{9-1}$:
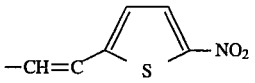
$R_{9-2}$: —H
$R_{9-3}$: —H
$R_{9-4}$:
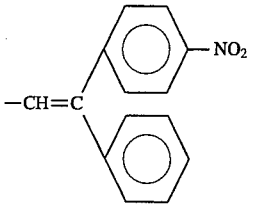
i: 1
Compound 9-(46)
$R_{9-1}$:
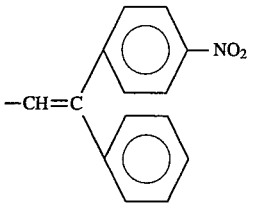
$R_{9-2}$: —H
$R_{9-3}$: —H
$R_{9-4}$:
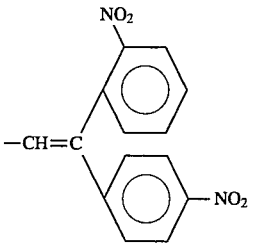
i: 1
Compound 9-(47)
$R_{9-1}$:
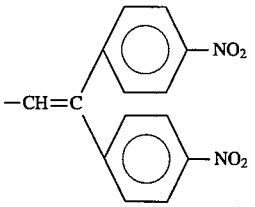
$R_{9-2}$: —H
$R_{9-3}$: —H
Basic constitution (Formula (9))
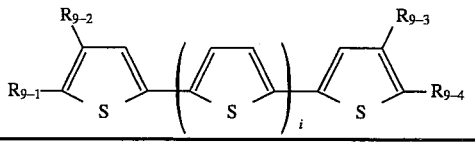
$R_{9-4}$:
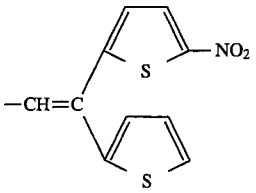
i: 1
Compound 9-(48)
$R_{9-1}$:
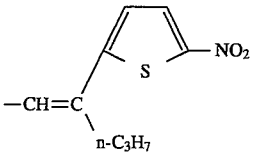
$R_{9-2}$: —H
$R_{9-3}$: —H
$R_{9-4}$:
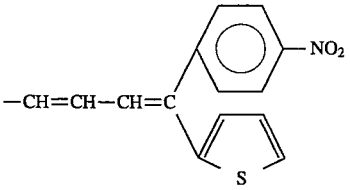
i: 1
Compound 9-(49)
$R_{9-1}$:
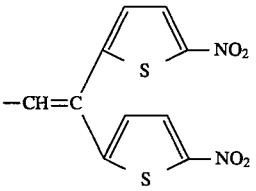
$R_{9-2}$: —H
$R_{9-3}$: —H
$R_{9-4}$:
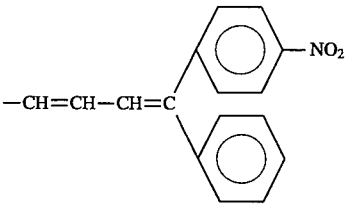
i: 1
Compound 9-(50)
$R_{9-1}$:
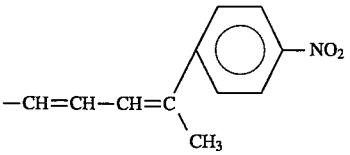

Basic constitution (Formula (9))
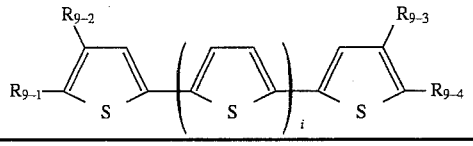
$R_{9-2}$: —H
$R_{9-3}$: —H
$R_{9-4}$:
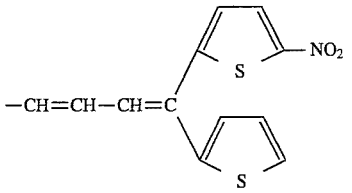
i: 1
Compound 9-(51)
$R_{9-1}$:
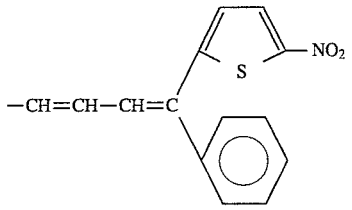
$R_{9-2}$: —H
$R_{9-3}$: —H
$R_{9-4}$:
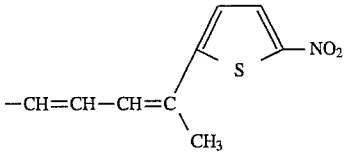
i: 1
Compound 9-(52)
$R_{9-1}$:
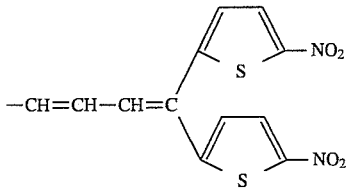
$R_{9-2}$: —H
$R_{9-3}$: —H
$R_{9-4}$:
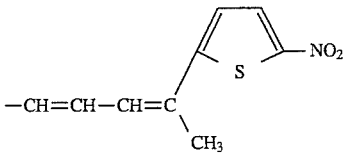
i: 2
Compound 9-(53)
$R_{9-1}$: —CH=CH—$NO_2$
$R_{9-2}$: —$CH_3$
$R_{9-3}$: —H
Basic constitution (Formula (9))
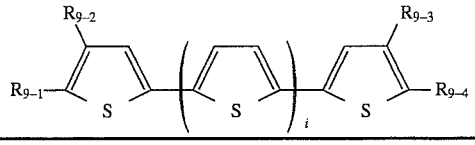
$R_{9-4}$:
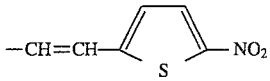
i: 1
Compound 9-(54)
$R_{9-1}$:
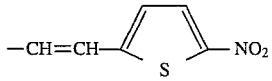
$R_{9-2}$: —$C_2H_5$
$R_{9-3}$: —H
$R_{9-4}$:
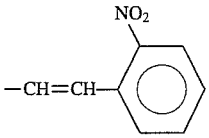
i: 1
Compound 9-(55)
$R_{9-1}$:
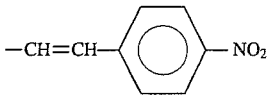
$R_{9-2}$: —$C_4H_9$(t)
$R_{9-3}$: —H
$R_{9-4}$:
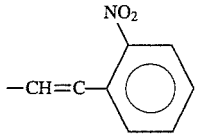
i: 1
Compound 9-(56)
$R_{9-1}$: —CH=CH—$NO_2$
$R_{9-2}$: —$CH_3$
$R_{9-3}$: —$CH_3$
$R_{9-4}$:
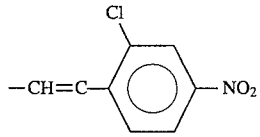
i: 1
Compound 9-(57)
$R_{9-1}$:
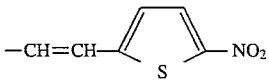
$R_{9-2}$: —$C_4H_9$(t)
$R_{9-3}$: —$CH_3$
$R_{9-4}$:
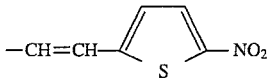
i: 1

Basic constitution (Formula (9))

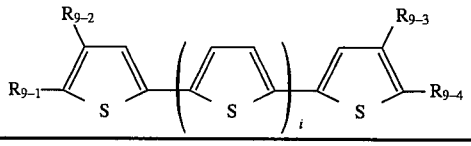

Compound 9-(58)

$R_{9-1}$: $-CH=CH-NO_2$
$R_{9-2}$: $-CH=CH-NO_2$
$R_{9-3}$: $-H$
$R_{9-4}$:

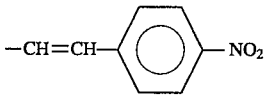

i: 1

Compound 9-(59)

$R_{9-1}$:

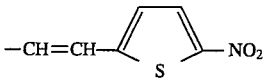

$R_{9-2}$: $-CH=CH-NO_2$
$R_{9-3}$: $-H$
$R_{9-4}$:

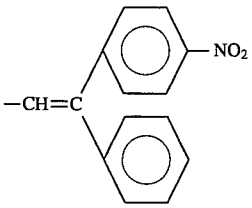

i: 1

Compound 9-(60)

$R_{9-1}$: $-CH=CH-NO_2$
$R_{9-2}$:

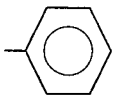

$R_{9-3}$: $-CH_3$
$R_{9-4}$:

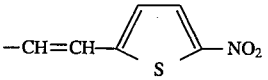

i: 1

Compound 9-(61)

$R_{9-1}$:

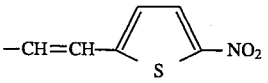

$R_{9-2}$: $-CH_2$
$R_{9-3}$: $-H$
$R_{9-4}$:

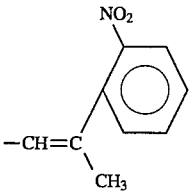

i: 1

Basic constitution (Formula (9))

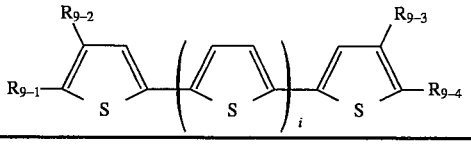

Compound 9-(62)

$R_{9-1}$: $-CH=CH-NO_2$
$R_{9-2}$:

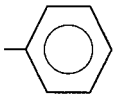

$R_{9-3}$: Cl
$R_{9-4}$: $-(CH=CH)_2-NO_2$
i: 1

Compound 9-(63)

$R_{9-1}$:

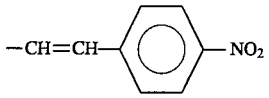

$R_{9-2}$: $-CH=CH-NO_2$
$R_{9-3}$: $-H$
$R_{9-4}$: $-C_4H_9(t)$
i: 1

Compound 9-(64)

$R_{9-1}$:

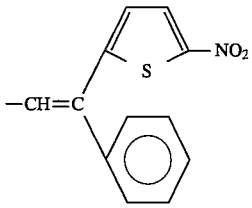

$R_{9-2}$: $-H$
$R_{9-3}$:

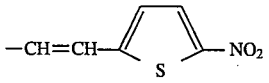

$R_{9-4}$: $-H$
i: 1

Compound 9-(65)

$R_{9-1}$:

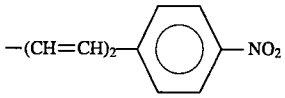

$R_{9-2}$: $-(CH=CH)_2-NO_2$
$R_{9-3}$: $-CH_3$
$R_{9-4}$: $-H$
i: 1

Compound 9-(66)

$R_{9-1}$: $-CH=CH-NO_2$
$R_{9-2}$:

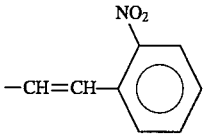

$R_{9-3}$: $-H$
$R_{9-4}$: $-H$
i: 2

Basic constitution (Formula (9))

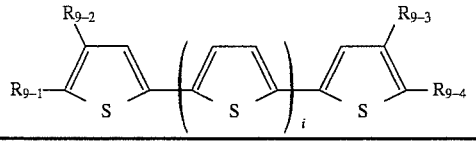

Compound 9-(67)

$R_{9-1}$: $-CH=CH-NO_2$ $R_{9-2}$:

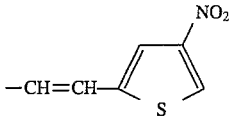

$R_{9-3}$: $-H$
$R_{9-4}$: $-H$
i: 1

Compound 9-(68)

$R_{9-1}$:

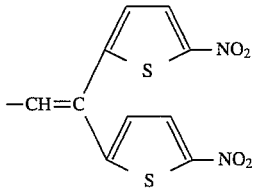

$R_{9-2}$: $-CH=CH-NO_2$
$R_{9-3}$: $-C_4H_9(t)$
$R_{9-4}$: $-H$
i: 1

Compound 9-(69)

$R_{9-1}$:

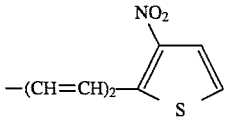

$R_{9-2}$: $-H$
$R_{9-3}$: $-CH=CH-NO_2$
$R_{9-4}$: $-CH_3$
i: 1

Compound 9-(70)

$R_{9-1}$: $-H$
$R_{9-2}$: $-CH=CH-NO_2$
$R_{9-3}$: $-CH=CH-NO_2$
$R_{9-4}$: $-H$
i: 1

Compound 9-(71)

$R_{9-1}$: $-H$ $R_{9-2}$:

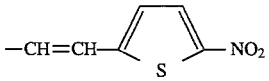

$R_{9-3}$:

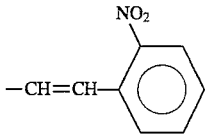

$R_{9-4}$: $-H$
i: 1

Compound 9-(72)

$R_{9-1}$: $-H$
$R_{9-2}$: $-CH=CH-NO_2$

Basic constitution (Formula (9))

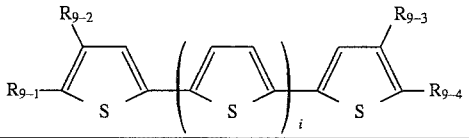

$R_{9-3}$:

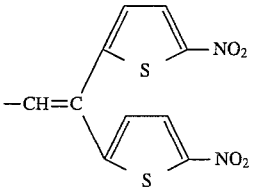

$R_{9-4}$: $-H$
i: 1

Compound 9-(73)

$R_{9-1}$: $-H$
$R_{9-2}$: $-CH=CH)_2-NO_2$ $R_{9-3}$:

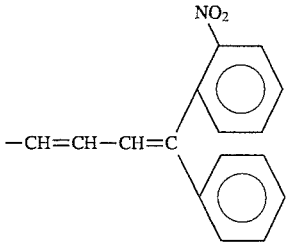

$R_{9-4}$: $-H$
i: 1

Compound 9-(74)

$R_{9-1}$: $-CH_3$ $R_{9-2}$:

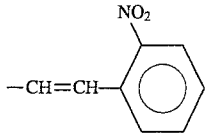

$R_{9-3}$: $-(CH=CH)_2-NO_2$
$R_{9-4}$: $-CH_3$
i: 1

Compound 9-(75)

$R_{9-1}$:

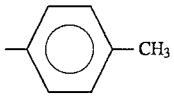

$R_{9-2}$:

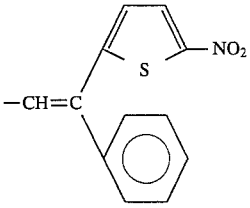

$R_{9-3}$: $-CH=CH-NO_2$
$R_{9-4}$: $-CH=CH-NO_2$
i: 1

Compound 9-(76)

$R_{9-1}$: $-CH=CH-NO_2$
$R_{9-2}$: $-CH_3$
$R_{9-3}$: $-H$

Basic constitution (Formula (9))
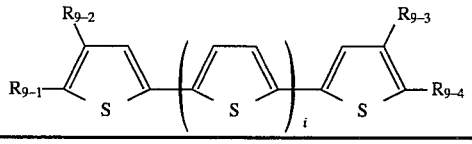
$R_{9-4}$:
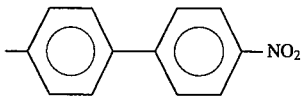
i: 1
Compound 9-(77)
$R_{9-1}$:
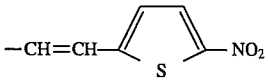
$R_{9-2}$: —H
$R_{9-3}$: —H
$R_{9-4}$:
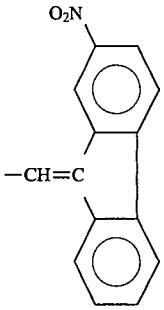
i: 1
Compound 9-(78)
$R_{9-1}$: —CH=CH—$NO_2$
$R_{9-2}$: —H
$R_{9-3}$: —H
$R_{9-4}$:
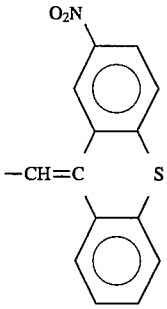
i: 1
Compound 9-(79)
$R_{9-1}$:
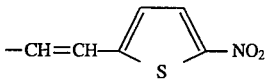
$R_{9-2}$: —H
$R_{9-3}$: —H
Basic constitution (Formula (9))
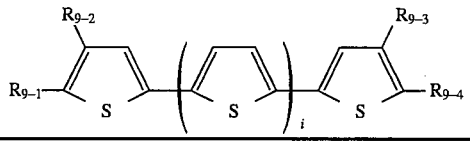
$R_{9-4}$:
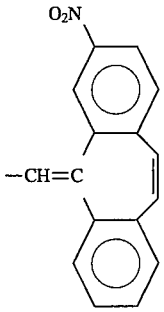
i: 1
Compound 9-(80)
$R_{9-1}$:
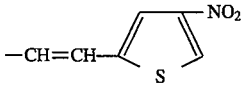
$R_{9-2}$: —H
$R_{9-3}$: —CH=CH—$NO_2$
$R_{9-4}$: —H
i: 1
Compound 9-(81)
$R_{9-1}$: —CH=CH—$NO_2$
$R_{9-2}$: —$CH_3$
$R_{9-3}$:
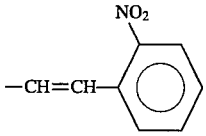
$R_{9-4}$: —H
i: 1
Compound 9-(82)
$R_{9-1}$: —$C_4H_9$(t)
$R_{9-2}$: —$(CH=CH)_2$—$NO_2$
$R_{9-3}$:
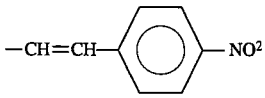
$R_{9-4}$: —H
i: 1
Compound 9-(83)
$R_{9-1}$: —$C_4H_9$(t)
$R_{9-2}$: —CH=CH—$NO_2$
$R_{9-3}$:
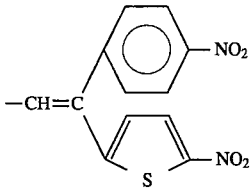
$R_{9-4}$: —H
i: 1

Basic constitution (Formula (9))
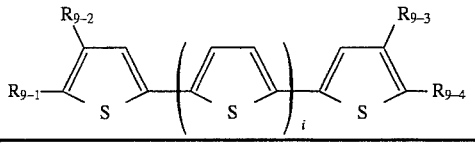
Compound 9-(84)
$R_{9-1}$:
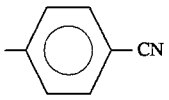
$R_{9-2}$: $-CH=CH-NO_2$
$R_{9-3}$: $-CH=CH-NO_2$
$R_{9-4}$:
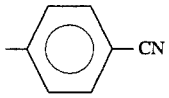
i: 1
Compound 9-(85)
$R_{9-1}$:
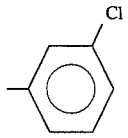
$R_{9-2}$: $-CH=CH-NO_2$
$R_{9-3}$:
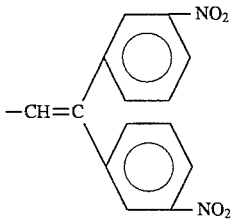
$R_{9-4}$:
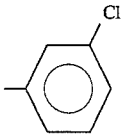
i: 1
Compound 9-(86)
$R_{9-1}$:
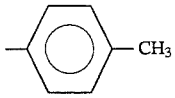
$R_{9-2}$:
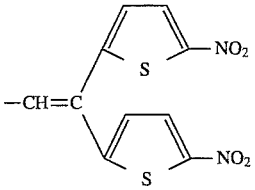
Basic constitution (Formula (9))
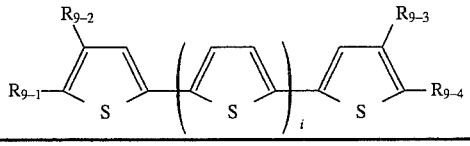
$R_{9-3}$:
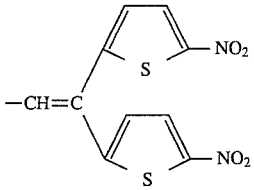
$R_{9-4}$:
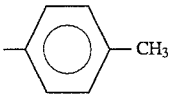
i: 1
Compound 9-(87)
$R_{9-1}$:
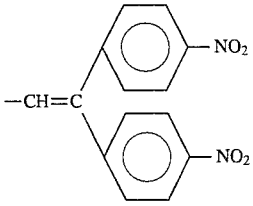
$R_{9-2}$: $-H$
$R_{9-3}$: $-CH=CH-NO_2$
$R_{9-4}$: $-C_2H_5$
i: 1
Compound 9-(88)
$R_{9-1}$:
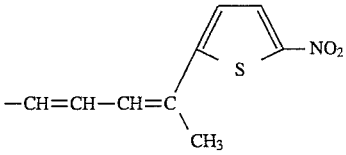
$R_{9-2}$: $-H$
$R_{9-3}$:
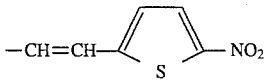
$R_{9-4}$: $-H$
i: 1
Compound 9-(89)
$R_{9-1}$: $-CH=CH-NO_2$
$R_{9-2}$: $-H$
$R_{9-3}$: $-H$
$R_{9-4}$: $-CH=CH-NO_2$
i: 2
Compound 9-(90)
$R_{9-1}$:
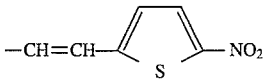
$R_{9-2}$: $-H$
$R_{9-3}$: $-CH_3$ Basic constitution (Formula (9))

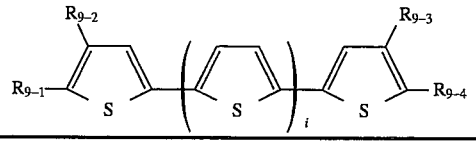

$R_{9-4}$:

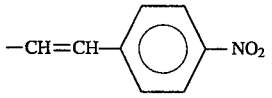

i: 2

Compound 9-(91)

$R_{9-1}$: $-(CH=CH)_2-NO_2$
$R_{9-2}$: $-H$
$R_{9-3}$: $-H$ $R_{9-4}$:

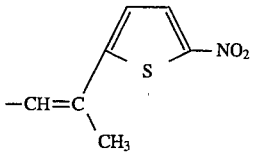

i: 2

Basic constitution (Formula (10))

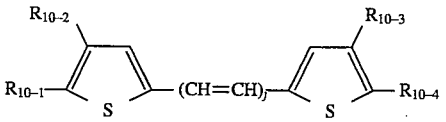

Compound 10-(1)

$R_{10-1}$: $-CH=CH-NO_2$
$R_{10-2}$: $-H$
$R_{10-3}$: $-H$
$R_{10-4}$: $-CH=CH-NO_2$
j: 1

Compound 10-(2)

$R_{10-1}$: $-CH=CH-NO_2$
$R_{10-2}$: $-H$
$R_{10-3}$: $-H$ $R_{10-4}$:

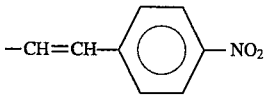

j: 1

Compound 10-(3)

$R_{10-1}$: $-CH=CH-NO_2$
$R_{10-2}$: $-H$
$R_{10-3}$: $-H$ $R_{10-4}$:

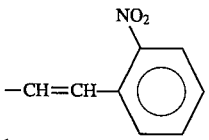

j: 1

Compound 10-(4)

$R_{10-1}$: $-CH=CH-NO_2$

Basic constitution (Formula (10))

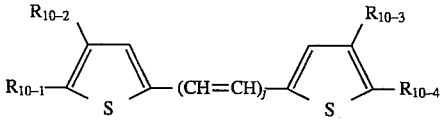

$R_{10-2}$: $-H$
$R_{10-3}$: $-H$
$R_{10-4}$: $-(CH=CH)_2-NO_2$
j: 1

Compound 10-(5)

$R_{10-1}$: $-CH=CH-NO_2$
$R_{10-2}$: $-H$
$R_{10-3}$: $-H$ $R_{10-4}$:

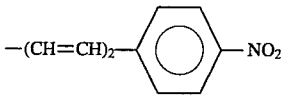

j: 1

Compound 10-(6)

$R_{10-1}$: $-CH=CH-NO_2$
$R_{10-2}$: $-H$
$R_{10-3}$: $-H$ $R_{10-4}$:

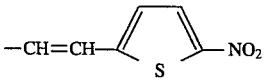

j: 1

Compound 10-(7)

$R_{10-1}$: $-CH=CH-NO_2$
$R_{10-2}$: $-H$
$R_{10-3}$: $-H$ $R_{10-4}$:

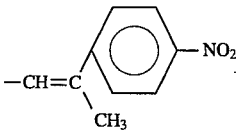

j: 1

Compound 10-(8)

$R_{10-1}$: $-CH=CH-NO_2$
$R_{10-2}$: $-H$
$R_{10-3}$: $-H$ $R_{10-4}$:

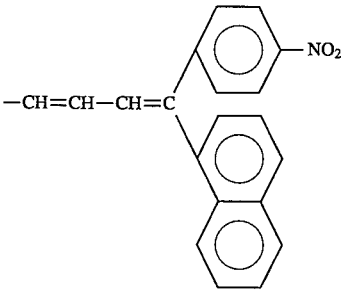

j: 1

Compound 10-(9)

$R_{10-1}$: $-CH=CH-NO_2$
$R_{10-2}$: $-H$
$R_{10-3}$: $-H$

Basic constitution (Formula (10))

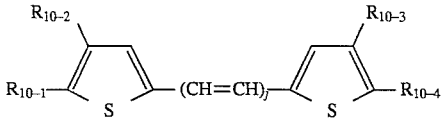

$R_{10-4}$:

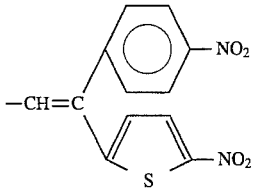

j: 1

Compound 10-(10)

$R_{10-1}$: $-CH=CH-NO_2$
$R_{10-2}$: $-H$
$R_{10-3}$: $-H$ $R_{10-4}$:

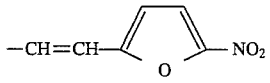

j: 1

Compound 10-(11)

$R_{10-1}$: $-CH=CH-NO_2$
$R_{10-2}$: $-H$
$R_{10-3}$: $-H$ $R_{10-4}$:

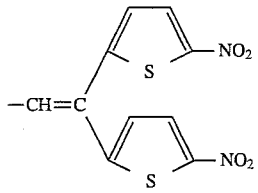

j: 1

Compound 10-(12)

$R_{10-1}$: $-CH=CH-NO_2$
$R_{10-2}$: $-H$
$R_{10-3}$: $-H$ $R_{10-4}$:

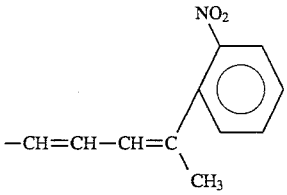

j: 1

Compound 10-(13)

$R_{10-1}$: $-CH=CH-NO_2$
$R_{10-2}$: $-H$
$R_{10-3}$: $-H$ $R_{10-4}$:

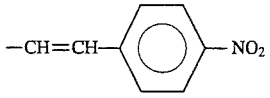

j: 1

Compound 10-(14)

$R_{10-1}$: $-(CH=CH)_2-NO_2$

Basic constitution (Formula (10))

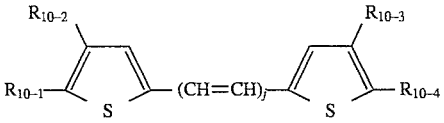

$R_{10-2}$: $-H$
$R_{10-3}$: $-H$
$R_{10-4}$: $-(CH=CH)_2-NO_2$
j: 1

Compound 10-(15)

$R_{10-1}$: $-(CH=CH)_2-NO_2$
$R_{10-2}$: $-H$
$R_{10-3}$: $-H$ $R_{10-4}$:

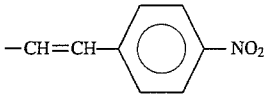

j: 1

Compound 10-(16)

$R_{10-1}$: $-(CH=CH)_2-NO_2$
$R_{10-2}$: $-H$
$R_{10-3}$: $-H$ $R_{10-4}$:

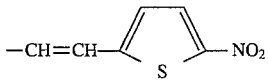

j: 1

Compound 10-(17)

$R_{10-1}$: $-(CH=CH)_2-NO_2$
$R_{10-2}$: $-H$
$R_{10-3}$: $-H$ $R_{10-4}$:

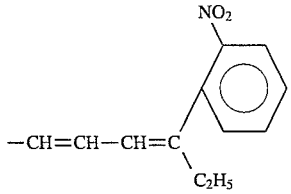

j: 1

Compound 10-(18)

$R_{10-1}$: $-(CH=CH)_2-NO_2$
$R_{10-2}$: $-H$
$R_{10-3}$: $-H$ $R_{10-4}$:

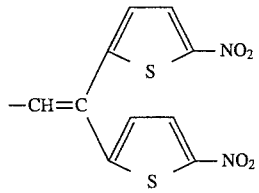

j: 2

Compound 10-(19)

$R_{10-1}$: $-(CH=CH)_2-NO_2$
$R_{10-2}$: $-H$
$R_{10-3}$: $-H$

Basic constitution (Formula (10))
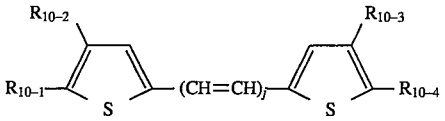
$R_{10-4}$:
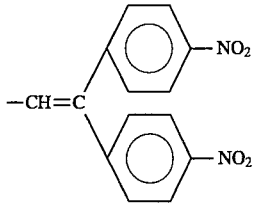
j: 1
Compound 10-(20)
$R_{10-1}$:
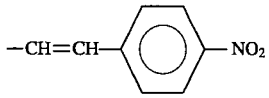
$R_{10-2}$: —H
$R_{10-3}$: —H
$R_{10-4}$:
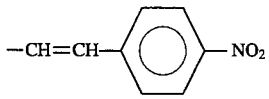
j: 1
Compound 10-(21)
$R_{10-1}$:
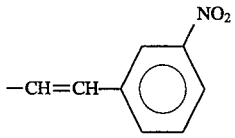
$R_{10-2}$: —H
$R_{10-3}$: —H
$R_{10-4}$:
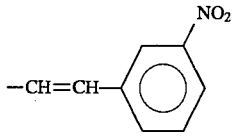
j: 1
Compound 10-(22)
$R_{10-1}$:
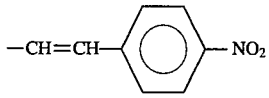
$R_{10-2}$: —H
$R_{10-3}$: —H
$R_{10-4}$:
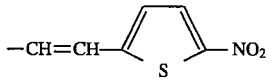
j: 1
Compound 10-(23)
$R_{10-1}$:
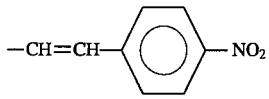
Basic constitution (Formula (10))
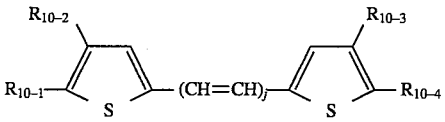
$R_{10-2}$: —H
$R_{10-3}$: —H
$R_{10-4}$:
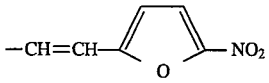
j: 1
Compound 10-(24)
$R_{10-1}$:
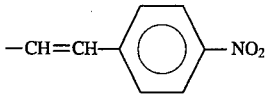
$R_{10-2}$: —H
$R_{10-3}$: —H
$R_{10-4}$:
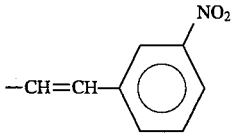
j: 2
Compound 10-(25)
$R_{10-1}$:
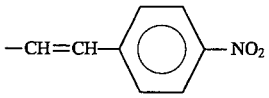
$R_{10-2}$: —H
$R_{10-3}$: —H
$R_{10-4}$:
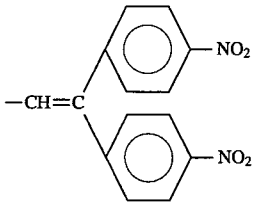
j: 1
Compound 10-(26)
$R_{10-1}$:
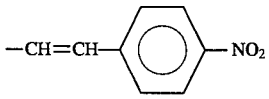
$R_{10-2}$: —H
$R_{10-3}$: —H
$R_{10-4}$:
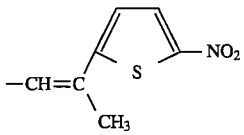
j: 1
Compound 10-(27)

Basic constitution (Formula (10))
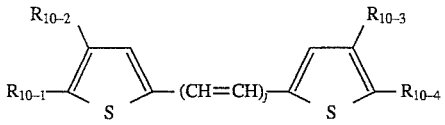
$R_{10-1}$:
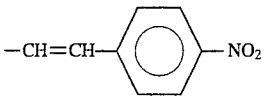
$R_{10-2}$: —H
$R_{10-3}$: —H
$R_{10-4}$:
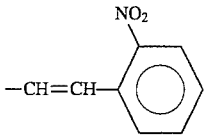
j: 1
Compound 10-(28)
$R_{10-1}$:
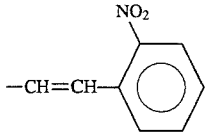
$R_{10-2}$: —H
$R_{10-3}$: —H
$R_{10-4}$:
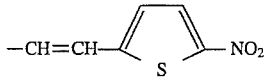
j: 1
Compound 10-(29)
$R_{10-1}$:
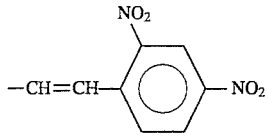
$R_{10-2}$: —H
$R_{10-3}$: —H
$R_{10-4}$: $-(CH=CH)_2-NO_2$
j: 1
Compound 10-(30)
$R_{10-1}$:
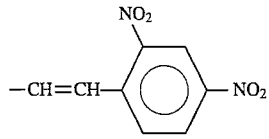
$R_{10-2}$: —H
$R_{10-3}$: —H
$R_{10-4}$:
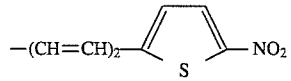
j: 1
Compound 10-(31)
$R_{10-1}$:
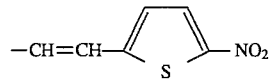
Basic constitution (Formula (10))
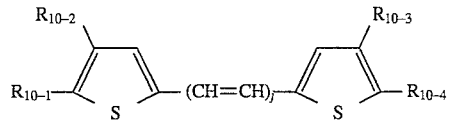
$R_{10-2}$: —H
$R_{10-3}$: —H
$R_{10-4}$:
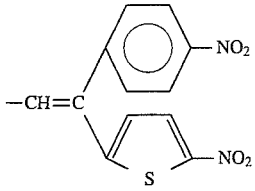
j: 1
Compound 10-(32)
$R_{10-1}$:
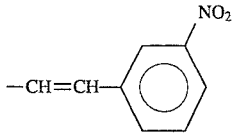
$R_{10-2}$: —H
$R_{10-3}$: —H
$R_{10-4}$:
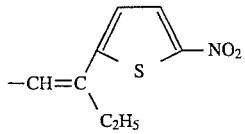
j: 1
Compound 10-(33)
$R_{10-1}$:
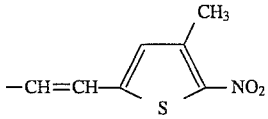
$R_{10-2}$: —H
$R_{10-3}$: —H
$R_{10-4}$:
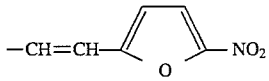
j: 2
Compound 10-(34)
$R_{10-1}$:
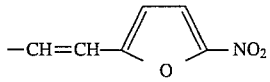
$R_{10-2}$: —H
$R_{10-3}$: —H
$R_{10-4}$:
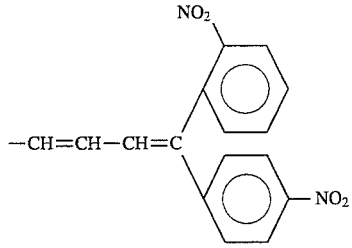

Basic constitution (Formula (10))

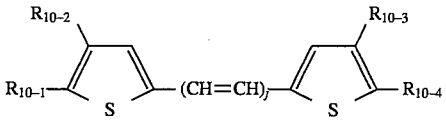

j: 1

Compound 10-(35)

$R_{10-1}$:

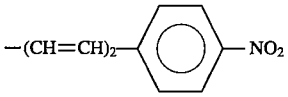

$R_{10-2}$: —H
$R_{10-3}$: —H $R_{10-4}$:

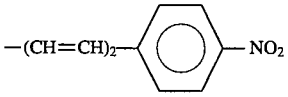

j: 1

Compound 10-(36)

$R_{10-1}$:

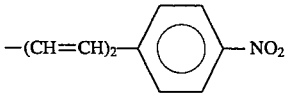

$R_{10-2}$: —H
$R_{10-3}$: —H $R_{10-4}$:

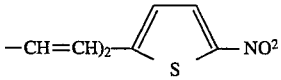

j: 1

Compound 10-(37)

$R_{10-1}$:

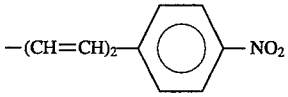

$R_{10-2}$: —H
$R_{10-3}$: —H $R_{10-4}$:

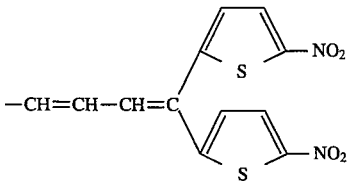

j: 1

Compound 10-(38)

$R_{10-1}$:

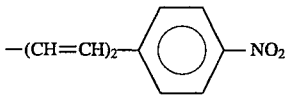

$R_{10-2}$: —H
$R_{10-3}$: —H

Basic constitution (Formula (10))

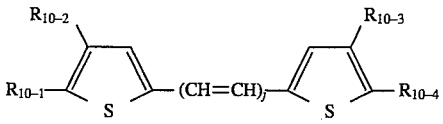

$R_{10-4}$:

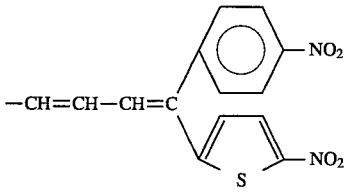

j: 1

Compound 10-(39)

$R_{10-1}$:

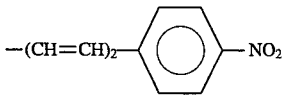

$R_{10-2}$: —H
$R_{10-3}$: —H $R_{10-4}$:

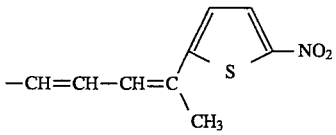

j: 2

Compound 10-(40)

$R_{10-1}$: —CH=CH—$NO_2$
$R_{10-2}$: —H
$R_{10-3}$: —H
$R_{10-4}$: —CH=CH—$NO_2$
j: 2

Compound 10-(41)

$R_{10-1}$: —CH=CH—$NO_2$
$R_{10-2}$: —Cl
$R_{10-3}$: —H
$R_{10-4}$: —CH=CH—$NO_2$
j: 2

Compound 10-(42)

$R_{10-1}$: —CH=CH—$NO_2$
$R_{10-2}$: —Br
$R_{10-3}$: —H $R_{10-4}$:

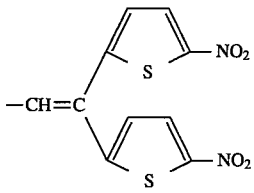

j: 1

Compound 10-(43)

$R_{10-1}$: —CH=CH—$NO_2$
$R_{10-2}$: —Cl
$R_{10-3}$: —Cl $R_{10-4}$:

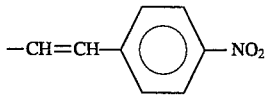

Basic constitution (Formula (10))
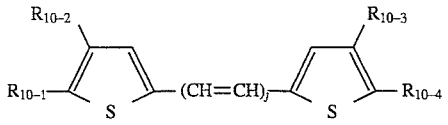
j: 1
Compound 10-(44)
$R_{10-1}$:
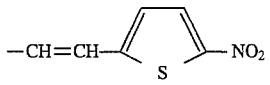
$R_{10-2}$: —Br
$R_{10-3}$: —H
$R_{10-4}$:
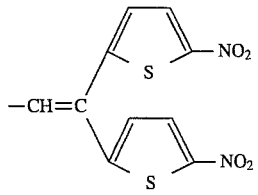
j: 1
Compound 10-(45)
$R_{10-1}$:
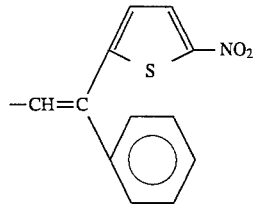
$R_{10-2}$: —H
$R_{10-3}$: —H
$R_{10-4}$:
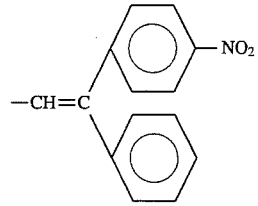
j: 1
Compound 10-(46)
$R_{10-1}$:
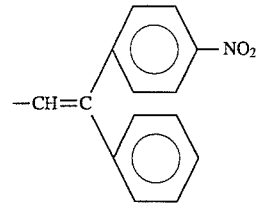
$R_{10-2}$: —H
$R_{10-3}$: —H
Basic constitution (Formula (10))
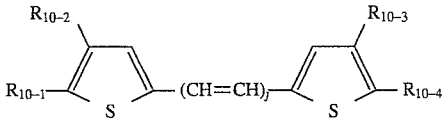
$R_{10-4}$:
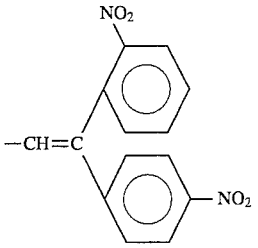
j: 1
Compound 10-(47)
$R_{10-1}$:
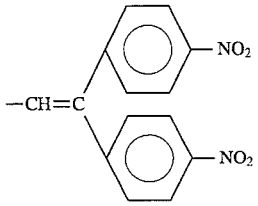
$R_{10-2}$: —H
$R_{10-3}$: —H
$R_{10-4}$:
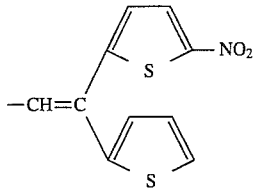
j: 1
Compound 10-(48)
$R_{10-1}$:
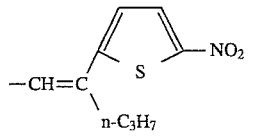
$R_{10-2}$: —H
$R_{10-3}$: —H
$R_{10-4}$:
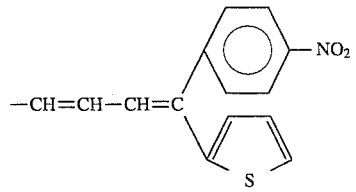
j: 1
Compound 10-(49)

-continued
Basic constitution (Formula (10))
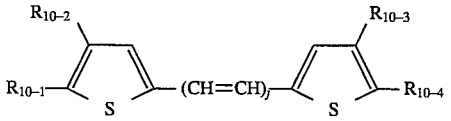
$R_{10-1}$:
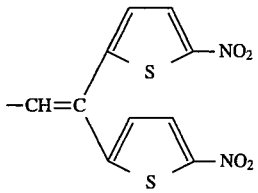
$R_{10-2}$: —H
$R_{10-3}$: —H
$R_{10-4}$:
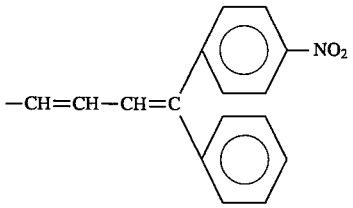
j: 1
Compound 10-(50)
$R_{10-1}$:
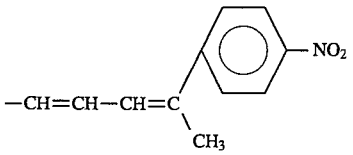
$R_{10-2}$: —H
$R_{10-3}$: —H
$R_{10-4}$:
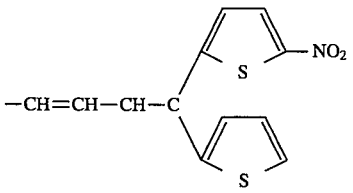
j: 1
Compound 10-(51)
$R_{10-1}$:
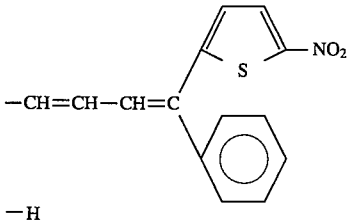
$R_{10-2}$: —H
$R_{10-3}$: —H
$R_{10-4}$:
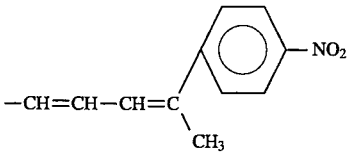
-continued
Basic constitution (Formula (10))
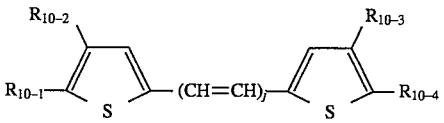
j: 1
Compound 10-(52)
$R_{10-1}$:
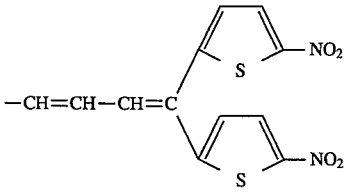
$R_{10-2}$: —H
$R_{10-3}$: —H
$R_{10-4}$:
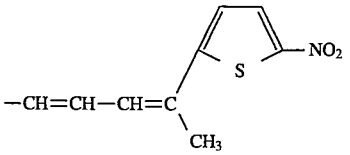
j: 2
Compound 10-(53)
$R_{10-1}$: —CH=CH—$NO_2$
$R_{10-2}$: —$CH_3$
$R_{10-3}$: —H
$R_{10-4}$:
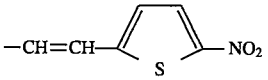
j: 1
Compound 10-(54)
$R_{10-1}$:
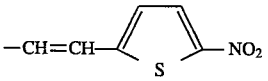
$R_{10-2}$: —$C_2H_5$
$R_{10-3}$: —H
$R_{10-4}$:
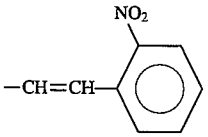
j: 1
Compound 10-(55)
$R_{10-1}$:
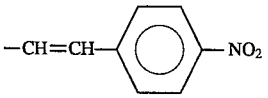
$R_{10-2}$: —$C_4H_9$(t)
$R_{10-3}$: —H Basic constitution (Formula (10))

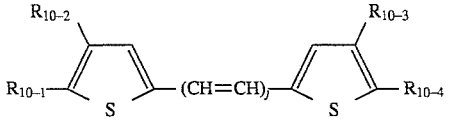

$R_{10-4}$:

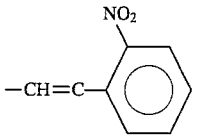

j: 1

Compound 10-(56)

$R_{10-1}$: $-CH=CH-NO_2$
$R_{10-2}$: $-CH_3$
$R_{10-3}$: $-CH_3$ $R_{10-4}$:

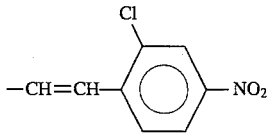

j: 1

Compound 10-(57)

$R_{10-1}$:

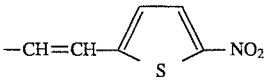

$R_{10-2}$: $C_4H_9(t)$
$R_{10-3}$: $-CH_3$ $R_{10-4}$:

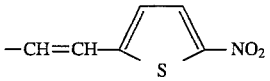

j: 1

Compound 10-(58)

$R_{10-1}$: $-CH=CH-NO_2$
$R_{10-2}$: $-CH=CH-NO_2$
$R_{10-3}$: $-H$ $R_{10-4}$:

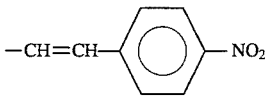

j: 1

Compound 10-(59)

$R_{10-1}$:

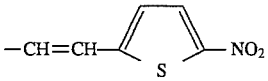

$R_{10-2}$: $-CH=CH-NO_2$
$R_{10-3}$: $-H$ $R_{10-4}$:

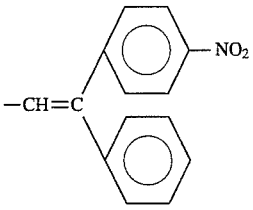

j: 1

Basic constitution (Formula (10))

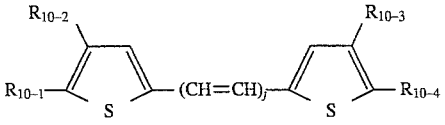

Compound 10-(60)

$R_{10-1}$: $-CH=CH-NO_2$ $R_{10-2}$:

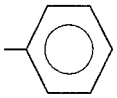

$R_{10-3}$: $-CH_3$ $R_{10-4}$:

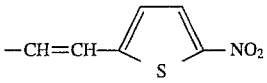

j: 1

Compound 10-(61)

$R_{10-1}$:

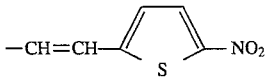

$R_{10-2}$:

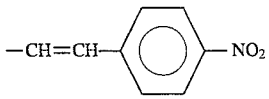

$R_{10-3}$: $-H$ $R_{10-4}$:

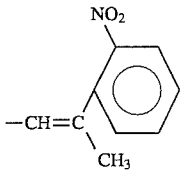

j: 1

Compound 10-(62)

$R_{10-1}$: $-CH=CH-NO_2$ $R_{10-2}$:

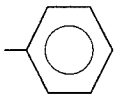

$R_{10-3}$:

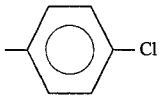

$R_{10-4}$: $-(CH=CH)_2-NO_2$
j: 1

Compound 10-(63)

$R_{10-1}$:

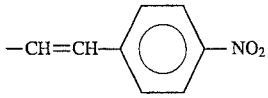

$R_{10-2}$: $-CH=CH-NO_2$ $R_{10-3}$: $-H$ $R_{10-4}$: $-C_4H_9(t)$
j: 1

Basic constitution (Formula (10))

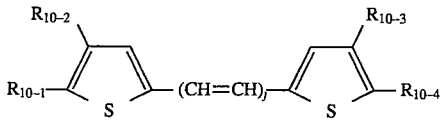

Compound 10-(64)

$R_{10-1}$:

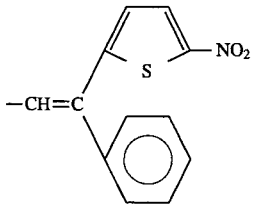

$R_{10-2}$: —H $R_{10-3}$:

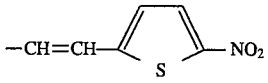

$R_{10-4}$: —H j: 1

Compound 10-(65)

$R_{10-1}$:

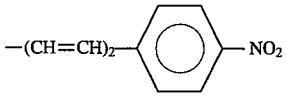

$R_{10-2}$: $-(CH=CH)_2-NO_2$ $R_{10-3}$: $-CH_3$ $R_{10-4}$: —H j: 1

Compound 10-(66)

$R_{10-1}$: $-CH=CH-NO_2$ $R_{10-2}$:

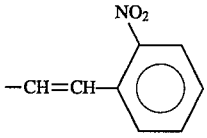

$R_{10-3}$: —H $R_{10-4}$: —H j: 2

Compound 10-(67)

$R_{10-1}$: $-CH=CH-NO_2$ $R_{10-2}$:

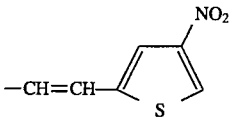

$R_{10-3}$: —H $R_{10-4}$: —H j: 1

Compound 10-(68)

$R_{10-1}$:

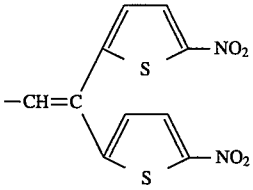

Basic constitution (Formula (10))

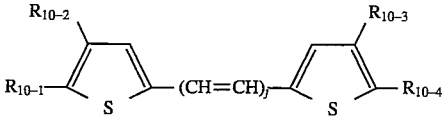

$R_{10-2}$: $-CH=CH-NO_2$ $R_{10-3}$: $-C_4H_9(t)$ $R_{10-4}$: —H j: 1

Compound 10-(69)

$R_{10-1}$:

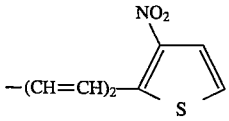

$R_{10-2}$: —H $R_{10-3}$: $-CH=CH-NO_2$ $R_{10-4}$: $-CH_3$ j: 1

Compound 10-(70)

$R_{10-1}$: —H $R_{10-2}$: $-CH=CH-NO_2$ $R_{10-3}$: $-CH=CH-NO_2$ $R_{10-4}$: —H j: 1

Compound 10-(71)

$R_{10-1}$: —H $R_{10-2}$:

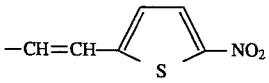

$R_{10-3}$:

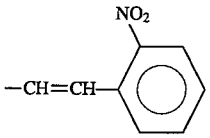

$R_{10-4}$: —H j: 1

Compound 10-(72)

$R_{10-1}$: —H $R_{10-2}$: $-CH=CH-NO_2$ $R_{10-3}$:

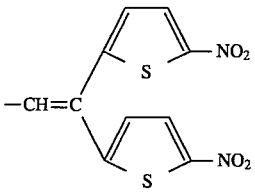

$R_{10-4}$: —H j: 1

Compound 10-(73)

$R_{10-1}$: —H $R_{10-2}$: $-(CH=CH)_2-NO_2$

Basic constitution (Formula (10))
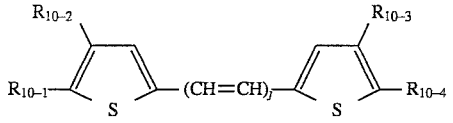
$R_{10-3}$:
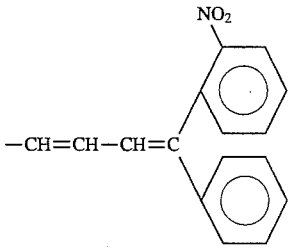
$R_{10-4}$: —H
j: 1
Compound 10-(74)
$R_{10-1}$: $-CH_3$
$R_{10-2}$:
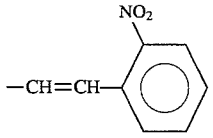
$R_{10-3}$: $-(CH=CH)_2-NO_2$
$R_{10-4}$: $-CH_3$
j: 1
Compound 10-(75)
$R_{10-1}$:
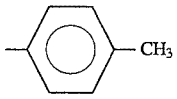
$R_{10-2}$:
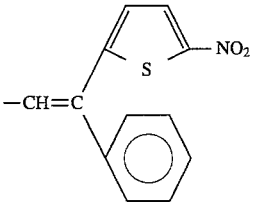
$R_{10-3}$: $-CH=CH-NO_2$
$R_{10-4}$: $-CH=CH-NO_2$
j: 1
Compound 10-(76)
$R_{10-1}$: $-CH=CH-NO_2$
$R_{10-2}$: $-CH_3$
$R_{10-3}$: —H
$R_{10-4}$:
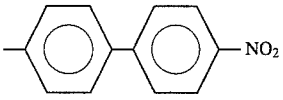
j: 1
Compound 10-(77)
$R_{10-1}$:
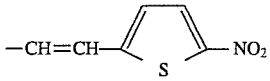
$R_{10-2}$: —H
$R_{10-3}$: —H
Basic constitution (Formula (10))
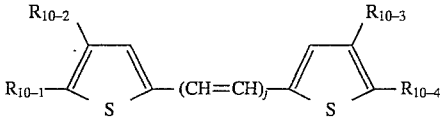
$R_{10-4}$:
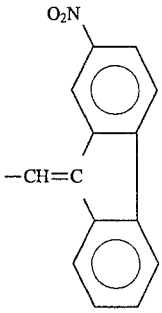
j: 1
Compound 10-(78)
$R_{10-1}$: $-CH=CH-NO_2$
$R_{10-2}$: —H
$R_{10-3}$: —H
$R_{10-4}$:
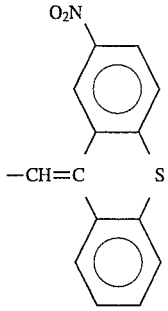
j: 1
Compound 10-(79)
$R_{10-1}$:
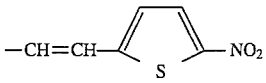
$R_{10-2}$: —H
$R_{10-3}$: —H
$R_{10-4}$:
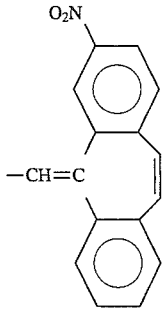
j: 1
Compound 10-(80)
$R_{10-1}$:
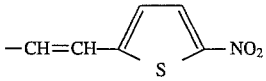

Basic constitution (Formula (10))
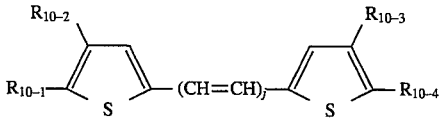
$R_{10-2}$: —H
$R_{10-3}$: —CH=CH—$NO_2$
$R_{10-4}$: —H
j: 1
Compound 10-(81)
$R_{10-1}$: —CH=CH—$NO_2$
$R_{10-2}$: —$CH_3$
$R_{10-3}$:
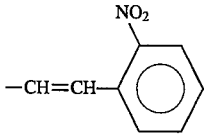
$R_{10-4}$: —H
j: 1
Compound 10-(82)
$R_{10-1}$: —$C_4H_9$(t)
$R_{10-2}$: —$(CH=CH)_2$—$NO_2$
$R_{10-3}$:
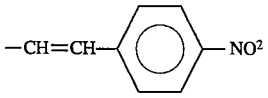
$R_{10-4}$: —H
j: 1
Compound 10-(83)
$R_{10-1}$: —$C_4H_9$(t)
$R_{10-2}$: —CH=CH—$NO_2$
$R_{10-3}$:
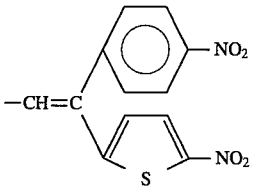
$R_{10-4}$: —H
j: 1
Compound 10-(84)
$R_{10-1}$:
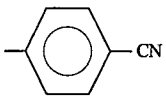
$R_{10-2}$: —CH=CH—$NO_2$
$R_{10-3}$: —CH=CH—$NO_2$
$R_{10-4}$:
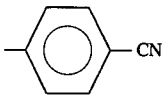
j: 1
Basic constitution (Formula (10))
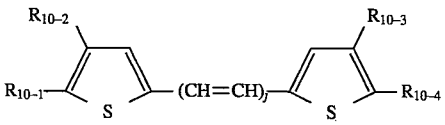
Compound 10-(85)
$R_{10-1}$:
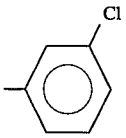
$R_{10-2}$: —CH=CH—$NO_2$
$R_{10-3}$:
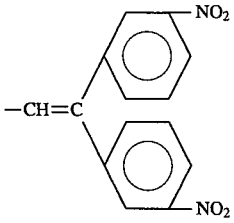
$R_{10-4}$:
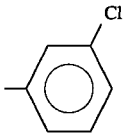
j: 1
Compound 10-(86)
$R_{10-1}$:
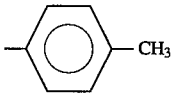
$R_{10-2}$:
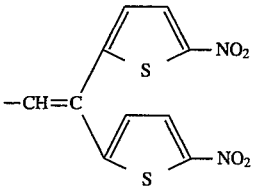
$R_{10-3}$:
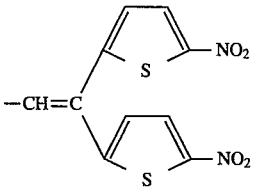
$R_{10-4}$:
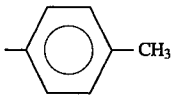
j: 1

-continued

Basic constitution (Formula (10))

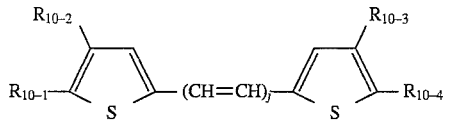

Compound 10-(87)

$R_{10-1}$:

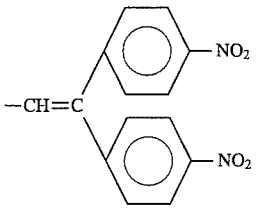

$R_{10-2}$: —H
$R_{10-3}$: —CH=CH—$NO_2$
$R_{10-4}$: —$C_2H_5$
j: 1

Compound 10-(88)

$R_{10-1}$:

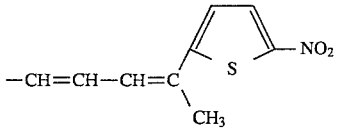

$R_{10-2}$: —H $R_{10-3}$:

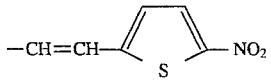

$R_{10-4}$: —H
j: 1

Compound 10-(89)

$R_{10-1}$: —CH=CH—$NO_2$
$R_{10-2}$: —H
$R_{10-3}$: —H
$R_{10-4}$: —CH=CH—$NO_2$
j: 2

Compound 10-(90)

$R_{10-1}$:

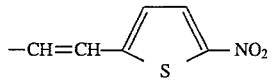

$R_{10-2}$: —H
$R_{10-3}$: —$CH_3$ $R_{10-4}$:

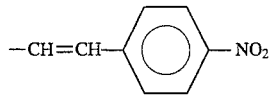

j: 2

Compound 10-(91)

$R_{10-1}$: —$(CH=CH)_2$—$NO_2$
$R_{10-2}$: —H
$R_{10-3}$: —H $R_{10-4}$:

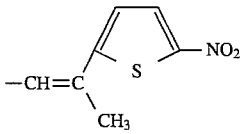

j: 2

Basic constitution (Formula (11))

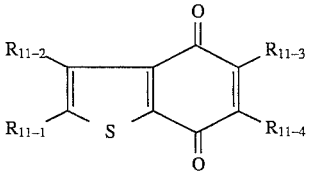

Compound 11-(1)

$R_{11-1}$: —$NO_2$
$R_{11-2}$: —H
$R_{11-3}$: —Cl
$R_{11-4}$: —Cl

Compound 11-(2)

$R_{11-1}$: —CH=CH—$NO_2$
$R_{11-2}$: —H
$R_{11-3}$: —Cl
$R_{11-4}$: —Cl

Compound 11-(3)

$R_{11-1}$: —$(CH=CH)_2$—$NO_2$
$R_{11-2}$: —H
$R_{11-3}$: —Cl
$R_{11-4}$: —Cl

Compound 11-(4)

$R_{11-1}$:

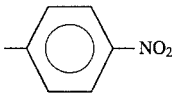

$R_{11-2}$: —H
$R_{11-3}$: —Cl
$R_{11-4}$: —Cl

Compound 11-(5)

$R_{11-1}$:

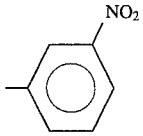

$R_{11-2}$: —H
$R_{11-3}$: —Cl
$R_{11-4}$: —Cl

Compound 11-(6)

$R_{11-1}$:

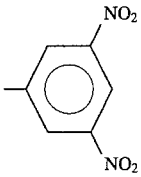

$R_{11-2}$: —H
$R_{11-3}$: —Cl
$R_{11-4}$: —Cl

Compound 11-(7)

$R_{11-1}$:

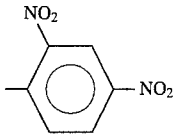

$R_{11-2}$: —H
$R_{11-3}$: —Cl
$R_{11-4}$: —Cl

Compound 11-(8)

Basic constitution (Formula (11))

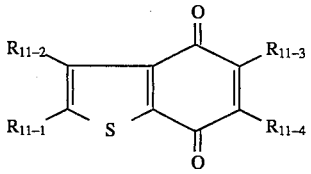

$R_{11-1}$: 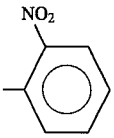

$R_{11-2}$: —H
$R_{11-3}$: —Cl
$R_{11-4}$: —Cl

Compound 11-(9)

$R_{11-1}$: 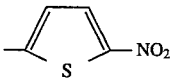

$R_{11-2}$: —H
$R_{11-3}$: —Cl
$R_{11-4}$: —Cl

Compound 11-(10)

$R_{11-1}$: 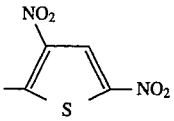

$R_{11-2}$: —H
$R_{11-3}$: —Cl
$R_{11-4}$: —Cl

Compound 11-(11)

$R_{11-1}$: 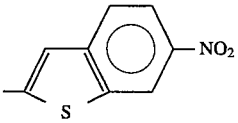

$R_{11-2}$: —H
$R_{11-3}$: —Cl
$R_{11-4}$: —Cl

Compound 11-(12)

$R_{11-1}$: 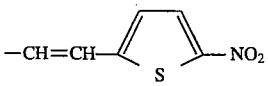

$R_{11-2}$: —H
$R_{11-3}$: —Cl
$R_{11-4}$: —Cl

Compound 11-(13)

$R_{11-1}$: 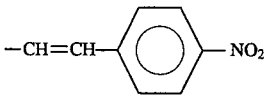

$R_{11-2}$: —H
$R_{11-3}$: —Cl
$R_{11-4}$: —Cl

Compound 11-(14)

$R_{11-1}$: 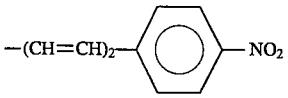

$R_{11-2}$: —H

Basic constitution (Formula (11))

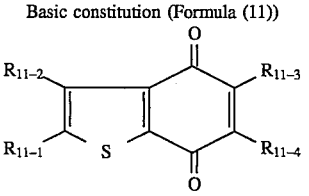

$R_{11-3}$: —Br
$R_{11-4}$: —Cl

Compound 11-(15)

$R_{11-1}$: 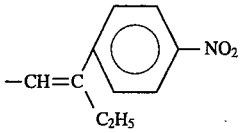

$R_{11-2}$: —H
$R_{11-3}$: —Br
$R_{11-4}$: —Br

Compound 11-(16)

$R_{11-1}$: 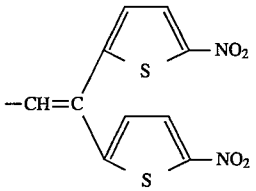

$R_{11-2}$: —H
$R_{11-3}$: —$CH_3$
$R_{11-4}$: —Cl

Compound 11-(17)

$R_{11-1}$: 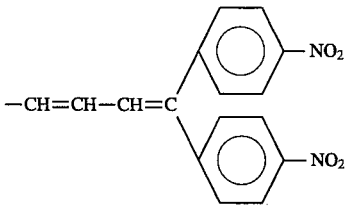

$R_{11-2}$: —H
$R_{11-3}$: —$C_4H_9$(t)
$R_{11-4}$: —$CH_3$

Compound 11-(18)

$R_{11-1}$: —CH=CH—$NO_2$ $R_{11-2}$: 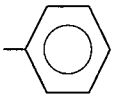

$R_{11-3}$: —$C_4H_9$(t)
$R_{11-4}$: —Cl

Compound 11-(19)

$R_{11-1}$: —CH=CH—$NO_2$ $R_{11-2}$: 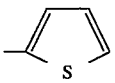

$R_{11-3}$: —Cl
$R_{11-4}$: —Cl

Compound 11-(20)

$R_{11-1}$: —CH=CH—$NO_2$
$R_{11-2}$: —$NO_2$
$R_{11-3}$: —Cl

Basic constitution (Formula (11))

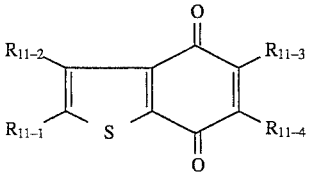

$R_{11-4}$: —Cl

Compound 11-(21)

$R_{11-1}$: —CH=CH—$NO_2$
$R_{11-2}$: —CN
$R_{11-3}$: —Cl
$R_{11-4}$: —Cl

Compound 11-(22)

$R_{11-1}$:

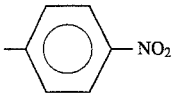

$R_{11-2}$: —CH=$CH_2$
$R_{11-3}$: —Cl
$R_{11-4}$: —Cl

Compound 11-(23)

$R_{11-1}$:

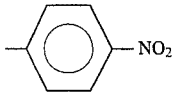

$R_{11-2}$: —$C_2H_5$
$R_{11-3}$: —$C_2H_5$
$R_{11-4}$: —$CH_3$

Compound 11-(24)

$R_{11-1}$:

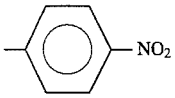

$R_{11-2}$: —CN
$R_{11-3}$: —$C_4H_9$(t)
$R_{11-4}$: —Br

Compound 11-(25)

$R_{11-1}$:

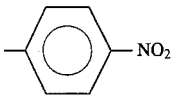

$R_{11-2}$: —$NO_2$
$R_{11-3}$: —$C_4H_9$(t)
$R_{11-4}$: —Br

Compound 11-(26)

$R_{11-1}$:

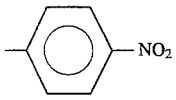

$R_{11-2}$:

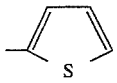

$R_{11-3}$: —$C_4H_9$(t)
$R_{11-4}$: —$CH_3$

Compound 11-(27)

$R_{11-1}$: —H
$R_{11-2}$: —CH=CH—$NO_2$
$R_{11-3}$: —Cl
$R_{11-4}$: —Cl

Compound 11-(28)

$R_{11-1}$: —H

Basic constitution (Formula (11))

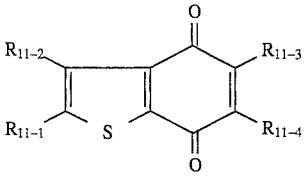

$R_{11-2}$: —$(CH=CH)_2$—$NO_2$
$R_{11-3}$: —Cl
$R_{11-4}$: —Cl

Compound 11-(29)

$R_{11-1}$: —H $R_{11-2}$:

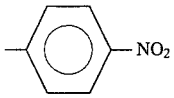

$R_{11-3}$: —CN
$R_{11-4}$: —Cl

Compound 11-(30)

$R_{11-1}$: —H $R_{11-2}$:

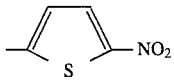

$R_{11-3}$: —$NO_2$
$R_{11-4}$: —Cl

Compound 11-(31)

$R_{11-1}$: —Cl $R_{11-2}$:

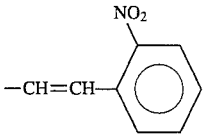

$R_{11-3}$: —$NO_2$
$R_{11-4}$: —CN

Compound 11-(32)

$R_{11-1}$: —Cl $R_{11-2}$:

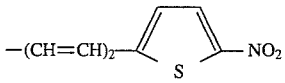

$R_{11-3}$: —$NO_2$
$R_{11-4}$: —$NO_2$

Compound 11-(33)

$R_{11-1}$: —Cl $R_{11-2}$:

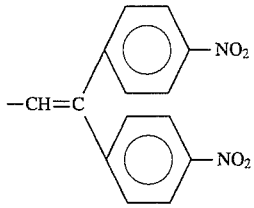

$R_{11-3}$: —$CH_3$
$R_{11-4}$: —$CH_3$

Compound 11-(34)

$R_{11-1}$: —Cl

-continued

Basic constitution (Formula (11))

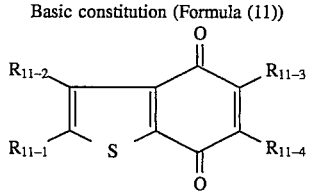

$R_{11-2}$:

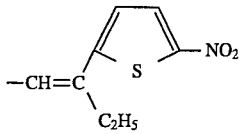

$R_{11-3}$: $-C_4H_9(t)$
$R_{11-4}$: $-CH_3$

Compound 11-(35)

$R_{11-1}$: $-CH_3$ $R_{11-2}$:

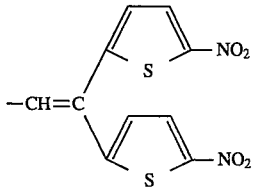

$R_{11-3}$: $-Cl$
$R_{11-4}$: $-C_4H_9(t)$

Compound 11-(36)

$R_{11-1}$: $-C_2H_5$
$R_{11-2}$: $-CH=CH-NO_2$
$R_{11-3}$: $-C_2H_5$
$R_{11-4}$: $-CH_3$

Compound 11-(37)

$R_{11-1}$: $-C_4H_9(t)$
$R_{11-2}$: $-CH=CH-NO_2$
$R_{11-3}$: $-Br$
$R_{11-4}$: $-Br$

Compound 11-(38)

$R_{11-1}$: $-CH_3$ $R_{11-2}$:

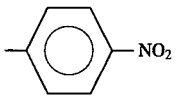

$R_{11-3}$: $-CN$
$R_{11-4}$: $-NO_2$

Compound 11-(39)

$R_{11-1}$: $-CH_3$
$R_{11-2}$: $-NO_2$
$R_{11-3}$: $-Cl$
$R_{11-4}$: $-CN$

Basic constitution (Formula (12))

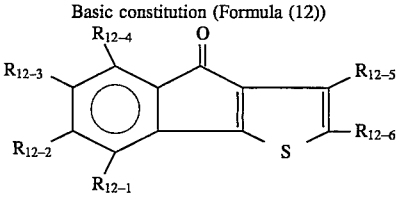

Compound 12-(1)

$R_{12-1}$: $-H$
$R_{12-2}$: $-NO_2$
$R_{12-3}$~$R_{12-5}$: $-H$
$R_{12-6}$: $-NO_2$

Compound 12-(2)

$R_{12-1}$: $-H$
$R_{12-2}$: $-NO_2$
$R_{12-3}$~$R_{12-5}$: $-H$
$R_{12-6}$: $-CH=CH-NO_2$

Compound 12-(3)

$R_{12-1}$: $-H$
$R_{12-2}$: $-NO_2$
$R_{12-3}$~$R_{12-5}$: $-H$ $R_{12-6}$:

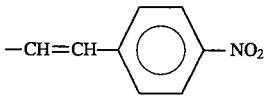

Compound 12-(4)

$R_{12-1}$: $-H$
$R_{12-2}$: $-NO_2$
$R_{12-3}$~$R_{12-5}$: $-H$ $R_{12-6}$:

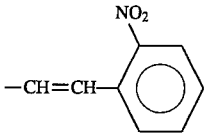

Compound 12-(5)

$R_{12-1}$: $-H$
$R_{12-2}$: $-NO_2$
$R_{12-3}$~$R_{12-5}$: $-H$
$R_{12-6}$: $-(CH=CH)_2-NO_2$

Compound 12-(6)

$R_{12-1}$: $-H$
$R_{12-2}$: $-NO_2$
$R_{12-3}$~$R_{12-5}$: $-H$ $R_{12-6}$:

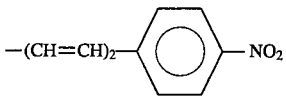

Compound 12-(7)

$R_{12-1}$: $-H$
$R_{12-2}$: $-NO_2$
$R_{12-3}$~$R_{12-5}$: $-H$ $R_{12-6}$:

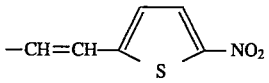

Compound 12-(8)

$R_{12-1}$: $-H$

Basic constitution (Formula (12))

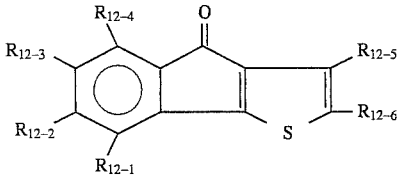

$R_{12-2}$: $-NO_2$
$R_{12-3}$~$R_{12-5}$: $-H$ $R_{12-6}$:

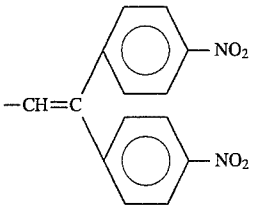

Compound 12-(9)

$R_{12-1}$: $-H$
$R_{12-2}$: $-NO_2$
$R_{12-3}$~$R_{12-5}$: $-H$ $R_{12-6}$:

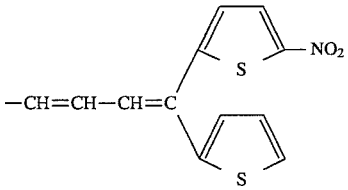

Compound 12-(10)

$R_{12-1}$: $-H$
$R_{12-2}$: $-NO_2$
$R_{12-3}$~$R_{12-5}$: $-H$ $R_{12-6}$:

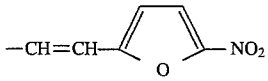

Compound 12-(11)

$R_{12-1}$: $-H$
$R_{12-2}$: $-NO_2$
$R_{12-3}$~$R_{12-5}$: $-H$ $R_{12-6}$:

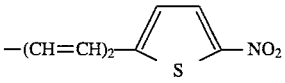

Compound 12-(12)

$R_{12-1}$: $-H$
$R_{12-2}$: $-NO_2$
$R_{12-3}$~$R_{12-5}$: $-H$ $R_{12-6}$:

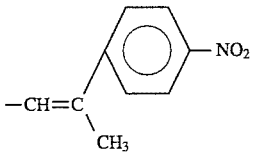

Compound 12-(13)

$R_{12-1}$: $-H$
$R_{12-2}$: $-NO_2$
$R_{12-3}$~$R_{12-5}$: $-H$

Basic constitution (Formula (12))

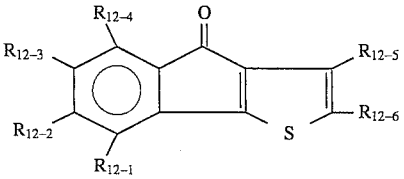

$R_{12-6}$:

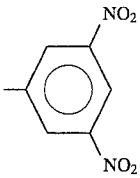

Compound 12-(14)

$R_{12-1}$: $-NO_2$
$R_{12-2}$~$R_{12-5}$: $-H$
$R_{12-6}$: $-NO_2$

Compound 12-(15)

$R_{12-1}$: $-NO_2$
$R_{12-2}$: $-H$
$R_{12-3}$: $-Cl$
$R_{12-4}$, $R_{12-5}$: $-H$ $R_{12-6}$:

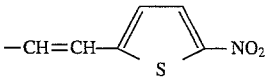

Compound 12-(16)

$R_{12-1}$: $-NO_2$
$R_{12-2}$: $-H$
$R_{12-3}$: $-Br$
$R_{12-4}$: $-H$
$R_{12-5}$: $-CH=CH-NO_2$
$R_{12-6}$: $-H$

Compound 12-(17)

$R_{12-1}$: $-NO_2$
$R_{12-2}$~$R_{12-4}$: $-H$ $R_{12-5}$:

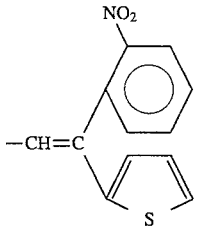

$R_{12-6}$: $-H$

Compound 12-(18)

$R_{12-1}$ $-NO_2$
$R_{12-2}$, $R_{12-3}$: $-H$
$R_{12-4}$: $-(CH=CH)_2-NO_2$
$R_{12-5}$: $-H$
$R_{12-6}$: $-C_4H_9$ (t)

Compound 12-(19)

$R_{12-1}$: $-NO_2$
$R_{12-2}$: $-H$ $R_{12-3}$:

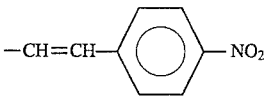

$R_{12-4}$: $-H$
$R_{12-5}$: $-CH_3$

Basic constitution (Formula (12))

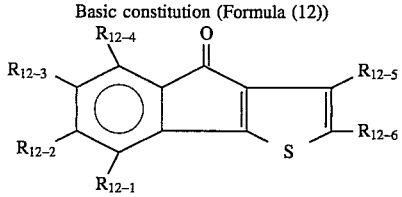

$R_{12-6}$: —H

Compound 12-(20)

$R_{12-1}$: $-NO_2$
$R_{12-2}$: —H $R_{12-3}$:

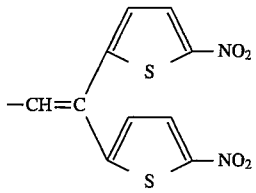

$R_{12-4}$~$R_{12-6}$: —H

Compound 12-(21)

$R_{12-1}$: $-NO_2$
$R_{12-2}$: —H
$R_{12-3}$: $-NO_2$
$R_{12-4}$, $R_{12-5}$: —H
$R_{12-6}$: $-C_2H_5$

Compound 12-(22)

$R_{12-1}$, $R_{12-2}$: —H
$R_{12-3}$: $-NO_2$
$R_{12-4}$, $R_{12-5}$ : —H
$R_{12-6}$: $-CH=CH-NO_2$

Compound 12-(23)

$R_{12-1}$, $R_{12-2}$: —H
$R_{12-3}$: $-NO_2$
$R_{12-4}$, $R_{12-5}$: —H $R_{12-6}$:

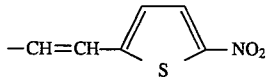

Compound 12-(24)

$R_{12-1}$, $R_{12-2}$: —H
$R_{12-3}$: $-NO_2$
$R_{12-4}$, $R_{12-5}$: —H $R_{12-6}$:

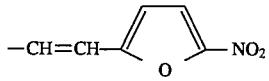

Compound 12-(25)

$R_{12-1}$: —Br
$R_{12-2}$: —H
$R_{12-3}$: $-NO_2$
$R_{12-4}$, $R_{12-5}$: —H
$R_{12-6}$: $-(CH=CH)_2-NO_2$

Compound 12-(26)

$R_{12-1}$: —Cl
$R_{12-2}$: —H
$R_{12-3}$: $-NO_2$
$R_{12-4}$, $R_{12-5}$: —H $R_{12-6}$:

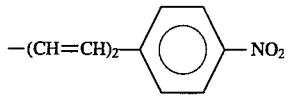

Basic constitution (Formula (12))

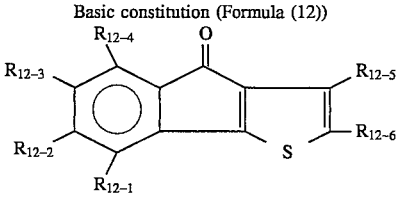

Compound 12-(27)

$R_{12-1}$, $R_{12-2}$: —H
$R_{12-3}$: $-NO_2$
$R_{12-4}$, $R_{12-5}$: —H $R_{12-6}$:

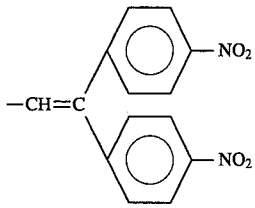

Compound 12-(28)

$R_{12-1}$, $R_{12-2}$: —H
$R_{12-3}$: $-NO_2$
$R_{12-4}$: —H
$R_{12-5}$: $-CH=CH-NO_2$
$R_{12-6}$: —H

Compound 12-(29)

$R_{12-1}$: —H
$R_{12-2}$: $-NO_2$
$R_{12-3}$, $R_{12-4}$: —H $R_{12-5}$:

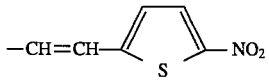

$R_{12-6}$: —H

Compound 12-(30)

$R_{12-1}$: —H
$R_{12-2}$: $-NO_2$
$R_{12-3}$, $R_{12-4}$: —H $R_{12-5}$:

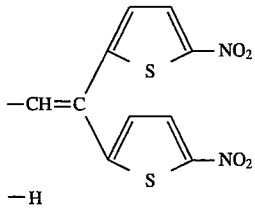

$R_{12-6}$: —H

Compound 12-(31)

$R_{12-1}$~$R_{12-3}$: —H
$R_{12-4}$: $-NO_2$
$R_{12-5}$: —H $R_{12-6}$:

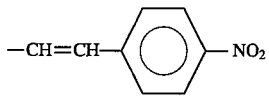

Compound 12-(32)

$R_{12-1}$~$R_{12-3}$: —H
$R_{12-4}$: $-NO_2$
$R_{12-5}$: —H
$R_{12-6}$: $-(CH=CH)_2-NO_2$

Compound 12-(33)

$R_{12-1}$: —H

Basic constitution (Formula (12))

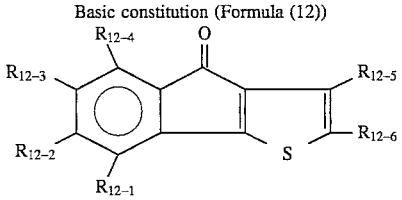

$R_{12-2}$: $-CH=CH-NO_2$
$R_{12-3}$~$R_{12-5}$: $-H$
$R_{12-6}$: $-CH=CH-NO_2$

Compound 12-(34)

$R_{12-1}$: $-H$
$R_{12-2}$: $-CH=CH-NO_2$
$R_{12-3}$: $-H$
$R_{12-4}$: $-Cl$
$R_{12-5}$: $-H$
$R_{12-6}$:

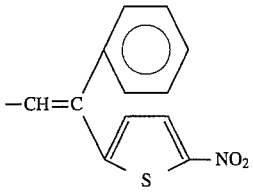

Compound 12-(35)

$R_{12-1}$: $-H$
$R_{12-2}$: $-CH=CH-NO_2$
$R_{12-3}$~$R_{12-5}$: $-H$
$R_{12-6}$:

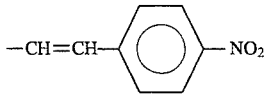

Compound 12-(36)

$R_{12-1}$: $-H$
$R_{12-2}$: $-CH=CH-NO_2$
$R_{12-3}$~$R_{12-5}$: $-H$
$R_{12-6}$:

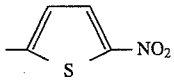

Compound 12-(37)

$R_{12-1}$: $-H$
$R_{12-2}$: $-NO_2$
$R_{12-3}$~$R_{12-5}$: $-H$
$R_{12-6}$:

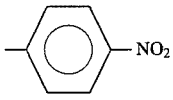

Compound 12-(38)

$R_{12-1}$: $-H$
$R_{12-2}$: $-NO_2$
$R_{12-3}$~$R_{12-5}$: $-H$
$R_{12-6}$:

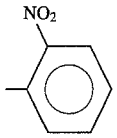

Compound 12-(39)

$R_{12\ 1}$: $-H$
$R_{12-2}$: $-NO_2$

Basic constitution (Formula (12))

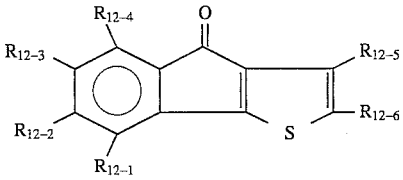

$R_{12-3}$, $R_{12-4}$: $-H$
$R_{12-5}$: $-CH=CH-NO_2$
$R_{12-6}$: $-H$

Compound 12-(40)

$R_{12-1}$: $-H$
$R_{12-2}$: $-CH=CH-NO_2$
$R_{12-3}$: $-H$
$R_{12-4}$:

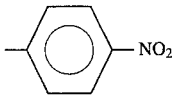

$R_{12-5}$, $R_{12-6}$: $-H$

Compound 12-(41)

$R_{12-1}$: $-H$
$R_{12-2}$: $-CH=CH-NO_2$
$R_{12-3}$: $-H$
$R_{12-4}$:

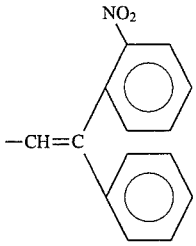

$R_{12-5}$, $R_{12-6}$: $-H$

Compound 12-(42)

$R_{12-1}$: $-H$
$R_{12-2}$: $-(CH=CH)_2-NO_2$
$R_{12-3}$~$R_{12-5}$: $-H$
$R_{12-6}$:

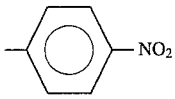

Compound 12-(43)

$R_{12-1}$: $-H$
$R_{12-2}$: $-(CH=CH)_2-NO_2$
$R_{12-3}$: $-H$
$R_{12-4}$: $-Cl$
$R_{12-5}$:

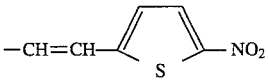

$R_{12-6}$: $-H$

Compound 12-(44)

$R_{12-1}$ $-CH=CH-NO_2$
$R_{12-2}$: $-H$
$R_{12-3}$: $-CH=CH-NO_2$
$R_{12-4}$~$R_{12-6}$: $-H$

Compound 12-(45)

$R_{12-1}$: $-CH=CH-NO_2$
$R_{12-2}$~$R_{12-5}$: $-H$

Basic constitution (Formula (12))

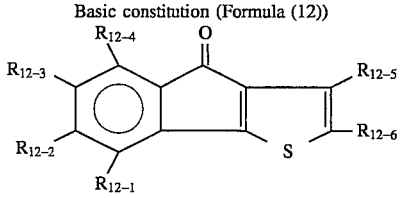

$R_{12-6}$:

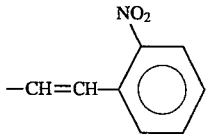

Compound 12-(46)

$R_{12-1}$: $-(CH=CH)_2-NO_2$
$R_{12-2}$~$R_{12-4}$: $-H$ $R_{12-5}$:

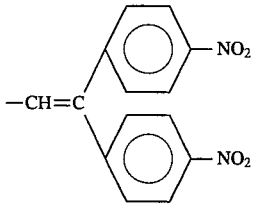

$R_{12-6}$: $-H$

Compound 12-(47)

$R_{12-1}$, $R_{12-2}$: $-H$
$R_{12-3}$: $-CH=CH=NO_2$
$R_{12-4}$ $R_{12-5}$: $-H$
$R_{12-6}$: $-(CH=CH)_2-NO_2$

Compound 12-(48)

$R_{12-1}$, $R_{12-2}$: $-H$
$R_{12-3}$: $-CH=CH-NO_2$
$R_{12-4}$, $R_{12-5}$: $-H$ $R_{12-6}$:

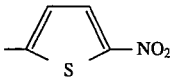

Compound 12-(49)

$R_{12-1}$: $-Cl$
$R_{12-2}$: $-H$
$R_{12-3}$: $-CH=CH-NO_2$
$R_{12-4}$, $R_{12-5}$: $-H$ $R_{12-6}$:

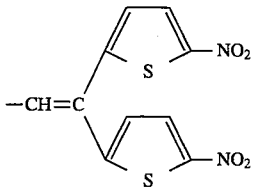

Compound 12-(50)

$R_{12-1}$, $R_{12-2}$: $-H$
$R_{12-3}$: $-CH=CH-NO_2$
$R_{12-4}$, $R_{12-5}$: H

Basic constitution (Formula (12))

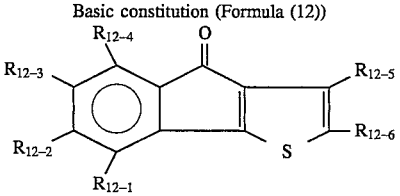

$R_{12-6}$:

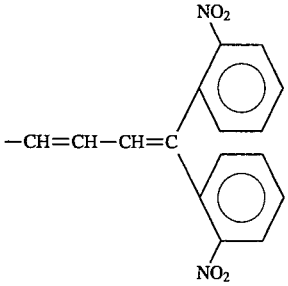

Compound 12-(51)

$R_{12-1}$, $R_{12-2}$: $-H$
$R_{12-3}$: $-CH=CH-NO_2$
$R_{12-4}$: $-H$
$R_{12-5}$: $-(CH=CH)_2-NO_2$
$R_{12-6}$: $-H$

Compound 12-(52)

$R_{12-1}$: $-CH_3$
$R_{12-2}$: $-H$
$R_{12-3}$: $-CH=CH-NO_2$
$R_{12-4}$: $-H$ $R_{12-5}$:

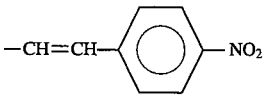

$R_{12-6}$: $-H$

Compound 12-(53)

$R_{12-1}$, $R_{12-2}$: $-H$
$R_{12-3}$: $-(CH=CH)_2-NO_2$
$R_{12-4}$: $-H$ $R_{12-5}$:

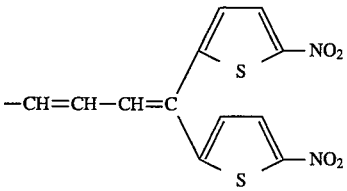

$R_{12-6}$: $-H$

Compound 12-(54)

$R_{12-1}$~$R_{12-3}$: $-H$
$R_{12-4}$: $-CH=CH-NO_2$
$R_{12-5}$: $-H$ $R_{12-6}$:

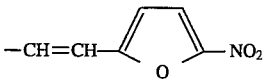

Compound 12-(55)

$R_{12-1}$~$R_{12-3}$: $-H$
$R_{12-4}$: $-CH=CH-NO_2$
$R_{12-5}$: $-(CH=CH)_2-NO_2$
$R_{12-6}$: $-H$

Compound 12-(56)

$R_{12-1}$~$R_{12-3}$: $-H$

Basic constitution (Formula (12))

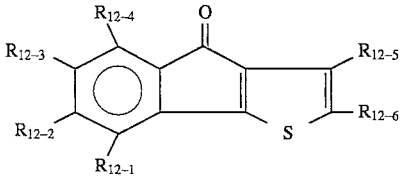

$R_{12-4}$: $-(CH=CH)_2-NO_2$
$R_{12-5}$: $-(CH=CH)_2-NO_2$
$R_{12-6}$: $-H$

Compound 12-(57)

$R_{12-1}$~$R_{12-4}$: $-H$
$R_{12-5}$: $-CH=CH-NO_2$
$R_{12-6}$: $-CH=CH-NO_2$

Compound 12-(58)

$R_{12-1}$~$R_{12-4}$: $-H$
$R_{12-5}$: $-CH=CH-NO_2$ $R_{12-6}$:

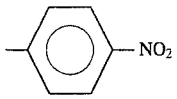

Compound 12-(59)

$R_{12-1}$~$R_{12-4}$: $-H$
$R_{12-5}$: $-NO_2$
$R_{12-6}$: $-CH=CH-NO_2$

Compound 12-(60)

$R_{12-1}$~$R_{12-4}$: $-H$
$R_{12-5}$: $-NO_2$ $R_{12-6}$:

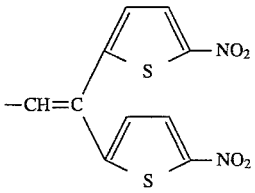

Compound 12-(61)

$R_{12-1}$: $-H$ $R_{12-2}$:

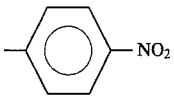

$R_{12-3}$~$R_{12-5}$: $-H$
$R_{12-6}$: $NO_2$

Compound 12-(62)

$R_{12-1}$: $-H$
$R_{12-2}$: $-CH=CH-NO_2$
$R_{12-3}$~$R_{12-5}$: $-H$
$R_{12-6}$: $-NO_2$

Compound 12-(63)

$R_{12-1}$: $-H$
$R_{12-2}$: $-(CH=CH)_2-NO_2$
$R_{12-3}$, $R_{12-4}$: $-H$
$R_{12-5}$: $-NO_2$
$R_{12-6}$: $-H$

Compound 12-(64)

$R_{12-1}$~$R_{12-3}$: $-H$
$R_{12-4}$: $-CH=CH-NO_2$
$R_{12-5}$: $-H$
$R_{12-6}$: $-NO_2$

Basic constitution (Formula (12))

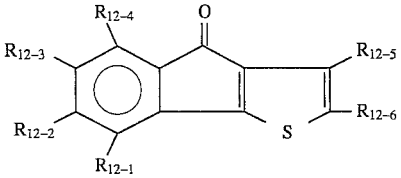

Compound 12-(65)

$R_{12-1}$~$R_{12-3}$: $-H$
$R_{12-4}$: $-(CH=CH)_2-NO_2$
$R_{12-5}$: $-NO_2$
$R_{12-6}$: $-H$

Compound 12-(66)

$R_{12-1}$: $-H$ $R_{12-2}$:

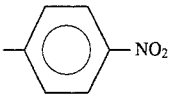

$R_{12-3}$~$R_{12-5}$: $-H$ $R_{12-6}$:

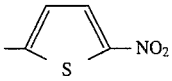

Compound 12-(67)

$R_{12-1}$: $-H$ $R_{12-2}$:

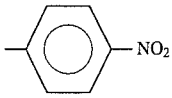

$R_{12-3}$~$R_{12-5}$: $-H$ $R_{12-6}$:

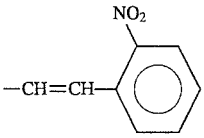

Compound 12-(68)

$R_{12-1}$: $-H$ $R_{12-2}$:

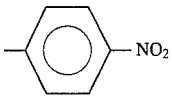

$R_{12-3}$, $R_{12-4}$: $-H$ $R_{12-5}$:

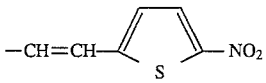

$R_{12-6}$: $-H$

Compound 12-(69)

$R_{12-1}$: $-H$ $R_{12-2}$:

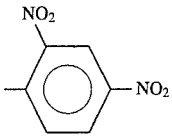

Basic constitution (Formula (12))

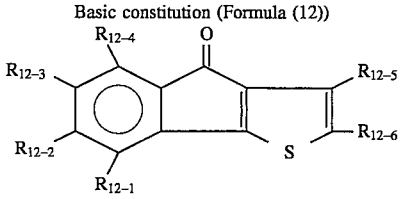

$R_{12-3}$~$R_{12-5}$: —H $R_{12-6}$: —(CH=CH)$_2$—NO$_2$

Compound 12-(70)

$R_{12-1}$: —H $R_{12-2}$:

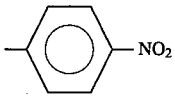

$R_{12-3}$~$R_{12-5}$: —H $R_{12-6}$:

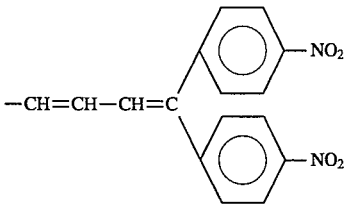

Compound 12-(71)

$R_{12-1}$: —H $R_{12-2}$:

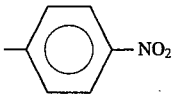

$R_{12-3}$: —H $R_{12-4}$: —NO$_2$ $R_{12-5}$, $R_{12-6}$: —H

Compound 12-(72)

$R_{12-1}$: —H $R_{12-2}$:

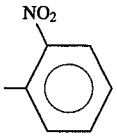

$R_{12-3}$: —H $R_{12-4}$: —CH=CH—NO$_2$ $R_{12-5}$, $R_{12-6}$: —H

Compound 12-(73)

$R_{12-1}$: —H $R_{12-2}$:

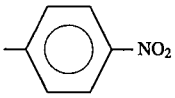

$R_{12-3}$~$R_{12-5}$: —H $R_{12-6}$:

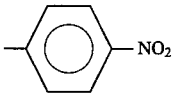

Compound 12-(74)

Basic constitution (Formula (12))

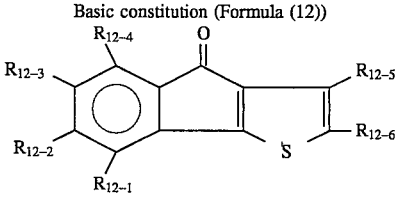

$R_{12-1}$:

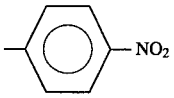

$R_{12-2}$~$R_{12-5}$: —H $R_{12-6}$: —CH=CH—NO$_2$

Compound 12-(75)

$R_{12-1}$:

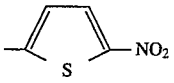

$R_{12-2}$~$R_{12-5}$: —H $R_{12-6}$: —NO$_2$

Compound 12-(76)

$R_{12-1}$:

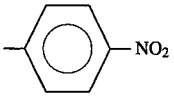

$R_{12-2}$~$R_{12-4}$: —H $R_{12-5}$:

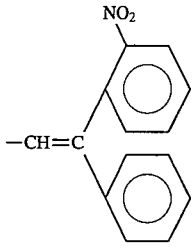

$R_{12-6}$: —H

Compound 12-(77)

$R_{12-1}$:

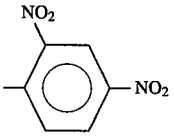

$R_{12-2}$: —H $R_{12-3}$:

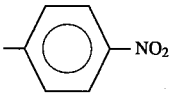

$R_{12-4}$~$R_{12-6}$: —H

Compound 12-(78)

$R_{12-1}$, $R_{12-2}$: —H $R_{12-3}$:

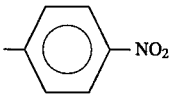

$R_{12-4}$, $R_{12-5}$: —H $R_{12-6}$: —CH=CH—NO$_2$

Compound 12-(79)

$R_{12-1}$, $R_{12-2}$: —H

Basic constitution (Formula (12))

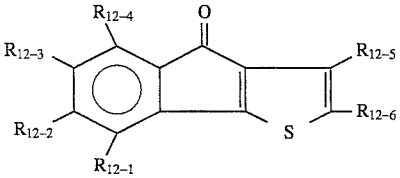

$R_{12-3}$: 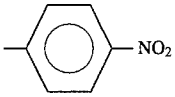

$R_{12-4}$, $R_{12-5}$: —H
$R_{12-6}$: —$NO_2$

Compound 12-(80)

$R_{12-1}$, $R_{12-2}$: —H $R_{12-3}$: 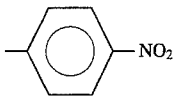

$R_{12-4}$, $R_{12-5}$: —H $R_{12-6}$: 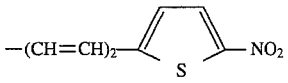

Compound 12-(81)

$R_{12-1}$, $R_{12-2}$: —H $R_{12-3}$: 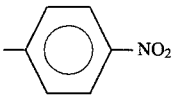

$R_{12-4}$: —H
$R_{12-5}$: —$(CH=CH)_2$—$NO_2$
$R_{12-6}$: —H

Compound 12-(82)

$R_{12-1}$: —Cl
$R_{12-2}$: —H $R_{12-3}$: 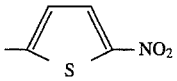

$R_{12-4}$, $R_{12-5}$: —H $R_{12-6}$: 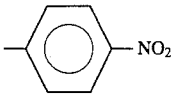

Compound 12-(83)

$R_{12-1}$, $R_{12-2}$: —H $R_{12-3}$: 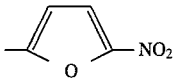

$R_{12-4}$: —H

Basic constitution (Formula (12))

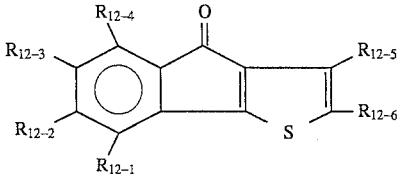

$R_{12-5}$: 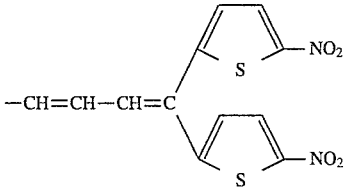

$R_{12-6}$: —H

Compound 12-(84)

$R_{12-1}$~$R_{12-3}$: —H $R_{12-4}$: 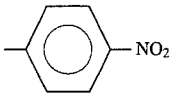

$R_{12-5}$: —H $R_{12-6}$: —$NO_2$

Compound 12-(85)

$R_{12-1}$: —H
$R_{12-2}$: —$CH_3$
$R_{12-3}$: —H $R_{12-4}$: 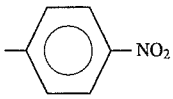

$R_{12-5}$: —CH=CH—$NO_2$
$R_{12-6}$: —H

Compound 12-(86)

$R_{12-1}$~$R_{12-4}$: —H $R_{12-5}$: 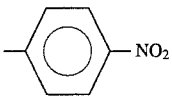

$R_{12-6}$: 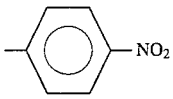

Compound 12-(87)

$R_{12-1}$~$R_{12-4}$: —H $R_{12-5}$: 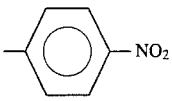

$R_{12-6}$: —CH=CH—$NO_2$

Compound 12-(88)

$R_{12-1}$: —H $R_{12-2}$: 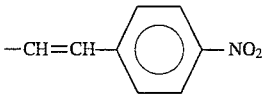

Basic constitution (Formula (12))

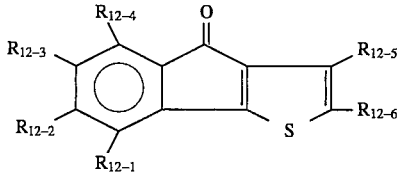

$R_{12-3}$~$R_{12-5}$: —H
$R_{12-6}$: —CH=CH—$NO_2$

Compound 12-(89)

$R_{12-1}$: —H $R_{12-2}$:

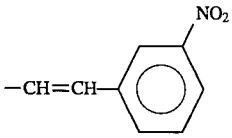

$R_{12-3}$~$R_{12-5}$: —H
$R_{12-6}$: —$NO_2$

Compound 12-(90)

$R_{12-1}$: —H $R_{12-2}$:

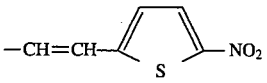

$R_{12-3}$, $R_{12-4}$: —H
$R_{12-5}$: —$NO_2$
$R_{12-6}$: —H

Compound 12-(91)

$R_{12-1}$: —H $R_{12-2}$:

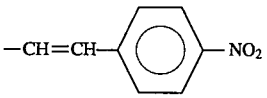

$R_{12-3}$~$R_{12-5}$: —H $R_{12-6}$:

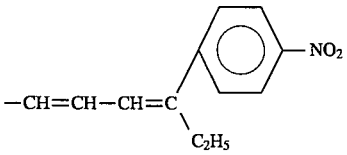

Compound 12-(92)

$R_{12-1}$: —H $R_{12-2}$:

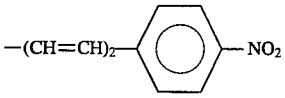

$R_{12-3}$~$R_{12-5}$: —H
$R_{12-6}$: —$NO_2$

Compound 12-(93)

$R_{12-1}$: —H $R_{12-2}$:

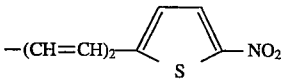

$R_{12-3}$: —H
$R_{12-4}$: —$NO_2$
$R_{12-5}$, $R_{12-6}$: —H

Basic constitution (Formula (12))

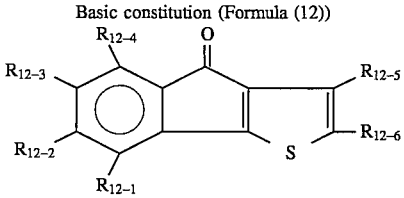

Compound 12-(94)

$R_{12-1}$: —H $R_{12-2}$:

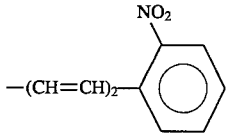

$R_{12-3}$~$R_{12-5}$: —H $R_{12-6}$:

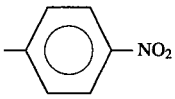

Compound 12-(95)

$R_{12-1}$:

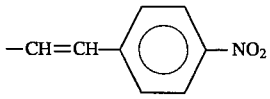

$R_{12-2}$~$R_{12-5}$: —H
$R_{12-6}$: —CH=CH—$NO_2$

Compound 12-(96)

$R_{12-1}$:

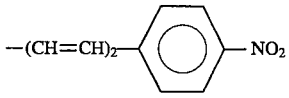

$R_{12-2}$~$R_{12-5}$: —H $R_{12-6}$:

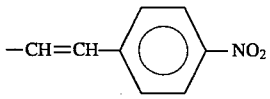

Compound 12-(97)

$R_{12-1}$, $R_{12-2}$: —H $R_{12-3}$:

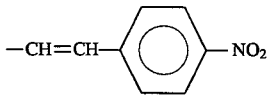

$R_{12-4}$, $R_{12-5}$: —H $R_{12-6}$:

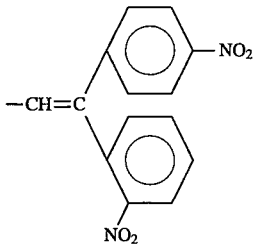

Compound 12-(98)

$R_{12-1}$, $R_{12-2}$: —H

Basic constitution (Formula (12))
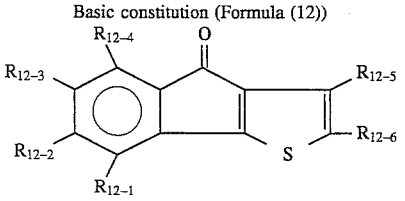
$R_{12-3}$:
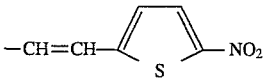
$R_{12-4}$, $R_{12-5}$: —H
$R_{12-6}$:
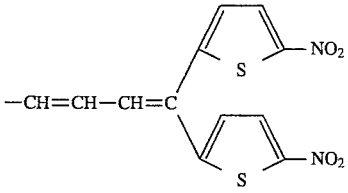
Compound 12-(99)
$R_{12-1}$, $R_{12-2}$: —H
$R_{12-3}$:
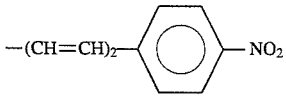
$R_{12-4}$: —H
$R_{12-5}$:
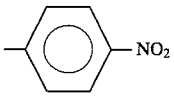
$R_{12-6}$: —H
Compound 12-(100)
$R_{12-1}$~$R_{12-3}$: —H
$R_{12-4}$:
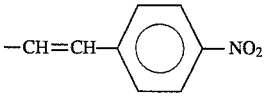
$R_{12-5}$: —H
$R_{12-6}$: —CH=CH—$NO_2$
Compound 12-(101)
$R_{12-1}$~$R_{12-4}$: —H
$R_{12-5}$:
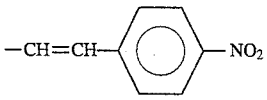
$R_{12-6}$: —$NO_2$
Compound 12-(102)
$R_{12-1}$~$R_{12-4}$: —H
$R_{12-5}$: —$NO_2$
$R_{12-6}$:
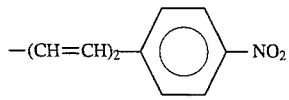
Compound 12-(103)
$R_{12-1}$: —H
Basic constitution (Formula (12))
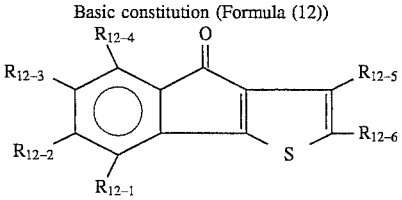
$R_{12-2}$:
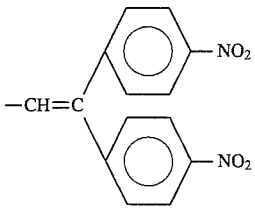
$R_{12-3}$~$R_{12-5}$: —H
$R_{12-6}$: —$NO_2$
Compound 12-(104)
$R_{12-1}$: —H
$R_{12-2}$:
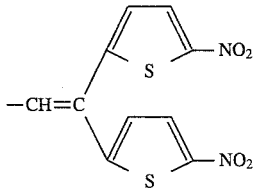
$R_{12-3}$~$R_{12-5}$: —H
$R_{12-6}$:
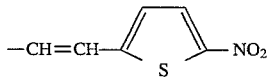
Compound 12-(105)
$R_{12-1}$: —H
$R_{12-2}$:
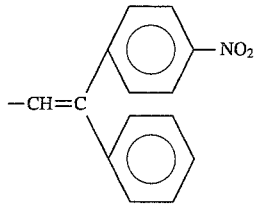
$R_{12-3}$, $R_{12-4}$: —H
$R_{12-5}$: —$NO_2$
$R_{12-6}$: —H
Compound 12-(106)
$R_{12-1}$: —H
$R_{12-2}$:
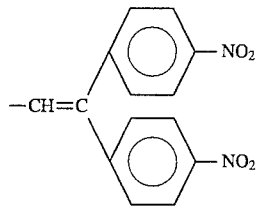
$R_{12-3}$, $R_{12-4}$: —H
$R_{12-5}$:
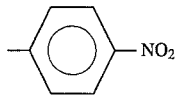

Basic constitution (Formula (12))

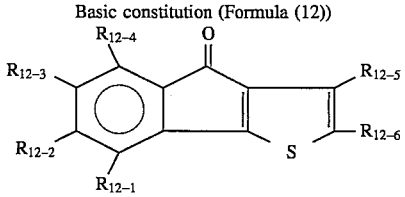

$R_{12-6}$: —H

Compound 12-(107)

$R_{12-1}$:

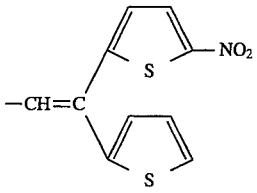

$R_{12-2}$: —H $R_{12-3}$:

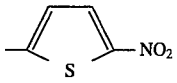

$R_{12-4}$–$R_{12-6}$: —H

Compound 12-(108)

$R_{12-1}$, $R_{12-2}$: —H $R_{12-3}$:

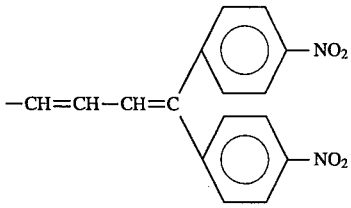

$R_{12-4}$, $R_{12-5}$: —H $R_{12-6}$: $—NO_2$

Compound 12-(109)

$R_{12-1}$–$R_{12-4}$: —H $R_{12-5}$:

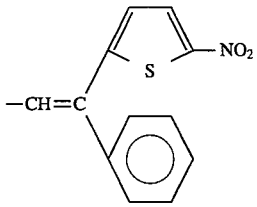

$R_{12-6}$: $—NO_2$

Compound 12-(110)

$R_{12-1}$–$R_{12-4}$: —H $R_{12-5}$: $—NO_2$ $R_{12-6}$:

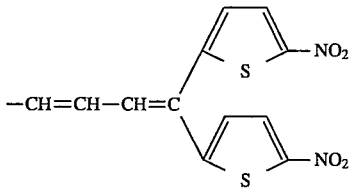

Compound 12-(111)

$R_{12-1}$: $—CH_3$

Basic constitution (Formula (12))

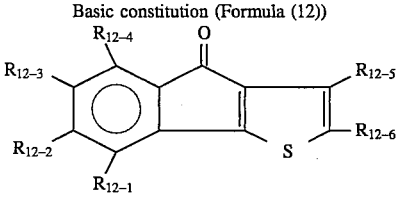

$R_{12-2}$: $—NO_2$ $R_{12-3}$: —H $R_{12-4}$: $—C_2H_5$ $R_{12-5}$: —H $R_{12-6}$: $—NO_2$

Compound 12-(112)

$R_{12-1}$: $—C_4H_9$ (t)

$R_{12-2}$: —H $R_{12-3}$:

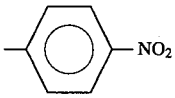

$R_{12-4}$: —H $R_{12-5}$: $—CH_3$ $R_{12-6}$: $—(CH=CH)_2—NO_2$

Compound 12-(113)

$R_{12-1}$: $—C_2H_5$ $R_{12-2}$: —H $R_{12-3}$: $—CH=CH—NO_2$ $R_{12-4}$: —H $R_{12-5}$: $—NO_2$ $R_{12-6}$: $—CH_3$

Compound 12-(114)

$R_{12-1}$: $—CH_3$ $R_{12-2}$:

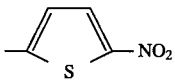

$R_{12-3}$: —H $R_{12-4}$: $—C_2H_5$ $R_{12-5}$: $—CH_3$ $R_{12-6}$: $—NO_2$

Compound 12-(115)

$R_{12-1}$: —H $R_{12-2}$: $—NO_2$ $R_{12-3}$: —H $R_{12-4}$:

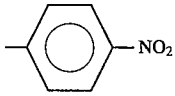

$R_{12-5}$: —H $R_{12-6}$: $—CH=CH—NO_2$

Compound 12-(116)

$R_{12-1}$: $—NO_2$ $R_{12-2}$: —H $R_{12-3}$: $—NO_2$ $R_{12-4}$: —H $R_{12-5}$: $—NO_2$ $R_{12-6}$: $—CH_3$

Compound 12-(117)

$R_{12-1}$: —H $R_{12-2}$: $—NO_2$ $R_{12-3}$: —H $R_{12-4}$: $—NO_2$ $R_{12-5}$: —H

Basic constitution (Formula (12))
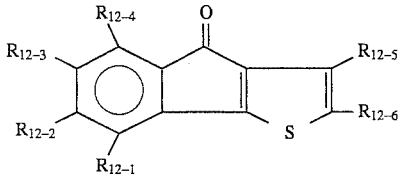
$R_{12-6}$:
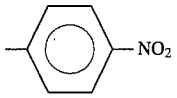
Compound 12-(118)
$R_{12-1}$: $-NO_2$
$R_{12-2}$: $-H$
$R_{12-3}$: $-NO_2$
$R_{12-4}$: $-H$
$R_{12-5}$: $-NO_2$
$R_{12-6}$: $-CH=CH-NO_2$
Compound 12-(119)
$R_{12-1}$: $-H$
$R_{12-2}$:
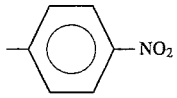
$R_{12-3}$~$R_{12-5}$: $-H$
$R_{12-6}$:
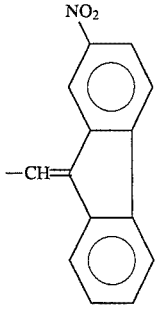
Compound 12-(120)
$R_{12-1}$, $R_{12-2}$: $-H$
$R_{12-3}$: $-NO_2$
$R_{12-4}$, $R_{12-5}$: $-H$
$R_{12-6}$:
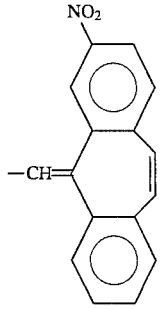
Compound 12-(121)
$R_{12-1}$~$R_{12-3}$: $-H$
$R_{12-4}$:
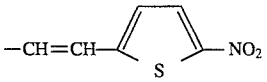
$R_{12-5}$: $-H$
Basic constitution (Formula (12))
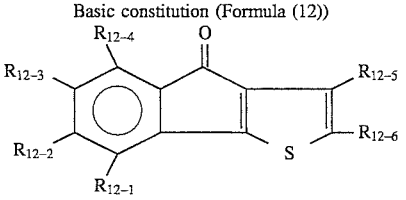
$R_{12-6}$:
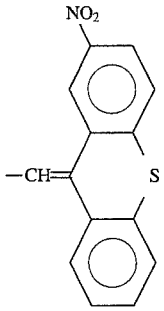
Compound 12-(122)
$R_{12-1}$:
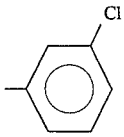
$R_{12-2}$: $-H$
$R_{12-3}$: $-NO_2$
$R_{12-4}$: $-H$
$R_{12-5}$:
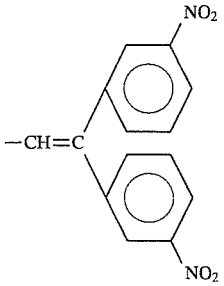
$R_{12-6}$: $-H$
Compound 12-(123)
$R_{12-1}$: $-H$
$R_{12-2}$:
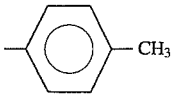
$R_{12-3}$: $-H$
$R_{12-4}$:
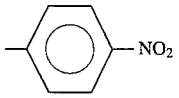
$R_{12-5}$:
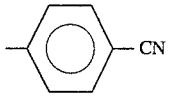
$R_{12-6}$: $-NO_2$
Compound 12-(124)
$R_{12-1}$: $-H$ Basic constitution (Formula (12))

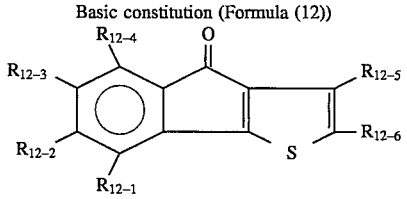

$R_{12-2}$:

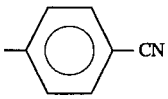

$R_{12-3}$: —H
$R_{12-4}$: $-NO_2$
$R_{12-5}$: $-NO_2$
$R_{12-6}$: $-C_2H_5$

Compound 12-(125)

$R_{12-1}$: —H $R_{12-2}$:

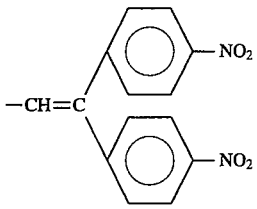

$R_{12-3}$: —H $R_{12-4}$:

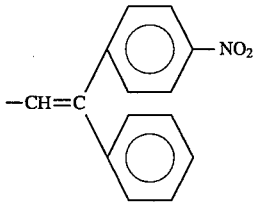

$R_{12-5}$, $R_{12-6}$: —H

Basic constitution (Formula (13))

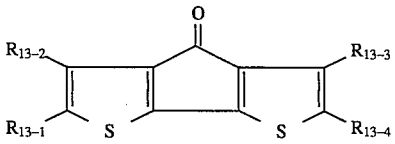

Compound 13-(1)

$R_{13-1}$: $-NO_2$
$R_{13-2}$: —H
$R_{13-3}$: —H
$R_{13-4}$: $-NO_2$

Compound 13-(2)

$R_{13-1}$: $-NO_2$
$R_{13-2}$: —H
$R_{13-3}$: —H
$R_{13-4}$: $-CH=CH-NO_2$

Compound 13-(3)

$R_{13-1}$: $-NO_2$
$R_{13-2}$: —H
$R_{13-3}$: —H

Basic constitution (Formula (13))

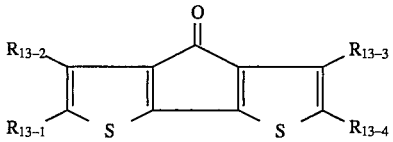

$R_{13-4}$:

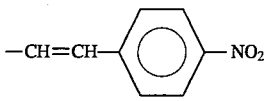

Compound 13-(4)

$R_{13-1}$: $-NO_2$
$R_{13-2}$: —H
$R_{13-3}$: —H $R_{13-4}$:

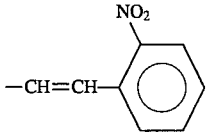

Compound 13-(5)

$R_{13-1}$: $-NO_2$
$R_{13-2}$: —H
$R_{13-3}$: —H $R_{13-4}$:

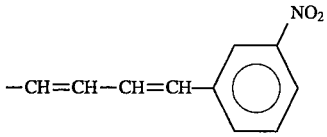

Compound 13-(6)

$R_{13-1}$: $-NO_2$
$R_{13-2}$: —H
$R_{13-3}$: —H $R_{13-4}$:

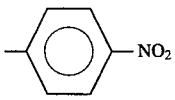

Compound 13-(7)

$R_{13-1}$: $-NO_2$
$R_{13-2}$: —H
$R_{13-3}$: —H $R_{13-4}$:

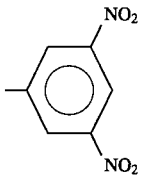

Compound 13-(8)

$R_{13-1}$: $-NO_2$
$R_{13-2}$: —H
$R_{13-3}$: —H $R_{13-4}$:

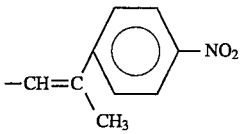

Basic constitution (Formula (13))

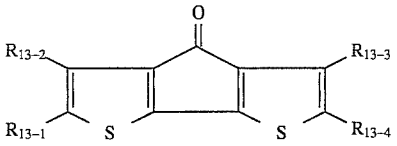

Compound 13-(9)

$R_{13-1}$: $-NO_2$
$R_{13-2}$: $-H$
$R_{13-3}$: $-H$ $R_{13-4}$:

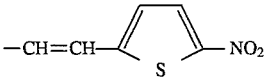

Compound 13-(10)

$R_{13-1}$: $-NO_2$
$R_{13-2}$: $-H$
$R_{13-3}$: $-H$ $R_{13-4}$:

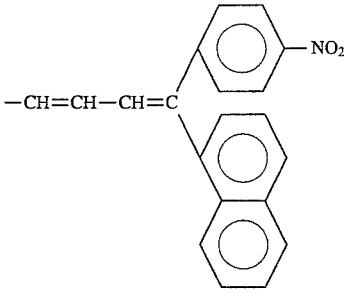

Compound 13-(11)

$R_{13-1}$: $-NO_2$
$R_{13-2}$: $-H$
$R_{13-3}$: $-H$ $R_{13-4}$:

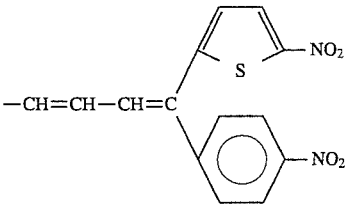

Compound 13-(12)

$R_{13-1}$: $-CH=CH-NO_2$
$R_{13-2}$: $-H$
$R_{13-3}$: $-H$
$R_{13-4}$: $-CH=CH-NO_2$

Compound 13-(13)

$R_{13-1}$: $-CH=CH-NO_2$
$R_{13-2}$: $-H$
$R_{13-3}$: $-H$ $R_{13-4}$:

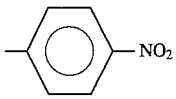

Compound 13-(14)

$R_{13-1}$: $-(CH=CH)_2-NO_2$
$R_{13-2}$: $-H$
$R_{13-3}$: $-H$

Basic constitution (Formula (13))

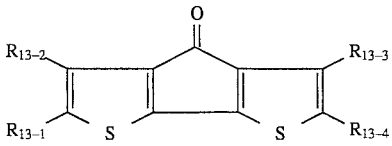

$R_{13-4}$:

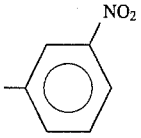

Compound 13-(15)

$R_{13-1}$: $-CH=CH-NO_2$
$R_{13-2}$: $-H$
$R_{13-3}$: $-H$ $R_{13-4}$:

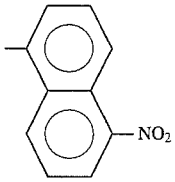

Compound 13-(16)

$R_{13-1}$: $-CH=CH-NO_2$
$R_{13-2}$: $-H$
$R_{13-3}$: $-H$ $R_{13-4}$:

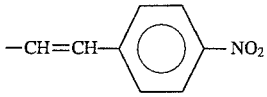

Compound 13-(17)

$R_{13-1}$: $-CH=CH-NO_2$
$R_{13-2}$: $-H$
$R_{13-3}$: $-H$ $R_{13-4}$:

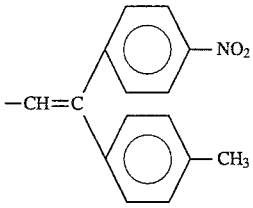

Compound 13-(18)

$R_{13-1}$: $-CH=CH-NO_2$
$R_{13-2}$: $-H$
$R_{13-3}$: $-H$ $R_{13-4}$:

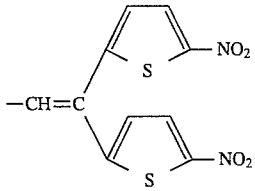

Compound 13-(19)

$R_{13-1}$: $-CH=CH-NO_2$
$R_{13-2}$: $-H$
$R_{13-3}$: $-H$

Basic constitution (Formula (13))
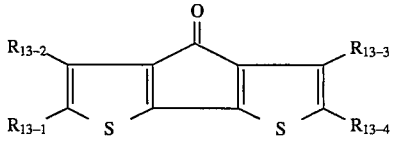
$R_{13-4}$:
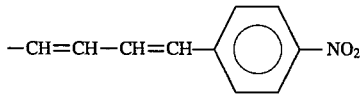
Compound 13-(20)
$R_{13-1}$:
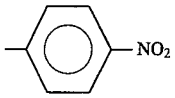
$R_{13-2}$: —H
$R_{13-3}$: —H
$R_{13-4}$:
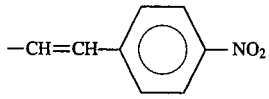
Compound 13-(21)
$R_{13-1}$:
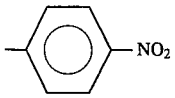
$R_{13-2}$: —H
$R_{13-3}$: —H
$R_{13-4}$:
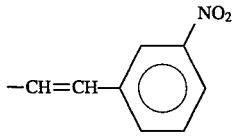
Compound 13-(22)
$R_{13-1}$:
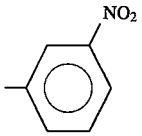
$R_{13-2}$: —H
$R_{13-3}$: —H
$R_{13-4}$:
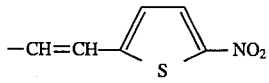
Compound 13-(23)
$R_{13-1}$:
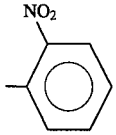
$R_{13-2}$: —H
$R_{13-3}$: —H
Basic constitution (Formula (13))
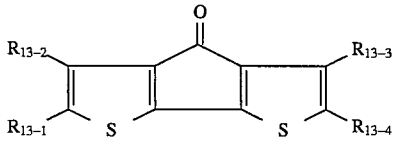
$R_{13-4}$:
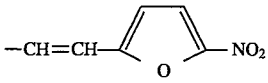
Compound 13-(24)
$R_{13-1}$:
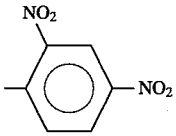
$R_{13-2}$: —H
$R_{13-3}$: —H
$R_{13-4}$:
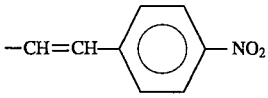
Compound 13-(25)
$R_{13-1}$:
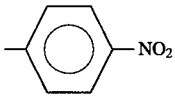
$R_{13-2}$: —H
$R_{13-3}$: —H
$R_{13-4}$:
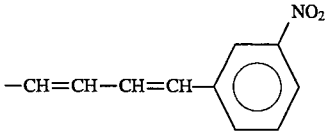
Compound 13-(26)
$R_{13-1}$:
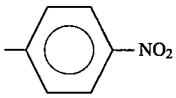
$R_{13-2}$: —H
$R_{13-3}$: —H
$R_{13-4}$:
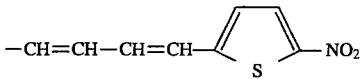
Compound 13-(27)
$R_{13-1}$:
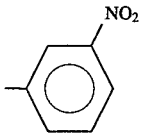
$R_{13-2}$: —H
$R_{13-3}$: —H Basic constitution (Formula (13))
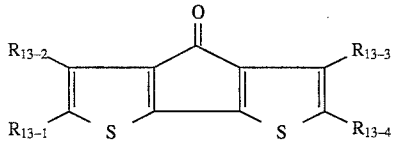
$R_{13-4}$:
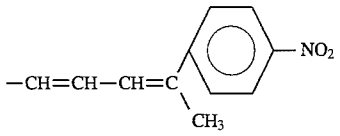
Compound 13-(28)
$R_{13-1}$:
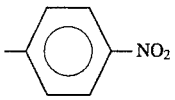
$R_{13-2}$: —H
$R_{13-3}$: —H
$R_{13-4}$:
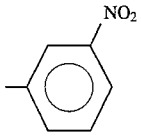
Compound 13-(29)
$R_{13-1}$:
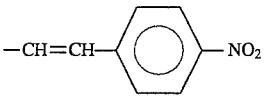
$R_{13-2}$: —H
$R_{13-3}$: —H
$R_{13-4}$:
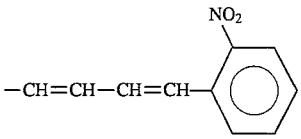
Compound 13-(30)
$R_{13-1}$:
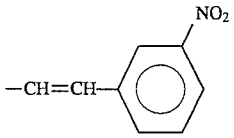
$R_{13-2}$: —H
$R_{13-3}$: —H
$R_{13-4}$:
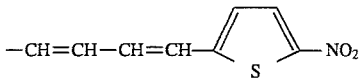
Compound 13-(31)
$R_{13-1}$:
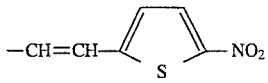
Basic constitution (Formula (13))
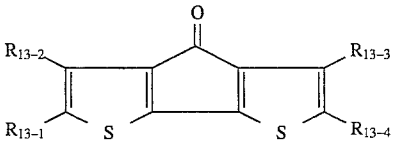
$R_{13-2}$: —H
$R_{13-3}$: —H
$R_{13-4}$:
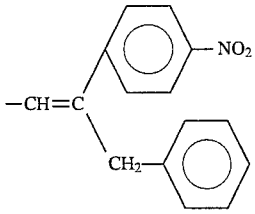
Compound 13-(32)
$R_{13-1}$:
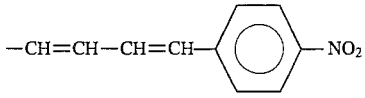
$R_{13-2}$: —H
$R_{13-3}$: —H
$R_{13-4}$:
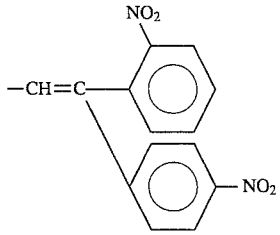
Compound 13-(33)
$R_{13-1}$:
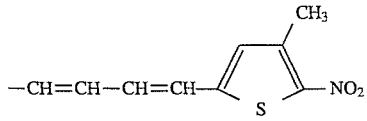
$R_{13-2}$: —H
$R_{13-3}$: —H
$R_{13-4}$:
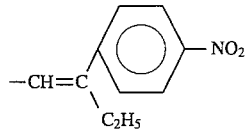
Compound 13-(34)
$R_{13-1}$:
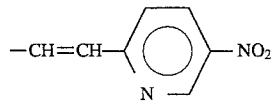
$R_{13-2}$: —H
$R_{13-3}$: —H Basic constitution (Formula (13))
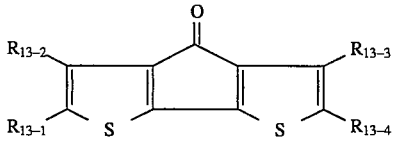
$R_{13-4}$:
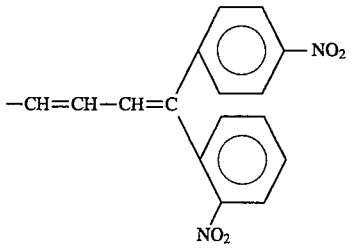
Compound 13-(35)
$R_{13-1}$:
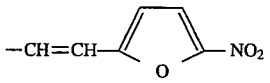
$R_{13-2}$: —H
$R_{13-3}$: —H
$R_{13-4}$:
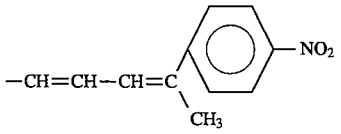
Compound 13-(36)
$R_{13-1}$:
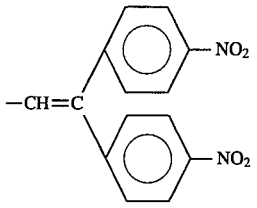
$R_{13-2}$: —H
$R_{13-3}$: —H
$R_{13-4}$:
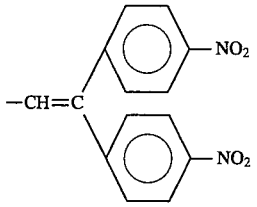
Compound 13-(37)
$R_{13-1}$:
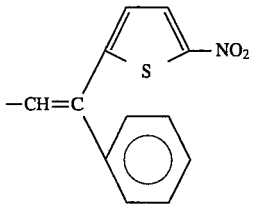
$R_{13-2}$: —H
$R_{13-3}$: —H
Basic constitution (Formula (13))
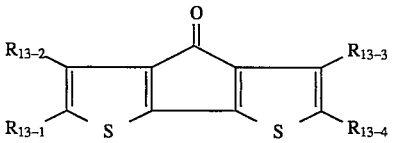
$R_{13-4}$:
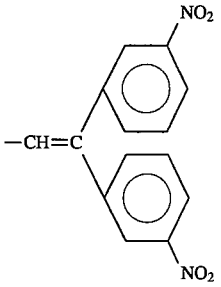
Compound 13-(38)
$R_{13-1}$:
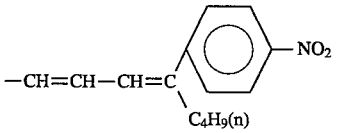
$R_{13-2}$: —H
$R_{13-3}$: —H
$R_{13-4}$:
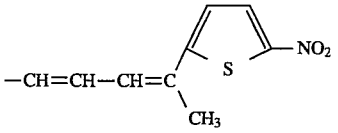
Compound 13-(39)
$R_{13-1}$:
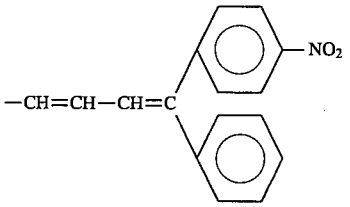
$R_{13-2}$: —H
$R_{13-3}$: —H
$R_{13-4}$:
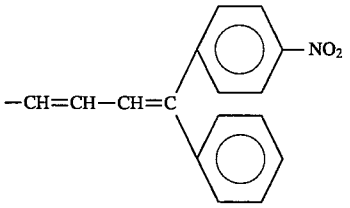
Compound 13-(40)
$R_{13-1}$:
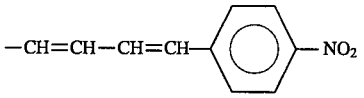
$R_{13-2}$: —H
$R_{13-3}$: —H Basic constitution (Formula (13))

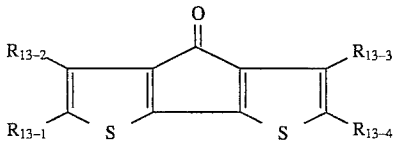

$R_{13-4}$:

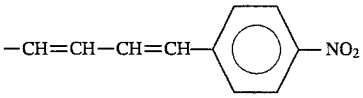

Compound 13-(41)

$R_{13-1}$: $-NO_2$
$R_{13-2}$: $-Cl$
$R_{13-3}$: $-H$ $R_{13-4}$:

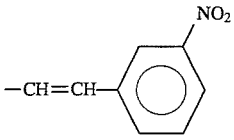

Compound 13-(42)

$R_{13-1}$: $-NO_2$
$R_{13-2}$: $-Cl$
$R_{13-3}$: $-H$ $R_{13-4}$:

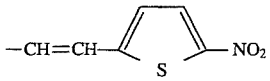

Compound 13-(43)

$R_{13-1}$:

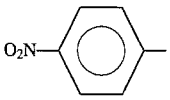

$R_{13-2}$: $-Cl$
$R_{13-3}$: $-H$ $R_{13-4}$:

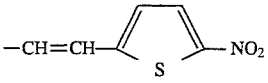

Compound 13-(44)

$R_{13-1}$:

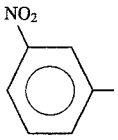

$R_{13-2}$: $-Br$
$R_{13-3}$: $-H$ $R_{13-4}$:

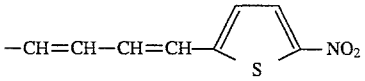

Compound 13-(45)

$R_{13-1}$:

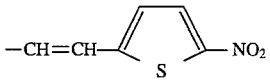

$R_{13-2}$: $-Br$
$R_{13-3}$: $-H$

Basic constitution (Formula (13))

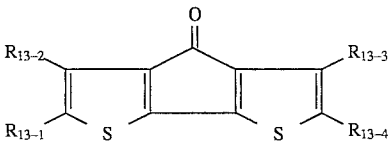

$R_{13-4}$:

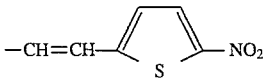

Compound 13-(46)

$R_{13-1}$: $-NO_2$
$R_{13-2}$: $-Cl$
$R_{13-3}$: $-Cl$ $R_{13-4}$:

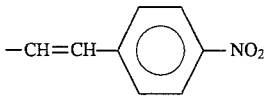

Compound 13-(47)

$R_{13-1}$: $-NO_2$
$R_{13-2}$: $-Cl$
$R_{13-3}$: $-Cl$ $R_{13-4}$:

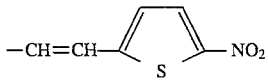

Compound 13-(48)

$R_{13-1}$:

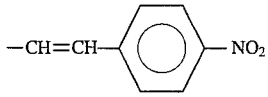

$R_{13-2}$: $-C_2H_5$
$R_{13-3}$: $-H$ $R_{13-4}$:

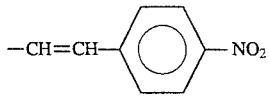

Compound 13-(49)

$R_{13-1}$:

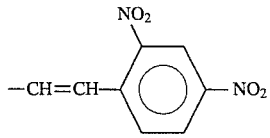

$R_{13-2}$: $-CH_3$
$R_{13-3}$: $-CH_3$ $R_{13-4}$:

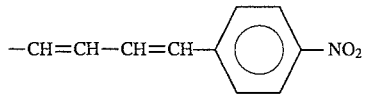

Compound 13-(50)

$R_{13-1}$: $-CH=CH-NO_2$
$R_{13-2}$: $-C_4H_9(t)$
$R_{13-3}$: $-H$
$R_{13-4}$: $-CH=CH-NO_2$

Compound 13-(51)

Basic constitution (Formula (13))
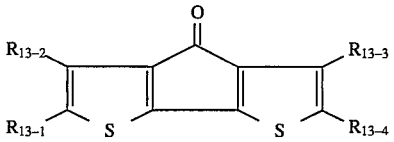
$R_{13-1}$:
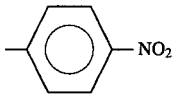
$R_{13-2}$: $-NO_2$
$R_{13-3}$: $-H$
$R_{13-4}$:
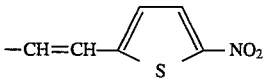
Compound 13-(52)
$R_{13-1}$:
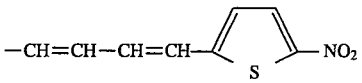
$R_{13-2}$: $-CH_2$
$R_{13-3}$: $-H$
$R_{13-4}$:
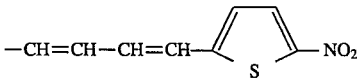
Compound 13-(53)
$R_{13-1}$:
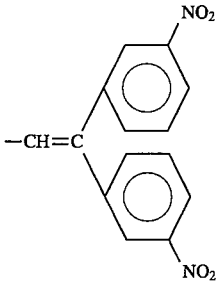
$R_{13-2}$: $-CH_2$
$R_{13-3}$: $-CH_2$
$R_{13-4}$:
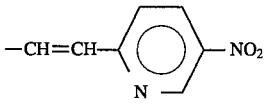
Compound 13-(54)
$R_{13-1}$: $-H$
$R_{13-2}$:
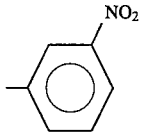
$R_{13-3}$: $-H$
$R_{13-4}$:
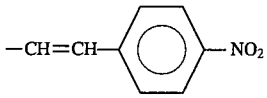
Basic constitution (Formula (13))
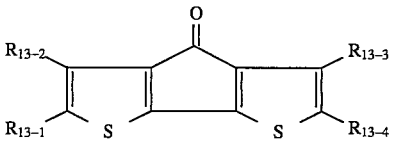
Compound 13-(55)
$R_{13-1}$: $-NO_2$
$R_{13-2}$:
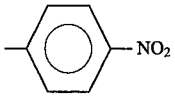
$R_{13-3}$: $-H$
$R_{13-4}$:
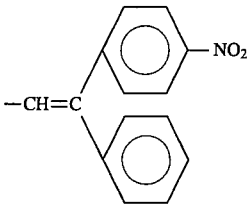
Compound 13-(56)
$R_{13-1}$:
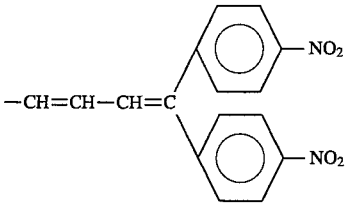
$R_{13-2}$
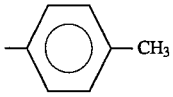
$R_{13-3}$: $-CH_3$
$R_{13-4}$:
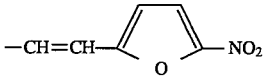
Compound 13-(57)
$R_{13-1}$:
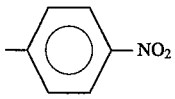
$R_{13-2}$:
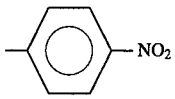
$R_{13-3}$: $-Cl$
$R_{13-4}$:
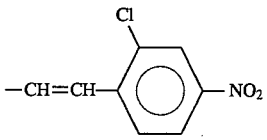
Compound 13-(58)

Basic constitution (Formula (13))

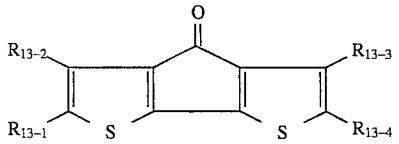

$R_{13-1}$:

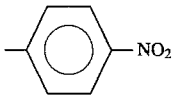

$R_{13-2}$:

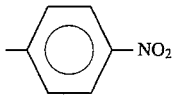

$R_{13-3}$: —H
$R_{13-4}$: —H

Compound 13-(59)

$R_{13-1}$: $-NO_2$ $R_{13-2}$:

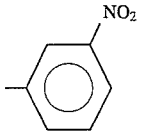

$R_{13-3}$: —H
$R_{13-4}$: —H

Compound 13-(60)

$R_{13-1}$: $-NO_2$ $R_{13-2}$:

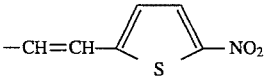

$R_{13-3}$: —H
$R_{13-4}$: —H

Compound 13-(61)

$R_{13-1}$:

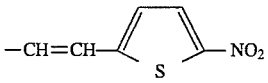

$R_{13-2}$:

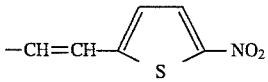

$R_{13-3}$: —H
$R_{13-4}$: —H

Compound 13-(62)

$R_{13-1}$: —H
$R_{13-2}$: $-NO_2$
$R_{13-3}$: $-CH=CH-NO_2$
$R_{13-4}$: —H

Compound 13-(63)

$R_{13-1}$: —H $R_{13-2}$:

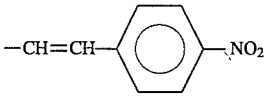

$R_{13-3}$:

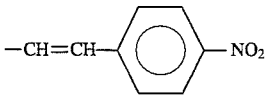

Basic constitution (Formula (13))

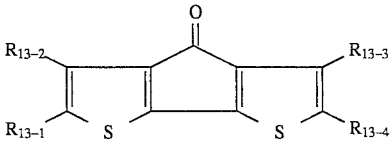

$R_{13-4}$: —H

Compound 13-(64)

$R_{13-1}$: —H
$R_{13-2}$: $-NO_2$ $R_{13-3}$:

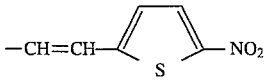

$R_{13-4}$: —H

Compound 13-(65)

$R_{13-1}$: —H $R_{13-2}$:

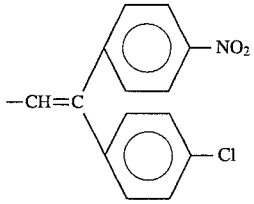

$R_{13-3}$:

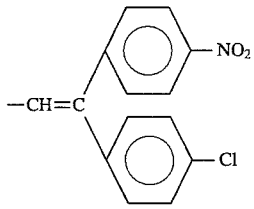

$R_{13-4}$: —H

Compound 13-(66)

$R_{13-1}$: $-NO_2$
$R_{13-2}$: $-CH=CH-NO_2$
$R_{13-3}$: —H $R_{13-4}$:

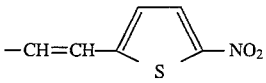

Compound 13-(67)

$R_{13-1}$:

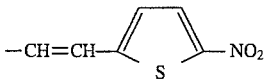

$R_{13-2}$: $-NO_2$
$R_{13-3}$: —H $R_{13-4}$:

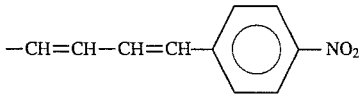

Compound 13-(68)

Basic constitution (Formula (13))
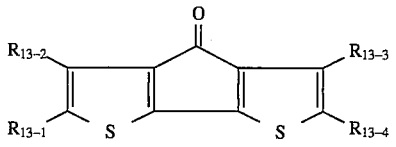
$R_{13-1}$:
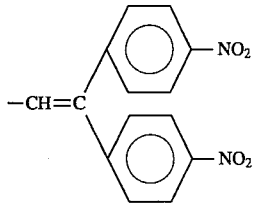
$R_{13-2}$: $-CH=CH-NO_2$
$R_{13-3}$: $-H$
$R_{13-4}$:
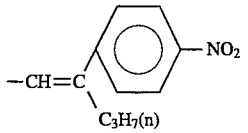
Compound 13-(69)
$R_{13-1}$:
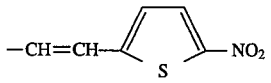
$R_{13-2}$:
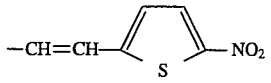
$R_{13-3}$: $-H$
$R_{13-4}$: $-NO_2$
Compound 13-(70)
$R_{13-1}$: $-NO_2$
$R_{13-2}$:
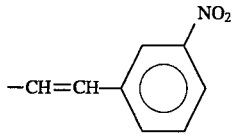
$R_{13-3}$:
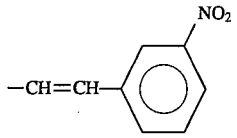
$R_{13-4}$: $-NO_2$
Compound 13-(71)
$R_{13-1}$:
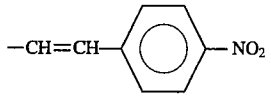
$R_{13-2}$:
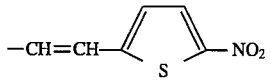
$R_{13-3}$:
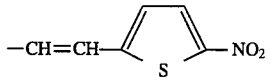
Basic constitution (Formula (13))
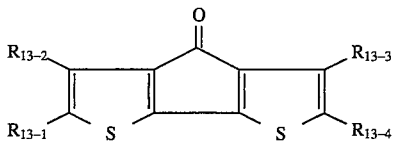
$R_{13-4}$:
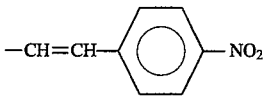
Compound 13-(72)
$R_{13-1}$: $-H$
$R_{13-2}$: $-NO_2$
$R_{13-3}$: $-H$
$R_{13-4}$:
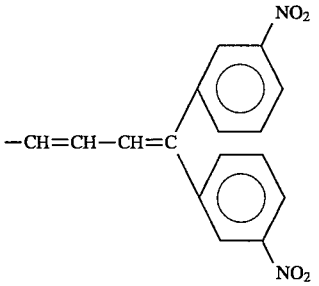
Compound 13-(73)
$R_{13-1}$: $-H$
$R_{13-2}$:
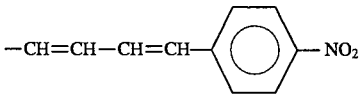
$R_{13-3}$: $-H$
$R_{13-4}$:
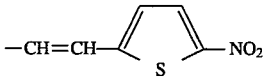
Compound 13-(74)
$R_{13-1}$: $-H$
$R_{13-2}$:
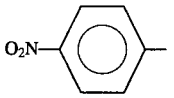
$R_{13-3}$: $-H$
$R_{13-4}$: $-NO_2$
Compound 13-(75)
$R_{13-1}$: $-NO_2$
$R_{13-2}$: $-H$
$R_{13-3}$: $-H$
$R_{13-4}$:
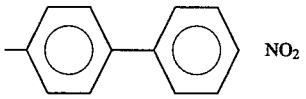
Compound 13-(76)
$R_{13-1}$: $-NO_2$
$R_{13-2}$: $-H$
$R_{13-3}$: $-H$ Basic constitution (Formula (13))
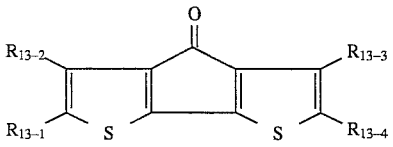
$R_{13-4}$:
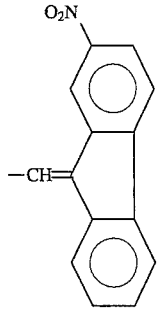
Compound 13-(77)
$R_{13-1}$:
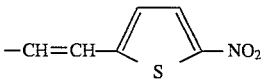
$R_{13-2}$: —H
$R_{13-3}$: —H
$R_{13-4}$:
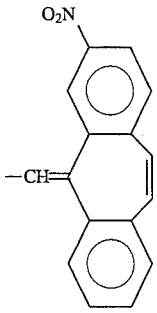
Compound 13-(78)
$R_{13-1}$: —CH=CH—$NO_2$
$R_{13-2}$: —H
$R_{13-3}$: —H
$R_{13-4}$:
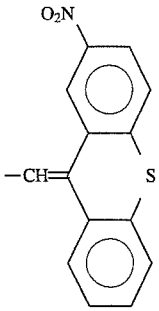
Compound 13-(79)
$R_{13-1}$: —$CH_3$
$R_{13-2}$:
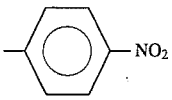
Basic constitution (Formula (13))
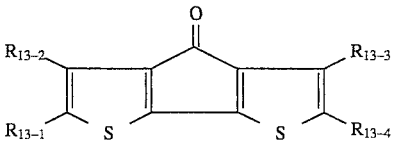
$R_{13-3}$:
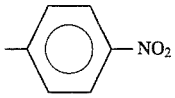
$R_{13-4}$: —$CH_3$
Compound 13-(80)
$R_{13-1}$: —$C_2H_5$
$R_{13-2}$:
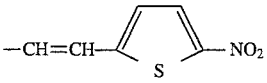
$R_{13-3}$:
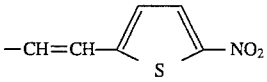
$R_{13-4}$: —$C_2H_5$
Compound 13-(81)
$R_{13-1}$:
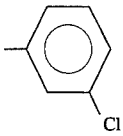
$R_{13-2}$:
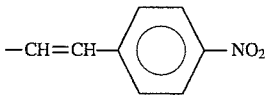
$R_{13-3}$:
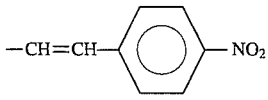
$R_{13-4}$:
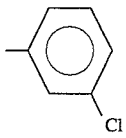
Compound 13-(82)
$R_{13-1}$:
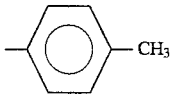
$R_{13-2}$:
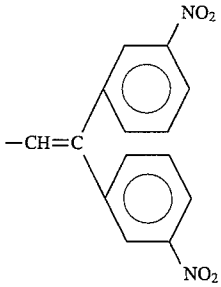

Basic constitution (Formula (13))

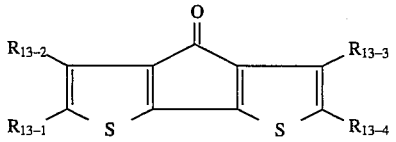

$R_{13-3}$:

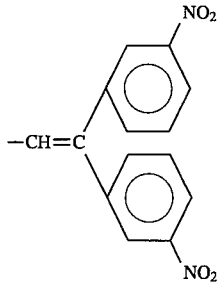

$R_{13-4}$:

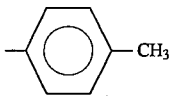

Compound 13-(83)

$R_{13-1}$:

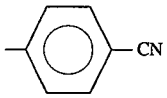

$R_{13-2}$:

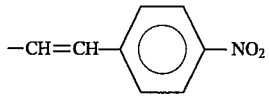

$R_{13-3}$:

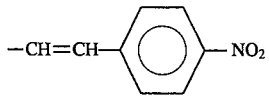

$R_{13-4}$:

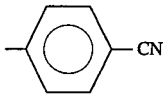

Compound 13-(84)

$R_{13-1}$: $-NO_2$
$R_{13-2}$: $-H$ $R_{13-3}$:

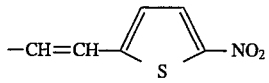

$R_{13-4}$: $-H$

Basic constitution (Formula 14)

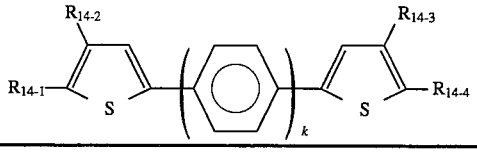

Compound 14-(1)

$R_{14-1}$: $-CH=CH-NO_2$

Basic constitution (Formula 14)

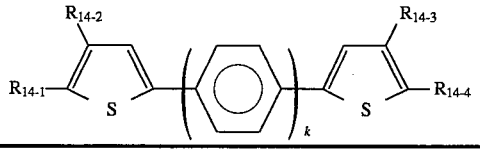

$R_{14-2}$: $-H$
$R_{14-3}$: $-H$
$R_{14-4}$: $-CH=CH-NO_2$
k: 1

Compound 14-(2)

$R_{14-1}$: $-CH=CH-NO_2$
$R_{14-2}$: $-H$
$R_{14-3}$: $-H$ $R_{14-4}$:

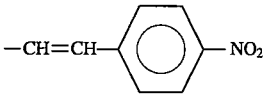

k: 1

Compound 14-(3)

$R_{14-1}$: $-CH=CH-NO_2$
$R_{14-2}$: $-H$
$R_{14-3}$: $-H$ $R_{14-4}$:

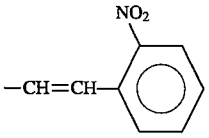

k 1

Compound 14-(4)

$R_{14-1}$: $-CH=CH-NO_2$
$R_{14-2}$: $-H$
$R_{14-3}$: $-H$
$R_{14-4}$: $-(CH=CH)_2-NO_2$
k: 1

Compound 14-(5)

$R_{14-1}$: $-CH=CH-NO_2$
$R_{14-2}$: $-H$
$R_{14-3}$: $-H$ $R_{14-4}$:

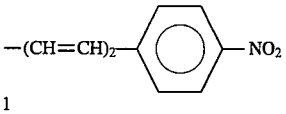

k: 1

Compound 14—(6)

$R_{14-1}$: $-CH=CH-NO_2$
$R_{14-2}$: $-H$
$R_{14-3}$: $-H$ $R_{14-4}$:

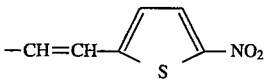

k: 1

Compound 14-(7)

$R_{14-1}$: $-CH=CH-NO_2$
$R_{14-2}$: $-H$
$R_{14-3}$: $-H$

Basic constitution
(Formula 14)

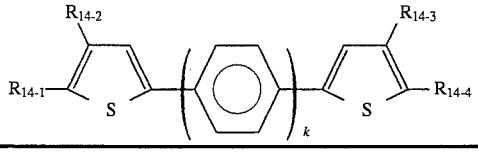

$R_{14\text{-}4}$:

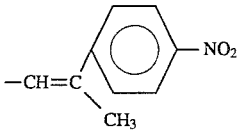

k: 1

Compound 14-(8)

$R_{14\text{-}1}$: $-CH=CH-NO_2$
$R_{14\text{-}2}$: $-H$
$R_{14\text{-}3}$: $-H$ $R_{14\text{-}4}$:

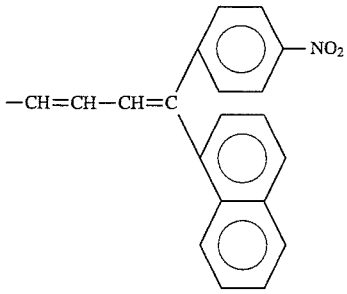

k: 1

Compound 14-(9)

$R_{14\text{-}1}$: $-CH=CH-NO_2$
$R_{14\text{-}2}$: $-H$
$R_{14\text{-}3}$: $-H$ $R_{14\text{-}4}$:

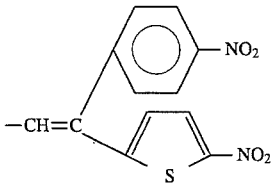

k: 1

Compound 14-(10)

$R_{14\text{-}1}$: $-CH=CH-NO_2$
$R_{14\text{-}2}$: $-H$
$R_{14\text{-}3}$: $-H$ $R_{14\text{-}4}$:

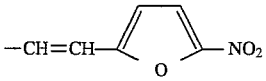

k: 1

Compound 14-(11)

$R_{14\text{-}1}$: $-CH=CH-NO_2$
$R_{14\text{-}2}$: $-H$
$R_{14\text{-}3}$: $-H$ Basic constitution
(Formula 14)

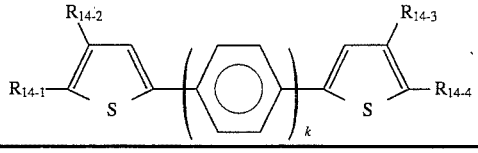

$R_{14\text{-}4}$:

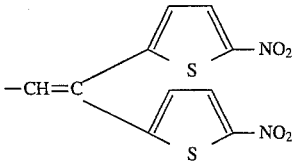

k: 1

Compound 14-(12)

$R_{14\text{-}1}$: $-CH=CH-NO_2$
$R_{14\text{-}2}$: $-H$
$R_{14\text{-}3}$: $-H$ $R_{14\text{-}4}$:

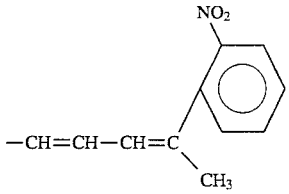

k: 1

Compound 14-(13)

$R_{14\text{-}1}$: $-CH=CH-NO_2$
$R_{14\text{-}2}$: $-H$
$R_{14\text{-}3}$: $-H$ $R_{14\text{-}4}$:

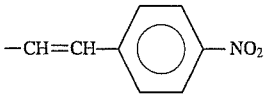

k: 1

Compound 14-(14)

$R_{14\text{-}1}$: $-(CH=CH)_2-NO_2$
$R_{14\text{-}2}$: $-H$
$R_{14\text{-}3}$: $-H$
$R_{14\text{-}4}$: $-(CH=CH)_2-NO_2$ k: 1

Compound 14-(15)

$R_{14\text{-}1}$: $-(CH=CH)_2-NO_2$
$R_{14\text{-}2}$: $-H$
$R_{14\text{-}3}$: $-H$ $R_{14\text{-}4}$:

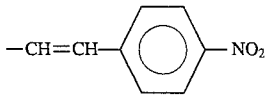

k 1

Compound 14-(16)

$R_{14\text{-}1}$: $-(CH=CH)_2-NO_2$
$R_{14\text{-}2}$: $-H$
$R_{14\text{-}3}$: $-H$ $R_{14\text{-}4}$:

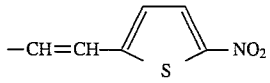

k 1

Basic constitution
(Formula 14)
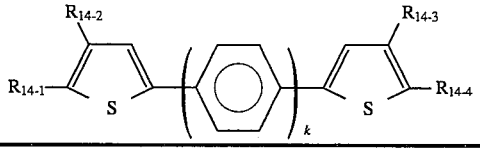
Compound 14-(17)
$R_{14-1}$: $-(CH=CH)_2-NO_2$
$R_{14-2}$: $-H$
$R_{14-3}$: $-H$
$R_{14-4}$:
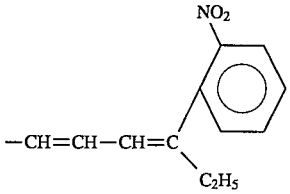
k 1
Compound 14-(18)
$R_{14-1}$: $-(CH=CH)_2-NO_2$
$R_{14-2}$: $-H$
$R_{14-3}$: $-H$
$R_{14-4}$:
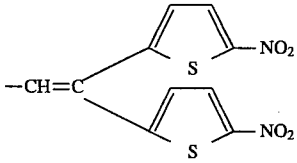
k 2
Compound 14-(19)
$R_{14-1}$: $-(CH=CH)_2-NO_2$
$R_{14-2}$: $-H$
$R_{14-3}$: $-H$
$R_{14-4}$:
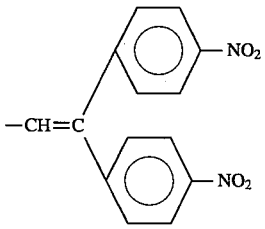
k 1
Compound 14-(20)
$R_{14-1}$:
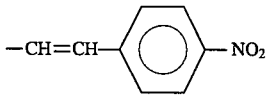
$R_{14-2}$: $-H$
$R_{14-3}$: $-H$
$R_{14-4}$:
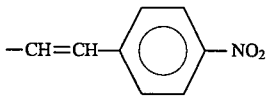
Basic constitution
(Formula 14)
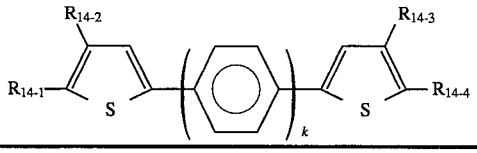
k: 1
Compound 14-(21)
$R_{14-1}$:
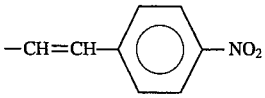
$R_{14-2}$: $-H$
$R_{14-3}$: $-H$
$R_{14-4}$:
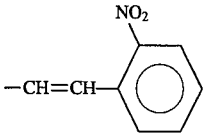
k: 1
Compound 14-(22)
$R_{14-1}$:
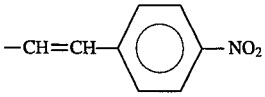
$R_{14-2}$: $-H$
$R_{14-3}$: $-H$
$R_{14-4}$:
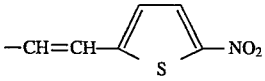
k: 1
Compound 14-(23)
$R_{14-1}$:
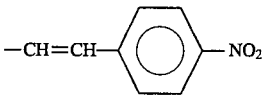
$R_{14-2}$: $-H$
$R_{14-3}$: $-H$
$R_{14-4}$:
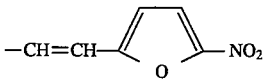
k: 1
Compound 14-(24)
$R_{14-1}$:
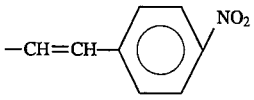
$R_{14-2}$: $-H$
$R_{14-3}$: $-H$ Basic constitution
(Formula 14)
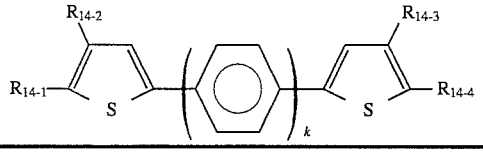
$R_{14-4}$:
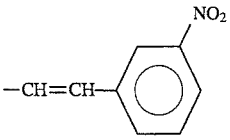
k: 2
Compound 14-(25)
$R_{14-1}$:
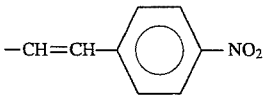
$R_{14-2}$: —H
$R_{14-3}$: —H
$R_{14-4}$:
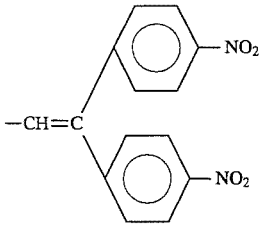
k: 1
Compound 14-(26)
$R_{14-1}$:
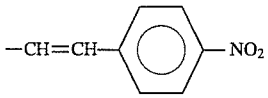
$R_{14-2}$: —H
$R_{14-3}$: —H
$R_{14-4}$:
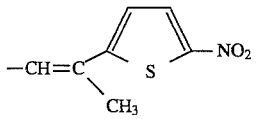
k: 1
Compound 14-(27)
$R_{14-1}$:
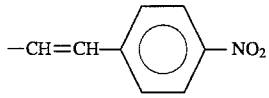
$R_{14-2}$: —H
$R_{14-3}$: —H
$R_{14-4}$:
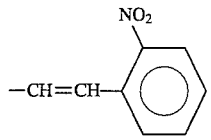
k: 1
Basic constitution
(Formula 14)
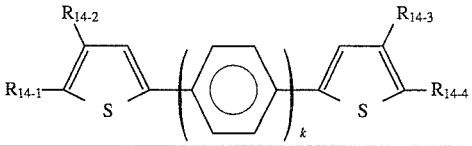
Compound 14-(28)
$R_{14-1}$:
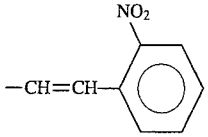
$R_{14-2}$: —H
$R_{14-3}$: —H
$R_{14-4}$:
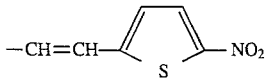
k: 1
Compound 14-(29)
$R_{14-1}$:
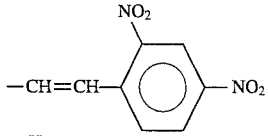
$R_{14-2}$: —H
$R_{14-3}$:
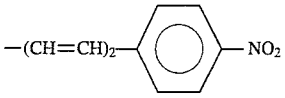
$R_{14-4}$:
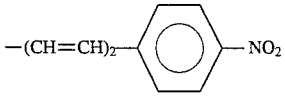
k: 1
Compound 14-(30)
$R_{14-1}$:
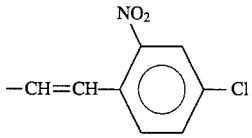
$R_{14-2}$: —H
$R_{14-3}$: —H
$R_{14-4}$:
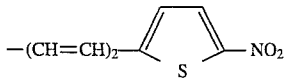
k: 1
Compound 14-(31)
$R_{14-1}$:
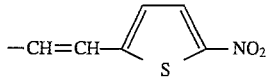
$R_{14-2}$: —H
$R_{14-3}$: —H Basic constitution
(Formula 14)
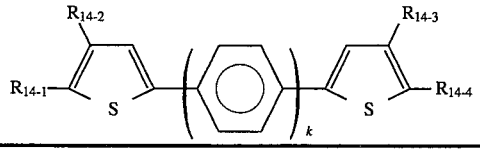
$R_{14-4}$:
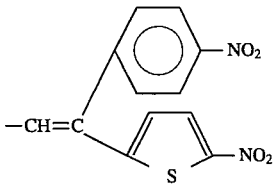
k: 1
Compound 14-(32)
$R_{14-1}$:
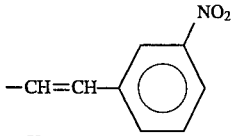
$R_{14-2}$: —H
$R_{14-3}$: —H
$R_{14-4}$:
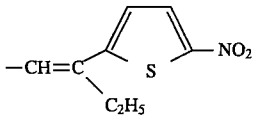
k: 1
Compound 14-(33)
$R_{14-1}$:
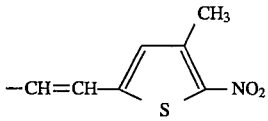
$R_{14-2}$: —H
$R_{14-3}$: —H
$R_{14-4}$:
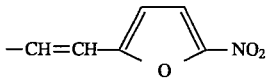
k: 2
Compound 14-(34)
$R_{14-1}$:
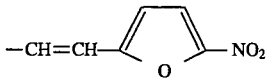
$R_{14-2}$: —H
$R_{14-3}$: —H
$R_{14-4}$:
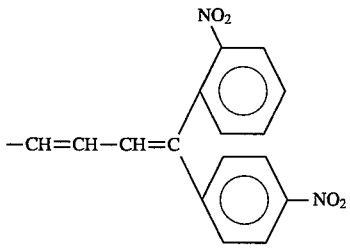
Basic constitution
(Formula 14)
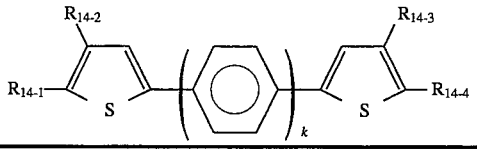
k: 1
Compound 14-(35)
$R_{14-1}$:
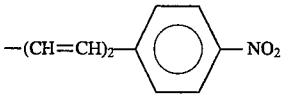
$R_{14-2}$: —H
$R_{14-3}$: —H
$R_{14-4}$:
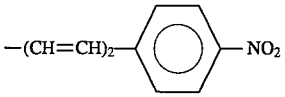
k: 1
Compound 14-(36)
$R_{14-1}$:
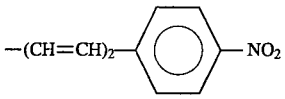
$R_{14-2}$: —H
$R_{14-3}$: —H
$R_{14-4}$:
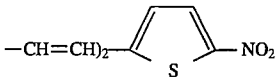
k: 1
Compound 14-(37)
$R_{14-1}$:
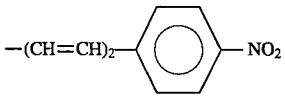
$R_{14-2}$: —H
$R_{14-3}$: —H
$R_{14-4}$:
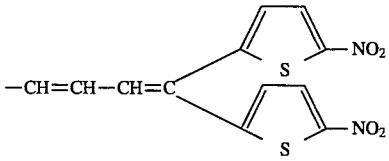
k: 1
Compound 14-(38)
$R_{14-1}$:
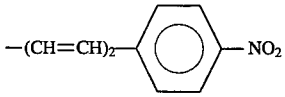
$R_{14-2}$: —H
$R_{14-3}$: —H Basic constitution
(Formula 14)
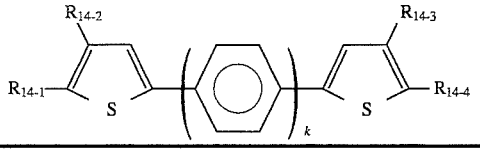
$R_{14-4}$:
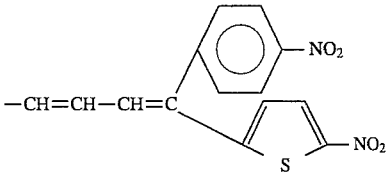
k: 1
Compound 14-(39)
$R_{14-1}$:
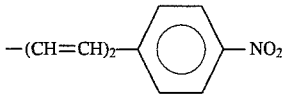
$R_{14-2}$: —H
$R_{14-3}$: —H
$R_{14-4}$:
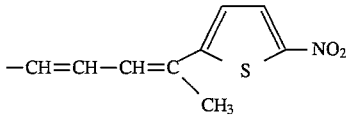
k: 2
Compound 14-(40)
$R_{14-1}$: —CH=CH—$NO_2$
$R_{14-2}$: —H
$R_{14-3}$: —H
$R_{14-4}$: —CH=CH—$NO_2$
k: 2
Compound 14-(41)
$R_{14-1}$: —CH=CH—$NO_2$
$R_{14-2}$: —Cl
$R_{14-3}$: —H
$R_{14-4}$: —CH=CH—$NO_2$
k: 2
Compound 14-(42)
$R_{14-1}$: —CH=CH—$NO_2$
$R_{14-2}$: —Br
$R_{14-3}$: —H
$R_{14-4}$:
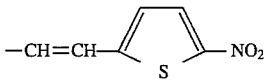
k: 1
Compound 14-(43)
$R_{14-1}$: —CH=CH—$NO_2$
$R_{14-2}$: —Cl
$R_{14-3}$: —Cl
$R_{14-4}$:
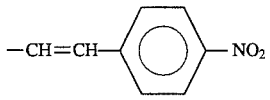
Basic constitution
(Formula 14)
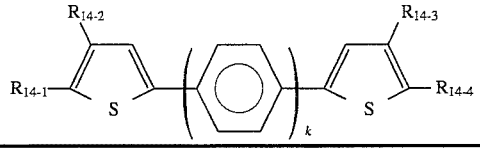
k: 1
Compound 14-(44)
$R_{14-1}$:
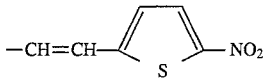
$R_{14-2}$: —Br
$R_{14-3}$: —H
$R_{14-4}$:
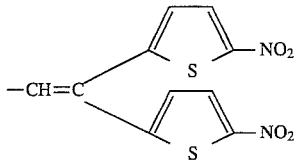
k: 1
Compound 14-(45)
$R_{14-1}$:
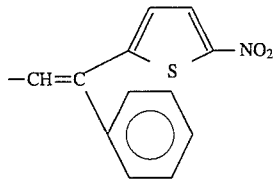
$R_{14-2}$: —H
$R_{14-3}$: —H
$R_{14-4}$:
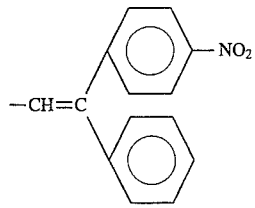
k: 1
Compound 14-(46)
$R_{14-1}$:
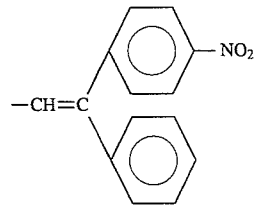
$R_{14-2}$: —H
$R_{14-3}$: —H Basic constitution (Formula 14)
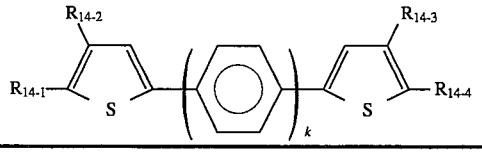
$R_{14-4}$:
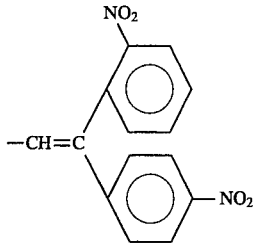
k: 1
Compound 14-(47)
$R_{14-1}$:
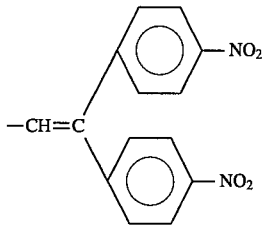
$R_{14-2}$: —H
$R_{14-3}$: —H
$R_{14-4}$:
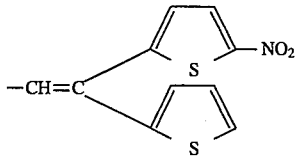
k: 1
Compound 14-(48)
$R_{14-1}$:
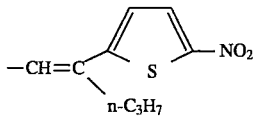
$R_{14-2}$: —H
$R_{14-3}$: —H
$R_{14-4}$:
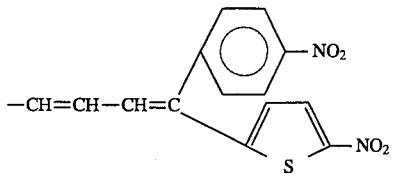
k: 1
Compound 14-(49)
Basic constitution (Formula 14)
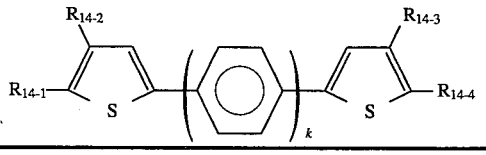
$R_{14-1}$:
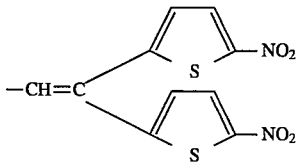
$R_{14-2}$: —H
$R_{14-3}$: —H
$R_{14-4}$:
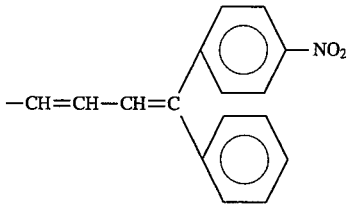
k: 1
Compound 14-(50)
$R_{14-1}$:
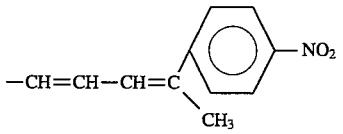
$R_{14-2}$: —H
$R_{14-3}$: —H
$R_{14-4}$:
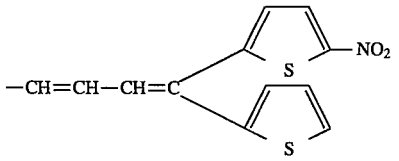
k: 1
Compound 14-(51)
14-1:
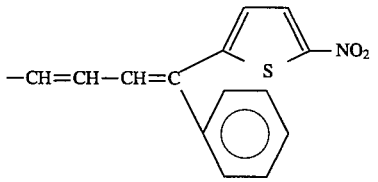
$R_{14-2}$: —H
$R_{14-3}$: —H
$R_{14-4}$:
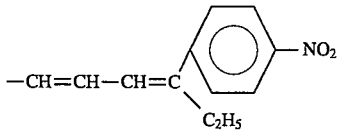
k: 1

Basic constitution
(Formula 14)

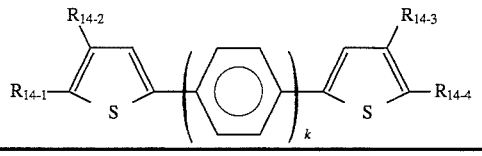

Compound 14-(52)

$R_{14-1}$:

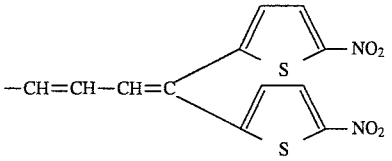

$R_{14-2}$: —H
$R_{14-3}$: —H $R_{14-4}$:

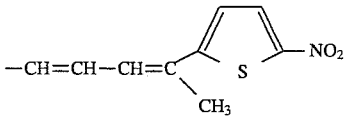

k: 2

Compound 14-(53)

$R_{14-1}$: —CH=CH—$NO_2$
$R_{14-2}$: —$CH_3$
$R_{14-3}$: —H $R_{14-4}$:

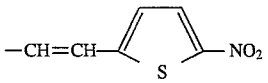

k: 1

Compound 14-(54)

$R_{14-1}$:

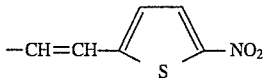

$R_{14-2}$: —$C_2H_5$
$R_{14-3}$: H $R_{14-4}$:

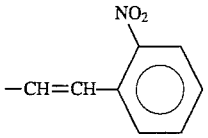

k: 1

Compound 14-(55)

$R_{14-1}$:

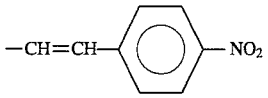

$R_{14-2}$: —$C_4H_9$(t)
$R_{14-3}$: —H $R_{14-4}$:

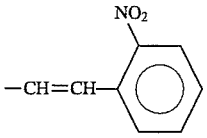

Basic constitution
(Formula 14)

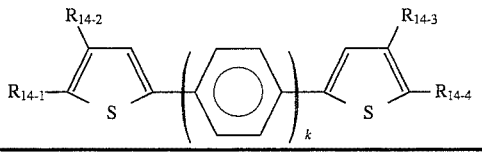

k: 1

Compound 14-(56)

$R_{14-1}$: —CH=CH—$NO_2$
$R_{14-2}$: —$CH_3$
$R_{14-3}$: —$CH_3$ $R_{14-4}$:

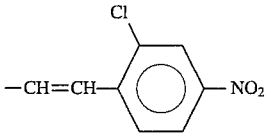

k: 1

Compound 14-(57)

$R_{14-1}$:

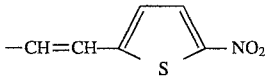

$R_{14-2}$: —$C_4H_9$(t)
$R_{14-3}$: —$CH_3$ $R_{14-4}$:

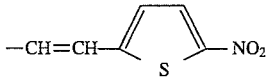

k: 1

Compound 14-(58)

$R_{14-1}$: —CH=CH—$NO_2$
$R_{14-2}$: —CH=CH—$NO_2$
$R_{14-3}$: —H $R_{14-4}$:

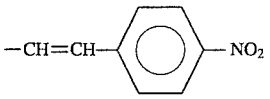

k: 1

Compound 14-(59)

$R_{14-1}$:

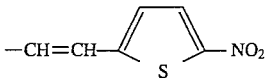

$R_{14-2}$: —CH=CH—$NO_2$
$R_{14-3}$: —H $R_{14-4}$:

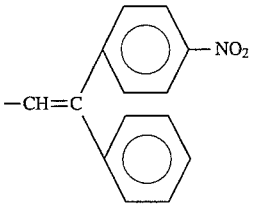

k: 1

Compound 14-(60)

$R_{14-1}$: —CH=CH—$NO_2$

Basic constitution
(Formula 14)

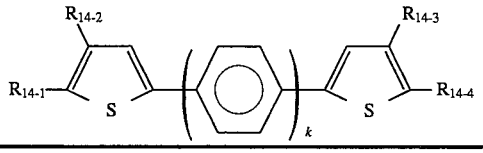

$R_{14-2}$: 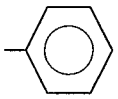

$R_{14-3}$: $-CH_3$ $R_{14-4}$: 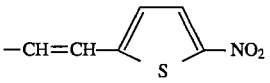

k: 1

Compound 14-(61)

$R_{14-1}$: 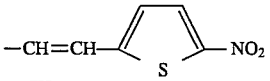

$R_{14-2}$: $-CH_2$ $R_{14-3}$: $-H$ $R_{14-1}$: 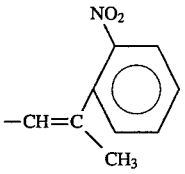

k: 1

Compound 14-(62)

$R_{14-1}$: $-CH=CH-NO_2$ $R_{14-2}$: 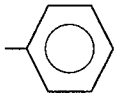

$R_{14-3}$: 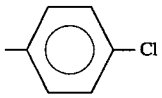

$R_{14-4}$: $-(CH=CH)_2-NO_2$ k: 1

Compound 14-(63)

$R_{14-1}$: 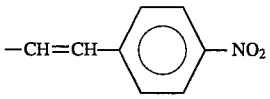

$R_{14-2}$: $-CH=CH-NO_2$ $R_{14-3}$: $-H$ $R_{14-4}$: $-C_4H_9(t)$ k: 1

Compound 14-(64)

Basic constitution
(Formula 14)

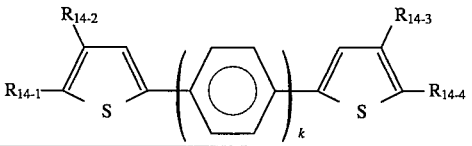

$R_{14-1}$: 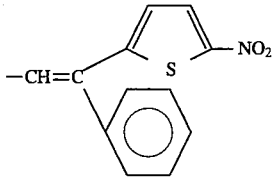

$R_{14-2}$: $-H$ $R_{14-3}$: 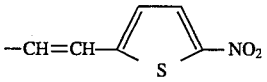

$R_{14-4}$: $-H$ k: 1

Compound 14-(65)

$R_{14-1}$: 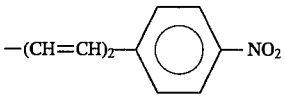

$R_{14-2}$: $-(CH=CH)_2-NO_2$ $R_{14-3}$: $-CH_3$ $R_{14-4}$: $-H$ k: 1

Compound 14-(66)

$R_{14-1}$: $-CH=CH-NO_2$ $R_{14-2}$: 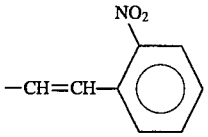

$R_{14-3}$: $-H$ $R_{14-4}$: $-H$ k: 2

Compound 14-(67)

$R_{14-1}$: $-CH=CH-NO_2$ $R_{14-2}$: 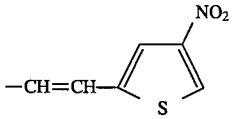

$R_{14-3}$: $-H$ $R_{14-4}$: $-H$ k: 1

Compound 14-(68)

$R_{14-1}$: 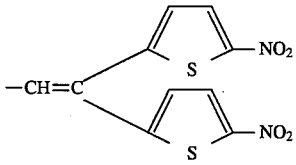

Basic constitution
(Formula 14)

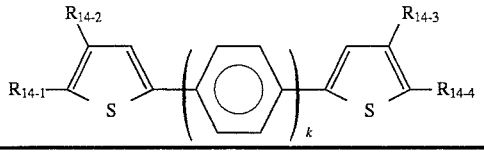

$R_{14-2}$: $-CH=CH-NO_2$
$R_{14-3}$: $-C_4H_9(t)$
$R_{14-4}$: $-H$
k: 1

Compound 14-(69)

$R_{14-1}$:

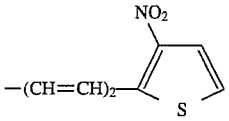

$R_{14-2}$: $-H$
$R_{14-3}$: $-CH=CH-NO_2$
$R_{14-4}$: $-CH_3$
k: 1

Compound 14-(70)

$R_{14-1}$: $-H$
$R_{14-2}$: $-CH=CH-NO_2$
$R_{14-3}$: $-CH=CH-NO_2$
$R_{14-4}$: $-H$
k: 1

Compound 14-(71)

$R_{14-1}$: $-H$ $R_{14-2}$:

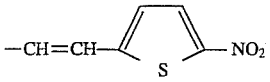

$R_{14-3}$:

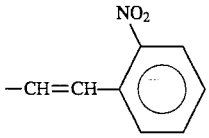

$R_{14-4}$: $-H$
k: 1

Compound 14-(72)

$R_{14-1}$: $-H$
$R_{14-2}$: $-CH=CH-NO_2$ $R_{14-3}$:

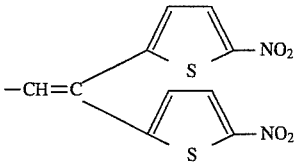

$R_{14-4}$: $-H$
k: 1

Compound 14-(73)

$R_{14-1}$: $-H$
$R_{14-2}$: $-(CH=CH)_2-NO_2$

Basic constitution
(Formula 14)

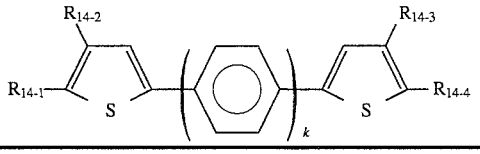

$R_{14-3}$:

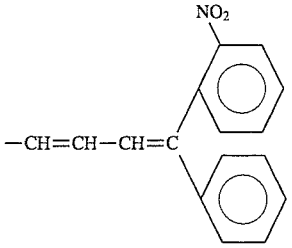

$R_{14-4}$: $-H$
k: 1

Compound 14-(74)

$R_{14-1}$: $-CH_3$ $R_{14-2}$:

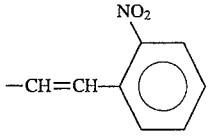

$R_{14-3}$: $(CH=CH)_2-NO_2$
$R_{14-4}$: $CH_3$
k: 1

Compound 14-(75)

$R_{14-1}$:

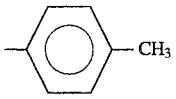

$R_{14-2}$:

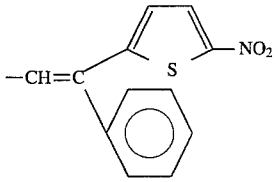

$R_{14-3}$: $-CH=CH-NO_2$
$R_{14-4}$: $-CH=CH-NO_2$
k: 1

Compound 14-(76)

$R_{14-1}$: $-CH=CH-NO_2$
$R_{14-2}$: $-CH_3$
$R_{14-3}$: $-H$ $R_{14-4}$:

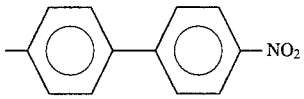

k: 1

Compound 14-(77)

$R_{14-1}$:

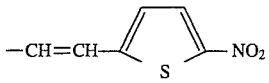

$R_{14-2}$: $-H$

Basic constitution
(Formula 14)
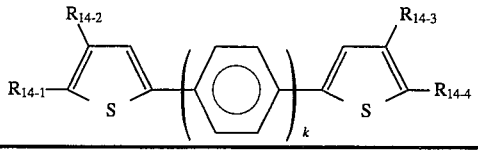
$R_{14-3}$: —H
$R_{14-4}$:
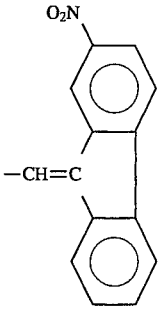
k: 1
Compound 14-(78)
$R_{14-1}$: —CH=CH—$NO_2$
$R_{14-2}$: —H
$R_{14-3}$: —H
$R_{14-4}$:
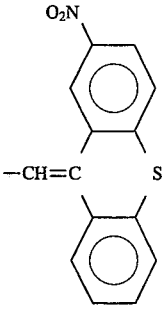
k: 1
Compound 14-(79)
$R_{14-1}$:
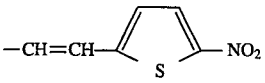
$R_{14-2}$: —H
$R_{14-3}$: —H
$R_{14-4}$:
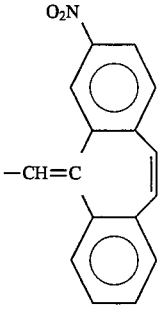
k: 1
Basic constitution
(Formula 14)
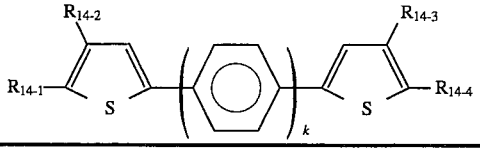
Compound 14-(80)
$R_{14-1}$:
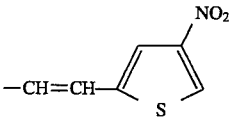
$R_{14-2}$: —H
$R_{14-3}$: —CH=CH—$NO_2$
$R_{14-4}$: —H
k: 1
Compound 14-(81)
$R_{14-1}$: CH=CH—$NO_2$
$R_{14-2}$: $CH_3$
$R_{14-3}$:
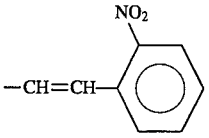
$R_{14-4}$: —H
k: 1
Compound 14-(82)
$R_{14-1}$: —$C_4H_9$(t)
$R_{14-2}$: —(CH=CH)$_2$—$NO_2$
$R_{14-3}$:
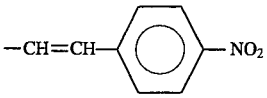
$R_{14-4}$: —H
k: 1
Compound 14-(83)
$R_{14-1}$: —$C_4H_9$(t)
$R_{14-2}$: CH=CH—$NO_2$
$R_{14-3}$:
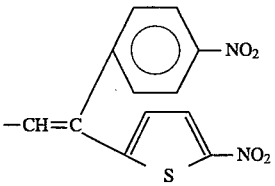
$R_{14-4}$: —H
k: 1
Compound 14-(84)
$R_{14-1}$:
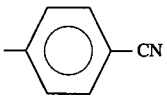
$R_{14-2}$: —CH=CH—$NO_2$
$R_{14-3}$: —CH=CH—$NO_2$ Basic constitution
(Formula 14)
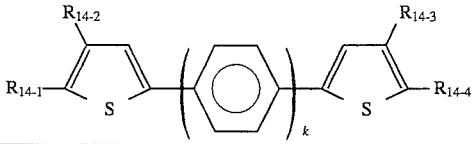
$R_{14-4}$:
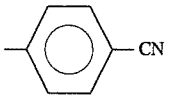
k: 1
Compound 14-(85)
$R_{14-1}$:
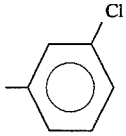
$R_{14-2}$: $-CH=CH-NO_2$
$R_{14-3}$:
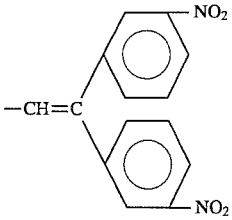
$R_{14-4}$:
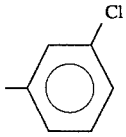
k: 1
Compound 14-(86)
$R_{14-1}$:
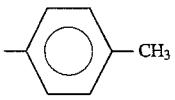
$R_{14-2}$:
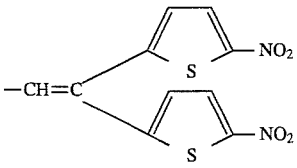
$R_{14-3}$:
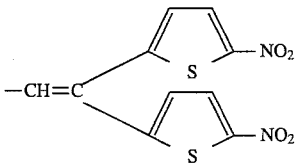
$R_{14-4}$:
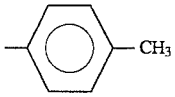
Basic constitution
(Formula 14)
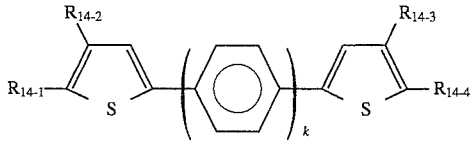
k: 1
Compound 14-(87)
$R_{14-1}$:
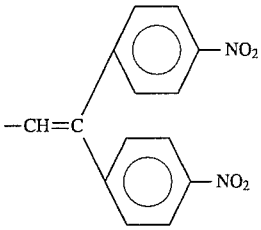
$R_{14-2}$: $-H$
$R_{14-3}$: $-CH=CH-NO_2$
$R_{14-4}$: $-C_2H_5$
k: 1
Compound 14-(88)
$R_{14-1}$:
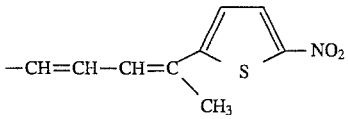
$R_{14-2}$: $-H$
$R_{14-3}$:
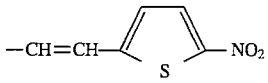
$R_{14-4}$: $-H$
k: 1
Compound 14-(89)
$R_{14-1}$: $-CH=CH-NO_2$
$R_{14-2}$: $-H$
$R_{14-3}$: $-H$
$R_{14-4}$: $-CH=CH-NO_2$
k: 2
Compound 14-(90)
$R_{14-1}$:
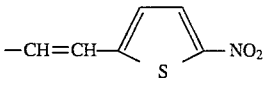
$R_{14-2}$: $-H$
$R_{14-3}$: $-CH_3$
$R_{14-4}$:
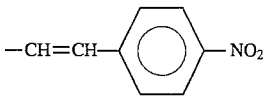
k: 2
Compound 14-(91)
$R_{14-1}$: $-(CH=CH)_2-NO_2$
$R_{14-2}$: $-H$
$R_{14-3}$: $-H$ Basic constitution
(Formula 14)
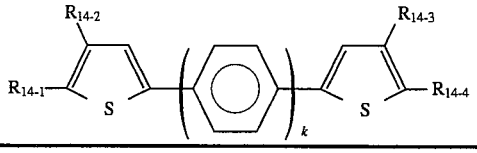
$R_{14-4}$:
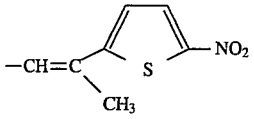
k: 2
Basic constitution
(Formula 15)
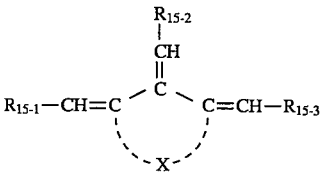
Compound 15-(1)
$R_{15-1}$:
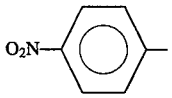
$R_{15-2}$:
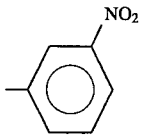
$R_{15-3}$:
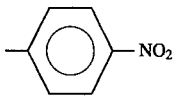
X: $-CH_2CH_2-$
Compound 15-(2)
$R_{15-1}$:
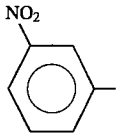
$R_{15-2}$:
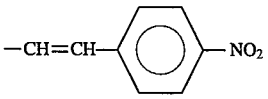
$R_{15-3}$:
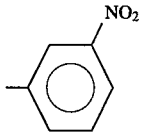
X: $-CH_2CH_2-$
Compound 15-(3)
Basic constitution
(Formula 15)
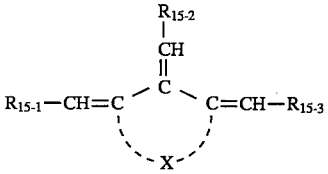
$R_{15-1}$:
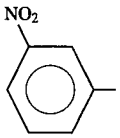
$R_{15-2}$:
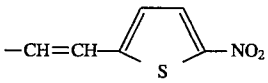
$R_{15-3}$:
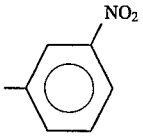
X: $-CH_2CH_2-$
Compound 15-(4)
$R_{15-1}$:
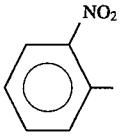
$R_{15-2}$: $-CH=CH-NO_2$
$R_{15-3}$:
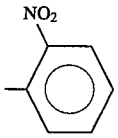
X: $-CH_2CH_2-$
Compound 15-(5)
$R_{15-1}$:
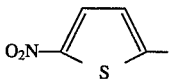
$R_{15-2}$:
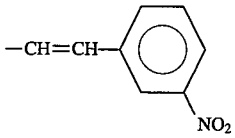
$R_{15-3}$:
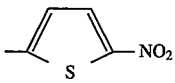
X: $-CH_2CH_2-$
Compound 15-(6)
$R_{15-1}$:
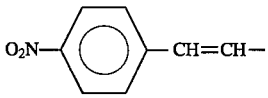

Basic constitution (Formula 15)

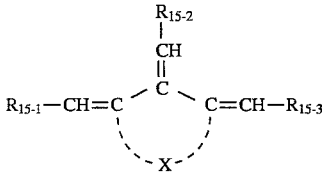

$R_{15\text{-}2}$:

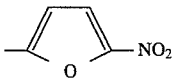

$R_{15\text{-}3}$: $-CH=CH-NO_2$

X: $-CH_2CH_2-$

Compound 15-(7)

$R_{15\text{-}1}$:

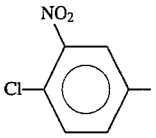

$R_{15\text{-}2}$:

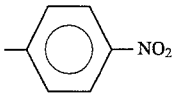

$R_{15\text{-}3}$:

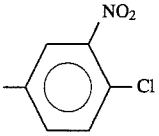

X: $-CH_2CH_2CH_2-$

Compound 15-(8)

$R_{15\text{-}1}$:

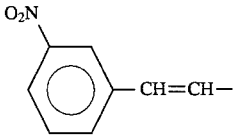

$R_{15\text{-}2}$:

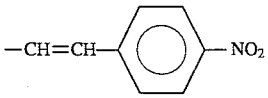

$R_{15\text{-}3}$:

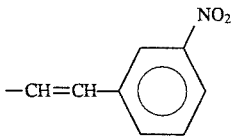

X: $-CH_2CH_2CH_2-$

Compound 15-(9)

$R_{15\text{-}1}$:

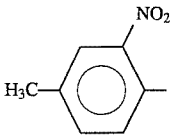

Basic constitution (Formula 15)

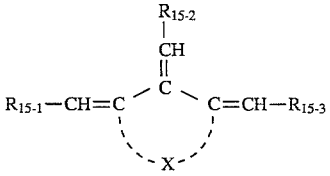

$R_{15\text{-}2}$:

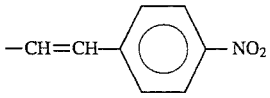

$R_{15\text{-}3}$:

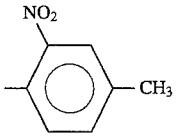

X: $-CH_2CH_2CH_2-$

Compound 15-(10)

$R_{15\text{-}1}$:

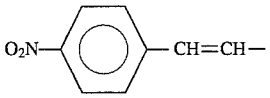

$R_{15\text{-}2}$:

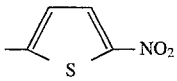

$R_{15\text{-}3}$:

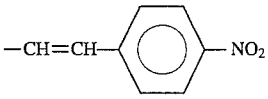

X: $-CH_2CH_2CH_2-$

Compound 15-(11)

$R_{15\text{-}1}$:

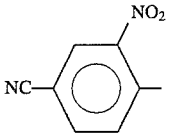

$R_{15\text{-}2}$: $-CH=CH-NO_2$ $R_{15\text{-}3}$:

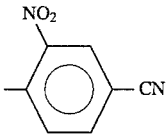

X: $-CH_2CH_2CH_2-$

Compound 15-(12)

$R_{15\text{-}1}$:

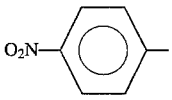

$R_{15\text{-}2}$:

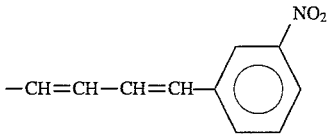

Basic constitution (Formula 15)
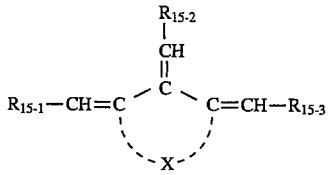
$R_{15\text{-}3}$:
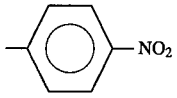
X: $-CH_2CH_2CH_2-$
Compound 15-(13)
$R_{15\text{-}1}$:
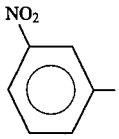
$R_{15\text{-}2}$:
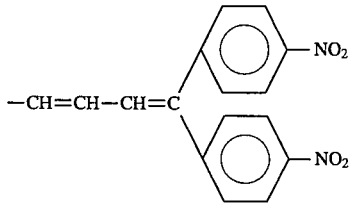
$R_{15\text{-}3}$:
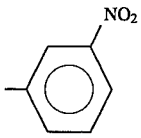
X: $-CH_2CH_2CH_2-$
Compound 15-(14)
$R_{15\text{-}1}$:
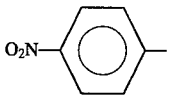
$R_{15\text{-}2}$:
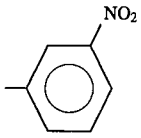
$R_{15\text{-}3}$:
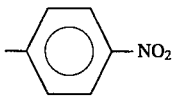
X: $-CH_2CHCH_2-$ ($CH_3$)
Compound 15-(15)
$R_{15\text{-}1}$:
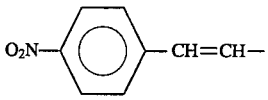
Basic constitution (Formula 15)
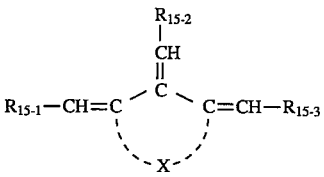
$R_{15\text{-}2}$:
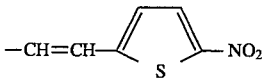
$R_{15\text{-}3}$: $-CH=CH-NO_2$
X: $-CH_2CHCH_2-$ ($CH_3$)
Compound 15-(16)
$R_{15\text{-}1}$:
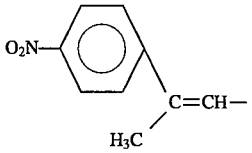
$R_{15\text{-}2}$:
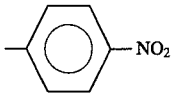
$R_{15\text{-}3}$:
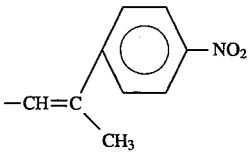
X: $-CH_2CHCH_2-$ ($CH_3$)
Compound 15-(17)
$R_{15\text{-}1}$:
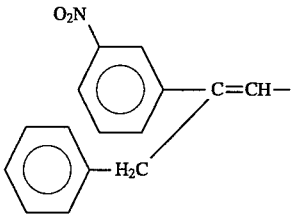
$R_{15\text{-}2}$:
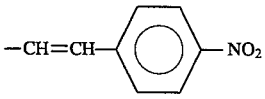
$R_{15\text{-}3}$:
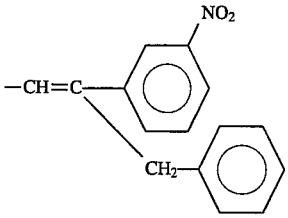

Basic constitution (Formula 15)

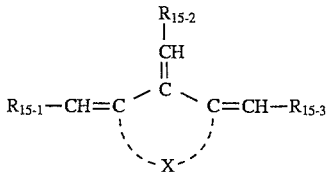

X: $-CH_2CH(CH_3)CH_2-$

Compound 15-(18)

$R_{15\text{-}1}$:

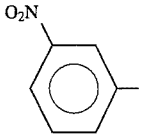

$R_{15\text{-}2}$:

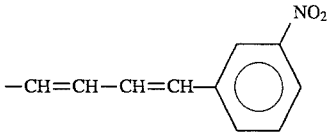

$R_{15\text{-}3}$:

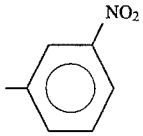

X: $-CH_2CH(CH_3)CH_2-$

Compound 15-(19)

$R_{15\text{-}1}$:

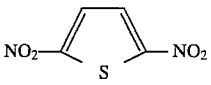

$R_{15\text{-}2}$:

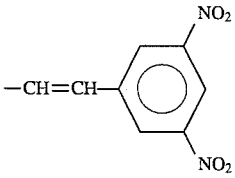

$R_{15\text{-}3}$:

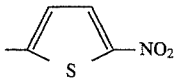

X: $-CH_2CH(CH_3)CH_2-$

Compound 15-(20)

$R_{15\text{-}1}$:

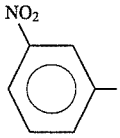

Basic constitution (Formula 15)

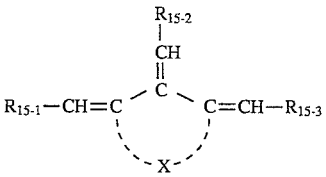

$R_{15\text{-}2}$:

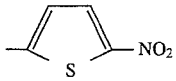

$R_{15\text{-}3}$:

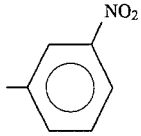

X: $-CH_2CH(C(CH_3)_2)CH_2-$

Compound 15-(21)

$R_{15\text{-}1}$:

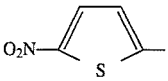

$R_{15\text{-}2}$:

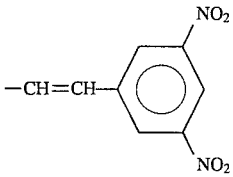

$R_{15\text{-}3}$:

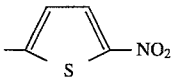

X: $-CH_2CH(C(CH_3)_2)CH_2-$

Compound 15-(22)

$R_{15\text{-}1}$: $O_2N-CH=CH-$ $R_{15\text{-}2}$:

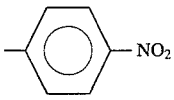

$R_{15\text{-}3}$: $-CH=CH-NO_2$

X: $-CH_2CH(C(CH_3)_2)CH_2-$

Compound 15-(23)

$R_{15\text{-}1}$:

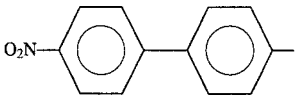

Basic constitution (Formula 15)
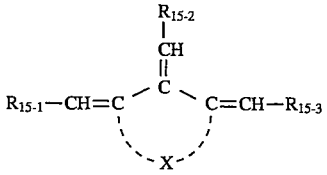
$R_{15\text{-}2}$:
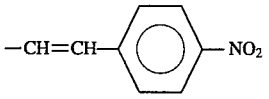
$R_{15\text{-}3}$:
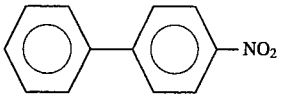
X:
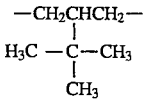
Compound 15-(24)
$R_{15\text{-}1}$:
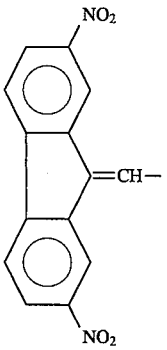
$R_{15\text{-}2}$:
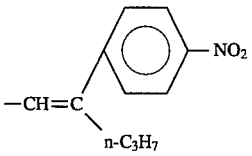
$R_{15\text{-}3}$:
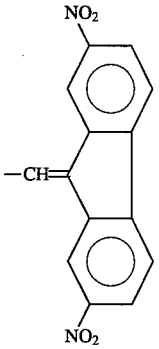
X:
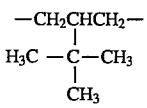
Compound 15-(25)
Basic constitution (Formula 15)
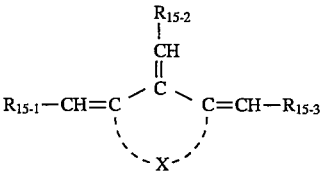
$R_{15\text{-}1}$:
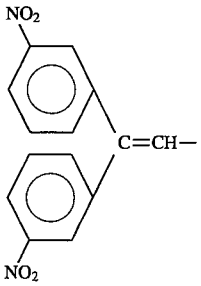
$R_{15\text{-}2}$:
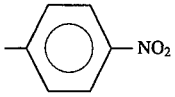
$R_{15\text{-}3}$:
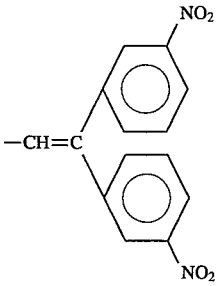
X:
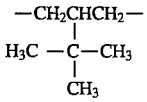
Compound 15-(26)
$R_{15\text{-}1}$:
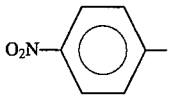
$R_{15\text{-}2}$:
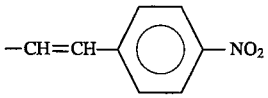
$R_{15\text{-}3}$:
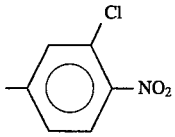
X:
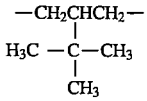
Compound 15-(27)

Basic constitution (Formula 15)
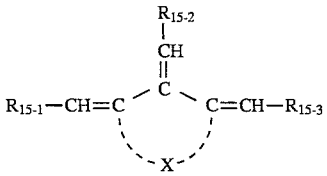
$R_{15\text{-}1}$:
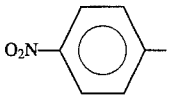
$R_{15\text{-}2}$:
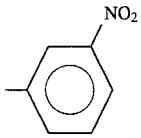
$R_{15\text{-}3}$:
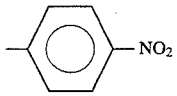
X:
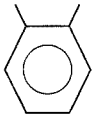
Compound 15-(28)
$R_{15\text{-}1}$:
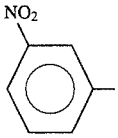
$R_{15\text{-}2}$:
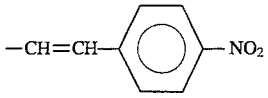
$R_{15\text{-}3}$:
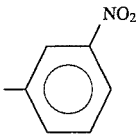
X:
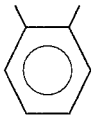
Compound 15-(29)
$R_{15\text{-}1}$:
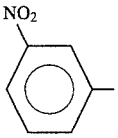
$R_{15\text{-}2}$:
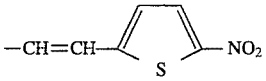
Basic constitution (Formula 15)
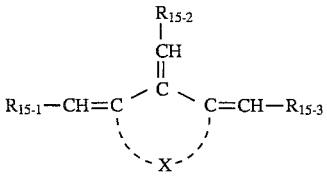
$R_{15\text{-}3}$:
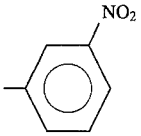
X:
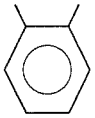
Compound 15-(30)
$R_{15\text{-}1}$:
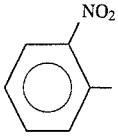
$R_{15\text{-}2}$:
$R_{15\text{-}3}$:
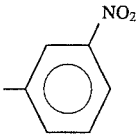
X:
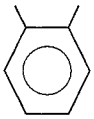
Compound 15-(31)
$R_{15\text{-}1}$:
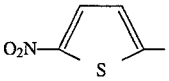
$R_{15\text{-}2}$:
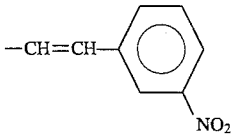
$R_{15\text{-}3}$:
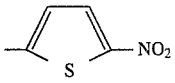
X:
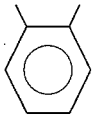
Compound 15-(32)

Basic constitution (Formula 15)
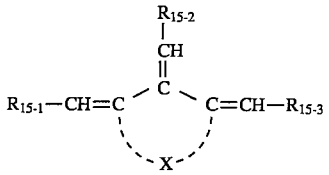
$R_{15-1}$:
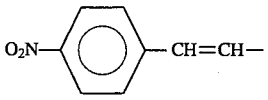
$R_{15-2}$:
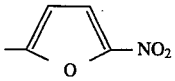
$R_{15-3}$: $-CH=CH-NO_2$
X:
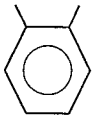
Compound 15-(33)
$R_{15-1}$:
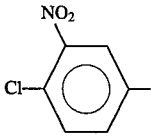
$R_{15-2}$:
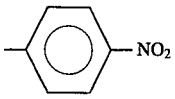
$R_{15-1}$:
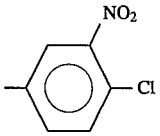
X:
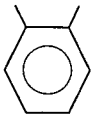
Compound 15-(34)
$R_{15-1}$:
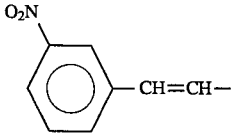
$R_{15-2}$:
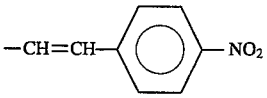
$R_{15-3}$:
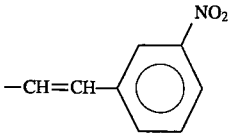
Basic constitution (Formula 15)
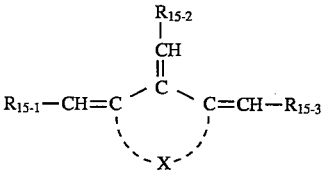
X:
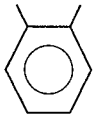
Compound 15-(35)
$R_{15-1}$:
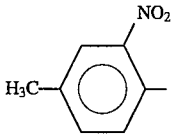
$R_{15-2}$:
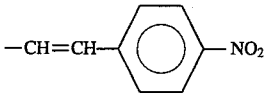
$R_{15-3}$:
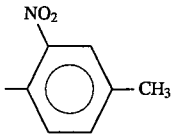
X:
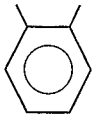
Compound 15-(36)
$R_{15-1}$:
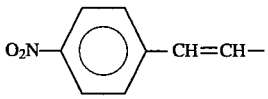
$R_{15-2}$:
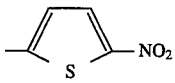
$R_{15-3}$:
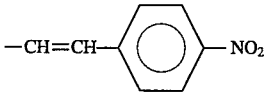
X:
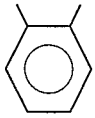
Compound 15-(37)

Basic constitution
(Formula 15)
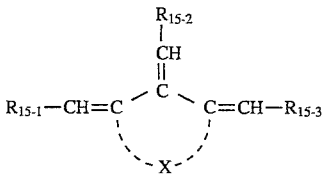
$R_{15\text{-}1}$:
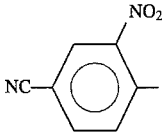
$R_{15\text{-}2}$: $-CH=CH-NO_2$
$R_{15\text{-}3}$:
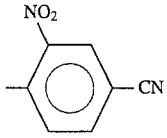
X:
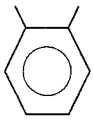
Compound 15-(38)
$R_{15\text{-}1}$:
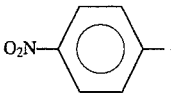
$R_{15\text{-}2}$:
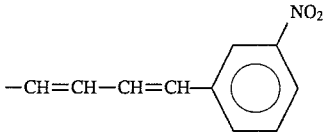
$R_{15\text{-}3}$:
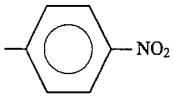
X:
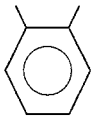
Compound 15-(39)
$R_{15\text{-}1}$:
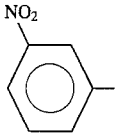
Basic constitution
(Formula 15)
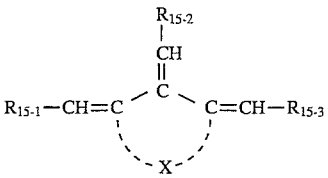
$R_{15\text{-}2}$:
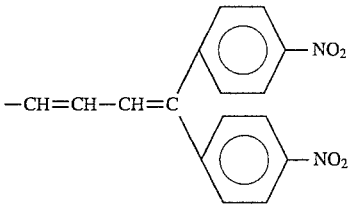
$R_{15\text{-}3}$:
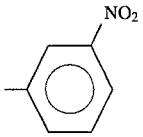
X:
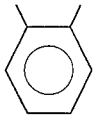
Compound 15-(40)
$R_{15\text{-}1}$:
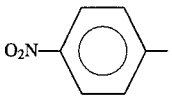
$R_{15\text{-}2}$:
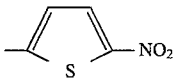
$R_{15\text{-}3}$:
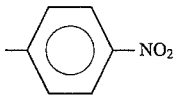
X:
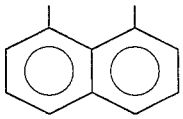
Compound 15-(41)
$R_{15\text{-}1}$:
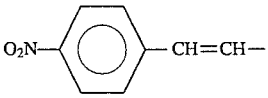
$R_{15\text{-}2}$:
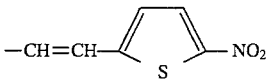
$R_{15\text{-}3}$: $-CH=CH-NO_2$
X:
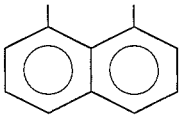

Basic constitution (Formula 15)
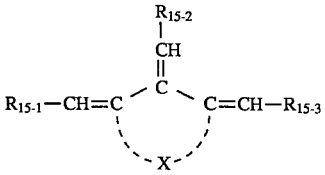
Compound 15-(42)
$R_{15\text{-}1}$:
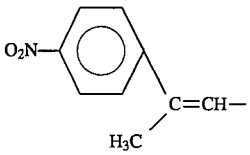
$R_{15\text{-}2}$:
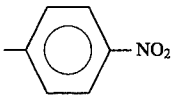
$R_{15\text{-}3}$:
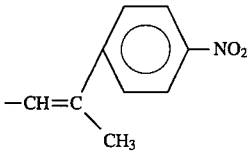
X:
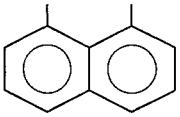
Compound 15-(43)
$R_{15\text{-}1}$:
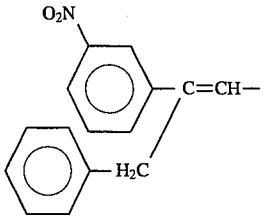
$R_{15\text{-}2}$:
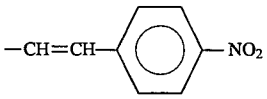
$R_{15\text{-}3}$:
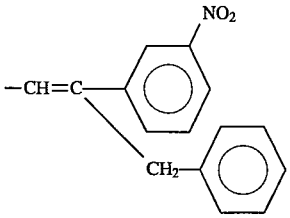
X:
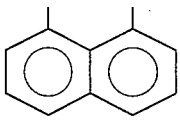
Basic constitution (Formula 15)
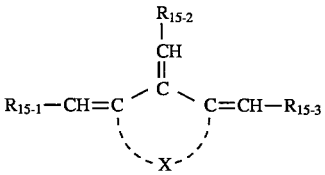
Compound 15-(44)
$R_{15\text{-}1}$:
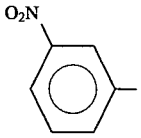
$R_{15\text{-}2}$:
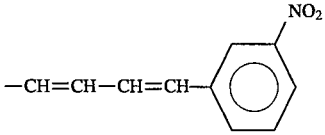
$R_{15\text{-}3}$:
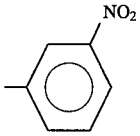
X:
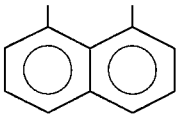
Compound 15-(45)
$R_{15\text{-}1}$:
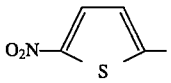
$R_{15\text{-}2}$:
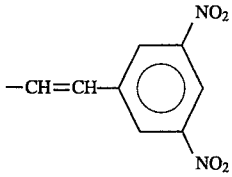
$R_{15\text{-}3}$:
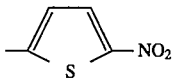
X:
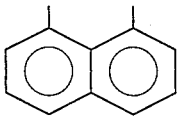
Compound 15-(46)
$R_{15\text{-}1}$:
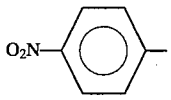

Basic constitution
(Formula 15)
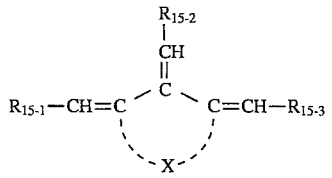
$R_{15\text{-}2}$:
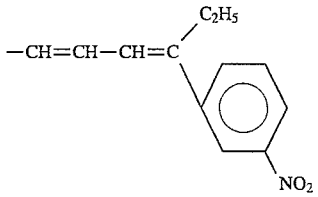
$R_{15\text{-}3}$:
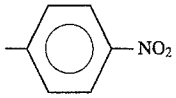
X:
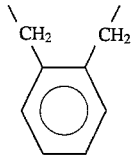
Compound 15-(47)
$R_{15\text{-}1}$:
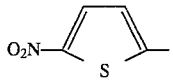
$R_{15\text{-}2}$:
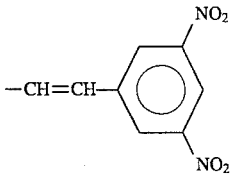
$R_{15\text{-}3}$:
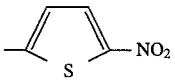
X:
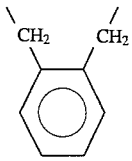
Compound 15-(48)
$R_{15\text{-}1}$: $O_2N-CH=CH-$
$R_{15\text{-}2}$:
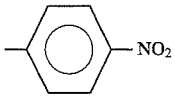
$R_{15\text{-}3}$: $-CH=CH-NO_2$
Basic constitution
(Formula 15)
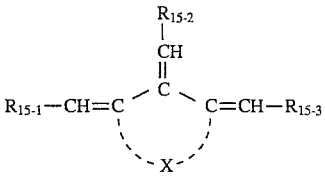
X:
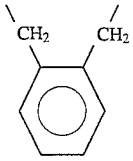
Compound 5-(49)
$R_{15\text{-}1}$:
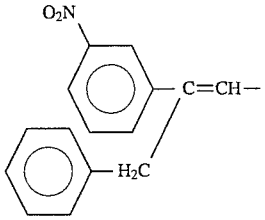
$R_{15\text{-}2}$:
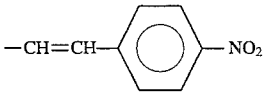
$R_{15\text{-}3}$:
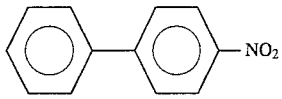
X:
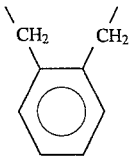
Compound 15-(50)
$R_{15\text{-}1}$:
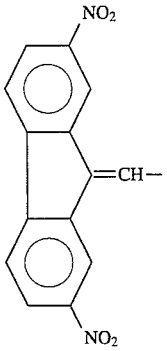
$R_{15\text{-}2}$:
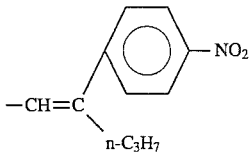

Basic constitution (Formula 15)
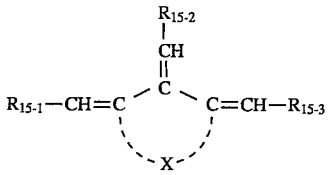
$R_{15-3}$:
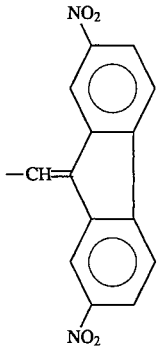
X:
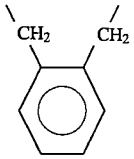
Compound 15-(51)
$R_{15-1}$:
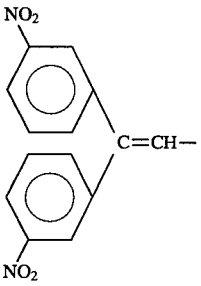
$R_{15-2}$:
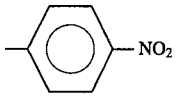
$R_{15-3}$:
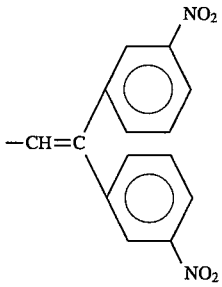
Basic constitution (Formula 15)
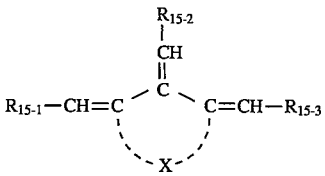
X:
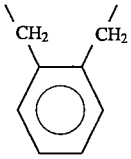
Compound 15-(52)
$R_{15-1}$:
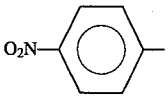
$R_{15-2}$:
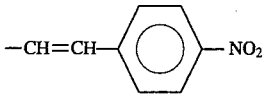
$R_{15-3}$:
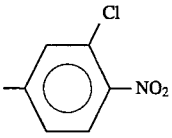
X:
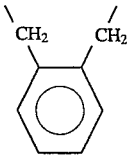
Compound 15-(53)
$R_{15-1}$:
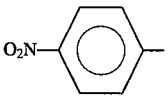
$R_{15-2}$:
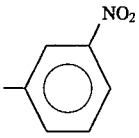
$R_{15-3}$:
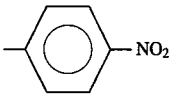
X:
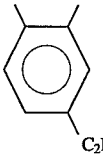
Compound 15-(54)

Basic constitution (Formula 15)
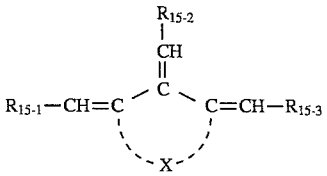
$R_{15\text{-}1}$:
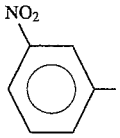
$R_{15\text{-}2}$:
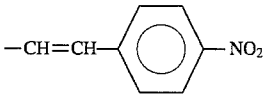
$R_{15\text{-}3}$:
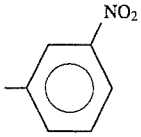
X:
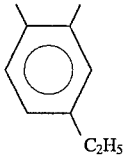
Compound 15-(55)
$R_{15\text{-}1}$:
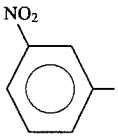
$R_{15\text{-}2}$:
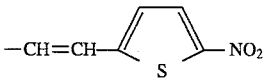
$R_{15\text{-}3}$:
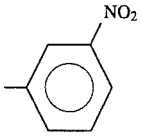
X:
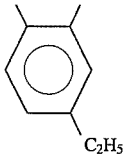
Compound 15-(56)
$R_{15\text{-}1}$:
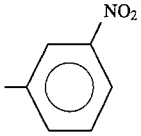
Basic constitution (Formula 15)
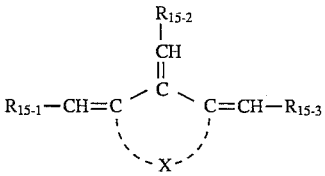
$R_{15\text{-}2}$: $-CH=CH-NO_2$
$R_{15\text{-}3}$:
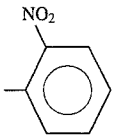
X:
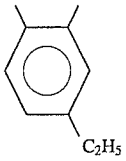
Compound 15-(57)
$R_{15\text{-}1}$:
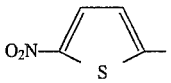
$R_{15\text{-}2}$:
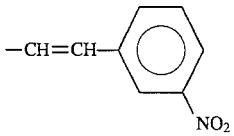
$R_{15\text{-}3}$:
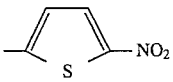
X:
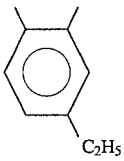
Compound 15-(58)
$R_{15\text{-}1}$:
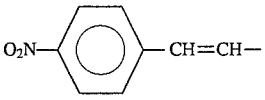
$R_{15\text{-}2}$:
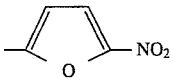
$R_{15\text{-}3}$: $-CH=CH-NO_2$
X:
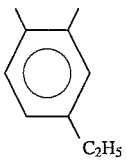

Basic constitution (Formula 15)
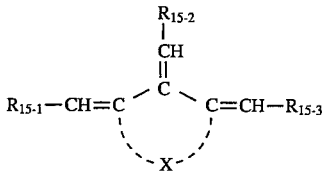
Compound 15-(59)
$R_{15\text{-}1}$:
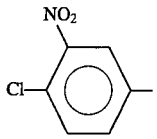
$R_{15\text{-}2}$:
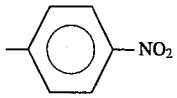
$R_{15\text{-}3}$:
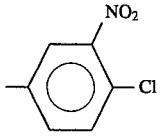
X:
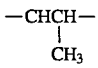
Compound 15-(60)
$R_{15\text{-}1}$:
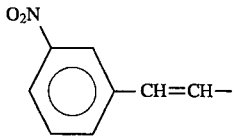
$R_{15\text{-}2}$:
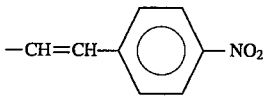
$R_{15\text{-}3}$:
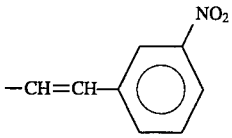
X:
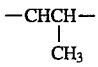
Compound 15-(61)
$R_{15\text{-}1}$:
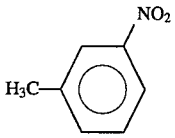
$R_{15\text{-}2}$:
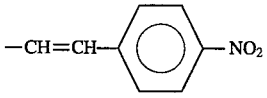
Basic constitution (Formula 15)
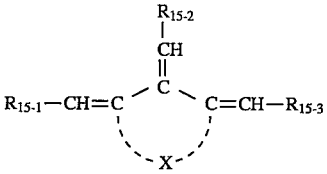
$R_{15\text{-}3}$:
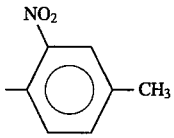
X:
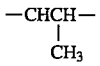
Compound 15-(62)
$R_{15\text{-}1}$:
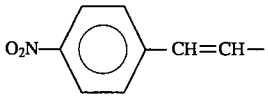
$R_{15\text{-}2}$:
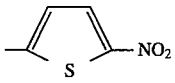
$R_{15\text{-}3}$:
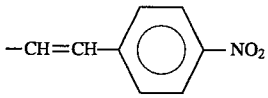
X:
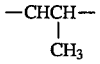
Compound 15-(63)
$R_{15\text{-}1}$:
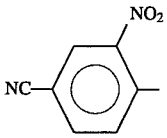
$R_{15\text{-}2}$: $-CH=CH-NO_2$
$R_{15\text{-}3}$:
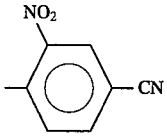
X:
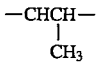
Compound 15-(64)
$R_{15\text{-}1}$:
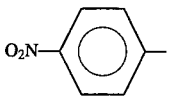

Basic constitution
(Formula 15)
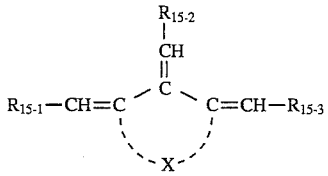
$R_{15-2}$:
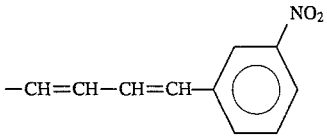
$R_{15-3}$:
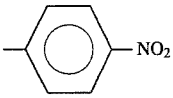
X:
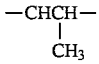
Compound 15-(65)
$R_{15-1}$:
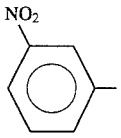
$R_{15-2}$:
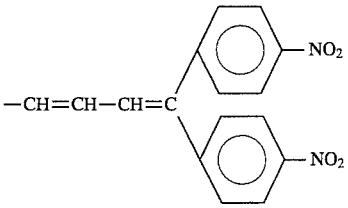
$R_{15-3}$:
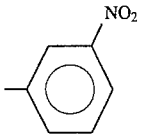
X:
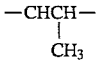
Compound 15-(66)
$R_{15-1}$:
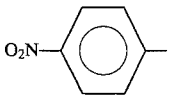
$R_{15-2}$:
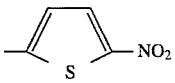
$R_{15-3}$:
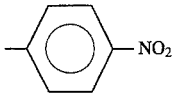
X: $-CH_2CH_2CH_2CH_2-$
Basic constitution
(Formula 15)
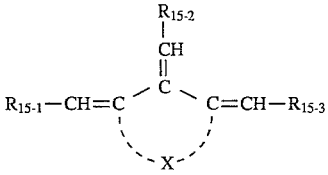
Compound 15-(67)
$R_{15-1}$:
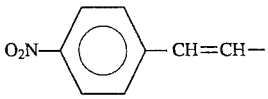
$R_{15-2}$:
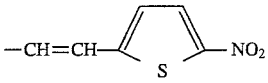
$R_{15-3}$: $-CH=CH-NO_2$
X: $-CH_2CH_2CH_2CH_2-$
Compound 15-(68)
$R_{15-1}$:
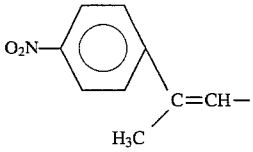
$R_{15-2}$:
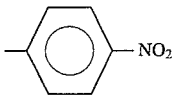
$R_{15-3}$:
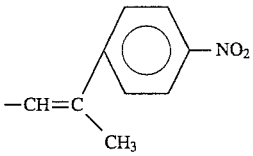
X: $-CH_2CH_2CH_2CH_2-$
Compound 15-(69)
$R_{15-1}$:
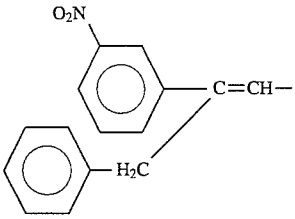
$R_{15-2}$:
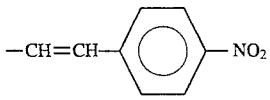

Basic constitution (Formula 15)

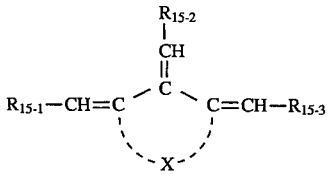

$R_{15\text{-}3}$:

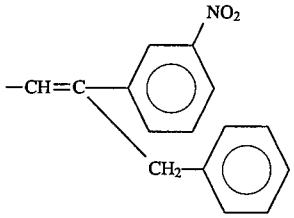

X: $-CH_2CH_2CH_2CH_2-$

Compound 15-(70)

$R_{15\text{-}1}$:

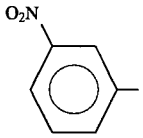

$R_{15\text{-}2}$:

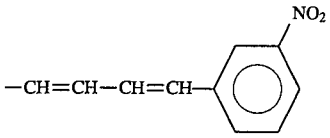

$R_{15\text{-}3}$:

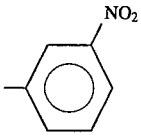

X: $-CH_2CH_2CH_2CH_2-$

Compound 15-(71)

$R_{15\text{-}1}$:

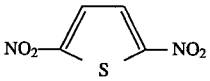

$R_{15\text{-}2}$:

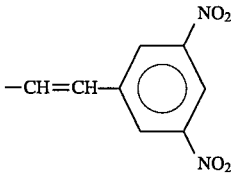

$R_{15\text{-}3}$:

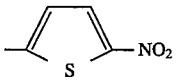

X: $-CH_2CH_2CH_2CH_2-$

Compound 15-(72)

$R_{15\text{-}1}$:

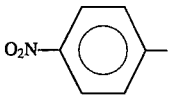

Basic constitution (Formula 15)

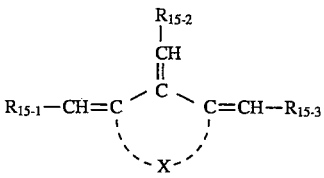

$R_{15\text{-}2}$:

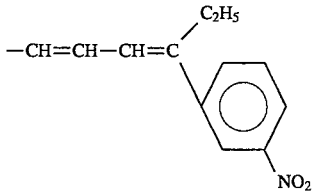

$R_{15\text{-}3}$:

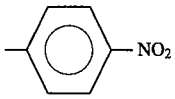

X: $-CH_2-$

Compound 15-(73)

$R_{15\text{-}1}$:

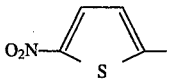

$R_{15\text{-}2}$:

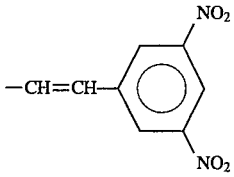

$R_{15\text{-}3}$:

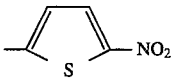

X: $-CH_2-$

Compound 15-(74)

$R_{15\text{-}1}$: $O_2N-CH=CH-$ $R_{15\text{-}2}$:

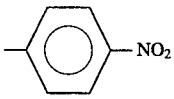

$R_{15\text{-}3}$: $-CH=CH-NO_2$

X: $-CH_2-$

Compound 15-(75)

$R_{15\text{-}1}$:

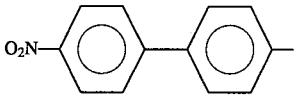

$R_{15\text{-}2}$:

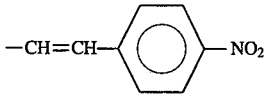

Basic constitution (Formula 15)
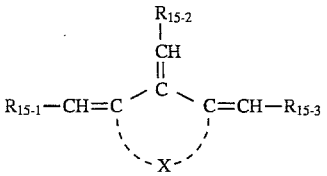
$R_{15-3}$:
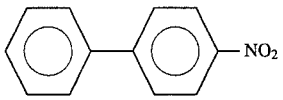
X: $-CH_2-$
Compound 15-(76)
$R_{15-1}$:
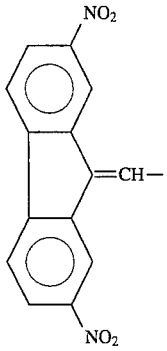
$R_{15-2}$:
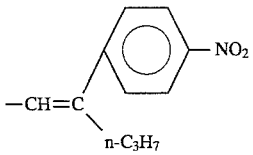
$R_{15-3}$:
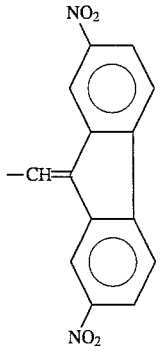
X: $-CH_2-$
Compound 15-(77)
$R_{15-1}$:
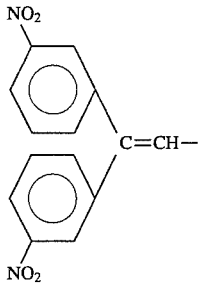
Basic constitution (Formula 15)
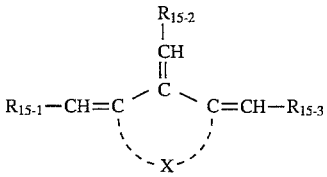
$R_{15-2}$:
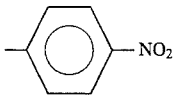
$R_{15-3}$:
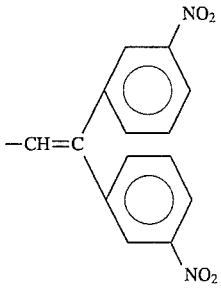
X: $-CH_2-$
Compound 15-(78)
$R_{15-1}$:
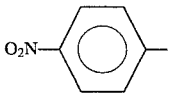
$R_{15-2}$:
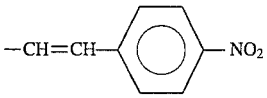
$R_{15-3}$:
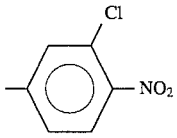
X: $-CH_2-$
Compound 15-(79)
$R_{15-1}$:
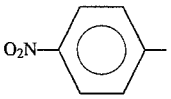
$R_{15-2}$:
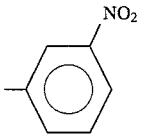
$R_{15-3}$:
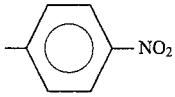

Basic constitution
(Formula 15)
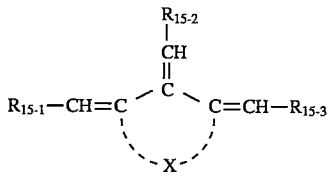
X:
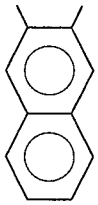
Compound 15-(80)
$R_{15-1}$:
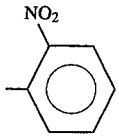
$R_{15-2}$:
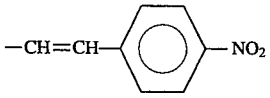
$R_{15-3}$:
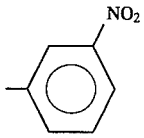
X:
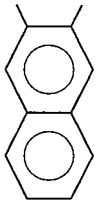
Compound 15-(81)
$R_{15-1}$:
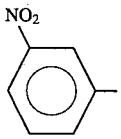
$R_{15-2}$:
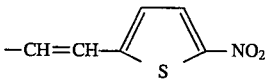
$R_{15-3}$:
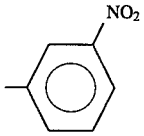
Basic constitution
(Formula 15)
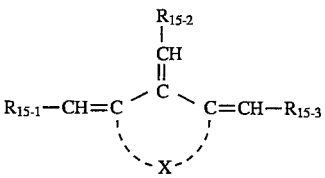
X:
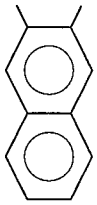
Compound 15-(82)
$R_{15-1}$:
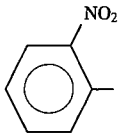
$R_{15-2}$:
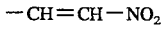
$R_{15-3}$:
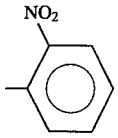
X:
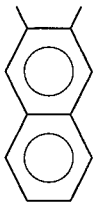
Compound 15-(83)
$R_{15-1}$:
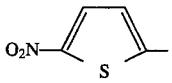
$R_{15-2}$:
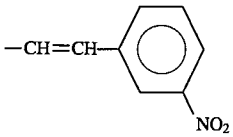
$R_{15-3}$:
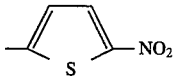
X:
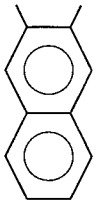

Basic constitution (Formula 15)
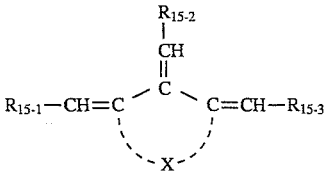
Compound 15-(84)
$R_{15\text{-}1}$:
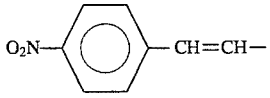
$R_{15\text{-}2}$:
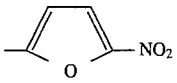
$R_{15\text{-}3}$: $-CH=CH-NO_2$
X:
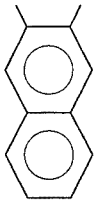
Compound 15-(85)
$R_{15\text{-}1}$:
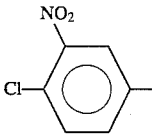
$R_{15\text{-}2}$:
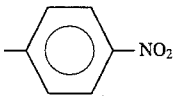
$R_{15\text{-}3}$:
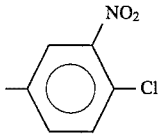
X:
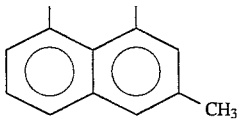
Compound 15-(86)
$R_{15\text{-}1}$:
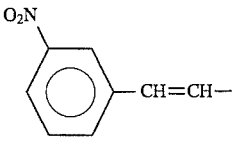
Basic constitution (Formula 15)
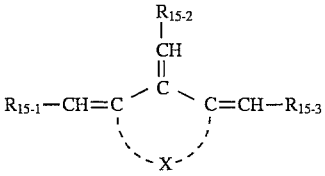
$R_{15\text{-}2}$:
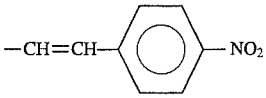
$R_{15\text{-}3}$:
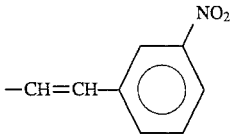
X:
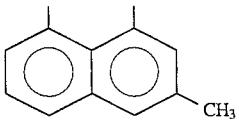
Compound 15-(87)
$R_{15\text{-}1}$:
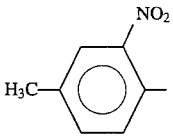
$R_{15\text{-}2}$:
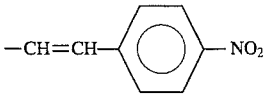
$R_{15\text{-}3}$:
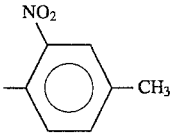
X:
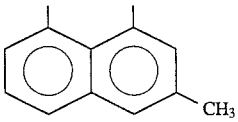
Compound 15-(88)
$R_{15\text{-}1}$:
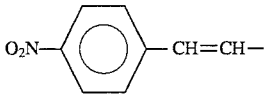
$R_{15\text{-}2}$:
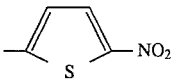
$R_{15\text{-}3}$:
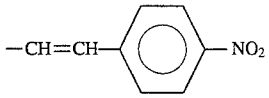

Basic constitution (Formula 15)
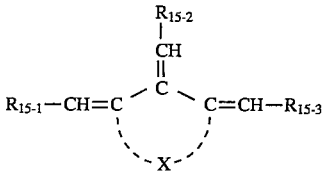
X:
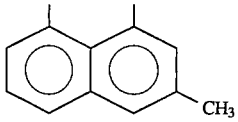
Compound 15-(89)
$R_{15-1}$:
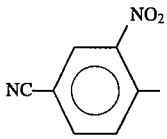
$R_{15-2}$: $-CH=CH-NO_2$
$R_{15-3}$:
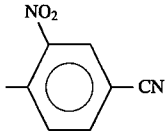
X:
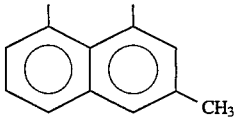
Compound 15-(90)
$R_{15-1}$:
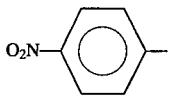
$R_{15-2}$:
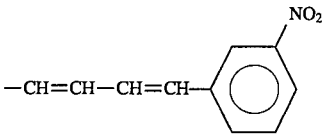
$R_{15-3}$:
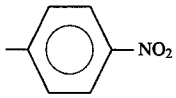
X:
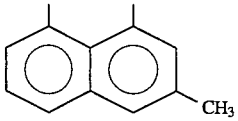
Compound 15-(91)
$R_{15-1}$:
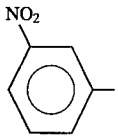
Basic constitution (Formula 15)
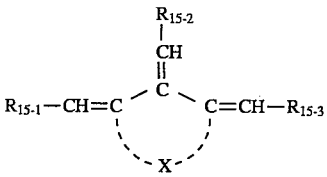
$R_{15-2}$:
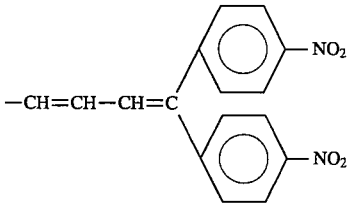
$R_{15-3}$:
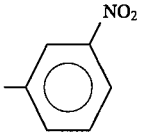
X:
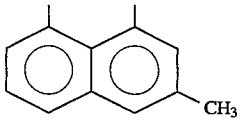
Basic Constitution (Formula 16)
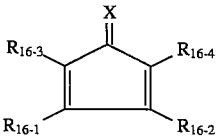
Compound 16-(1)
$R_{16-1}$:
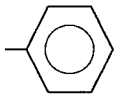
$R_{16-2}$:
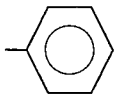
$R_{16-3}$: $-H$
$R_{16-4}$: $-H$
X: Oxygen atom
Compound 16-(2)
$R_{16-1}$:
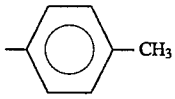
$R_{16-2}$:
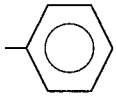
$R_{16-3}$: $-H$
$R_{16-4}$: $-H$ Basic Constitution (Formula 16)

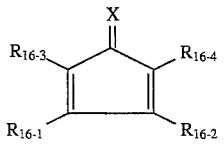

X: Oxygen atom

Compound 16-(3)

$R_{16-1}$:

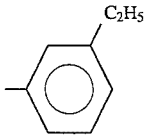

$R_{16-2}$:

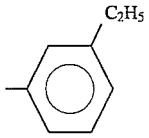

$R_{16-3}$: —H
$R_{16-4}$: —H
X: Oxygen atom

Compound 16-(4)

$R_{16-1}$:

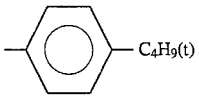

$R_{16-2}$:

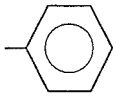

$R_{16-3}$: —H
$R_{16-4}$: —H
X: Oxygen atom

Compound 16-(5)

$R_{16-1}$:

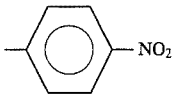

$R_{16-2}$:

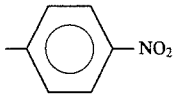

$R_{16-3}$: —H
$R_{16-4}$: —H
X: Oxygen atom

Compound 16-(6)

$R_{16-2}$:

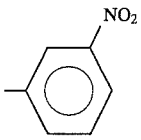

$R_{16-2}$:

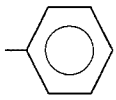

$R_{16-3}$: —H

Basic Constitution (Formula 16)

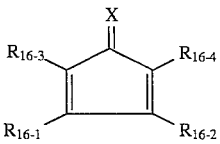

$R_{16-4}$: —H
X: Oxygen atom

Compound 16-(7)

$R_{16-1}$

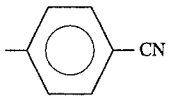

$R_{16-2}$

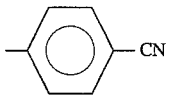

$R_{16-3}$ —H
$R_{16-4}$ —H
X Oxygen atom

Compound 16-(8)

$R_{16-1}$:

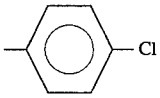

$R_{16-2}$: $-CH_3$
$R_{16-3}$: —H
$R_{16-4}$: —H
X: Oxygen atom

Compound 16-(9)

$R_{16-1}$:

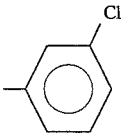

$R_{16-2}$:

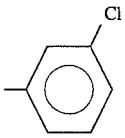

$R_{16-3}$: —H
$R_{16-4}$: —H
X: Oxygen atom

Compound 16-(10)

$R_{16-1}$:

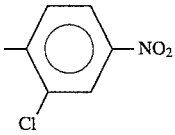

$R_{16-2}$:

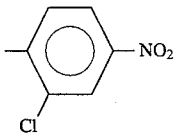

$R_{16-3}$: —H
$R_{16-4}$: —H

Basic Constitution (Formula 16)
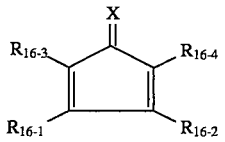
X: Oxygen atom
Compound 16-(11)
$R_{16-1}$:
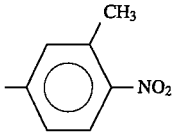
$R_{16-2}$:
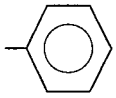
$R_{16-3}$: —H
$R_{16-4}$: —H
X: Oxygen atom
Compound 16-(12)
$R_{16-1}$:
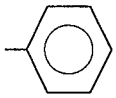
$R_{16-2}$:
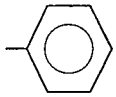
$R_{16-3}$:
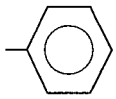
$R_{16-4}$:
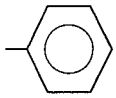
X: Oxygen atom
Compound 16-(13)
$R_{16-1}$:
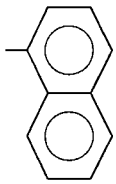
$R_{16-2}$:
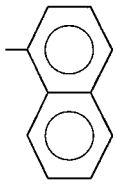
$R_{16-3}$: —H
$R_{16-4}$: —H
X: Oxygen atom
Basic Constitution (Formula 16)
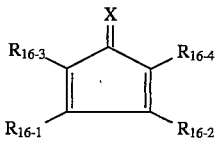
Compound 16-(14)
$R_{16-1}$:
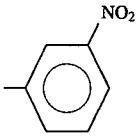
$R_{16-2}$:
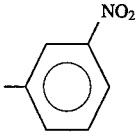
$R_{16-3}$: $-CH_3$
$R_{16-4}$: $-CH_3$
X: Oxygen atom
Compound 16-(15)
$R_{16-1}$:
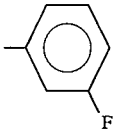
$R_{16-2}$:
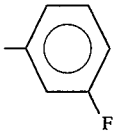
$R_{16-3}$: $-C_2H_5$
$R_{16-4}$: $-C_2H_5$
X: Oxygen atom
Compound 16-(16)
$R_{16-1}$:
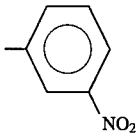
$R_{16-2}$:
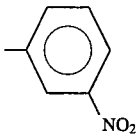
$R_{16-3}$: $-CH_3$
$R_{16-4}$: —H
X: Oxygen atom
Compound 16-(17)
$R_{16-1}$:
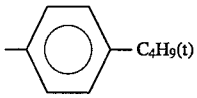

Basic Constitution (Formula 16)
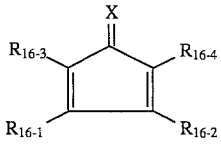
$R_{16-2}$:
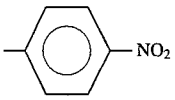
$R_{16-3}$:
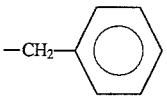
$R_{16-4}$:
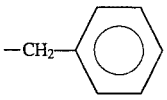
X: Oxygen atom
Compound 16-(18)
$R_{16-1}$:
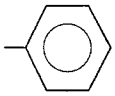
$R_{16-2}$:
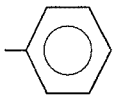
$R_{16-3}$:
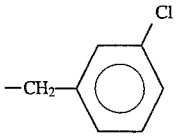
$R_{16-4}$:
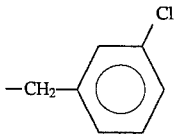
X: Oxygen atom
Compound 16-(19)
$R_{16-1}$:
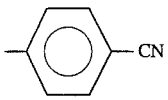
$R_{16-2}$:
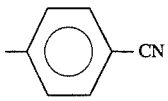
$R_{16-3}$: —Cl
$R_{16-4}$: —Cl
X: Oxygen atom
Compound 16-(20)
$R_{16-1}$:
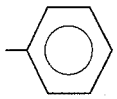
Basic Constitution (Formula 16)
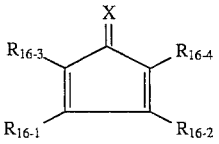
$R_{16-2}$:
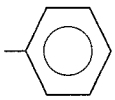
$R_{16-3}$: —Cl
$R_{16-4}$: —Cl
X: Oxygen atom
Compound 16-(21)
$R_{16-1}$:
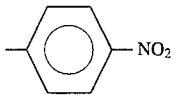
$R_{16-2}$:
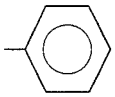
$R_{16-3}$: —Br
$R_{16-4}$: —Br
X: Oxygen atom
Compound 16-(22)
$R_{16-1}$:
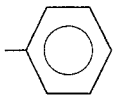
$R_{16-2}$:
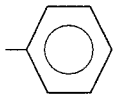
$R_{16-3}$: —H
$R_{16-4}$: —H
X: Sulfur atom
Compound 16-(23)
$R_{16-1}$:
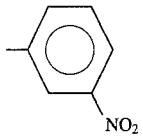
$R_{16-2}$:
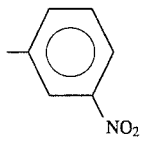
$R_{16-3}$: —H
$R_{16-4}$: —H
X: Sulfur atom
Compound 16-(24)
$R_{16-1}$:
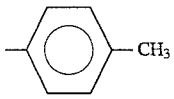

Basic Constitution (Formula 16)
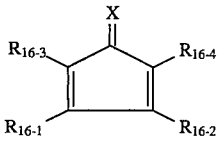
$R_{16-2}$: 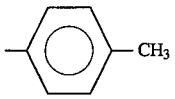
$R_{16-3}$: $-CH_3$
$R_{16-4}$: $-CH_3$
X: Sulfur atom
Compound 16-(25)
$R_{16-1}$: 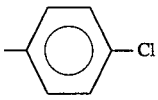
$R_{16-2}$: 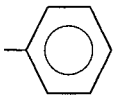
$R_{16-3}$: 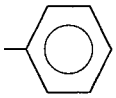
$R_{16-4}$: 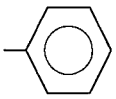
X: Sulfur atom
Compound 16-(26)
$R_{16-1}$: 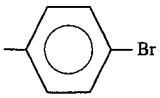
$R_{16-2}$: 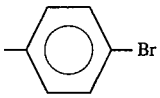
$R_{16-3}$: $-H$
$R_{16-4}$: $-H$
X: Sulfur atom
Compound 16-(27)
$R_{16-1}$: 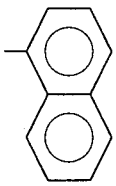
$R_{16-2}$: 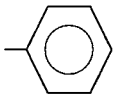
$R_{16-3}$: $-H$
$R_{16-4}$: $-H$
Basic Constitution (Formula 16)
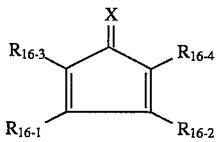
X: Sulfur atom
Compound 16-(28)
$R_{16-1}$: $-CH_3$
$R_{16-2}$: $-CH_3$
$R_{16-3}$: $-H$
$R_{16-4}$: $-H$
X: 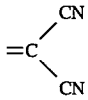
Compound 16-(29)
$R_{16-1}$: 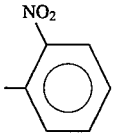
$R_{16-2}$: 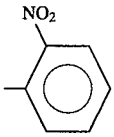
$R_{16-3}$: $-H$
$R_{16-4}$: $-H$
X: 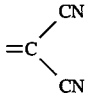
Compound 16-(30)
$R_{16-1}$: 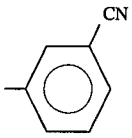
$R_{16-2}$: 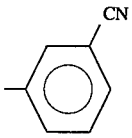
$R_{16-3}$: $-H$
$R_{16-4}$: $-H$
X: 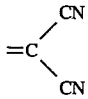
Compound 16-(31)

Basic Constitution (Formula 16)
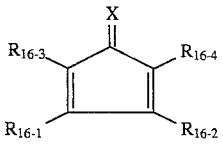
$R_{16\text{-}1}$:
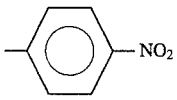
$R_{16\text{-}2}$:
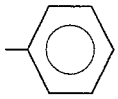
$R_{16\text{-}3}$:
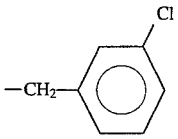
$R_{16\text{-}4}$:
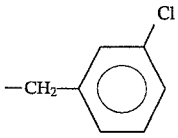
X:
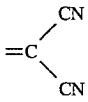
Compound 16-(32)
$R_{16\text{-}1}$:
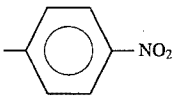
$R_{16\text{-}2}$:
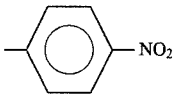
$R_{16\text{-}3}$:
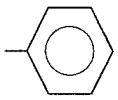
$R_{16\text{-}4}$:
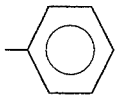
X:
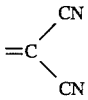
Compound 16-(33)
$R_{16\text{-}1}$:
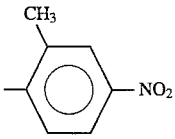
Basic Constitution (Formula 16)
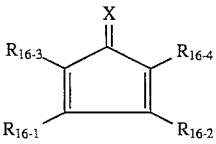
$R_{16\text{-}2}$:
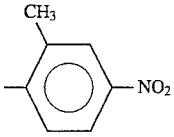
$R_{16\text{-}3}$:
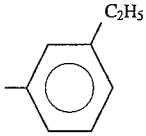
$R_{16\text{-}4}$:
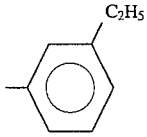
X:
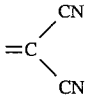
Compound 16-(34)
$R_{16\text{-}1}$:
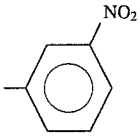
$R_{16\text{-}2}$:
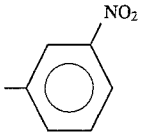
$R_{16\text{-}3}$: —Cl
$R_{16\text{-}4}$: —Cl
X:
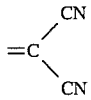
Compound 16-(35)
$R_{16\text{-}1}$:
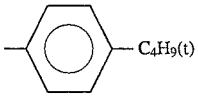
$R_{16\text{-}2}$:
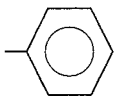
$R_{16\text{-}3}$: $-CH_3$
$R_{16\text{-}4}$: $-CH_3$ Basic Constitution (Formula 16)
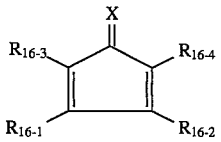
X: 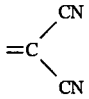
Compound 16-(36)
$R_{16-1}$: 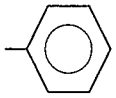
$R_{16-2}$: 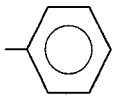
$R_{16-3}$: —H
$R_{16-4}$: —H
X: 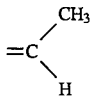
Compound 16-(37)
$R_{16-1}$: 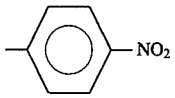
$R_{16-2}$: 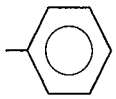
$R_{16-3}$: —H
$R_{16-4}$: —H
X: 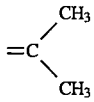
Compound 16-(38)
$R_{16-1}$: 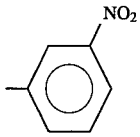
$R_{16-2}$: 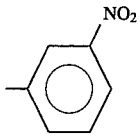
$R_{16-3}$: —Cl
$R_{16-4}$: —Cl
Basic Constitution (Formula 16)
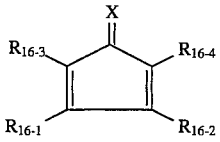
X: 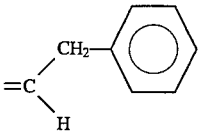
Compound 16-(39)
$R_{16-1}$: 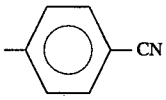
$R_{16-2}$: 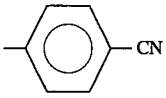
$R_{16-3}$: $-CH_3$
$R_{16-4}$: $-CH_3$
X: 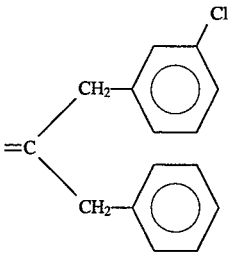
Compound 16-(40)
$R_{16-1}$: 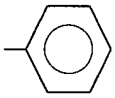
$R_{16-2}$: 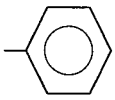
$R_{16-3}$: —H
$R_{16-4}$: —H
X: 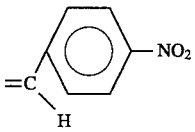
Compound 16-(41)
$R_{16-1}$: 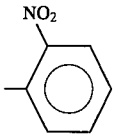

Basic Constitution (Formula 16)
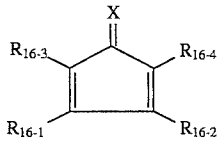
$R_{16-2}$: 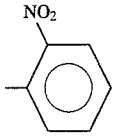
$R_{16-3}$: —H
$R_{16-4}$: —H
X: 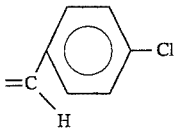
Compound 16-(42)
$R_{16-1}$: 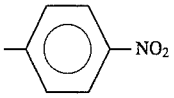
$R_{16-2}$: 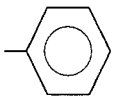
$R_{16-3}$: 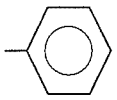
$R_{16-4}$: 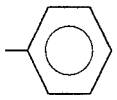
X: 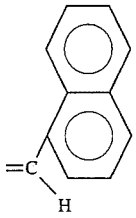
Compound 16-(43)
$R_{16-1}$: 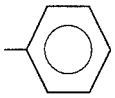
$R_{16-2}$: 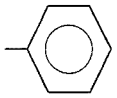
$R_{16-3}$: 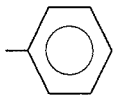
Basic Constitution (Formula 16)
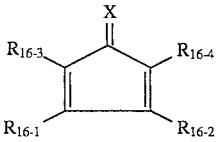
$R_{16-4}$: 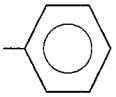
X: 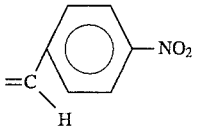
Compound 16-(44)
$R_{16-1}$: 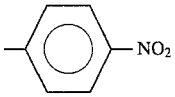
$R_{16-2}$: 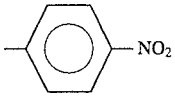
$R_{16-3}$: $-CH_3$
$R_{16-4}$: $-CH_3$
X: 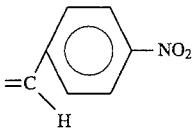
Compound 16-(45)
$R_{16-1}$: 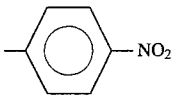
$R_{16-2}$: 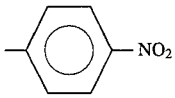
$R_{16-3}$: —H
$R_{16-4}$: —H
X: 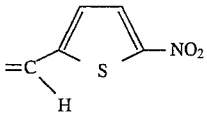
Compound 16-(46)
$R_{16-1}$: 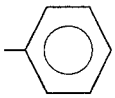
$R_{16-2}$: 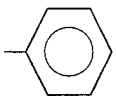

Basic Constitution (Formula 16)
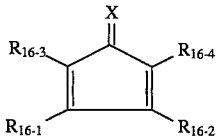
$R_{16-3}$:
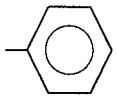
$R_{16-4}$:
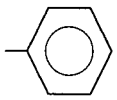
X:
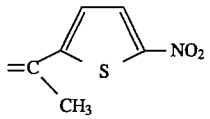
Compound 16-(47)
$R_{16-1}$:
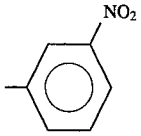
$R_{16-2}$:
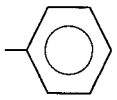
$R_{16-3}$: $-CH_3$
$R_{16-4}$: $-CH_3$
X:
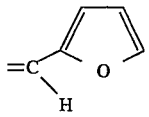
Compound 16-(48)
$R_{16-1}$:
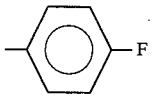
$R_{16-2}$:
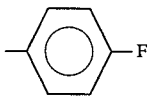
$R_{16-3}$: $-H$
$R_{16-4}$: $-H$
X:
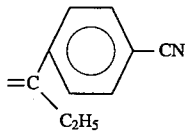
Compound 16-(49)
Basic Constitution (Formula 16)
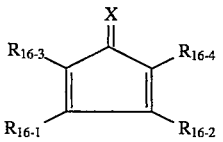
$R_{16-1}$:
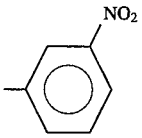
$R_{16-2}$:
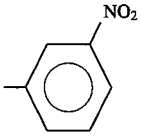
$R_{16-3}$: $-H$
$R_{16-4}$: $-H$
X:
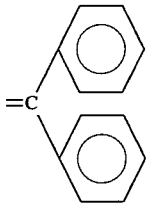
Compound 16-(50)
$R_{16-1}$:
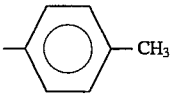
$R_{16-2}$:
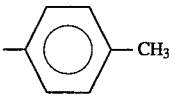
$R_{16-3}$: $-H$
$R_{16-4}$: $-H$
X:
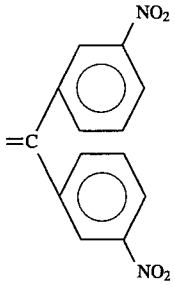
Compound 16-(51)
$R_{16-1}$: $-C_2H_5$
$R_{16-2}$: $-C_2H_5$
$R_{16-3}$: $-C_2H_5$
$R_{16-4}$: $-C_2H_5$ Basic Constitution (Formula 16)
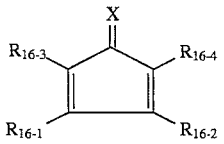
X:
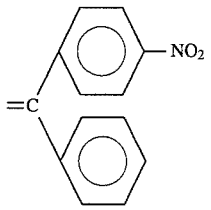
Compound 16-(52)
$R_{16-1}$:
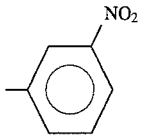
$R_{16-2}$:
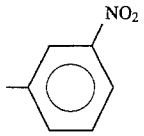
$R_{16-3}$: —H
$R_{16-4}$: —H
X:
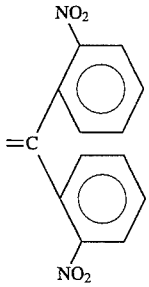
Compound 16-(53)
$R_{16-1}$:
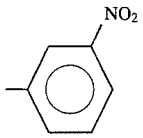
$R_{16-2}$:
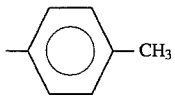
$R_{16-3}$: $-CH_3$
$R_{16-4}$: $-CH_3$
X:
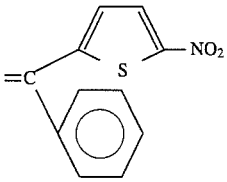
Basic Constitution (Formula 16)
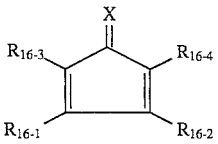
Compound 16-(54)
$R_{16-1}$:
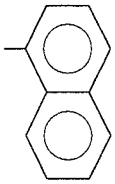
$R_{16-2}$:
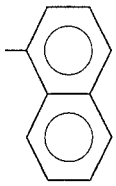
$R_{16-3}$: —H
$R_{16-4}$: —H
X:
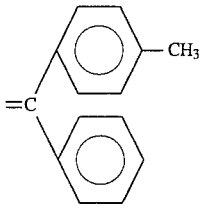
Compound 16-(55)
$R_{16-1}$:
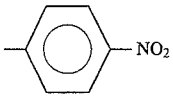
$R_{16-2}$:
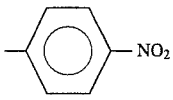
$R_{16-3}$: —H
$R_{16-4}$: —H
X:
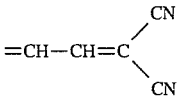
Compound 16-(56)
$R_{16-1}$:
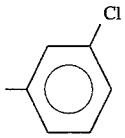

Basic Constitution (Formula 16)
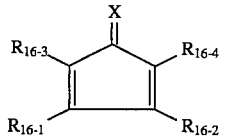
$R_{16-2}$:
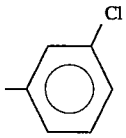
$R_{16-3}$: $-CH_3$
$R_{16-4}$: $-CH_3$
X:
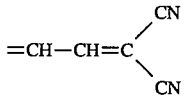
Compound 16-(57)
$R_{16-1}$:
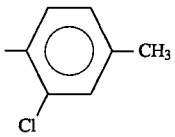
$R_{16-2}$:
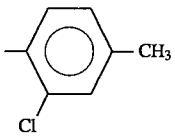
$R_{16-3}$:
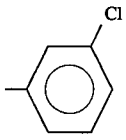
$R_{16-4}$:
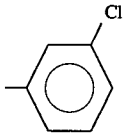
X:
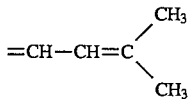
Compound 16-(58)
$R_{16-1}$:
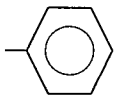
$R_{16-2}$:
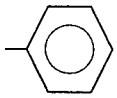
$R_{16-3}$:
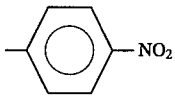
Basic Constitution (Formula 16)
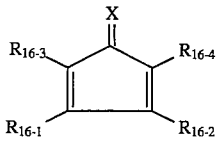
$R_{16-4}$:
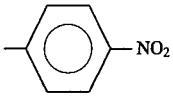
X:
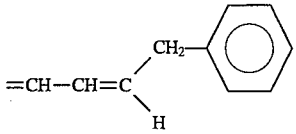
Compound 16-(59)
$R_{16-1}$:
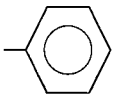
$R_{16-2}$:
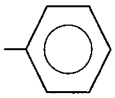
$R_{16-3}$:
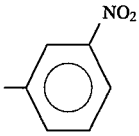
$R_{16-4}$:
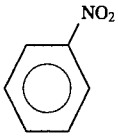
X:
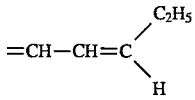
Compound 16-(60)
$R_{16-1}$:
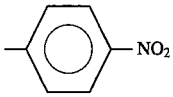
$R_{16-2}$:
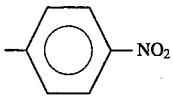
$R_{16-3}$: $-H$
$R_{16-4}$: $-H$
X:
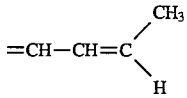

Basic Constitution (Formula 16)
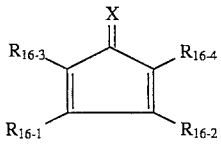
Compound 16-(61)
$R_{16-1}$:
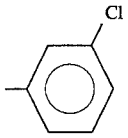
$R_{16-2}$:
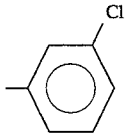
$R_{16-3}$: —Cl
$R_{16-4}$: —Cl
X:
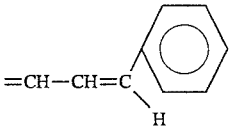
Compound 16-(62)
$R_{16-1}$:
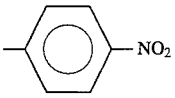
$R_{16-2}$:
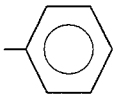
$R_{16-3}$: $-CH_3$
$R_{16-4}$: $-CH_3$
X:
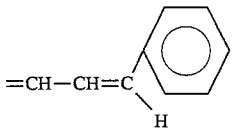
Compound 16-(63)
$R_{16-1}$:
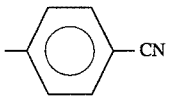
$R_{16-2}$:
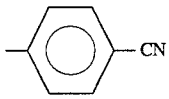
$R_{16-3}$: —H
$R_{16-4}$: —H
X:
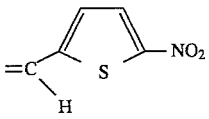
Basic Constitution (Formula 16)
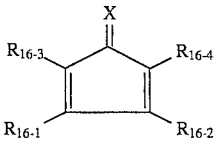
Compound 16-(64)
$R_{16-1}$:
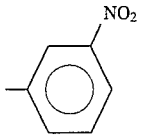
$R_{16-2}$:
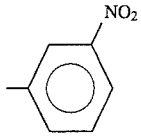
$R_{16-3}$:
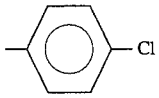
$R_{16-4}$:
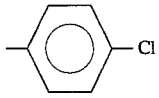
X:
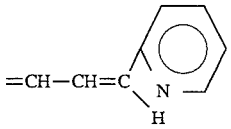
Compound 16-(65)
$R_{16-1}$:
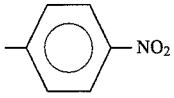
$R_{16-2}$:
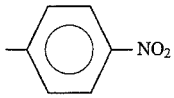
$R_{16-3}$: $-CH_3$
$R_{16-4}$: $-CH_3$
X:
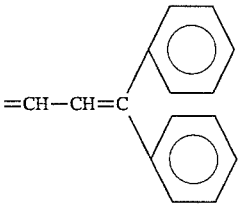
Compound 16-(66)
$R_{16-1}$:
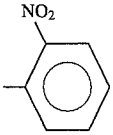

Basic Constitution (Formula 16)
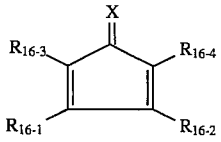
$R_{16-2}$:
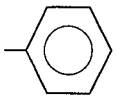
$R_{16-3}$:
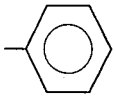
$R_{16-4}$:
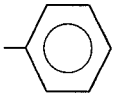
X:
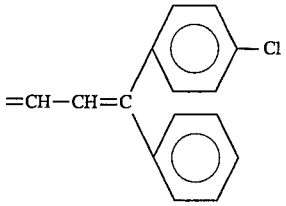
Compound 16-(67)
$R_{16-1}$:
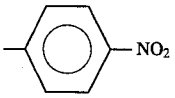
$R_{16-2}$:
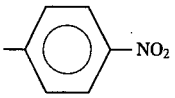
$R_{16-3}$: $-C_2H_5$
$R_{16-4}$: $-C_2H_5$
X:
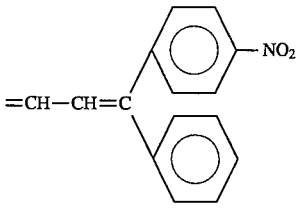
Compound 16-(68)
$R_{16-1}$: $-C_2H_5$
$R_{16-2}$: $-C_2H_5$
$R_{16-3}$:
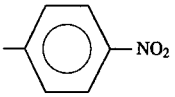
$R_{16-4}$:
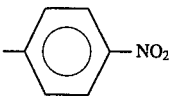
Basic Constitution (Formula 16)
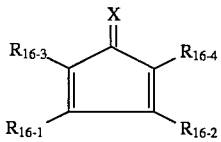
X:
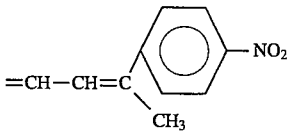
Compound 16-(69)
$R_{16-1}$: $-CH_3$
$R_{16-2}$: $-CH_3$
$R_{16-3}$:
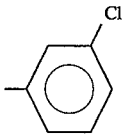
$R_{16-4}$:
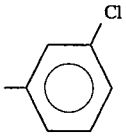
X:
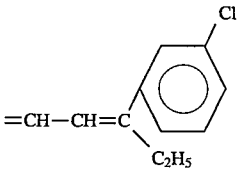
Compound 16-(70)
$R_{16-1}$:
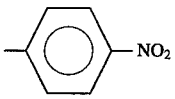
$R_{16-2}$:
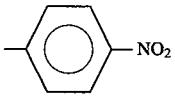
$R_{16-3}$:
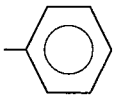
$R_{16-4}$:
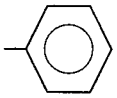
X:
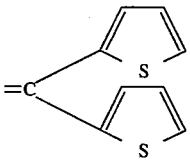
Compound 16-(71)

Basic Constitution (Formula 16)
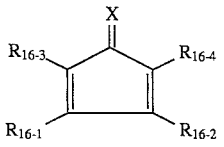
$R_{16\text{-}1}$:
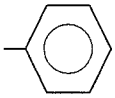
$R_{16\text{-}2}$:
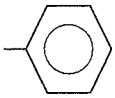
$R_{16\text{-}3}$: $-C_2H_5$
$R_{16\text{-}4}$: $-C_2H_5$
X:
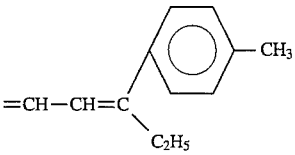
Compound 16-(72)
$R_{16\text{-}1}$:
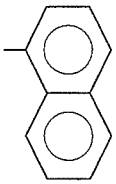
$R_{16\text{-}2}$:
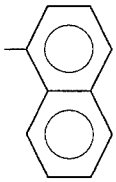
$R_{16\text{-}3}$:
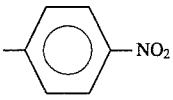
$R_{16\text{-}4}$:
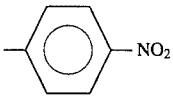
X:
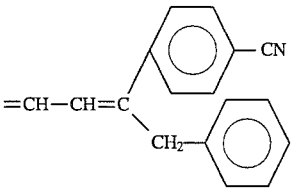
Compound 16-(73)
Basic Constitution (Formula 16)
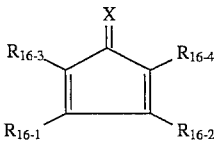
$R_{16\text{-}1}$:
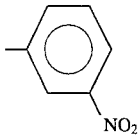
$R_{16\text{-}2}$:
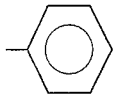
$R_{16\text{-}3}$:
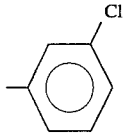
$R_{16\text{-}4}$:
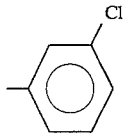
X:
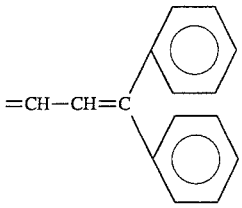
Compound 16-(74)
$R_{16\text{-}1}$:
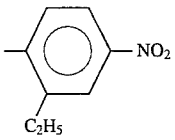
$R_{16\text{-}2}$:
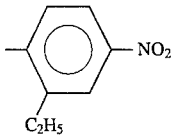
$R_{16\text{-}3}$: $-Cl$
$R_{16\text{-}4}$: $-Cl$
X:
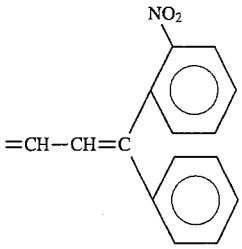
Compound 16-(75)

-continued

Basic Constitution (Formula 16)

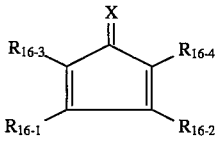

$R_{16-1}$:

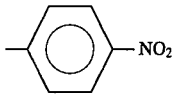

$R_{16-2}$:

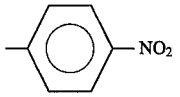

$R_{16-3}$: —H
$R_{16-4}$: —H

X:

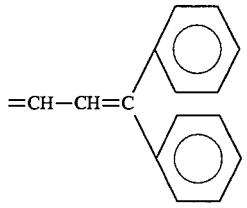

Next, synthesis examples of the compounds which can be used in the present invention will be described.

Synthesis Example 1

[Synthesis of Compound Example 1-(1)]

5 g of dimethyl diphenylmethylsulfonate and 3.5 g of 7-nitrofluorenone-2-aldehyde were dissolved in 60 ml of N,N-dimethylformamide (DFM), and 1.77 g of sodium methoxide was slowly added thereto at room temperature. After completion of the addition, the solution was stirred at room temperature for 1 hour as it was, and it was further stirred for 3 hours, while being heated up to 50° C. on a water bath. After standing for cooling, the solution was poured into water, and the precipitated crystals were collected by filtration and then recrystallized twice from a mixed solvent of toluene and methyl ethyl ketone, thereby obtaining 1.9 g of the desired compound. Its yield was 37.2%.

Synthesis Example 2

[Synthesis of Compound Example 2-(3)]

0.81 g (14.9 mmols) of sodium methylate was added to 40 ml of DMF, and a solution of 3.90 g (14.27 mmols) of diethyl p-nitrobenzylphosphonate and 10 ml of DMF were slowly added dropwise thereto. After completion of the addition, the solution was stirred for 15 minutes as it was, and a solution of 2.04 g (13.0 mmols) of 5-nitro-2-thiophenecarboxyaldehyde and 8 ml of DMF was then slowly added dropwise thereto at 25° C. or less. After completion of the addition, the solution was stirred for 30 minutes as it was, and it was further heated and stirred at 40°–50° C. for 2 hours on a water bath. After standing for cooling, the solution was poured into 300 ml of an aqueous saturated sodium chloride solution, followed by extraction with toluene. The resultant organic layer was then washed with water and then dried over anhydrous sodium sulfate. After the removal of the solvent under reduced pressure, separation/purification was carried out through a silica gel column to obtain 2.45 g of the desired compound. Its yield was 68%.

Synthesis Example 3

[Synthesis of Compound Example 3-(21)]

0.76 g (14.0 mmols) of sodium methylate was added to 15 ml of DMF, and a solution of 3.25 g (11.9 mmols) of diethyl m-nitrobenzylphosphonate and 20 ml of DMF were slowly added dropwise thereto at 20°–25° C. After completion of the addition, the solution was stirred for 15 minutes as it was, and a solution of 2.0 g (7.0 mmols) of

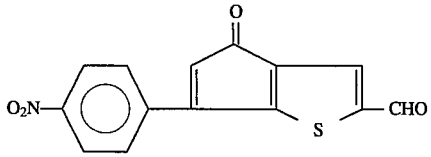

and 40 ml of DMF were then slowly added dropwise thereto at 25° C. or less. After completion of the addition, the solution was stirred for 10 minutes as it was, and it was further heated and stirred at 50°–60° C. for 2 hours on an oil bath. After standing fur cooling, the solution was poured into 400 ml of methanol, and the precipitated crystals were then collected by filtration.

The resultant crude crystals were further washed with methanol and then recrystallized several times from a mixed solvent of toluene and ethyl acetate, thereby obtaining 1.24 g of the desired compound. Its yield was 44%.

Synthesis Example 4

[Synthesis of Compound Example 4-(17)]

0.63 g (11.7 mmols) of sodium methylate was added to 15 ml of DMF, and a solution of 2.8 g (10.2 mmols) of diethyl o-nitrobenzylphosphate and 15 ml of DMF were slowly added dropwise thereto at 20°–25° C. After completion of the addition, the solution was stirred for 15 minutes as it was, and a solution of 1.5 g (6.4 mmols) of

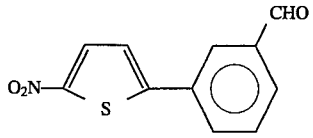

and 10 ml of DMF were then slowly added dropwise thereto at 25° C. or less. After completion of the addition, the solution was stirred for 15 minutes as it was, and it was further heated and stirred at 50°–60° C. for 2 hours on an oil bath. After standing for cooling, the solution was poured into 300 ml of methanol, and the precipitated crystals were then collected by filtration.

The resultant crude crystals were further washed with methanol and then recrystallized several times from a mixed solvent of toluene and ethyl acetate, thereby obtaining 1.6 g of the desired compound. Its yield was 1%.

Synthesis Example 5

[Synthesis of Compound Example 5-(3)]

0.68 g (12.6 mmols) of sodium methylate was added to 10 ml of DMF, and a solution of 3.0 g (11.0 mmols) of diethyl p-nitrobenzylphosphonate and 10 ml of DMF were slowly added dropwise thereto at 20°–25° C.. After completion of the addition, the solution was stirred for 15 minutes as it was, and a solution of 2.0 g (7.0 mmols) of

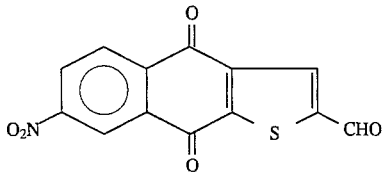

and 15 ml of DMF were then slowly added dropwise thereto at 25° C. or less. After completion of the addition, the solution was stirred for 30 minutes as it was, and it was further heated and stirred at 50°–60° C. for 2 hours on an oil bath. After standing for cooling, the solution was poured into 300 ml of methanol, and the precipitated crystals were then collected by filtration.

The resultant crude crystals were further washed with acetone and then recrystallized several times from a mixed solvent of toluene and DMF to obtain 1.17 g of the desired compound. Its yield was 41%.

Synthesis Example 6

[Synthesis of Compound Example 6-(4)]

1.70 g (31.5 mmols) of sodium methylate was added to 15 ml of DMF, and a solution of 8.08 g (29.6 mmols) of diethyl o-nitrobenzylphosphonate and 15 ml of DMF were slowly added dropwise thereto at 20°–25° C. After completion of the addition, the solution was stirred for 15 minutes as it was, and a solution of 5.0 g (17.4 mmols) of

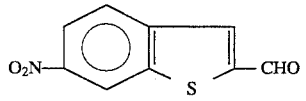

and 10 ml of DMF were then slowly added dropwise thereto at 20° C. or less. After completion of the addition, the solution was stirred for 15 minutes as it was, and it was further heated and stirred at 40°–45° C. for 2 hours on an oil bath.

After standing for cooling, the solution was poured into 350 ml of methanol, and the precipitated crystals were then collected by filtration. The resultant crude crystals were further washed with methanol and then recrystallized several times from a mixed solvent of toluene and ethyl acetate, thereby obtaining 4.62 g of the desired compound. Its yield was 68%.

Synthesis Example 7

[Synthesis of Compound Example 7-(4)]

0.73 g (13.5 mmols) of sodium methylate was added to 10 ml of DMF, and a solution of 3.35 g (12.3 mmols) of diethyl o-nitrobenzylphosphonate and 15 ml of DMF were slowly added dropwise thereto at 20°–25° C. After completion of the addition, the solution was stirred for 30 minutes as it was, and a solution of 2.0 g (6.8 mmols) of

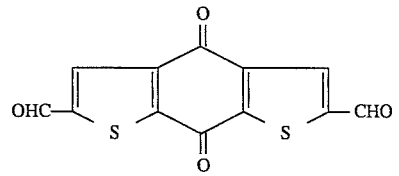

and 20 ml of DMF were then slowly added dropwise thereto at 25° C. or less. After completion of the addition, the solution was stirred for 10 minutes as it was, and it was further heated and stirred at 50°–60° C. for 2 hours on an oil bath. After standing for cooling, the solution was poured into 300 ml of methanol, and the precipitated crystals were then collected by filtration.

The resultant crude crystals were further washed with methanol and then recrystallized several times from a mixed solvent of toluene and ethyl acetate, thereby obtaining 1.19 g of the desired compound. Its yield was 42.4%.

Synthesis Example 8

[Synthesis of Compound Example 8-(4)]

1.0 g (18.5 mmols) of sodium methylate was added to 15 ml of DMF, and a solution of 4.36 g (16.0 mmols) of diethyl m-nitrobenzylphosphonate and 20 ml of DMF were slowly added dropwise thereto at 20°–25° C. After completion of the addition, the solution was stirred for 20 minutes as it was, and a solution of 2.0 g (9.4 mmols) of

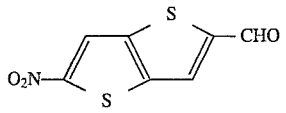

and 40 ml of DMF were then slowly added dropwise thereto at 25° C. or less. After completion of the addition, the solution was stirred for 10 minutes as it was, and it was further heated and stirred at 50°–60° C. for 3 hours on an oil bath. After standing for cooling, the solution was poured into 500 ml of methanol, and the precipitated crystals were then collected by filtration.

The resultant crude crystals were further washed with methanol and then recrystallized several times from a mixed solvent of toluene and ethyl acetate, thereby obtaining 1.2 g of the desired compound. Its yield was 38.5%.

Synthesis Example 9

[Synthesis of Compound Example 9-(24)]

2.6 g (48.1 mmols) of sodium methylate was added to 15 ml of DMF, and a solution of 11.0 g (40.3 mmols) of diethyl m-nitrobenzylphosphonate and 30 ml of DMF were slowly added dropwise thereto at 20°–25° C. After completion of the addition, the solution was stirred for 30 minutes as it was, and a solution of 3.0 g (13.5 mmols) of

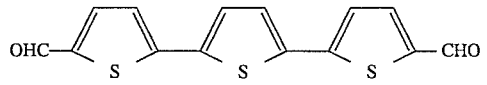

and 15 ml of DMF were then slowly added dropwise thereto at 30° C. or less. After completion of the addition, the solution was stirred for 10 minutes as it was, and it was further heated and stirred at 50°–55° C. for 2 hours on an oil bath.

After standing for cooling, the solution was poured into 250 ml of methanol, and the precipitated crystals were then collected by filtration. The resultant crude crystals were further washed with methanol and then recrystallized several times from a mixed solvent of toluene and ethyl acetate, thereby obtaining 4.2 g of the desired compound. Its yield was 67.6%.

Synthesis Example 10

[Synthesis of Compound Example 10-(21)]

1.4 g (25.9 mmols) of sodium methylate was added to 15 ml of DMF, and a solution of 6.2 g (22.7 mmols) of diethyl m-nitrobenzylphosphonate and 30 ml of DMF were slowly added dropwise thereto at 20°–25° C. After completion of the addition, the solution was stirred for 20 minutes as it was, and a solution of 2.0 g (8.1 mmols) of

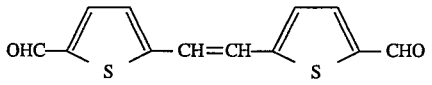

and 30 ml of DMF were then slowly added dropwise thereto at 25° C. or less. After completion of the addition, the solution was stirred for 15 minutes as it was, and it was further heated and stirred at 60°–70° C. for 3 hours on an oil bath.

After standing for cooling, the solution was poured into 500 ml of methanol, and the precipitated crystals were then collected by filtration. The resultant crude crystals were further washed with methanol and then recrystallized several times from a mixed solvent of toluene and ethyl acetate to obtain 1.87 g of the desired compound. Its yield was 47.4%.

Synthesis Example 11

[Synthesis of Compound Example 11-(21)]

1.25 g (23.1 mmols) of sodium methylate was added to 15 ml of DMF, and a solution of 4.71 g (17.2 mmols) of diethyl p-nitrobenzylphosphonate and 15 ml of DMF were slowly added dropwise thereto at 20°–25° C. After completion of the addition, the solution was stirred for 30 minutes as it was, and a solution of 3.0 g (11.5 mmols) of

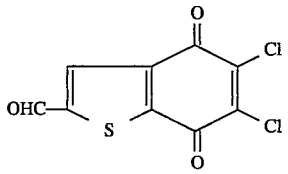

and 25 ml of DMF were then slowly added dropwise thereto at 25° C. or less. After completion of the addition, the solution was stirred for 20 minutes as it was, and it was further heated and stirred at 60°–65° C. for 3 hours on an oil bath.

After standing for cooling, the solution was poured into 300 ml of methanol, and the precipitated crystals were then collected by filtration. The resultant crude crystals were further washed with methanol and then recrystallized several times from a mixed solvent of toluene and ethyl acetate, thereby obtaining 1.66 g of the desired compound. Its yield was 38%.

Synthesis Example 12

[Synthesis of Compound Example 12-(24)]

0.84 g (15.5 mmols) of sodium methylate was added to 20 ml of DMF, and a solution of 3.79 g (13.9 mmols) of diethyl p-nitrobenzylphosphonate and 15 ml of DMF were slowly added dropwise thereto at 20°–25° C. After completion of the addition, the solution was stirred for 10 minutes as it was, and a solution of 2.0 g (7.7 mmols) of

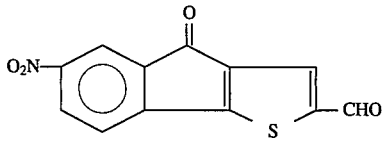

and 40 ml of DMF were then slowly added dropwise thereto at 20° C. or less. After completion of the addition, the solution was stirred for 30 minutes as it was, and it was further heated and stirred at 50°–60° C. for 2 hours on an oil bath. After standing for cooling, the solution was poured into 400 ml of methanol, and the precipitated crystals were then collected by filtration.

The resultant crude crystals were further washed with acetone and then recrystallized several times from a mixed solvent of toluene and DMF, thereby obtaining 1.49 g of the desired compound. Its yield was 51%.

Synthesis Example 13

[Synthesis of Compound Example 13-(4)]

0.62 g (11.5 mmols) of sodium methylate was added to 10 ml of DMF, and a solution of 2.6 g (9.5 mmols) of diethyl o-nitrobenzylphosphonate and 15 ml of DMF were slowly added dropwise thereto at 20°–25° C. After completion of the addition, the solution was stirred for 10 minutes as it was, and a solution of 1.5 g (5.7 mmols) of

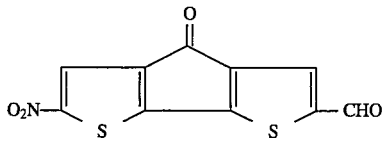

and 20 ml of DMF were then slowly added dropwise thereto at 25° C. or less. After completion of the addition, the solution was stirred for 10 minutes as it was, and it was further heated and stirred at 50°–60° C. for 2 hours on an oil bath. After standing for cooling, the solution was poured into 300 ml of methanol, and the precipitated crystals were then collected by filtration.

The resultant crude crystals were further washed with methanol and then recrystallized several times from a mixed solvent of toluene and ethyl acetate, thereby obtaining 1.1 g of the desired compound. Its yield was 50%.

Synthesis Example 14

[Synthesis of Compound Example 14-(20)]

3.6 g (66.6 mmols) of sodium methylate was added to 30 ml of DMF, and a solution of 13.2 g (48.3 mmols) of diethyl p-nitrobenzylphosphonate and 45 ml of DMF were slowly added dropwise thereto at 20°–25° C. After completion of the addition, the solution was stirred for 30 minutes as it was, and a solution of 5.0 g (16.8 mmols) of

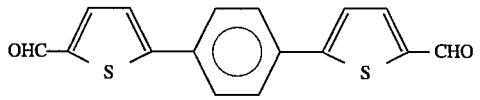

and 40 ml of DMF were then slowly added dropwise thereto at 30° C. or less. After completion of the addition, the solution was stirred for 10 minutes as it was, and it was further heated and stirred at 50°–60° C. for 2 hours on an oil bath.

After standing for cooling, the solution was poured into 500 ml of methanol, and the precipitated crystals were then collected by filtration. The resultant crude crystals were further washed with methanol and then recrystallized several times from a mixed solvent of toluene and ethyl acetate, thereby obtaining 4.3 g of the desired compound. Its yield was 47.7%.

Synthesis Example 15

[Synthesis of Compound Example 15-(14)]

0.57 g (10.6 mmols) of sodium methylate was added to 20 ml of DMF, and a solution of 2.45 g (9.0 mmols) of diethyl m-nitrobenzylphosphonate and 10 ml of DMF were slowly added dropwise thereto at 20°–25° C. After completion of the addition, the solution was stirred for 30 minutes as it was, and a solution of 2.0 g (5.3 mmols) of

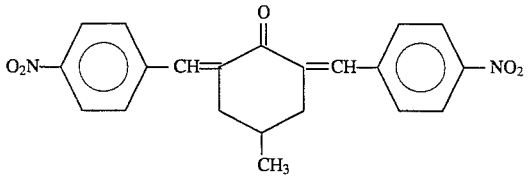

and 15 ml of DMF were then slowly added dropwise thereto at 25° C. or less. After completion of the addition, the solution was stirred for 15 minutes as it was, and it was further heated and stirred at 60°–70° C. for 2 hours on an oil bath.

After standing for cooling, the solution was poured into 300 ml of methanol, and the precipitated crystals were then collected by filtration. The resultant crude crystals were further washed with methanol and then recrystallized several times from a mixed solvent of toluene and ethyl acetate to obtain 1.1 g of the desired compound. Its yield was 41.9%.

Synthesis Example 16

[Synthesis of Compound Example 16-(43)]

2.66 g (49.2 mmols) of sodium methylate was added to 40 ml of DMF, and a solution of 12.22 g (44.7 mmols) of diethyl p-nitrobenzylphosphonate and 40 ml of DMF were slowly added dropwise thereto at about 20° C. After completion of the addition, the solution was stirred for 15 minutes as it was, and a solution of 8.95 g (34.4 mmols) of 2,5-dimethyl-3,4-diphenylcyclopentadienone and 50 ml of DMF were then slowly added dropwise thereto at 25° C. or less. After completion of the addition, the solution was stirred for 30 minutes as it was, and it was further heated and stirred at 50°–60° C. for 3 hours on a water bath. After standing for cooling, the solution was poured into water, and the precipitated crystals were collected by filtration, washed with methanol, and then recrystallized from a mixed solvent of toluene and DMF, thereby obtaining 5.95 g of the desired compound. Its yield was 45.6%.

The other compounds can also be synthesized in similar ways, but these synthesis methods are not restrictive.

The electrophotographic photosensitive member of the present invention comprises an electroconductive support and a photosensitive layer laid on the electroconductive support. Constitutional examples of the photosensitive layer include the following types (1), (2), (3) and (4). Each constitution of these types will be shown with the expression of a lower layer/an upper layer.

(1) Layer containing a charge-generating substance/layer containing a charge transporting substance, (2) layer containing a charge-transporting substance/layer containing a charge-generating substance, (3) layer containing a charge-generating substance and a charge transporting substance, and (4) layer containing a charge-generating substance/layer containing a charge-generating substance and a charge transporting substance.

The usable compounds in the present invention which can be typified by the above-mentioned compounds have high ability for enhancing the mobility of electrons. In the type (1) photosensitive layer, the compounds are preferably employed for positive charges; in the type (2), the compounds are preferably employed for negative charges; and in the types (3) and (4), the compounds can be employed either for positive charges or for negative charges.

Naturally, the constitution of the electrophotographic photosensitive member of the present invention is not limited to the above-mentioned fundamental constitutions.

The particularly preferable type of the photosensitive layer of the present invention is the above-mentioned type (1), and thus this type will be described in more detail.

In the present invention, any charge-generating substance can be used, so long as it has charge-generating ability. Examples of the charge-generating substance are as follows.

(1) Azo pigments such as monoazo, bisazo and trisazo, (2) phthalocyanine pigments such as metal phthalocyanine and non-metal phthalocyanine, (3) indigo pigments such as indigo and thioindigo, (4) perylene pigments such as perylenic anhydride and perylenic imide, (5) polycyclic quinone pigments such as anthraquinone and pyrenequinone, (6) squarilium dyes, (7) pyrylium salts and thiopyrylium salts, (8) triphenylmethane dyes, and (9) inorganic substances such as selenium and amorphous silicon.

Such a charge-generating substance may be used singly or in combination of two or more thereof.

A layer containing the charge-generating substance, that is, a charge-generating layer can be formed by dispersing the charge-generating substance in a suitable binder, and then applying the resultant dispersion on an electroconductive support. The charge-generating layer can also be obtained by forming a thin film on an electroconductive support by a dry method such as vapor deposition, sputtering, CVD and the like.

The above-mentioned binder may be selected from a great variety of binder resins, and examples of the binder resins include polycarbonates, polyesters, polyarylates, butyral resins, polystyrenes, polyvinylacetals, diallyl phthalate resins, acrylic resins, methacrylic resins, vinyl acetate resins, phenolic resins, silicone resins, polysulfones, styrene-butadiene copolymers, alkyd resins, epoxy resins, urea resins and vinyl chloride-vinyl acetate copolymers. However, the above-mentioned binder is not limited thereto.

These resins may be used singly or in combination of two or more thereof.

The resin is contained in the charge-generating layer preferably in an amount of not more than 80% by weight, more preferably not more than 40% by weight based on the total layer weight.

The film thickness of the charge-generating layer is preferably not more than 5 μm, more preferably in the range of from 0.01 to 2 μm.

The charge-generating layer may further contain a sensitizing agent.

The layer containing the charge-transporting substance, that is, a charge-transporting layer can be formed by combining the compound which can be used in the present invention with a suitable binder resin. In this case, the compounds regarding the present invention can be used singly or in combination of two or more thereof, and another charge-transporting substance may further be used in combination.

Examples of the binder resin for the charge-transporting layer include photoconductive polymers such as polyvinylcarbazoles and polyvinylanthracenes in addition to the above-mentioned substances used as the binder for the charge-generating layer.

The blend ratio of the compound which can be used in the present invention to the binder resin is such that the amount of the fluorene is from 10 to 500 parts by weight with respect to 100 parts by weight of the binder.

The thickness of the charge-transporting layer is preferably in the range of from 5 to 40 μm, more preferably from 10 to 30 μm.

The charge-transporting layer can additionally contain an antioxidant, an ultraviolet absorbing agent or a plasticizer, if necessary.

In the case where the photosensitive layer has the constitution type (3) mentioned above, that is, in the case of the single layer, this layer is formed by dispersing or dissolved the above-mentioned charge-generating substance and the compound which can be used in the present invention in the above-mentioned suitable binder to prepare a coating liquid, applying the coating liquid on a support, and then drying the same. The thickness of the layer is preferably in the range of from 5 to 40 μm, more preferably from 10 to 30 μm.

In the present invention, a layer having a barrier function and an adhesive function, i.e., the so-called subbing layer can be provided between the electroconductive support and the photosensitive layer.

Examples of the material for the subbing layer include polyvinyl alcohol, polyethylene oxide, ethyl cellulose, methyl cellulose, casein, polyamide, glue and gelatin.

The subbing layer can be formed by dissolving the above-mentioned material in a suitable solvent, and then applying the resultant solution on an electroconductive support. The thickness of the subbing layer is preferably 5 μm or less, more preferably in the range of from 0.2 to 3.0 μm.

Furthermore, in the present invention, for protecting the photosensitive layer from various external mechanical and electrical forces, a resin layer or another resin layer containing an electroconductive substance dispersed therein may be provided on the photosensitive layer.

The above-mentioned various layers can be formed on the electroconductive support by coating technique such as immersion coating, spray coating, spinner coating, roller coating, Meyer-bar coating or blade coating by the use of a suitable solvent.

Examples of the electroconductive support in the present invention include the following types.

(1) A metal such as aluminum, an aluminum alloy, stainless steel or copper in a plate shape or a drum shape.

(2) A non-electroconductive support such as a glass, a resin or a paper, or an electroconductive support mentioned in the previous item (1) on which a metal such as aluminum, palladium, rhodium, gold or platinum is vapor-deposited or laminated in the form of a coating film.

(3) A non-electroconductive support such as a glass, a resin or a paper, or an electroconductive support mentioned in the previous item (1) on which an electroconductive polymer, or an electroconductive compound such as tin oxide or indium oxide is vapor-deposited or applied.

The electrophotographic photosensitive member of the present invention is useful not only for electrophotographic copying machines but also for a variety of application fields of electrophotography such as facsimiles, laser printers, CRT printers and electrophotographic engraving systems.

FIG. 1 shows a schematic embodiment of a usual transfer type electrophotographic apparatus employing the electrophotographic photosensitive member of the present invention.

In FIG. 1, a drum type photosensitive member 1 serves as an image carrier and is rotated around an axis 1*a* in an arrow direction at a predetermined peripheral speed. The photosensitive member 1 is uniformly charged with positive or negative predetermined potential on the peripheral surface thereof by an electrostatic charging means 2 during the rotation thereof, and an exposure part 3 of the member 1 is then exposed to image-exposure light L (e.g., slit exposure, laser beam-scanning exposure or the like) by an image-exposure means (not shown), whereby an electrostatic latent image corresponding to the exposed image is sequentially formed on the peripheral surface of the photosensitive member 1.

The electrostatic latent image is developed with a toner by a developing means 4, and the toner-developed image is sequentially transferred by a transfer means 5 onto the surface of a transfer material P which is fed from a paper feeder (not shown) between the photosensitive member 1 and the transfer means 5 synchronizing with the rotation of the photosensitive member 1.

The transfer material P which has received the transferred image is separated from the surface of the photosensitive member, introduced into an image fixing means 8 to fix the image, and then discharged from the copying machine as a copy.

After the transfer of the image, the surface of the photosensitive member 1 is cleaned with a cleaning means 6 to remove the residual untransferred toner, and the member 1 is then subjected to an electrostatic charge eliminating treatment by an exposure means 7 so as to be repeatedly used for image formation.

As the uniform charging means for the photosensitive member 1, a corona charging apparatus is usually widely used. Furthermore, also as the transfer means 5, the corona charging apparatus is usually widely used. The electrophotographic apparatus can comprise an integral apparatus unit consisting of some of constitutional members such as the above-mentioned photosensitive member, developing means, cleaning means and the like, and this unit may be adapted to be detachable from the main apparatus. For example, at least one of the electrostatic charging means, the developing means and the cleaning means can be combined with the photosensitive member to form a unit which can be optionally detached from the main apparatus with the aid of a guiding means such as rails extending from the main apparatus. In this case, the apparatus unit may be associated with the electrostatic charging means and/or the developing means.

In the case where the electrophotographic apparatus is used as a copying machine or a printer, the optical image exposure light L is projected onto the photosensitive member as the reflected light or transmitted light from an original copy, or alternatively the signalized information is read out from an original copy by a sensor and then followed by scanning with a leaser beam, driving an LED array, or driving a liquid crystal shutter array in accordance with the signal, and the exposure light is projected onto the photosensitive member.

Figure 2:
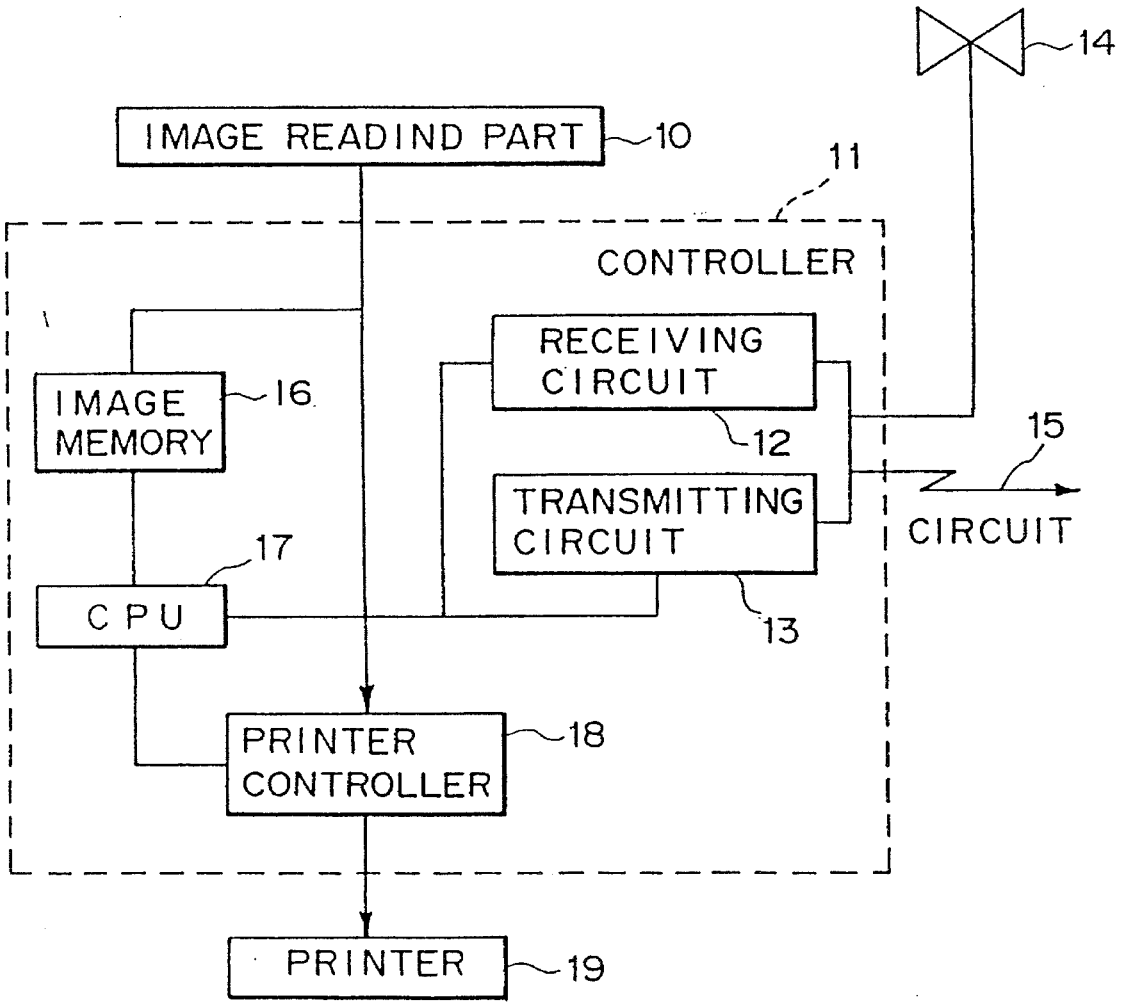
FIG. 2 illustrates an example of the block diagram of a facsimile device employing the electrophotographic photosensitive member of the present invention.

In the case where the electrophotographic apparatus is used as a printer of a facsimile device, the optical image exposure light L functions as an exposure for printing the received data. FIG. 2 is a block diagram of one example in this case.

A controller 11 controls an image reading part 10 and a printer 19. The whole of the controller 11 is controlled by a CPU 17. The readout data from the image reading part is transmitted through a transmitting circuit 13 to the partner communication station. The data received from the partner communication station is transmitted through a receiving circuit 12 to a printer 19. The predetermined amount of the image data is stored in an image memory. A printer controller 18 controls the printer 19. Numeral 14 denotes a telephone set.

The image received through the circuit 15 (the image information from a remote terminal connected through the circuit) is demodulated by the receiving circuit 12, treated to decode the image information in the CPU 17, and then successively stored in an image memory 16. When at least one page of the image has been stored in the image memory 16, the image is recorded in such a manner that the CPU 17 reads out the one page of the image information from the image memory 16, and then sends out the decoded one page of the information to the printer controller 18. On receiving the one page of the information from the CPU 17, this printer controller 18 controls the printer 19 to record the image information.

Incidentally, the CPU 17 receives the following page of the information, while the recording is conducted by the printer 19.

The receiving and recording of the images are carried out in the above-mentioned manner.

EXAMPLE 1

4 g of oxytitaniumphthalocyanine obtained in accordance with a preparation example disclosed in Japanese Patent Application Laid-open No. 61-239248 (U.S. Pat. No. 4,728,592) was dispersed in a solution obtained by dissolving 2 g of a polybutyral resin (butyralization degree 70 mol %, weight average molecular weight 50,000) in 90 ml of cyclohexanone for 20 hours by means of a sand mill, thereby preparing a coating liquid.

This coating liquid, after diluted, was applied onto an aluminum sheet by a Meyer bar so that the thickness of a dry layer might be 0.2 μm, to form a charge-generating layer.

Next, 5 g of Compound Example 1-(9) which was a charge-transporting substance and 5 g of a polycarbonate resin (weight average molecular weight 40,000) were dissolved in 40 g of a mixture of monochlorobenzene (50 parts by weight) and N,N-dimethylformamide (50 parts by weight), and the resultant solution was applied onto the above-mentioned charge-generating layer by the Meyer bar to form a charge-transporting layer having a dry thickness of 15 μm, whereby an electrophotographic photosensitive member was prepared.

The charging characteristics of the thus prepared electrophotographic photosensitive member were evaluated by subjecting this member to corona discharge under +6 KV in accordance with a static mode by the use of an electrostatic copying-paper tester (model EPA-8100, made by Kawaguchi Denki K.K.), allowing it to stand in the dark for 1 hour, and then exposing it to the light having an illuminance of 20 lux.

As the charging characteristics, there were measured a surface potential ($V_0$), a potential ($V_1$) after dark decay by standing for 1 second in the dark, an exposure ($E_{1/2}$) necessary to decay $V_1$ to ½, and a potential after irradiation of a light volume of 100 Lux.sec, i.e., a remaining potential ($V_R$).

Furthermore, for the purpose of evaluating the durability of the previously prepared electrophotographic photosensitive member, this member was attached onto the photosensitive drum of a copying machine (a remodeled type of NP-6650, made by Canon K. K.), and 1,000 sheets were copied by the machine. In this case, a light-portion potential ($V_L$) and a dark-portion potential ($V_D$) were measured for the copies at an early stage and the copies after 1,000 sheets were copied. Here, $V_D$ and $V_L$ at the early stage were set so as to be +650 V and +150 V, respectively. The results are shown in Table 1.

TABLE 1

| | $V_0$ (+V) | $V_1$ (+V) | $E_{1/2}$ (lux · sec) | $V_R$ (+V) |
|---|---|---|---|---|
| Example 1 | 710 | 700 | 3.6 | 50 |

| | | Initial Potential (+V) | Potential after Durability Test of 1,000 Copies (+V) |
|---|---|---|---|
| Example 1 | $V_D$ | 650 | 648 |
| | $V_L$ | 150 | 153 |

EXAMPLES 2 to 10

The same procedure as in Example 1 was effected except that Compound Example 1-(9) of a charge-transporting substance was replaced with each of Compound Examples 1-(3), 1-(6), 1-(10), 1-(11), 1-(13), 1-(21), 1-(29), 1-(36) and 1-(43), to prepare electrophotographic photosensitive members, and these members were then evaluated.

The results are shown in Table 2.

COMPARATIVE EXAMPLES 1 to 6

The same procedure as in the above-mentioned examples was effected except that the following compounds were used as charge-transporting substances, thereby preparing electrophotographic photosensitive members, and these members were then evaluated.

The results are shown in Table 3.

Comparative Compound Example 1-(1)

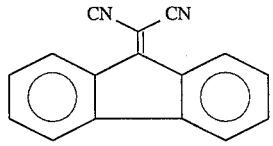

-continued

Comparative Compound Example 1-(2)

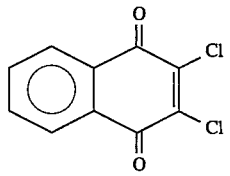

Comparative Compound Example 1-(3)

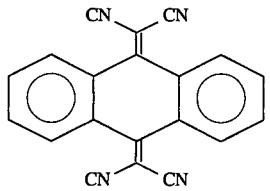

Comparative Compound Example 1-(4)

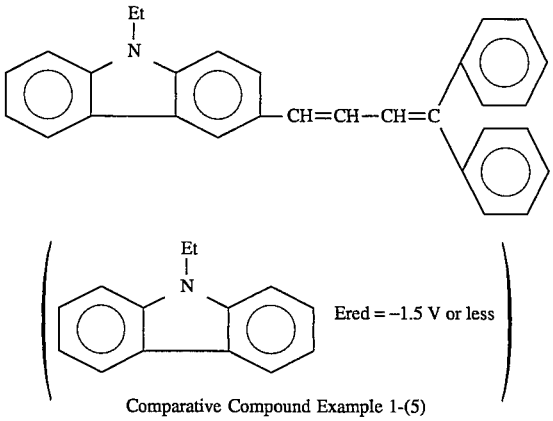

Comparative Compound Example 1-(5)

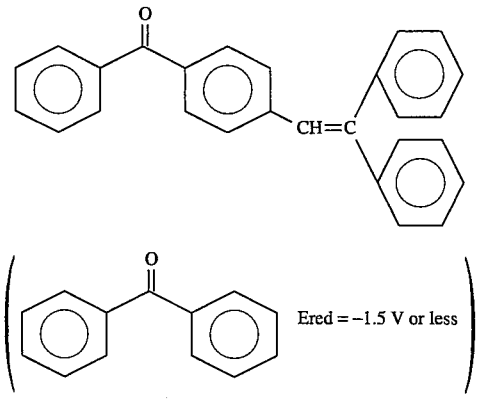

Comparative Compound Example 1-(6)

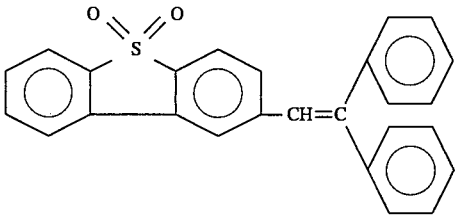

-continued

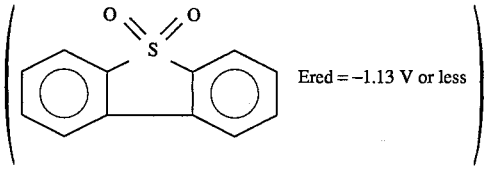

TABLE 2

| Example | Compound Example | $V_0$ (+V) | $V_1$ (+V) | $E_{1/2}$ (lux · sec) | $V_R$ (+V) |
|---|---|---|---|---|---|
| 2 | 1-(3) | 710 | 700 | 3.1 | 60 |
| 3 | 1-(6) | 700 | 697 | 3.3 | 50 |
| 4 | 1-(10) | 715 | 710 | 3.0 | 60 |
| 5 | 1-(11) | 685 | 680 | 3.9 | 70 |
| 6 | 1-(13) | 695 | 690 | 3.6 | 70 |
| 7 | 1-(21) | 701 | 694 | 3.8 | 60 |
| 8 | 1-(29) | 700 | 694 | 2.5 | 50 |
| 9 | 1-(36) | 702 | 693 | 2.3 | 40 |
| 10 | 1-(43) | 695 | 690 | 4.1 | 60 |

| | Initial Potential | | Potential after Durability Test of 1,000 Copies | |
|---|---|---|---|---|
| Example | $V_D$ (+V) | $V_L$ (+V) | $V_D$ (+V) | $V_L$ (+V) |
| 2 | 650 | 150 | 640 | 140 |
| 3 | 650 | 150 | 635 | 141 |
| 4 | 650 | 150 | 642 | 149 |
| 5 | 650 | 150 | 650 | 137 |
| 6 | 650 | 150 | 641 | 140 |
| 7 | 650 | 150 | 637 | 143 |
| 8 | 650 | 150 | 649 | 148 |
| 9 | 650 | 150 | 650 | 151 |
| 10 | 650 | 150 | 639 | 139 |

TABLE 3

| Comp. Example | Comparative Compound Example | $V_0$ (+V) | $V_1$ (+V) | $E_{1/2}$ (lux·sec) | $V_R$ (+V) |
|---|---|---|---|---|---|
| 1 | 1-(1) | 710 | 702 | 13.4 | 260 |
| 2 | 1-(2) | 711 | 704 | 14.5 | 240 |
| 3 | 1-(3) | 689 | 679 | 11.2 | 180 |
| 4 | 1-(4) | 702 | 698 | — | 695 |
| 5 | 1-(5) | 699 | 696 | — | 690 |
| 6 | 1-(6) | 702 | 697 | — | 695 |

| Comp. | Initial Potential | | Potential after Durability Test of 1,000 Copies | |
|---|---|---|---|---|
| Example | $V_D$ (+V) | $V_L$ (+V) | $V_D$ (+V) | $V_L$ (+V) |
| 1 | — | — | — | — |
| 2 | — | — | — | — |
| 3 | — | — | — | — |
| 4 | — | — | — | — |
| 5 | — | — | — | — |
| 6 | — | — | — | — |

Note:
The symbol "—" means that sensitivity was low and the remaining potential was high, and thus measurement or setting was impossible.

EXAMPLE 11

The same procedure as in Example 1 was effected except that the weight average molecular weight of a polyvinylbutyral resin was 40,000, the amount of cyclohexane was 95 ml, a dispersing time was 24 hours, a charge-transporting substance was Comparative Example 2-(4), the weight average molecular weight of a polycarbonate resin was 35,000, its amount was 6 g, and 100 g of chlorobenzene was used as a solvent for a charge-transporting layer, whereby an electrophotographic photosensitive member was prepared. In this case, the thickness of a charge-generating layer was 0.4 μm and that of the charge-transporting layer was 17 μm.

The thus prepared photosensitive member was evaluated in the same manner as in Example 1 except that 2,000 sheets were copied.

The results are shown in Table 4.

TABLE 4

| | $V_0$ (+V) | $V_1$ (+V) | $E_{1/2}$ (lux · sec) | $V_R$ (+V) |
|---|---|---|---|---|
| Example 11 | 690 | 680 | 2.9 | 29 |

| | | Initial Potential (+V) | Potential after Durability Test of 2,000 Copies (+V) |
|---|---|---|---|
| Example 11 | $V_D$ | 650 | 655 |
| | $V_L$ | 150 | 145 |

EXAMPLES 12 to 20 and

Comparative Examples 7 to 10

The same procedure as in Example 11 was effected except that Compound Example 2-(4) of a charge-transporting substance was replaced with each of Compound Examples 2-(1), 2-(11), 2-(12), 2-(22), 2-(23), 2-(37), 2-(45), 2-(70) and 2-(61), to prepare electrophotographic photosensitive members, and these members were then evaluated.

For comparison, the same procedure as in the above-mentioned examples was effected except that the following comparative compounds were used as charge-transporting materials, thereby obtaining electrophotographic photosensitive members, and these members were then evaluated.

The results are shown in Table 5.

Comparative Compound Example 2-(1)

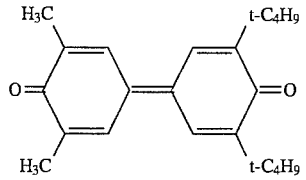

Comparative Compound Example 2-(2)

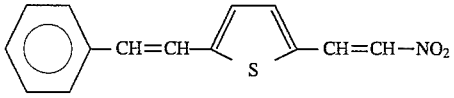

Comparative Compound Example 2-(3)

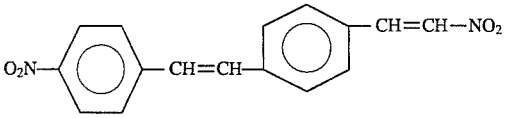

-continued

Comparative Compound Example 2-(4)

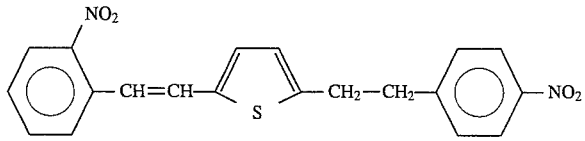

TABLE 5

| Example | Compound Example | $V_0$ (+V) | $V_1$ (+V) | $E_{1/2}$ (lux · sec) | $V_R$ (+V) |
|---|---|---|---|---|---|
| 12 | 2-(1) | 710 | 700 | 3.9 | 50 |
| 13 | 2-(11) | 705 | 690 | 2.7 | 40 |
| 14 | 2-(12) | 710 | 695 | 3.1 | 40 |
| 15 | 2-(22) | 700 | 685 | 2.3 | 30 |
| 16 | 2-(23) | 700 | 690 | 3.2 | 30 |
| 17 | 2-(37) | 710 | 705 | 2.4 | 30 |
| 18 | 2-(45) | 700 | 690 | 2.2 | 40 |
| 19 | 2-(70) | 710 | 700 | 3.1 | 45 |
| 20 | 2-(61) | 710 | 695 | 2.9 | 40 |

| | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 12 | 650 | 150 | 640 | 160 |
| 13 | 650 | 150 | 645 | 145 |
| 14 | 650 | 150 | 635 | 155 |
| 15 | 650 | 150 | 645 | 150 |
| 16 | 650 | 150 | 635 | 135 |
| 17 | 650 | 150 | 640 | 155 |
| 18 | 650 | 150 | 650 | 155 |
| 19 | 650 | 150 | 635 | 145 |
| 20 | 650 | 150 | 640 | 140 |

| Comp. Example | Comparative Compound Example | $V_0$ (+V) | $V_1$ (+V) | $E_{1/2}$ (lux · sec) | $V_R$ (+V) |
|---|---|---|---|---|---|
| 7 | 2-(1) | 700 | 680 | 6.0 | 140 |
| 8 | 2-(2) | 700 | 700 | — | 340 |
| 9 | 2-(3) | 700 | 690 | 19.0 | 230 |
| 10 | 2-(4) | 700 | 700 | 23.0 | 250 |

| Comp. | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 7 | 650 | 150 | 600 | 196 |
| 8 | — | — | — | — |
| 9 | — | — | — | — |
| 10 | — | — | — | — |

Note:
The symbol "—" means that sensitivity was low and the remaining potential was high, and thus measurement or setting was impossible.

EXAMPLE 21

The same procedure as in Example 11 was effected except that a charge-transporting substance was Compound Example 3-(8) and the weight average molecular weight of a polycarbonate resin was 80,000, thereby obtaining an electrophotographic photosensitive member. In this case, the thickness of a charge-transporting layer was 20 μm.

The thus obtained photosensitive member was then evaluated in the same manner as in Example 11.

The results are shown in Table 6.

TABLE 6

| | $V_0$ (+V) | $V_1$ (+V) | $E_{1/2}$ (lux · sec) | $V_R$ (+V) |
|---|---|---|---|---|
| Example 21 | 690 | 680 | 2.7 | 35 |

| | | Initial Potential (+V) | Potential after Durability Test of 2,000 Copies (+V) |
|---|---|---|---|
| Example 21 | $V_D$ | 650 | 640 |
| | $V_L$ | 150 | 145 |

EXAMPLES 22 to 30 and

Comparative Examples 11 to 12

The same procedure as in Example 21 was effected except that Compound Example 3-(8) of a charge-transporting substance was replaced with each of Compound Examples 3-(3), 3-(15), 3-(29), 3-(33), 3-(45), 3-(58), 3-(60), 3-(69) and 3-(78), to prepare electrophotographic photosensitive members, and these members were then evaluated.

For comparison, the same procedure as in the above-mentioned examples was effected except that the following comparative compounds were used as charge-transporting materials, thereby obtaining electrophotographic photosensitive members, and these members were then evaluated.

The results are shown in Table 7.

Comparative Compound Example 3-(1)

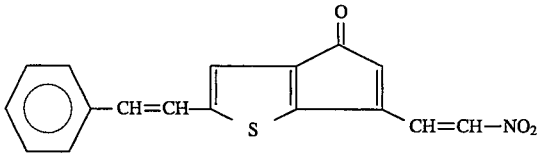

Comparative Compound Example 3-(2)

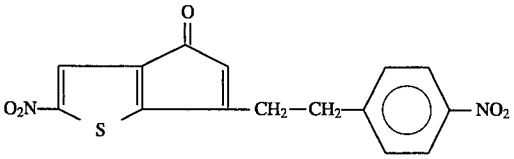

TABLE 7

| Example | Compound Example | $V_0$ (+V) | $V_1$ (+V) | $E_{1/2}$ (lux · sec) | $V_R$ (+V) |
|---|---|---|---|---|---|
| 22 | 3-(3) | 710 | 690 | 2.8 | 40 |
| 23 | 3-(15) | 705 | 690 | 2.7 | 40 |
| 24 | 3-(29) | 710 | 690 | 2.6 | 30 |
| 25 | 3-(33) | 700 | 695 | 2.3 | 30 |
| 26 | 3-(45) | 700 | 690 | 2.5 | 30 |
| 27 | 3-(58) | 710 | 705 | 2.4 | 35 |
| 28 | 3-(60) | 700 | 690 | 3.0 | 50 |
| 29 | 3-(69) | 710 | 700 | 3.1 | 50 |
| 30 | 3-(78) | 710 | 695 | 2.9 | 45 |

| Example | Initial Potential $V_D$ (+V) | Initial Potential $V_L$ (+V) | Potential after Durability Test of 2,000 Copies $V_D$ (+V) | Potential after Durability Test of 2,000 Copies $V_L$ (+V) |
|---|---|---|---|---|
| 22 | 650 | 150 | 640 | 160 |
| 23 | 650 | 150 | 645 | 145 |
| 24 | 650 | 150 | 640 | 150 |
| 25 | 650 | 150 | 650 | 145 |
| 26 | 650 | 150 | 650 | 135 |
| 27 | 650 | 150 | 645 | 140 |
| 28 | 650 | 150 | 660 | 155 |
| 29 | 650 | 150 | 655 | 145 |
| 30 | 650 | 150 | 640 | 140 |

| Comp. Example | Comparative Compound Example | $V_0$ (+V) | $V_1$ (+V) | $E_{1/2}$ (lux · sec) | $V_R$ (+V) |
|---|---|---|---|---|---|
| 11 | 3-(1) | 700 | 700 | — | 650 |
| 12 | 3-(2) | 700 | 700 | 22.0 | 300 |

| Comp. Example | Initial Potential $V_D$ (+V) | Initial Potential $V_L$ (+V) | Potential after Durability Test of 2,000 Copies $V_D$ (+V) | Potential after Durability Test of 2,000 Copies $V_L$ (+V) |
|---|---|---|---|---|
| 11 | — | — | — | — |
| 12 | — | — | — | — |

Note:
The symbol "—" means that sensitivity was low and the remaining potential was high, and thus measurement or setting was impossible.

EXAMPLE 31

The same procedure as in Example 11 was effected except that the weight average molecular weight of a polyvinylbutyral resin was 80,000, a dispersing time was 10 hours, a charge-transporting substance was Compound Example 4-(4), and the weight average molecular weight of a polycarbonate resin was 50,000, whereby an electrophotographic photosensitive member was prepared. In this case, the thickness of a charge-transporting layer was 19 μm.

The thus prepared photosensitive member was evaluated in the same manner as in Example 11.

The results are shown in Table 8.

TABLE 8

| | $V_0$ (+V) | $V_1$ (+V) | $E_{1/2}$ (lux · sec) | $V_R$ (+V) |
|---|---|---|---|---|
| Example 31 | 690 | 680 | 2.6 | 30 |

| | | Initial Potential (+V) | Potential after Durability Test of 2,000 Copies (+V) |
|---|---|---|---|
| Example 31 | $V_D$ | 650 | 640 |
| | $V_L$ | 150 | 145 |

EXAMPLES 32 to 40 and

Comparative Examples 13 to 14

The same procedure as in Example 31 was effected except that Compound Example 4-(4) of a charge-transporting substance was replaced with each of Compound Examples 4-(3), 4-(8), 4-(9), 4-(13), 4-(18), 4-(21), 4-(27), 4-(29) and 4-(37), to prepare electrophotographic photosensitive members, and these members were then evaluated.

For comparison, the same procedure as in the above-mentioned examples was effected except that the following comparative compounds were used as charge-transporting materials, thereby obtaining electrophotographic photosensitive members, and these members were then evaluated.

The results are shown in Table 9.

Comparative Compound Example 4-(1)

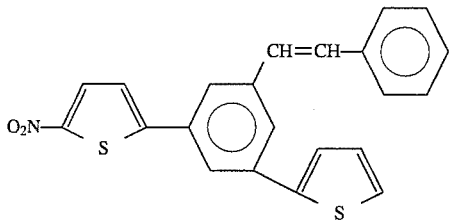

Comparative Compound Example 4-(2)

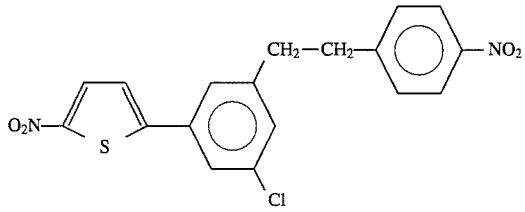

TABLE 9

| Example | Compound Example | $V_0$ (+V) | $V_1$ (+V) | $E_{1/2}$ (lux · sec) | $V_R$ (+V) |
|---|---|---|---|---|---|
| 32 | 4-(3) | 710 | 700 | 2.8 | 40 |
| 33 | 4-(8) | 705 | 690 | 3.2 | 50 |
| 34 | 4-(9) | 710 | 695 | 3.4 | 55 |
| 35 | 4-(13) | 700 | 690 | 2.3 | 30 |
| 36 | 4-(18) | 700 | 695 | 3.0 | 45 |
| 37 | 4-(21) | 710 | 705 | 2.9 | 40 |
| 38 | 4-(27) | 700 | 690 | 2.2 | 30 |
| 39 | 4-(29) | 710 | 700 | 2.3 | 25 |
| 40 | 4-(37) | 710 | 695 | 2.2 | 25 |

| | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 32 | 650 | 150 | 640 | 150 |
| 33 | 650 | 150 | 645 | 145 |
| 34 | 650 | 150 | 635 | 160 |
| 35 | 650 | 150 | 645 | 145 |
| 36 | 650 | 150 | 650 | 140 |
| 37 | 650 | 150 | 640 | 155 |
| 38 | 650 | 150 | 650 | 160 |
| 39 | 650 | 150 | 655 | 145 |
| 40 | 650 | 150 | 640 | 140 |

| Comp. Example | Comparative Compound Example | $V_0$ (+V) | $V_1$ (+V) | $E_{1/2}$ (lux · sec) | $V_R$ (+V) |
|---|---|---|---|---|---|
| 13 | 4-(1) | 700 | 700 | — | — |
| 14 | 4-(2) | 700 | 700 | — | 630 |

TABLE 9-continued

| Comp. | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 13 | — | — | — | — |
| 14 | — | — | — | — |

Note:
The symbol "—" means that sensitivity was low and the remaining potential was high, and thus measurement or setting was impossible.

EXAMPLE 41

The same procedure as in Example 11 was effected except that the weight average molecular weight of a polyvinylbutyral resin was 100,000, a dispersing time was 10 hours, and a charge-transporting substance was Compound Example 5-(48), thereby preparing an electrophotographic photosensitive member. In this case, the thickness of a charge-generating layer was 0.2 μm, and that of a charge-transporting layer was 20 μm.

The thus prepared photosensitive member was evaluated in the same manner as in Example 11.

The results are shown in Table 10.

TABLE 10

| | $V_0$ (+V) | $V_1$ (+V) | $E_{1/2}$ (lux · sec) | $V_R$ (+V) |
|---|---|---|---|---|
| Example 41 | 690 | 680 | 2.8 | 35 |

| | | Initial Potential (+V) | Potential after Durability Test of 2,000 Copies (+V) |
|---|---|---|---|
| Example 41 | $V_D$ | 650 | 645 |
| | $V_L$ | 150 | 150 |

EXAMPLES 42 to 50 and

Comparative Examples 15 to 16

The same procedure as in Example 41 was effected except that Compound Example 5-(48) of a charge-transporting substance was replaced with each of Compound Examples 5-(7), 5-(12), 5-(19), 5-(23), 5-(29), 5-(66), 5-(85), 5-(111) and 5-(114), to prepare electrophotographic photosensitive members, and these members were then evaluated.

For comparison, the same procedure as in the above-mentioned examples was effected except that the following comparative compounds were used as .charge-transporting materials, thereby obtaining electrophotographic photosensitive members, and these members were then evaluated.

The results are shown in Table 11.

Comparative Compound Example 5-(1)

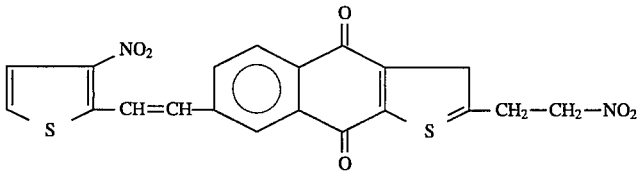

Comparative Compound Example 5-(2)

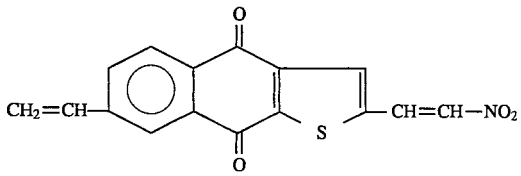

TABLE 11

| Example | Compound Example | $V_0$ (+V) | $V_1$ (+V) | $E_{1/2}$ (lux · sec) | $V_R$ (+V) |
|---|---|---|---|---|---|
| 42 | 5-(7) | 710 | 700 | 2.8 | 50 |
| 43 | 5-(12) | 705 | 690 | 2.7 | 40 |
| 44 | 5-(19) | 710 | 695 | 4.0 | 60 |
| 45 | 5-(23) | 700 | 685 | 2.6 | 35 |
| 46 | 5-(29) | 700 | 690 | 3.2 | 45 |
| 47 | 5-(66) | 710 | 705 | 2.4 | 30 |
| 48 | 5-(85) | 700 | 690 | 3.8 | 45 |
| 49 | 5-(111) | 710 | 700 | 2.7 | 35 |
| 50 | 5-(114) | 710 | 695 | 2.9 | 40 |

| | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 42 | 650 | 150 | 640 | 145 |
| 43 | 650 | 150 | 645 | 140 |
| 44 | 650 | 150 | 635 | 130 |
| 45 | 650 | 150 | 645 | 145 |
| 46 | 650 | 150 | 630 | 135 |
| 47 | 650 | 150 | 640 | 150 |
| 48 | 650 | 150 | 665 | 170 |
| 49 | 650 | 150 | 635 | 145 |
| 50 | 650 | 150 | 645 | 145 |

| Comp. Example | Comparative Compound Example | $V_0$ (+V) | $V_1$ (+V) | $E_{1/2}$ (lux · sec) | $V_R$ (+V) |
|---|---|---|---|---|---|
| 15 | 5-(1) | 700 | 700 | — | — |
| 16 | 5-(2) | 700 | 700 | 17.0 | 260 |

| Comp. | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 15 | — | — | — | — |
| 16 | — | — | — | — |

Note: The symbol "—" means that sensitivity was low and the remaining potential was high, and thus measurement or setting was impossible.

EXAMPLE 51

The same procedure as in Example 11 was effected except that a charge-transporting substance was Compound Example 6-(91), its amount was 6 g, and the weight average molecular weight of a polycarbonate resin was 50,000, thereby preparing an electrophotographic photosensitive member. In this case, the thickness of a charge-generating layer was 0.2 μm, and that of a charge-transporting layer was 19 μm.

The thus prepared photosensitive member was evaluated in the same manner as in Example 11.

The results are shown in Table 12.

TABLE 12

| | $V_0$ (+V) | $V_1$ (+V) | $E_{1/2}$ (lux · sec) | $V_R$ (+V) |
|---|---|---|---|---|
| Example 51 | 690 | 680 | 2.3 | 35 |

| | | Initial Potential (+V) | Potential after Durability Test of 2,000 Copies (+V) |
|---|---|---|---|
| Example 51 | $V_D$ | 650 | 645 |
| | $V_L$ | 150 | 140 |

EXAMPLES 52 to 60 and

Comparative Examples 17 and 18

The same procedure as in Example 51 was effected except that Compound Example 6-(91) of a charge-transporting substance was replaced with each of Compound Examples 6-(5), 6-(27), 6-(39), 6-(49), 6-(60), 6-(65), 6-(70), 6-(77) and 6-(82), to prepare electrophotographic photosensitive members, and these members were then evaluated.

For comparison, the same procedure as in the above-mentioned examples was effected except that the following comparative compounds were used as charge-transporting materials, thereby obtaining electrophotographic photosensitive members, and these members were then evaluated.

The results are shown in Table 13.

Comparative Compound Example 6-(1)

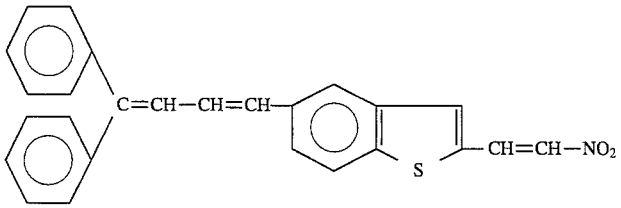

Comparative Compound Example 6-(2)

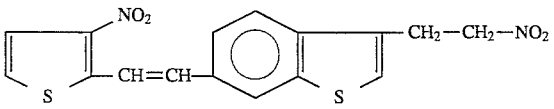

TABLE 13

| Example | Compound Example | $V_0$ (+V) | $V_1$ (+V) | $E_{1/2}$ (lux · sec) | $V_R$ (+V) |
|---|---|---|---|---|---|
| 51 | 6-(5) | 710 | 700 | 3.8 | 55 |
| 52 | 6-(27) | 705 | 690 | 2.7 | 40 |
| 53 | 6-(39) | 710 | 695 | 3.9 | 55 |
| 54 | 6-(49) | 705 | 690 | 2.3 | 30 |
| 55 | 6-(60) | 700 | 690 | 2.5 | 30 |
| 56 | 6-(65) | 705 | 705 | 2.2 | 45 |
| 57 | 6-(70) | 700 | 690 | 2.6 | 40 |
| 58 | 6-(77) | 705 | 700 | 3.4 | 50 |
| 59 | 6-(82) | 710 | 695 | 2.9 | 45 |

| | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 51 | 650 | 150 | 635 | 160 |
| 52 | 650 | 150 | 645 | 145 |
| 53 | 650 | 150 | 630 | 160 |
| 54 | 650 | 150 | 645 | 150 |
| 55 | 650 | 150 | 650 | 135 |
| 56 | 650 | 150 | 655 | 155 |
| 57 | 650 | 150 | 650 | 145 |
| 58 | 650 | 150 | 635 | 130 |
| 59 | 650 | 150 | 640 | 140 |

| Comp. Example | Comparative Compound Example | $V_0$ (+V) | $V_1$ (+V) | $E_{1/2}$ (lux · sec) | $V_R$ (+V) |
|---|---|---|---|---|---|
| 17 | 6-(1) | 700 | 700 | — | 600 |
| 18 | 6-(2) | 700 | 700 | — | 380 |

| Comp. | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 17 | — | — | — | — |
| 18 | — | — | — | — |

Note: The symbol "—" means that sensitivity was low and the remaining potential was high, and thus measurement or setting was impossible.

EXAMPLE 61

The same procedure as in Example 11 was effected except that the weight average molecular weight of a polyvinylbutyral resin was 50,000, a dispersing time was 20 hours, a charge-transporting substance was Compound Example 7-(3), and the weight average molecular weight of a polycarbonate resin was 50,000, thereby preparing an electrophotographic photosensitive member. In this case, the thickness of a charge-generating layer was 0.3 μum, and that of a charge-transporting layer was 18 μm.

The thus prepared photosensitive member was evaluated in the same manner as in Example 11.

The results are shown in Table 14.

TABLE 14

| | $V_0$ (+V) | $V_1$ (+V) | $E_{1/2}$ (lux · sec) | $V_R$ (+V) |
|---|---|---|---|---|
| Example 61 | 690 | 680 | 2.8 | 35 |

| | | Initial Potential (+V) | Potential after Durability Test of 2,000 Copies (+V) |
|---|---|---|---|
| Example 61 | $V_D$ | 650 | 645 |
| | $V_L$ | 150 | 140 |

EXAMPLES 62 to 70 and

Comparative Examples 19 and 20

The same procedure as in Example 61 was effected except that Compound Example 7-(3) of a charge-transporting substance was replaced with each of Compound Examples 7-(5), 7-(13), 7-(26), 7-(32), 7-(48), 7-(59), 7-(68), 7-(78) and 7-(84), to prepare electrophotographic photosensitive members, and these members were then evaluated.

For comparison, the same procedure as in the above-mentioned examples was effected except that the following comparative compounds were used as charge-transporting materials, thereby obtaining electrophotographic photosensitive members, and these members were then evaluated.

The results are shown in Table 15.

Comparative Compound Example 7-(1)

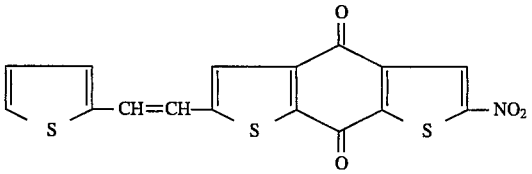

Comparative Compound Example 7-(2)

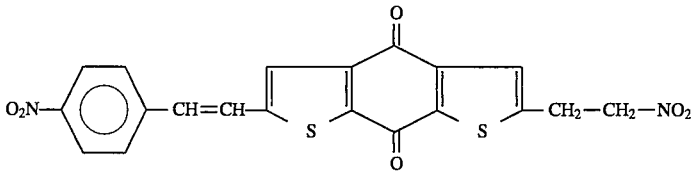

TABLE 15

| Example | Compound Example | $V_0$ (+V) | $V_1$ (+V) | $E_{1/2}$ (lux · sec) | $V_R$ (+V) |
|---|---|---|---|---|---|
| 62 | 7-(5) | 710 | 700 | 3.0 | 55 |
| 63 | 7-(13) | 705 | 690 | 2.7 | 45 |
| 64 | 7-(26) | 710 | 695 | 2.9 | 50 |
| 65 | 7-(32) | 700 | 685 | 2.5 | 35 |
| 66 | 7-(48) | 700 | 690 | 2.5 | 30 |
| 67 | 7-(59) | 710 | 705 | 3.9 | 50 |
| 68 | 7-(68) | 700 | 690 | 2.2 | 20 |
| 69 | 7-(78) | 710 | 700 | 2.8 | 35 |
| 70 | 7-(84) | 710 | 695 | 2.9 | 40 |

| | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 62 | 650 | 150 | 640 | 140 |
| 63 | 650 | 150 | 645 | 145 |
| 64 | 650 | 150 | 635 | 135 |
| 65 | 650 | 150 | 645 | 150 |
| 66 | 650 | 150 | 635 | 145 |
| 67 | 650 | 150 | 665 | 165 |
| 68 | 650 | 150 | 650 | 155 |
| 69 | 650 | 150 | 640 | 145 |
| 70 | 650 | 150 | 640 | 140 |

| Comp. Example | Comparative Compound Example | $V_0$ (+V) | $V_1$ (+V) | $E_{1/2}$ (lux · sec) | $V_R$ (+V) |
|---|---|---|---|---|---|
| 19 | 7-(1) | 700 | 700 | — | — |
| 20 | 7-(2) | 700 | 700 | 15.0 | 280 |

| Comp. | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 19 | — | — | — | — |
| 20 | — | — | — | — |

Note: The symbol "—" means that sensitivity was low and the remaining potential was high, and thus measurement or setting was impossible.

EXAMPLE 71

The same procedure as in Example 11 was effected except that the weight average molecular weight of a polyvinylbutyral resin was 30,000, a charge-transporting substance was Compound Example 8-(11), and the weight average molecular weight of a polycarbonate resin was 55,000, thereby preparing an electrophotographic photosensitive member. In this case, the thickness of a charge-generating layer was 0.3 μm.

The thus prepared photosensitive member was evaluated in the same manner as in Example 11.

The results are shown in Table 16.

TABLE 16

| | $V_0$ (+V) | $V_1$ (+V) | $E_{1/2}$ (lux · sec) | $V_R$ (+V) |
|---|---|---|---|---|
| Example 71 | 690 | 680 | 3.0 | 45 |

| | | Initial Potential (+V) | Potential after Durability Test of 2,000 Copies (+V) |
|---|---|---|---|
| Example 71 | $V_D$ | 650 | 655 |
| | $V_L$ | 150 | 145 |

EXAMPLES 72 to 80 and

Comparative Examples 21 and 22

The same procedure as in Example 71 was effected except that Compound Example 8-(11) of a charge-transporting substance was replaced with each of Compound Examples 8-(9), 8-(14), 8-(21), 8-(26), 8-(30), 8-(61), 8-(63), 8-(66) and 8-(69), to prepare electrophotographic photosensitive members, and these members were then evaluated.

For comparison, the same procedure as in the above-mentioned examples was effected except that the following comparative compounds were used as charge-transporting materials, thereby obtaining electrophotographic photosensitive members, and these members were then evaluated.

The results are shown in Table 17.

Comparative Compound Example 8-(1)

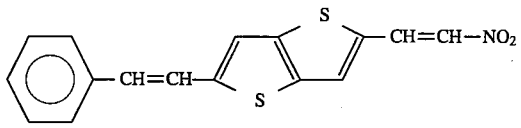

-continued

Comparative Compound Example 8-(2)

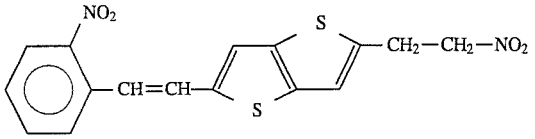

TABLE 17

| Example | Compound Example | $V_0$ (+V) | $V_1$ (+V) | $E_{1/2}$ (lux · sec) | $V_R$ (+V) |
|---|---|---|---|---|---|
| 72 | 8-(9) | 710 | 700 | 2.4 | 30 |
| 73 | 8-(14) | 705 | 690 | 2.5 | 35 |
| 74 | 8-(21) | 710 | 695 | 2.9 | 50 |
| 75 | 8-(26) | 700 | 685 | 2.4 | 40 |
| 76 | 8-(30) | 700 | 690 | 2.5 | 35 |
| 77 | 8-(61) | 710 | 705 | 3.0 | 50 |
| 78 | 8-(63) | 700 | 690 | 3.2 | 55 |
| 79 | 8-(66) | 710 | 700 | 2.8 | 40 |
| 80 | 8-(69) | 710 | 695 | 2.2 | 30 |

| | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 72 | 650 | 150 | 645 | 160 |
| 73 | 650 | 150 | 640 | 160 |
| 74 | 650 | 150 | 635 | 155 |
| 75 | 650 | 150 | 640 | 140 |
| 76 | 650 | 150 | 645 | 145 |
| 77 | 650 | 150 | 640 | 160 |
| 78 | 650 | 150 | 635 | 160 |
| 79 | 650 | 150 | 635 | 145 |
| 80 | 650 | 150 | 640 | 145 |

| Comp. Example | Comparative Compound Example | $V_0$ (+V) | $V_1$ (+V) | $E_{1/2}$ (lux · sec) | $V_R$ (+V) |
|---|---|---|---|---|---|
| 21 | 8-(1) | 700 | 700 | — | 600 |
| 22 | 8-(2) | 700 | 700 | — | 450 |

| Comp. | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 21 | — | — | — | — |
| 22 | — | — | — | — |

Note: The symbol "—" means that sensitivity was low and the remaining potential was high, and thus measurement or setting was impossible.

EXAMPLE 81

The same procedure as in Example 11 was effected except that the weight average molecular weight of a polyvinylbutyral resin was 50,000, a dispersing time was 20 hours, a charge-transporting substance was Compound Example 9-(6), and the weight average molecular weight of a polycarbonate resin was 60,000, thereby preparing an electrophotographic photosensitive member. In this case, the thickness of a charge-generating layer was 0.5 μm, and that of a charge-transporting layer was 19 μm.

The thus prepared photosensitive member was evaluated in the same manner as in Example 11.

The results are shown in Table 18.

TABLE 18

| | $V_0$ (+V) | $V_1$ (+V) | $E_{1/2}$ (lux · sec) | $V_R$ (+V) |
|---|---|---|---|---|
| Example 81 | 690 | 680 | 2.3 | 30 |

| | | Initial Potential (+V) | Potential after Durability Test of 2,000 Copies (+V) |
|---|---|---|---|
| Example 81 | $V_D$ | 650 | 645 |
| | $V_L$ | 150 | 140 |

EXAMPLES 82 to 90 and

Comparative Examples 23 and 24

The same procedure as in Example 81 was effected except that Compound Example 9-(6) of a charge-transporting substance was replaced with each of Compound Examples 9-(5), 9-(23), 9-(29), 9-(35), 9-(57), 9-(71), 9-(76), 9-(85) and 9-(91), to prepare electrophotographic photosensitive members, and these members were then evaluated.

For comparison, the same procedure as in the above-mentioned examples was effected except that the following comparative compounds were used as charge-transporting materials, thereby obtaining electrophotographic photosensitive members, and these members were then evaluated.

The results are shown in Table 19.

Comparative Compound Example 9-(1)

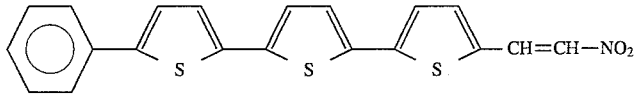

Comparative Compound Example 9-(2)

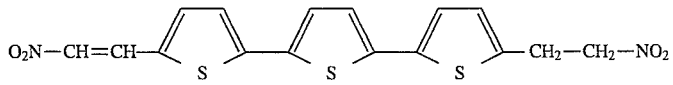

TABLE 19

| Example | Compound Example | $V_0$ (+V) | $V_1$ (+V) | $E_{1/2}$ (lux · sec) | $V_R$ (+V) |
|---|---|---|---|---|---|
| 82 | 9-(5) | 710 | 695 | 2.3 | 30 |
| 83 | 9-(23) | 705 | 690 | 3.0 | 50 |
| 84 | 9-(29) | 710 | 695 | 2.5 | 30 |
| 85 | 9-(35) | 700 | 685 | 2.3 | 25 |
| 86 | 9-(57) | 700 | 690 | 2.8 | 40 |
| 87 | 9-(71) | 710 | 705 | 2.4 | 35 |
| 88 | 9-(76) | 700 | 690 | 2.2 | 20 |
| 89 | 9-(85) | 710 | 700 | 2.6 | 35 |
| 90 | 9-(91) | 710 | 700 | 2.5 | 35 |

| | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 82 | 650 | 150 | 640 | 145 |
| 83 | 650 | 150 | 645 | 130 |
| 84 | 650 | 150 | 635 | 145 |
| 85 | 650 | 150 | 645 | 140 |
| 86 | 650 | 150 | 640 | 135 |
| 87 | 650 | 150 | 640 | 140 |
| 88 | 650 | 150 | 650 | 145 |
| 89 | 650 | 150 | 645 | 145 |
| 90 | 650 | 150 | 640 | 140 |

| Comp. Example | Comparative Compound Example | $V_0$ (+V) | $V_1$ (+V) | $E_{1/2}$ (lux · sec) | $V_R$ (+V) |
|---|---|---|---|---|---|
| 23 | 9-(1) | 700 | 700 | — | 650 |
| 24 | 9-(2) | 700 | 700 | — | 450 |

TABLE 19-continued

| | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 23 | — | — | — | — |
| 24 | — | — | — | — |

Note: The symbol "—" means that sensitivity was low and the remaining potential was high, and thus measurement or setting was impossible.

EXAMPLE 91

The same procedure as in Example 11 was effected except that the amount of oxytitaniumphthalocyanine was 6 g, and a charge-transporting substance was Compound Example 10-(6), thereby preparing an electrophotographic photosensitive member. In this case, the thickness of a charge-generating layer was 0.3 μm.

The thus prepared photosensitive member was evaluated in the same manner as in Example 11.

The results are shown in Table 20.

TABLE 20

| | $V_0$ (+V) | $V_1$ (+V) | $E_{1/2}$ (lux · sec) | $V_R$ (+V) |
|---|---|---|---|---|
| Example 91 | 690 | 680 | 2.6 | 30 |

| | | Potential (+V) | Potential after Durability Test of 2,000 Copies (+V) |
|---|---|---|---|
| Example 91 | $V_D$ | 650 | 650 |
| | $V_L$ | 150 | 145 |

EXAMPLES 92 to 100 and

Comparative Examples 25 and 26

The same procedure as in Example 91 was effected except that Compound Example 10-(6) of a charge-transporting substance was replaced with each of Compound Examples 10-(1), 10-(8), 10-(13), 10-(19), 10-(27), 10-(39), 10-(55), 10-(73) and 10-(89), to prepare electrophotographic photosensitive members, and these members were then evaluated.

For comparison, the same procedure as in the above-mentioned examples was effected except that the following comparative compounds were used as charge-transporting materials, thereby obtaining electrophotographic photosensitive members, and these members were then evaluated.

The results are shown in Table 21.

Comparative Compound Example 10-(1)

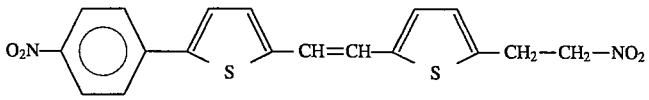

Comparative Compound Example 10-(2)

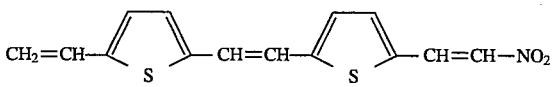

TABLE 22

| Example | Compound Example | $V_0$ (+V) | $V_1$ (+V) | $E_{1/2}$ (lux · sec) | $V_R$ (+V) |
|---|---|---|---|---|---|
| 92 | 10-(1) | 710 | 700 | 2.5 | 30 |
| 93 | 10-(8) | 705 | 690 | 2.7 | 35 |
| 94 | 10-(13) | 710 | 695 | 2.7 | 30 |
| 95 | 10-(19) | 700 | 685 | 2.3 | 25 |
| 96 | 10-(27) | 700 | 690 | 2.5 | 30 |
| 97 | 10-(39) | 710 | 705 | 2.4 | 25 |
| 98 | 10-(55) | 700 | 690 | 2.2 | 20 |
| 99 | 10-(73) | 710 | 700 | 3.9 | 40 |
| 100 | 10-(87) | 710 | 695 | 3.6 | 50 |

| | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 92 | 650 | 150 | 650 | 160 |

TABLE 22-continued

| | | | | |
|---|---|---|---|---|
| 93 | 650 | 150 | 645 | 145 |
| 94 | 650 | 150 | 645 | 155 |
| 95 | 650 | 150 | 645 | 150 |
| 96 | 650 | 150 | 640 | 135 |
| 97 | 650 | 150 | 640 | 155 |
| 98 | 650 | 150 | 650 | 155 |
| 99 | 650 | 150 | 630 | 135 |
| 100 | 650 | 150 | 660 | 155 |

| Comp. Example | Comparative Compound Example | $V_0$ (+V) | $V_1$ (+V) | $E_{1/2}$ (lux · sec) | $V_R$ (+V) |
|---|---|---|---|---|---|
| 25 | 10-(1) | 700 | 700 | — | 600 |
| 26 | 10-(2) | 700 | 700 | — | 580 |

| | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 25 | — | — | — | — |
| 26 | — | — | — | — |

Note: The symbol "—" means that sensitivity was low and the remaining potential was high, and thus measurement or setting was impossible.

EXAMPLE 101

The same procedure as in Example 11 was effected except that the weight average molecular weight of a polyvinylbutyral resin was 80,000, a charge-transporting substance was Compound Example 11-(2), and the weight average molecular weight of a polycarbonate resin was 50,000, thereby preparing an electrophotographic photosensitive member. In this case, the thickness of a charge-generating layer was 0.5 μm, and that of a charge-transporting layer was 19 μm.

The thus prepared photosensitive member was evaluated in the same manner as in Example 11.

The results are shown in Table 22.

TABLE 22

| | $V_0$ (+V) | $V_1$ (+V) | $E_{1/2}$ (lux · sec) | $V_R$ (+V) |
|---|---|---|---|---|
| Example 101 | 690 | 680 | 3.1 | 40 |

| | | Initial Potential (+V) | Potential after Durability Test of 2,000 Copies (+V) |
|---|---|---|---|
| Example 101 | $V_D$ | 650 | 640 |
| | $V_L$ | 150 | 645 |

EXAMPLES 102 to 110 and

Comparative Examples 27 to 29

The same procedure as in Example 101 was effected except that Compound Example 11-(2) of a charge-transporting substance was replaced with each of Compound Examples 11-(3), 11-(5), 11-(9), 11-(11), 11-(14), 11-(17), 11-(24), 11-(27) and 11-(30), to prepare electrophotographic photosensitive members, and these members were then evaluated.

For comparison, the same procedure as in the above-mentioned examples was effected except that the following comparative compounds were used as charge-transporting materials, thereby obtaining electrophotographic photosensitive members, and these members were then evaluated.

The results are shown in Table 23.

Comparative Compound Example 11-(1)

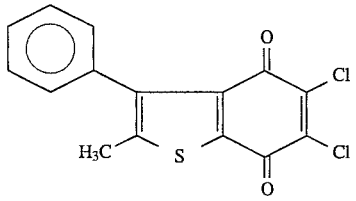

Comparative Compound Example 11-(2)

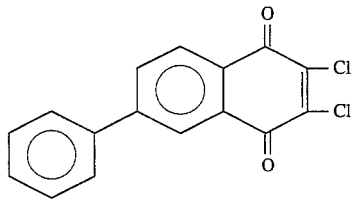

Comparative Compound Example 11-(3)

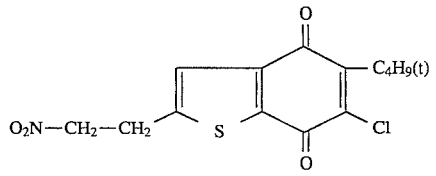

TABLE 23

| Example | Compound Example | $V_0$ (+V) | $V_1$ (+V) | $E_{1/2}$ (lux · sec) | $V_R$ (+V) |
|---|---|---|---|---|---|
| 102 | 11-(3) | 710 | 700 | 3.0 | 50 |
| 103 | 11-(5) | 705 | 690 | 2.7 | 40 |
| 104 | 11-(9) | 710 | 695 | 2.9 | 40 |
| 105 | 11-(11) | 700 | 685 | 2.7 | 30 |
| 106 | 11-(14) | 700 | 690 | 2.6 | 30 |
| 107 | 11-(17) | 710 | 705 | 2.8 | 40 |
| 108 | 11-(24) | 700 | 690 | 2.9 | 45 |
| 109 | 11-(27) | 710 | 700 | 2.7 | 45 |
| 110 | 11-(30) | 710 | 695 | 3.1 | 45 |

| | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 102 | 650 | 150 | 640 | 135 |
| 103 | 650 | 150 | 640 | 145 |
| 104 | 650 | 150 | 645 | 155 |
| 105 | 650 | 150 | 635 | 150 |
| 106 | 650 | 150 | 655 | 135 |
| 107 | 650 | 150 | 640 | 150 |
| 108 | 650 | 150 | 660 | 160 |
| 109 | 650 | 150 | 645 | 145 |
| 110 | 650 | 150 | 650 | 140 |

| Comp. Example | Comparative Compound Example | $V_0$ (+V) | $V_1$ (+V) | $E_{1/2}$ (lux · sec) | $V_R$ (+V) |
|---|---|---|---|---|---|
| 27 | 11-(1) | 700 | 700 | — | 250 |
| 28 | 11-(2) | 700 | 690 | — | 230 |

TABLE 23-continued

| | | | | | |
|---|---|---|---|---|---|
| 29 | 11-(3) | 700 | 700 | — | 230 |

| | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 27 | — | — | — | — |
| 28 | — | — | — | — |
| 29 | — | — | — | — |

Note: The symbol "—" means that sensitivity was low and the remaining potential was high, and thus measurement or setting was impossible.

EXAMPLE 111

The same procedure as in Example 11 was effected except that the butyralation degree and the weight average molecular weight of a polyvinylbutyral resin were 68 mol % and 80,000, respectively, the amount of cyclohexanone was 90 ml, a charge-transporting substance was Compound Example 12-(3), and the weight average molecular weight of a polycarbonate resin was 50,000, thereby preparing an electrophotographic photosensitive member. In this case, the thickness of a charge-generating layer was 0.3 μm, and that of a charge-transporting layer was 18 μm.

The thus prepared photosensitive member was evaluated in the same manner as in Example 11.

The results are shown in Table 24.

TABLE 24

| | $V_0$ (+V) | $V_1$ (+V) | $E_{1/2}$ (lux · sec) | $V_R$ (+V) |
|---|---|---|---|---|
| Example 111 | 690 | 680 | 2.7 | 40 |

| | | Initial Potential (+V) | Potential after Durability Test of 2,000 Copies (+V) |
|---|---|---|---|
| Example 111 | $V_D$ | 650 | 655 |
| | $V_L$ | 150 | 145 |

EXAMPLES 112 to 120 and

Comparative Examples 30 and 31

The same procedure as in Example 111 was effected except that Compound Example 12-(3) of a charge-transporting substance was replaced with each of Compound Examples 12-(7), 12-(9), 12-(20), 12-(24), 12-(34), 12-(45), 12-(66), 12-(99) and 12-(104), to prepare electrophotographic photosensitive members, and these members were then evaluated.

For comparison, the same procedure as in the above-mentioned examples was effected except that the following comparative compounds were used as charge-transporting materials, thereby obtaining electrophotographic photosensitive members, and these members were then evaluated.

The results are shown in Table 25.

Comparative Compound Example 12-(1)

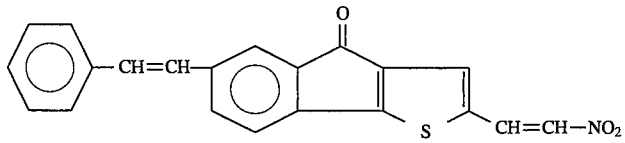

Comparative Compound Example 12-(2)

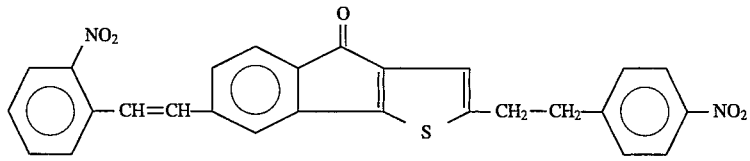

TABLE 25

| Example | Compound Example | $V_0$ (+V) | $V_1$ (+V) | $E_{1/2}$ (lux · sec) | $V_R$ (+V) |
|---|---|---|---|---|---|
| 112 | 12-(7) | 710 | 700 | 3.0 | 50 |
| 113 | 12-(9) | 705 | 690 | 2.8 | 40 |
| 114 | 12-(20) | 710 | 695 | 3.9 | 55 |
| 115 | 12-(24) | 700 | 685 | 2.3 | 30 |
| 116 | 12-(34) | 700 | 690 | 3.9 | 45 |
| 117 | 12-(45) | 710 | 705 | 2.8 | 40 |
| 118 | 12-(66) | 700 | 690 | 2.6 | 40 |
| 119 | 12-(99) | 710 | 700 | 2.8 | 45 |
| 120 | 12-(104) | 710 | 695 | 2.5 | 35 |

| | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 112 | 650 | 150 | 640 | 160 |
| 113 | 650 | 150 | 645 | 145 |
| 114 | 650 | 150 | 635 | 165 |
| 115 | 650 | 150 | 645 | 150 |
| 116 | 650 | 150 | 630 | 130 |
| 117 | 650 | 150 | 640 | 155 |
| 118 | 650 | 150 | 650 | 155 |
| 119 | 650 | 150 | 640 | 150 |
| 120 | 650 | 150 | 650 | 140 |

| Comp. Example | Comparative Compound Example | $V_0$ (+V) | $V_1$ (+V) | $E_{1/2}$ (lux · sec) | $V_R$ (+V) |
|---|---|---|---|---|---|

TABLE 25-continued

| | | | | | |
|---|---|---|---|---|---|
| 30 | 12-(1) | 700 | 700 | 24.0 | 280 |
| 31 | 12-(2) | 700 | 700 | 19.0 | 250 |

| Comp. | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 30 | — | — | — | — |
| 31 | — | — | — | — |

Note:
The symbol "—" means that sensitivity was low and the remaining potential was high, and thus measurement or setting was impossible.

EXAMPLE 121

The same procedure as in Example 11 was effected except that the butyralation degree and the weight average molecular weight of a polyvinylbutyral resin were 74 mol % and 60,000, respectively, a charge-transporting substance was Compound Example 13-(4), and the weight average molecular weight of a polycarbonate resin was 100,000, thereby preparing an electrophotographic photosensitive member. In this case, the thickness of a charge-generating layer was 0.2 μm, and that of a charge-transporting layer was 20 μm.

The thus prepared photosensitive member was evaluated in the same manner as in Example 11.

The results are shown in Table 26.

TABLE 26

| | $V_0$ (+V) | $V_1$ (+V) | $E_{1/2}$ (lux · sec) | $V_R$ (+V) |
|---|---|---|---|---|
| Example 121 | 690 | 680 | 3.8 | 55 |

| | | Initial Potential (+V) | Potential after Durability Test of 2,000 Copies (+V) |
|---|---|---|---|
| Example 121 | $V_D$ | 650 | 635 |
| | $V_L$ | 150 | 145 |

EXAMPLES 122 to 130 and

Comparative Examples 33 and 34

The same procedure as in Example 121 was effected except that Compound Example 13-(4) of a charge-transporting substance was replaced with each of Compound Examples 13-(9), 13-(11), 13-(15), 13-(25), 13-(50), 13-(52), 13-(57), 13-(61) and 13-(65), to prepare electrophotographic photosensitive members, and these members were then evaluated.

For comparison, the same procedure as in the above-mentioned examples was effected except that the following comparative compounds were used as charge-transporting materials, thereby obtaining electrophotographic photosensitive members, and these members were then evaluated.

The results are shown in Table 27.

Comparative Compound Example 13-(1)

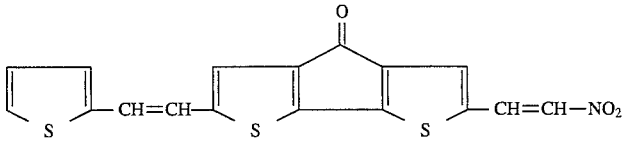

Comparative Compound Example 13-(2)

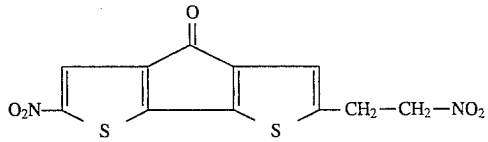

TABLE 27

| Example | Compound Example | $V_0$ (+V) | $V_1$ (+V) | $E_{1/2}$ (lux · sec) | $V_R$ (+V) |
|---|---|---|---|---|---|
| 122 | 13-(9) | 715 | 705 | 3.1 | 50 |
| 123 | 13-(11) | 705 | 685 | 2.8 | 45 |
| 124 | 13-(15) | 710 | 695 | 3.9 | 55 |
| 125 | 13-(25) | 705 | 690 | 2.8 | 40 |
| 126 | 13-(50) | 700 | 695 | 4.3 | 60 |
| 127 | 13-(52) | 710 | 705 | 3.0 | 45 |
| 128 | 13-(57) | 700 | 695 | 2.9 | 40 |
| 129 | 13-(61) | 710 | 690 | 4.2 | 55 |
| 130 | 13-(65) | 710 | 690 | 4.0 | 50 |

| | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 122 | 650 | 150 | 645 | 160 |
| 123 | 650 | 150 | 645 | 145 |
| 124 | 650 | 150 | 650 | 160 |
| 125 | 650 | 150 | 645 | 145 |
| 126 | 650 | 150 | 640 | 135 |
| 127 | 650 | 150 | 640 | 140 |
| 128 | 650 | 150 | 650 | 145 |
| 129 | 650 | 150 | 645 | 140 |
| 130 | 650 | 150 | 640 | 135 |

| Comp. Example | Comparative Compound Example | $V_0$ (+V) | $V_1$ (+V) | $E_{1/2}$ (lux · sec) | $V_R$ (+V) |
|---|---|---|---|---|---|
| 33 | 13-(1) | 700 | 700 | — | — |
| 34 | 13-(2) | 700 | 700 | 29.0 | 310 |

TABLE 27-continued

| Comp. Example | Initial Potential $V_D$ (+V) | Initial Potential $V_L$ (+V) | Potential after Durability Test of 2,000 Copies $V_D$ (+V) | Potential after Durability Test of 2,000 Copies $V_L$ (+V) |
|---|---|---|---|---|
| 33 | — | — | — | — |
| 34 | — | — | — | — |

Note:
The symbol "—" means that sensitivity was low and the remaining potential was high, and thus measurement or setting was impossible.

EXAMPLE 131

The same procedure as in Example 11 was effected except that a charge-transporting substance was Compound Example 14-(28), thereby preparing an electrophotographic photosensitive member. In this case, the thickness of a charge-generating layer was 0.3 μm.

The thus prepared photosensitive member was evaluated in the same manner as in Example 11.

The results are shown in Table 28.

TABLE 28

| | $V_0$ (+V) | $V_1$ (+V) | $E_{1/2}$ (lux · sec) | $V_R$ (+V) |
|---|---|---|---|---|
| Example 131 | 690 | 680 | 2.8 | 30 |

| | | Initial Potential (+V) | Potential after Durability Test of 2,000 Copies (+V) |
|---|---|---|---|
| Example 131 | $V_D$ | 650 | 640 |
| | $V_L$ | 150 | 145 |

EXAMPLES 132 to 140 and

Comparative Examples 35 and 36

The same procedure as in Example 131 was effected except that Compound Example 14-(28) of a charge-transporting substance was replaced each of with Compound Examples 14-(9), 14-(22), 14-(33), 14-(42), 14-(49), 14-(53), 14-(59), 14-(74) and 14-(89), to prepare electrophotographic photosensitive members, and these members were then evaluated.

For comparison, the same procedure as in the above-mentioned examples was effected except that the following comparative compounds were used as charge-transporting materials, thereby obtaining electrophotographic photosensitive members, and these members were then evaluated.

The results are shown in Table 29.

Comparative Compound Example 14-(1)

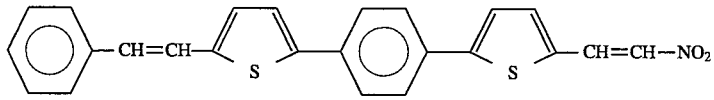

Comparative Compound Example 14-(2)

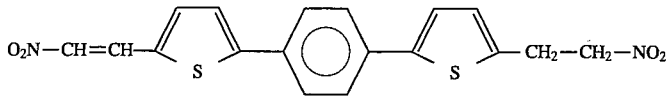

TABLE 29

| Example | Compound Example | $V_0$ (+V) | $V_1$ (+V) | $E_{1/2}$ (lux · sec) | $V_R$ (+V) |
|---|---|---|---|---|---|
| 132 | 14-(9) | 710 | 700 | 2.8 | 30 |
| 133 | 14-(22) | 705 | 690 | 2.7 | 30 |
| 134 | 14-(33) | 710 | 680 | 3.9 | 60 |
| 135 | 14-(42) | 700 | 685 | 2.3 | 20 |
| 136 | 14-(49) | 700 | 690 | 2.6 | 35 |
| 137 | 14-(53) | 710 | 705 | 2.4 | 30 |
| 138 | 14-(59) | 700 | 690 | 2.2 | 25 |
| 139 | 14-(74) | 710 | 690 | 3.5 | 50 |
| 140 | 14-(89) | 710 | 695 | 2.9 | 45 |

| Example | Initial Potential $V_D$ (+V) | Initial Potential $V_L$ (+V) | Potential after Durability Test of 2,000 Copies $V_D$ (+V) | Potential after Durability Test of 2,000 Copies $V_L$ (+V) |
|---|---|---|---|---|
| 132 | 650 | 150 | 640 | 160 |
| 133 | 650 | 150 | 645 | 145 |
| 134 | 650 | 150 | 635 | 160 |
| 135 | 650 | 150 | 645 | 150 |
| 136 | 650 | 150 | 635 | 135 |
| 137 | 650 | 150 | 640 | 155 |
| 138 | 650 | 150 | 650 | 155 |
| 139 | 650 | 150 | 635 | 130 |
| 140 | 650 | 150 | 640 | 140 |

| Comp. Example | Comparative Compound Example | $V_0$ (+V) | $V_1$ (+V) | $E_{1/2}$ (lux · sec) | $V_R$ (+V) |
|---|---|---|---|---|---|
| 35 | 14-(1) | 700 | 700 | — | 650 |
| 36 | 14-(2) | 700 | 700 | — | 580 |

| Comp. Example | Initial Potential $V_D$ (+V) | Initial Potential $V_L$ (+V) | Potential after Durability Test of 2,000 Copies $V_D$ (+V) | Potential after Durability Test of 2,000 Copies $V_L$ (+V) |
|---|---|---|---|---|
| 35 | — | — | — | — |
| 36 | — | — | — | — |

Note:
The symbol "—" means that sensitivity was low and the remaining potential was high, and thus measurement or setting was impossible.

EXAMPLE 141

The same procedure as in Example 11 was effected except that the butyralation degree and the weight average molecular weight of a polyvinylbutyral resin were 68 mol % and 35,000, respectively, a charge-transporting substance was Compound Example 15-(8), and the weight average molecular weight of a polycarbonate resin was 25,000, thereby preparing an electrophotographic photosensitive member. In this case, the thickness of a charge-generating layer was 0.2 μm, and that of a charge-transporting layer was 18 μm.

The thus prepared photosensitive member was evaluated in the same manner as in Example 11.

The results are shown in Table 30.

TABLE 30

| | $V_0$ (+V) | $V_1$ (+V) | $E_{1/2}$ (lux · sec) | $V_R$ (+V) |
|---|---|---|---|---|
| Example 141 | 690 | 685 | 2.8 | 40 |

| | | Initial Potential (+V) | Potential after Durability Test of 2,000 Copies (+V) |
|---|---|---|---|
| Example 141 | $V_D$ | 650 | 655 |
| | $V_L$ | 150 | 155 |

EXAMPLES 142 to 150 and

Comparative Examples 37 to 39

The same procedure as in Example 141 was effected except that Compound Example 15-(8) of a charge-transporting substance was replaced with each of Compound Examples 15-(2), 15-(5), 15-(16), 15-(21), 15-(28), 15-(31), 15-(44), 15-(57) and 15-(86), to prepare electrophotographic photosensitive members, and these members were then evaluated.

For comparison, the same procedure as in the above-mentioned examples was effected except that the following comparative compounds were used as charge-transporting materials, thereby obtaining electrophotographic photosensitive members, and these members were then evaluated.

The results are shown in Table 31.

Comparative Compound Example 15-(1)

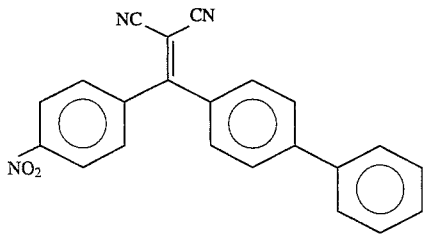

-continued

Comparative Compound Example 15-(2)

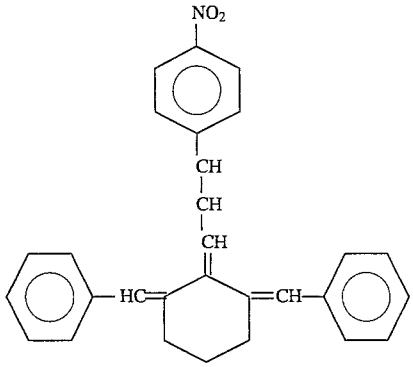

Comparative Compound Example 15-(3)

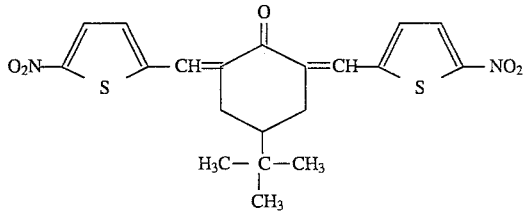

TABLE 31

| Example | Compound Example | $V_0$ (+V) | $V_1$ (+V) | $E_{1/2}$ (lux · sec) | $V_R$ (+V) |
|---|---|---|---|---|---|
| 142 | 15-(2) | 710 | 700 | 2.7 | 40 |
| 143 | 15-(5) | 700 | 690 | 3.1 | 45 |
| 144 | 15-(16) | 700 | 695 | 3.2 | 50 |
| 145 | 15-(21) | 700 | 685 | 2.5 | 30 |
| 146 | 15-(28) | 705 | 690 | 3.5 | 55 |
| 147 | 15-(31) | 710 | 700 | 2.8 | 50 |
| 148 | 15-(44) | 710 | 695 | 2.9 | 50 |
| 149 | 15-(57) | 705 | 700 | 2.8 | 45 |
| 150 | 15-(86) | 700 | 690 | 3.0 | 40 |

| | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 142 | 650 | 150 | 640 | 140 |
| 143 | 650 | 150 | 640 | 145 |
| 144 | 650 | 150 | 635 | 160 |
| 145 | 650 | 150 | 640 | 150 |
| 146 | 650 | 150 | 650 | 155 |
| 147 | 650 | 150 | 655 | 160 |
| 148 | 650 | 150 | 635 | 150 |
| 149 | 650 | 150 | 660 | 155 |
| 150 | 650 | 150 | 650 | 145 |

| Comp. Example | Comparative Compound Example | $V_0$ (+V) | $V_1$ (+V) | $E_{1/2}$ (lux · sec) | $V_R$ (+V) |
|---|---|---|---|---|---|
| 37 | 15-(1) | 705 | 690 | 7.6 | 270 |
| 38 | 15-(2) | 700 | 700 | — | 550 |
| 39 | 15-(3) | 700 | 695 | 10.9 | 210 |

| Comp. | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 37 | — | — | — | — |

TABLE 31-continued

| | | | | |
|---|---|---|---|---|
| 38 | — | — | — | — |
| 39 | 650 | 150 | 580 | 295 |

Note: The symbol "—" means that sensitivity was low and the remaining potential was high, and thus measurement or setting was impossible.

EXAMPLE 151

The same procedure as in Example 11 was effected except that the weight average molecular weight of a polyvinylbutyral resin was 60,000, the amount of cyclohexanone was 90 ml, a dispersing time was 20 hours, a charge-transporting substance was Compound Example 16-(44), its amount was 10 g, the weight average molecular weight of a polycarbonate resin was 65,000, its amount 10 g, and 80 g of a mixture of chlorobenzene (70 parts by weight) and N,N-dimethylformamide (50 parts by weight) was used as a solvent for the charge-transporting layer, thereby preparing an electrophotographic photosensitive member. In this case, the thickness of a charge-generating layer was 0.2 μm, and that of a charge-transporting layer was 16 μm.

The thus prepared photosensitive member was evaluated in the same manner as in Example 11.

The results are shogun in Table 32.

TABLE 32

| | $V_0$ (+V) | $V_1$ (+V) | $E_{1/2}$ (lux · sec) | $V_R$ (+V) |
|---|---|---|---|---|
| Example 151 | 701 | 695 | 2.5 | 30 |

| | | Initial Potential (+V) | Potential after Durability Test of 2,000 Copies (+V) |
|---|---|---|---|
| Example 151 | $V_D$ | 650 | 641 |
| | $V_L$ | 150 | 147 |

EXAMPLES 152 to 162 and

Comparative Example 40 and 42

The same procedure as in Example 151 was effected except that Compound Example 16-(44) of a charge-transporting substance was replaced with each of Compound Examples 16-(5), 16-(9), 16-(15), 16-(23), 16-(34), 16-(43), 16-(45), 16-(50), 16-(57), 16-(65) and 16-(75), to prepare electrophotographic photosensitive members, and these members were then evaluated.

For comparison, the same procedure as in the above-mentioned examples was effected except that the following comparative compounds were used as charge-transporting materials, thereby obtaining electrophotographic photosensitive members, and these members were then evaluated.

The results are shown in Table 33.

Comparative Compound Example 16-(1)

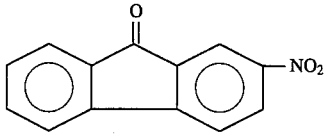

-continued

Comparative Compound Example 16-(2)

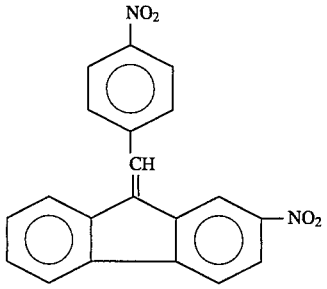

Comparative Compound Example 16-(3)

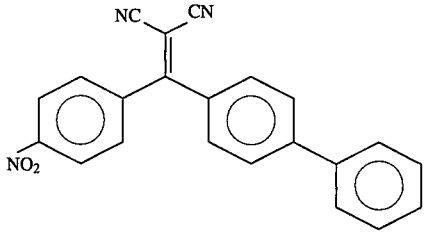

TABLE 33

| Example | Compound Example | $V_0$ (+V) | $V_1$ (+V) | $E_{1/2}$ (lux · sec) | $V_R$ (+V) |
|---|---|---|---|---|---|
| 152 | 16-(5) | 701 | 694 | 4.2 | 50 |
| 153 | 16-(9) | 698 | 690 | 5.4 | 40 |
| 154 | 16-(15) | 696 | 690 | 5.5 | 40 |
| 155 | 16-(23) | 700 | 692 | 4.0 | 45 |
| 156 | 16-(34) | 700 | 693 | 3.7 | 35 |
| 157 | 16-(43) | 698 | 687 | 3.8 | 30 |
| 158 | 16-(45) | 696 | 688 | 2.5 | 30 |
| 159 | 16-(50) | 702 | 694 | 2.7 | 35 |
| 160 | 16-(57) | 695 | 690 | 4.9 | 40 |
| 161 | 16-(65) | 696 | 691 | 2.1 | 25 |
| 162 | 16-(75) | 697 | 690 | 2.3 | 25 |

| | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 152 | 650 | 150 | 660 | 169 |
| 153 | 650 | 150 | 659 | 170 |
| 154 | 650 | 150 | 661 | 165 |
| 155 | 650 | 150 | 641 | 160 |
| 156 | 650 | 150 | 640 | 149 |
| 157 | 650 | 150 | 641 | 148 |
| 158 | 650 | 150 | 649 | 150 |
| 159 | 650 | 150 | 651 | 149 |
| 160 | 650 | 150 | 662 | 169 |
| 161 | 650 | 150 | 650 | 148 |
| 162 | 650 | 150 | 647 | 145 |

| Comp. Example | Comparative Compound Example | $V_0$ (+V) | $V_1$ (+V) | $E_{1/2}$ (lux · sec) | $V_R$ (+V) |
|---|---|---|---|---|---|
| 40 | 16-(1) | 700 | 697 | — | 590 |
| 41 | 16-(2) | 698 | 690 | 14.4 | 290 |
| 42 | 16-(3) | 698 | 687 | 7.6 | 250 |

| Comp. | Initial Potential | | Potential after Durability Test of 2,000 Copies | |
|---|---|---|---|---|
| Example | $V_D$ (+V) | $V_L$ (+V) | $V_D$ (+V) | $V_L$ (+V) |
| 40 | — | — | — | — |
| 41 | — | — | — | — |

TABLE 33-continued

| | | | | |
|---|---|---|---|---|
| 42 | — | — | — | — |

Note: The symbol "—" means that sensitivity was low and the remaining potential was high, and thus measurement or setting was impossible.

EXAMPLE 163

An aluminum sheet was coated by a Meyer bar with a solution which was prepared by dissolving 5 g of an N-methoxymethylated nylon 6 resin (weight average molecular weight 150,000) and 5 g of an alcohol-soluble copolymerized nylon resin (weight average molecular weight 100,000) in 90 g of methanol, whereby a subbing layer having a dry thickness of 1 μm was formed on the aluminum sheet.

Next, 1 g of a charge-generating substance represented by the formula

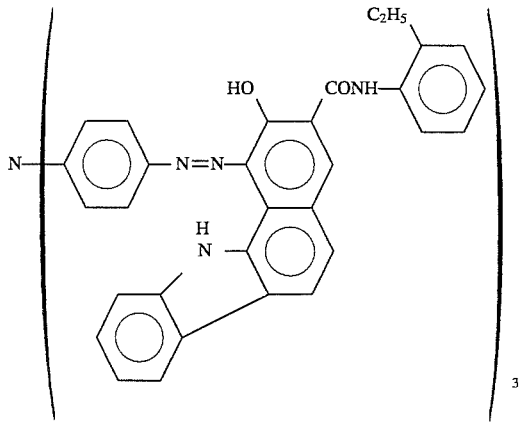

0.5 g of a polyvinylbutyral resin (butyralization degree 70%, and weight average molecular weight 50,000) and 50 g of dioxane were dispersed for 30 hours by means of a ball mill dispersing device. The resultant dispersion, after dilution, was applied onto the above-mentioned subbing layer by blade coating to form a charge-generating layer having a dry thickness of 0.15 μm thereon.

Next, 10 g of Compound Example 1-(38) which was a charge-transporting substance and 15 g of a polymethyl methacrylate resin (weight average molecular weight 70,000) were dissolved in 100 g of monochlorobenzene, and the resultant solution was applied onto the previously formed charge-generating layer by blade coating to form a charge-transporting layer having a dry layer thickness of 14 μm thereon.

The thus prepared photosensitive member was then subjected to corona discharge under +6 KV, and at this time, a surface potential ($V_0$) was measured. Furthermore, this photosensitive member was allowed to stand in the dark for 1 second, and after the dark decay, a surface potential ($V_1$) was measured. Sensitivity was evaluated by measuring an exposure ($E_{1/2}$) necessary to decay $V_1$ to ½. Further, for remaining potential, a potential where a laser light volume of 100 μJ/cm$^2$ was projected was measured. A light source which was used in this case was a ternary semiconductor laser comprising gallium, aluminum and arsenic (output 5 mW; oscillation wave length 780 nm).

Next, the above-mentioned photosensitive member was set on a remodeled type of NP-9330 made by Canon K.K. which was a reversal development system digital copying machine equipped with the same semiconductor laser as mentioned above, and an actual image forming test was carried out. Setting was made so that a surface potential after primary charging might be +600 V and so that a surface potential after image exposure might be +100 V (exposure 2.0 μJ/cm$^2$), and letters and images were visually evaluated at an early stage of the copying and after 1,000 sheets were copied.

The results are shown in Table 34.

EXAMPLE 164

The same procedure as in Example 163 was effected except that the weight average molecular weight of an N-methoxymethylated nylon 6 resin was 200,000, the weight average molecular weight of an alcohol-soluble copolymerized nylon resin was 80,000, the amount of methanol was 100 g, the weight average molecular weight of a polyvinylbutyral resin was 100,000, its amount was 0.7 g, a dispersing time was 20 hours, a charge-transporting substance was Compound Example 2-(18), the weight average molecular weight of a polymethyl methacrylate resin was 80,000, and its amount was 10 g, whereby an electrophotographic photosensitive member was prepared. In this case, the thickness of a charge-generating layer was 0.2 μm and that of a charge-transporting layer was 13 μm.

The thus prepared photosensitive member was evaluated in the same manner as in Example 163 except that 5,000 sheets were copied.

The results are shown in Table 34.

EXAMPLE 165

The same procedure as in Example 164 was effected except that the weight average molecular weight of an N-methoxymethylated nylon 6 resin was 100,000, the amount of a polyvinylbutyral resin was 1 g, a charge-transporting substance was Compound Example 3-(16), and the weight average molecular weight of a polymethyl methacrylate resin was 40,000, whereby an electrophotographic photosensitive member was prepared. In this case, the thickness of a subbing layer was 0.5 μm, that of a charge-generating layer was 0.3 μm, and that of a charge-transporting layer was 16 μm.

Images and potential characteristics of the photosensitive member thus prepared were evaluated in the same manner as in Example 164 except that exposure was 3.8 μcm$^2$.

The results are shown in Table 34.

EXAMPLE 166

The same procedure as in Example 164 was effected except that the weight average molecular weight of an N-methoxymethylated nylon 6 resin was 100,000, the weight average molecular weight of a polyvinylbutyral resin was 150,000, a charge-transporting substance was Compound Example 4-(18), and the weight average molecular weight of a polymethyl methacrylate resin was 100,000, thereby preparing an electrophotographic photosensitive member. In this case, the thickness of a charge-generating layer was 0.4 μm and that of a charge-transporting layer was 16 μm.

The thus prepared photosensitive member was evaluated in the same manner as in Example 164 except that an exposure at the time of an image evaluation was 3.2 μJ/cm$^2$.

The results are shown in Table 34.

Example 167

The same procedure as in Example 164 was effected except that the weight average molecular weight of an N-methoxymethylated nylon 6 resin was 150,000, the weight average molecular weight of an alcohol-soluble copolymerized resin was 100,000, the weight average molecular weight of a polyvinylbutyral resin was 80,000, its amount was 0.4 g, and a charge-transporting substance was Compound Example 5-(61), thereby preparing an electrophotographic photosensitive member. In this case, the thickness of a subbing layer was 0.8 μm, that of a charge-generating layer was 0.3 μm, and that of a charge-transporting layer was 16 μm.

The thus prepared photosensitive member was evaluated in the same manner as in Example 166.

The results are shown in Table 34.

EXAMPLE 168

The same procedure as in Example 164 was effected except that the weight average molecular weight of an N-methoxymethylated nylon 6 resin was 100,000, its amount was 3 g, a dispersing time was 10 hours, and a charge-transporting substance was Compound Example 6-(121), thereby preparing an electrophotographic photosensitive member. In this case, the thickness of a charge-transporting layer was 18 μm.

The thus prepared photosensitive member was evaluated in the same manner as in Example 166.

The results are shown in Table 34.

EXAMPLE 169

The same procedure as in Example 164 was effected except that the amount of a polyvinylbutyral resin was 0.5 g and a charge-transporting substance was Compound Example 7-(20), thereby preparing an electrophotographic photosensitive member. In this case, the thickness of a subbing layer was 0.8 μm, that of a charge-generating layer was 0.3 μm, and that of a charge-transporting layer was 16 μm.

The thus prepared photosensitive member was evaluated in the same manner as in Example 164 except that an exposure at the time of an image evaluation was 3.9 $\mu J/cm^2$ and 2,000 sheets were copied.

The results are shown in Table 34.

EXAMPLE 170

The same procedure as in Example 164 was effected except that the weight average molecular weight of an N-methoxymethylated nylon 6 resin was 150,000, the weight average molecular weight of an alcohol-soluble copolymerized nylon resin was 50,000, the amount of a charge-generating substance was 2 g, the weight average molecular weight of a polyvinylbutyral resin was 150,000, a dispersing time was 10 hours, a charge-transporting substance was Compound Example 8-(18), and the weight average molecular weight of a polymethyl methacrylate resin was 50,000, thereby preparing an electrophotographic photosensitive member. In this case, the thickness of a charge-transporting layer was 16 μm.

The thus prepared photosensitive member was evaluated in the same manner as in Example 164 except that an exposure at the time of an image evaluation was 3.0 $\mu J/cm^2$.

The results are shown in Table 34.

EXAMPLE 171

The same procedure as in Example 164 was effected except that the weight average molecular weight of an N-methoxymethylated nylon 6 resin was 150,000 and a charge-transporting substance was Compound Example 9-(11), thereby preparing an electrophotographic photosensitive member. In this case, the thickness of a subbing layer was 0.5 μm, that of a charge-generating layer was 0.3 μm, and that of a charge-transporting layer was 16 μm.

The thus prepared photosensitive member was evaluated in the same manner as in Example 170.

The results are shown in Table 34.

EXAMPLE 172

The same procedure as in Example 164 was effected except that the amount of a polyvinylbutyral resin was 0.4 g, a charge-transporting substance was Compound Example 10-(89), and the amount of a polymethyl methacrylate resin was 13 g, thereby preparing an electrophotographic photosensitive member. In this case, the thickness of a charge-generating layer was 0.3 μm and that of a charge-transporting layer was 16 μm.

The thus prepared photosensitive member was evaluated in the same manner as in Example 164 except that an exposure at the time of an image evaluation was 2.5 $\mu J/cm^2$.

The results are shown in Table 34.

EXAMPLE 173

The same procedure as in Example 164 was effected except that the weight average molecular weight of an N-methoxymethylated nylon 6 resin was 100,000, the weight average molecular weight of an alcohol-soluble copolymerized nylon resin was 50,000, its amount was 7 g, the amount of a polyvinylbutyral resin was 0.4 g, a charge-transporting substance was Compound Example 11-(18), and its amount was 13 g, thereby preparing an electrophotographic photosensitive member. In this case, the thickness of a charge-transporting layer was 17 μm.

The thus prepared photosensitive member was evaluated in the same manner as in Example 164 except that an exposure at the time of an image evaluation was 2.6 $\mu J/cm^2$.

The results are shown in Table 34.

EXAMPLE 174

The same procedure as in Example 164 was effected except that the weight average molecular weight of an alcohol-soluble copolymerized nylon resin was 50,000, its amount was 6 g, the weight average molecular weight of a polyvinylbutyral resin was 80,000, a charge-transporting substance was Compound Example 12-(78), and the amount of a polymethyl methacrylate resin was 15 g, thereby preparing an electrophotographic photosensitive member. In this case, the thickness of a charge-generating layer was 0.3 μm and that of a charge-transporting layer was 19 μm.

The thus prepared photosensitive member was evaluated in the same manner as in Example 164 except that an exposure at the time of an image evaluation was 4.1 $\mu J/cm^2$.

The results are shown in Table 34.

EXAMPLE 175

The same procedure as in Example 164 was effected except that the weight average molecular weight of an N-methoxymethylated nylon 6 resin was 100,000, the weight average molecular weight of an alcohol-soluble copolymerized nylon resin was 50,000, the weight average molecular weight of a polyvinylbutyral resin was 150,000, a dispersing time was 10 hours, a charge-transporting substance was Compound Example 13-(26), the weight average molecular weight of a polymethyl methacrylate resin was 50,000, and its amount was 15 g, thereby preparing an electrophotographic photosensitive member. In this case, the thickness of a charge-generating layer was 0.3 μm and that of a charge-transporting layer was 18 μm.

The thus prepared photosensitive member was evaluated in the same manner as in Example 164 except that an exposure at the time of an image evaluation was 4.5 μJ/cm$^2$.

The results are shown in Table 34.

EXAMPLE 176

The same procedure as in Example 164 was effected except that a charge-transporting substance was Compound Example 14-(19) and the amount of a polymethyl methacrylate resin was 12 g, thereby preparing an electrophotographic photosensitive member. In this case, the thickness of a charge-transporting layer was 14 μm.

The thus prepared photosensitive member was evaluated in the same manner as in Example 164 except that an exposure at the time of an image evaluation was 2.5 μJ/cm$^2$, and 3,000 sheets were copied.

The results are shown in Table 34.

EXAMPLE 177

The same procedure as in Example 164 was effected except that the weight average molecular weight of an N-methoxymethylated nylon 6 resin was 100,000, the weight average molecular weight of a polyvinylbutyral resin was 50,000, its amount was 0.6 g, the amount of dioxane was 60 g, a charge-transporting substance was Compound Example 15-(14), and the weight average molecular weight of a polymethyl methacrylate resin was 60,000, whereby an electrophotographic photosensitive member was prepared. In this case, the thickness of a charge-generating layer was 0.1 μm.

The thus prepared photosensitive member was evaluated in the same manner as in Example 164 except that an exposure at the time of an image evaluation was 2.0 μJ/cm$^2$.

The results are shown in Table 34.

EXAMPLE 178

The same procedure as in Example 164 was effected except that the weight average molecular weight of an alcohol-soluble copolymerized nylon resin was 100,000, the amount of methanol was 80 g, the weight average molecular weight of a polyvinylbutyral resin was 70,000, its amount was 0.6 g, the amount of dioxane was 55 g, a dispersing time was 24 hours, a charge-transporting substance was Compound Example 16-(67), the weight average molecular weight of a polymethyl methacrylate resin was 100,000, and its amount was 9.5 g, thereby preparing an electrophotographic photosensitive member. In this case, the thickness of a charge-transporting layer was 18 μm.

The thus prepared photosensitive member was evaluated in the same manner as in Example 177 except that 3,000 sheets were copied.

The results are shown in Table 34.

TABLE 34

| Example | Compound Example | $V_0$ (+V) | $V_1$ (+V) | $E_{1/2}$ (μJ/cm$^2$) |
|---|---|---|---|---|
| 163 | 1-(38) | 670 | 664 | 2.7 |
| 164 | 2-(18) | 700 | 690 | 1.9 |
| 165 | 3-(16) | 700 | 690 | 1.9 |
| 166 | 4-(18) | 700 | 695 | 1.8 |
| 167 | 5-(61) | 700 | 690 | 1.8 |
| 168 | 6-(121) | 700 | 690 | 1.8 |
| 169 | 7-(20) | 700 | 695 | 2.3 |
| 170 | 8-(18) | 700 | 695 | 1.8 |
| 171 | 9-(11) | 700 | 695 | 1.8 |
| 172 | 10-(89) | 700 | 690 | 1.7 |
| 173 | 11-(18) | 700 | 690 | 1.8 |
| 174 | 12-(78) | 700 | 690 | 2.6 |
| 175 | 13-(26) | 700 | 690 | 2.8 |
| 176 | 14-(19) | 700 | 690 | 2.2 |
| 177 | 15-(14) | 700 | 695 | 2.0 |
| 178 | 16-(67) | 680 | 675 | 2.1 |

| Example | $V_R$ (+V) | Image Evaluation: Early Stage | Image Evaluation: After Copying |
|---|---|---|---|
| 163 | 45 | good | good |
| 164 | 50 | good | good |
| 165 | 40 | good | good |
| 166 | 40 | good | good |
| 167 | 40 | good | good |
| 168 | 50 | good | good |
| 169 | 45 | good | good |
| 170 | 55 | good | good |
| 171 | 40 | good | good |
| 172 | 50 | good | good |
| 173 | 50 | good | good |
| 174 | 50 | good | good |
| 175 | 55 | good | good |
| 176 | 50 | good | good |
| 177 | 40 | good | good |
| 178 | 55 | good | good |

EXAMPLE 179

5 g of oxytitaniumphthalocyanine obtained in accordance with a preparation example disclosed in Japanese Patent Application Laid-open No. 62-67094 (U.S. Pat. No. 4,664,997) was added to a solution prepared by dissolving 3 g of a polyvinylbenzal resin (benzalation degree 75 mol %, weight average molecular weight 150,000) in 100 g of cyclohexanone, and they were then dispersed in a ball mill for 10 hours. The resultant dispersion, after dilution, was applied onto an aluminum sheet by a Meyer bar, followed by drying at 80° C. for 30 minutes, whereby a charge-generating layer having a thickness of 0.1 μm was formed thereon.

Next, 4 g of Compound Example 1-(40) which was a charge-transporting substance and 5 g of a bisphenol Z type polycarbonate resin (weight average molecular weight 35,000) were dissolved in 40 g of monochlorobenzene, and the resultant solution was then applied onto the previously formed charge-generating layer by the Meyer bar, followed by drying at 120° C. for 1 hour, thereby forming a charge-transporting layer having a thickness of 12 μm. The thus prepared photosensitive member was evaluated in the same manner as in Example 163.

The results are shown in Table 35.

EXAMPLE 180

7 g of oxytitaniumphthalocyanine used in Example 179 was added to a solution prepared by dissolving 4 g of a polyvinylbenzal resin (benzalation degree 78 mol %, weight average molecular weight 100,000) in 100 g of cyclohexanone, and they were then dispersed in a ball mill for 48 hours. The resultant dispersion, after diluted, was applied onto an aluminum sheet by a Meyer bar, followed by drying at 90° C. for 30 minutes, whereby a charge-generating layer having a thickness of 0.20 μm was formed thereon.

Next, 5 g of Compound Example 2-(73) which was a charge-transporting substance and 5 g of a bisphenol Z type polycarbonate resin (weight average molecular weight 100,000) were dissolved in 80 g of chlorobenzene, and the resultant solution was then applied onto the previously formed charge-generating layer by the Meyer bar, followed by drying at 140° C. for 1 hour, thereby forming a charge-transporting layer having a thickness of 20 μm.

The thus prepared photosensitive member was evaluated in the same manner as in Example 164.

The results are shown in Table 35.

EXAMPLE 181

The same procedure as in Example 180 was effected except that the weight average molecular weight of a polyvinylbenzal resin was 120,000, a dispersing time was 20 hours, a drying time for a charge-generating layer was 1 hour, and a charge-transporting substance was Compound Example 3-(76), thereby preparing an electrophotographic photosensitive member. In this case, the thickness of a charge-generating layer was 0.4 μm.

The thus prepared photosensitive member was evaluated in the same manner as in Example 165.

The results are shown in Table 35.

EXAMPLE 182

The same procedure as in Example 180 was effected except that a dispersing time was 20 hours and a charge-transporting substance was Compound Example 4-(29), thereby preparing an electrophotographic photosensitive member. In this case, the thickness of a charge-generating layer was 0.3 μm.

The thus prepared photosensitive member was evaluated in the same manner as in Example 166.

The results are shown in Table 35.

EXAMPLE 183

The same procedure as in Example 180 was effected except that a dispersing time was 20 hours, a charge-transporting substance was Compound Example 5-(73), and the amount of a polycarbonate resin was 3.5 g, thereby preparing an electrophotographic photosensitive member.

The thus prepared photosensitive member was evaluated in the same manner as in Example 167.

The results are shown in Table 35.

EXAMPLE 184

The same procedure as in Example 180 was effected except that the weight average molecular weight of a polyvinylbenzal resin was 80,000, a dispersing time was 20 hours, and a charge-transporting substance was Compound Example 6-(108), thereby preparing an electrophotographic photosensitive member.

The thus prepared photosensitive member was evaluated in the same manner as in Example 168.

The results are shown in Table 35.

EXAMPLE 185

The same procedure as in Example 180 was effected except that the amount of oxytitaniumphthalocyanine was 8 g, the weight average molecular weight of a polyvinylbenzal resin was 50,000, a dispersing time was 20 hours, a charge-transporting substance was Compound Example 7-(62), the amount of a polycarbonate resin was 7 g, and a drying time for a charge-transporting layer was 30 minutes, thereby preparing an electrophotographic photosensitive member.

The thus prepared photosensitive member was evaluated in the same manner as in Example 169.

The results are shown in Table 35.

EXAMPLE 186

The same procedure as in Example 180 was effected except that a charge-transporting substance was Compound Example 8-(77) and the amount of a polycarbonate resin was 6 g, thereby preparing an electrophotographic photosensitive member. In this case, the thickness of a charge-transporting layer was 19 μm.

The thus prepared photosensitive member was evaluated in the same manner as in Example 170.

The results are shown in Table 35.

EXAMPLE 187

The same procedure as in Example 180 was effected except that a charge-transporting substance was Compound Example 9-(47) and the amount of a polycarbonate resin was 7 g, thereby preparing an electrophotographic photosensitive member. In this case, the thickness of a charge-generating layer was 0.3 μm.

The thus prepared photosensitive member was evaluated in the same manner as in Example 171.

The results are shown in Table 35.

EXAMPLE 188

The same procedure as in Example 180 was effected except that a dispersing time was 40 hours, a charge-transporting substance was Compound Example 10-(68), the weight average molecular weight of a polycarbonate resin was 80,000, and its amount was 6 g, thereby preparing an electrophotographic photosensitive member. In this case, the thickness of a charge-generating layer was 0.4 μm and that of a charge-transporting layer was 18 μm.

The thus prepared photosensitive member was evaluated in the same manner as in Example 172.

The results are shown in Table 35.

EXAMPLE 189

The same procedure as in Example 180 was effected except that the amount of a polyvinylbenzal resin was 7 g, a dispersing time was 20 hours, a charge-transporting substance was Compound Example 11-(20), and the amount of a polycarbonate resin was 7 g, thereby preparing an electrophotographic photosensitive member. In this case, the thickness of a charge-generating layer was 0.3 μm.

The thus prepared photosensitive member was evaluated in the same manner as in Example 173.

The results are shown in Table 35.

EXAMPLE 190

The same procedure as in Example 180 was effected except that a charge-transporting substance was Compound Example 12-(100), thereby preparing an electrophotographic photosensitive member.

The thus prepared photosensitive member was evaluated in the same manner as in Example 174.

The results are shown in Table 35.

EXAMPLE 191

The same procedure as in Example 180 was effected except that the amount of oxytitaniumphthalocyanine was 8 g, the weight average molecular weight of a polyvinylbenzal resin was 80,000, a drying temperature for a charge-generating layer was 120° C., a charge-transporting substance was Compound Example 13-(62), the amount of a polycarbonate resin was 7 g, and a drying time for a charge-transporting layer was 30 minutes, thereby preparing an electrophotographic photosensitive member.

The thus prepared photosensitive member was evaluated in the same manner as in Example 175.

The results are shown in Table 35.

EXAMPLE 192

The same procedure as in Example 180 was effected except that the weight average molecular weight of a polyvinylbenzal resin was 50,000, a dispersing time was 24 hours, a charge-transporting substance was Compound Example 14-(73), thereby preparing an electrophotographic photosensitive member.

The thus prepared photosensitive member was evaluated in the same manner as in Example 176.

The results are shown in Table 35.

EXAMPLE 193

The same procedure as in Example 180 was effected except that a charge-transporting substance was Compound Example 15-(83), the weight average molecular weight of a polycarbonate resin was 50,000, 70 g of chlorobenzene/N,N-dimethylformamide (1 part by weight/1 part by weight) was used as a solvent for a charge-transporting layer, a drying temperature and a drying time for the charge-transporting layer were 130° C. and 2 hours, respectively, thereby preparing an electrophotographic photosensitive member. In this case, the thickness of a charge-generating layer was 0.1 μm.

The thus prepared photosensitive member was evaluated in the same manner as in Example 178.

The results are shown in Table 35.

EXAMPLE 194

2 g of oxytitaniumphthalocyanine used in Example 179 was added to a solution prepared by dissolving 1 g of a polyvinylbenzal resin (benzalation degree 70 mol %, weight average molecular weight 100,000) in 40 g of cyclohexanone, and they were then dispersed in a ball mill for 48 hours.

The resultant dispersion, after dilution, was applied onto an aluminum sheet by a Meyer bar, followed by drying at 80° C. for 1 hour, whereby a charge-generating layer having a thickness of 0.1 μm was formed thereon.

Next, 5 g of Compound Example 16-(66) which was a charge-transporting substance and 4.5 g of a bisphenol Z type polycarbonate resin (weight average molecular weight 35,000) were dissolved in 40 g of a chlorobenzene (80 parts by weight)/N,N-dimethylformamide (20 parts by weight) solution, and the solution was then applied onto the previously formed charge-generating layer by the Meyer bar, followed by drying at 130° C. for 2 hours, thereby forming a charge-transporting layer having a thickness of 17 μm.

The thus prepared photosensitive member was evaluated in the same manner as in Example 179.

The results are shown in Table 35.

TABLE 35

| Example | Compound Example | $V_0$ (+V) | $V_1$ (+V) | $E_{1/2}$ (μJ/cm$^2$) |
|---|---|---|---|---|
| 179 | 1-(40) | 685 | 680 | 3.6 |
| 180 | 2-(73) | 700 | 695 | 1.8 |
| 181 | 3-(76) | 700 | 695 | 3.0 |
| 182 | 4-(29) | 700 | 695 | 1.6 |
| 183 | 5-(73) | 700 | 690 | 2.2 |
| 184 | 6-(108) | 700 | 695 | 1.8 |
| 185 | 7-(62) | 700 | 695 | 3.2 |
| 186 | 8-(77) | 700 | 695 | 1.5 |
| 187 | 9-(47) | 700 | 695 | 1.5 |
| 188 | 10-(68) | 700 | 695 | 2.1 |
| 189 | 11-(20) | 700 | 690 | 2.3 |
| 190 | 12-(100) | 700 | 695 | 2.3 |
| 191 | 13-(62) | 700 | 695 | 2.2 |
| 192 | 14-(73) | 700 | 695 | 3.1 |
| 193 | 15-(83) | 705 | 700 | 2.3 |
| 194 | 16-(66) | 685 | 680 | 2.0 |

| Example | $V_R$ (+V) | Image Evaluation | |
|---|---|---|---|
| | | Early Stage | After Copying |
| 179 | 60 | good | good |
| 180 | 50 | good | good |
| 181 | 50 | good | good |
| 182 | 45 | good | good |
| 183 | 50 | good | good |
| 184 | 45 | good | good |
| 185 | 60 | good | good |
| 186 | 50 | good | good |
| 187 | 40 | good | good |
| 188 | 40 | good | good |
| 189 | 60 | good | good |
| 190 | 35 | good | good |
| 191 | 55 | good | good |
| 192 | 45 | good | good |
| 193 | 55 | good | good |
| 194 | 50 | good | good |

EXAMPLE 195

2 g of a dye represented by the formula

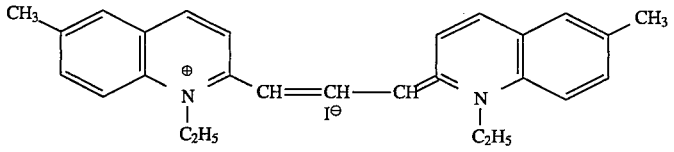

and 4 g of Compound Example 1-(30) which was a charge-transporting substance were mixed with 30 g of a toluene (70 parts by weight)/dioxane (30 parts by weight) solution of a polycarbonate resin (weight average molecular weight 30,000), and they were then dispersed in a ball mill for 15 hours. The resultant dispersant was diluted and then applied onto an aluminum sheet by Meyer bar, followed by drying at 110° C. for 1 hour, whereby a photosensitive member having a thickness of 15 μm was formed thereon.

The thus prepared photosensitive member was evaluated in the same manner as in Example 1.

The results are shown in Table 36.

TABLE 36

| | $V_0$ (+V) | $V_1$ (+V) | $E_{1/2}$ (lux · sec) | $V_R$ (+V) |
|---|---|---|---|---|
| Example 195 | 695 | 690 | 3.8 | 60 |

| | | Initial Potential (+V) | Potential after Durability Test of 1,000 Copies (+V) |
|---|---|---|---|
| Example 195 | $V_D$ | 650 | 635 |
| | $V_L$ | 150 | 136 |

EXAMPLE 196

An aluminum substrate was coated with a 5% methanol solution of an alcohol-soluble copolymerized nylon resin (weight average molecular weight 50,000), so that a subbing layer having a dry thickness of 0.5 μm was formed thereon.

Next, 5 g of a pigment represented by the formula

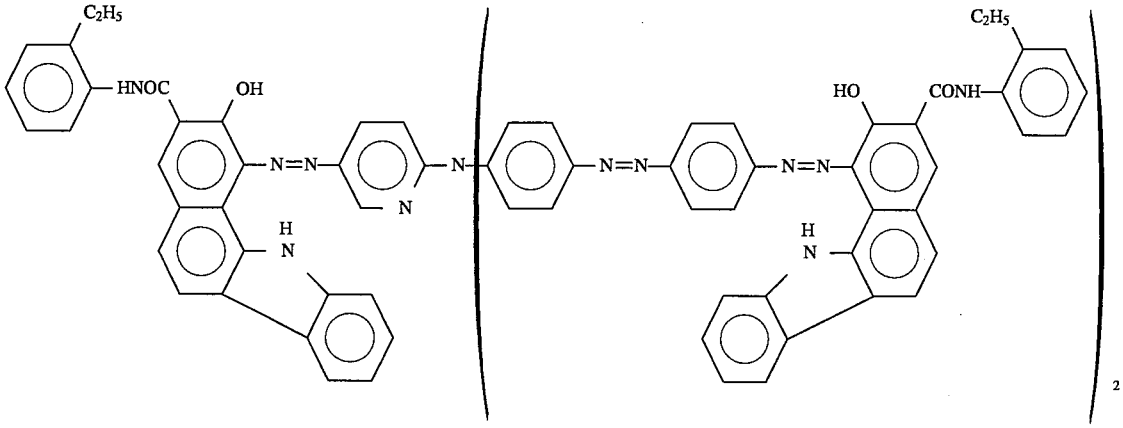

was dispersed in 50 ml of tetrahydrofuran by means of a sand mill.

Afterward, 5 g of Compound Example 2-(67) which was a charge-transporting substance and 7 g of a polycarbonate resin (weight average molecular weight 50,000) were dissolved in 50 g of a chlorobenzene (70 parts by weight)/dichloromethane (30 parts by weight) solution, and the solution was then added to the previously prepared dispersion, followed by further dispersing for 25 hours by the sand mill.

The dispersion was applied onto the previously formed subbing layer by a Meyer bar and dried so that a dry thickness might be 18 μm.

The thus prepared photosensitive member was evaluated in the same manner as in Example 11.

The results are shown in Table 37.

EXAMPLE 197

The same procedure as in Example 196 was effected except that a charge-transporting substance was Compound Example 3-(73), thereby preparing an electrophotographic photosensitive member. In this case, the thickness of a subbing layer was 1.0 μm.

The thus prepared photosensitive member was evaluated in the same manner as in Example 196.

The results are shown in Table 37.

EXAMPLE 198

The same procedure as in Example 196 was effected except that a charge-transporting substance was Compound Example 4-(26), thereby preparing an electrophotographic photosensitive member. Afterward, evaluation was made for this member.

The results are shown in Table 37.

EXAMPLE 199

The same procedure as in Example 196 was effected except that the weight average molecular weight of an alcohol-soluble copolymerized nylon resin was 80,000, a charge-transporting substance was Compound Example 5-(86), and a dispersing time was 24 hours, thereby preparing an electrophotographic photosensitive member. In this case, the thickness of a subbing layer was 1.0 μm.

The thus prepared photosensitive member was evaluated in the same manner as in Example 196.

The results are shown in Table 37.

EXAMPLE 200

The same procedure as in Example 196 was effected except that a charge-transporting substance was Compound Example 6-(67), thereby preparing an electrophotographic photosensitive member. Afterward, evaluation was made for this member.

The results are shown in Table 37.

EXAMPLE 201

The same procedure as in Example 196 was effected except that the weight average molecular weight of an alcohol-soluble copolymerized nylon resin was 80,000, a charge-transporting substance was Compound Example 7-(82), and a dispersing time was 10 hours, thereby preparing an electrophotographic photosensitive member. Afterward, evaluation was made for this member.

The results are shown in Table 37.

EXAMPLE 202

The same procedure as in Example 196 was effected except that the weight average molecular weight of an alcohol-soluble copolymerized nylon resin was 100,000 and a charge-transporting substance was Compound Example 8-(81), thereby preparing an electrophotographic photosensitive member. In this case, the thickness of a subbing layer was 1.0 μm.

The thus prepared photosensitive member was evaluated in the same manner as in Example 196.

EXAMPLE 203

The same procedure as in Example 196 was effected except that a charge-transporting substance was Compound Example 9-(55) and a dispersing time was 48 hours, thereby preparing an electrophotographic photosensitive member. In this case, the thickness of a subbing layer was 0.8 μm.

The thus prepared photosensitive member was evaluated in the same manner as in Example 196.

The results are shown in Table 37.

EXAMPLE 204

The same procedure as in Example 196 was effected except that the weight average molecular weight of an alcohol-soluble copolymerized nylon resin was 70,000 and a charge-transporting substance was Compound Example 10-(55), thereby preparing an electrophotographic photosensitive member. In this case, the thickness of a subbing layer was 1.0 μm.

The thus prepared photosensitive member was evaluated in the same manner as in Example 196.

The results are shown in Table 37.

EXAMPLE 205

The same procedure as in Example 196 was effected except that a charge-transporting substance was Compound Example 11-(35) and the amount of a polycarbonate resin was 10 g, thereby preparing an electrophotographic photosensitive member. Afterward, evaluation was made for this member.

The results are shown in Table 37.

EXAMPLE 206

The same procedure as in Example 196 was effected except that a charge-transporting substance was Compound Example 12-(67) and the weight average molecular weight of a polycarbonate resin was 80,000, thereby preparing an electrophotographic photosensitive member. In this case, the thickness of a subbing layer was 0.2 μm.

The thus prepared photosensitive member was evaluated in the same manner as in Example 196.

The results are shown in Table 37.

EXAMPLE 207

The same procedure as in Example 196 was effected except that a charge-transporting substance was Compound Example 13-(67), the weight average molecular weight of a polycarbonate resin was 80,000, and a dispersing time was 15 hours, thereby preparing an electrophotographic photosensitive member. Afterward, evaluation was made for this member.

The results are shown in Table 37.

EXAMPLE 208

The same procedure as in Example 196 was effected except that a charge-transporting substance was Compound Example 14-(68), thereby preparing an electrophotographic photosensitive member. In this case, the thickness of a subbing layer was 1.0 μm.

The thus prepared photosensitive member was evaluated in the same manner as in Example 196.

The results are shown in Table 37.

EXAMPLE 209

The same procedure as in Example 196 was effected except that the weight average molecular weight of an alcohol-soluble copolymerized nylon resin was 80,000, a charge-transporting substance was Compound Example 15-(71), the weight average molecular weight of a polycarbonate resin was 35,000, its amount was 10 g, and a dispersing time was 20 hours, thereby preparing an electrophotographic photosensitive member. In this case, the thickness of a subbing layer was 1.0 μm and that of the photosensitive member was 19 μm.

The thus prepared photosensitive member was evaluated in the same manner as in Example 196.

The results are shown in Table 37.

TABLE 37

| Example | Compound Example | $V_0$ (+V) | $V_1$ (+V) | $E_{1/2}$ (lux · sec) | $V_R$ (+V) |
|---|---|---|---|---|---|
| 196 | 2-(67) | 700 | 690 | 3.8 | 60 |
| 197 | 3-(73) | 700 | 685 | 3.5 | 65 |
| 198 | 4-(26) | 700 | 690 | 3.8 | 65 |
| 199 | 5-(86) | 700 | 690 | 3.2 | 60 |
| 200 | 6-(67) | 700 | 690 | 3.2 | 55 |
| 201 | 7-(82) | 700 | 690 | 2.1 | 55 |
| 202 | 8-(81) | 700 | 690 | 3.5 | 65 |
| 203 | 9-(55) | 700 | 690 | 3.2 | 60 |
| 204 | 10-(55) | 700 | 690 | 2.9 | 60 |
| 205 | 11-(35) | 700 | 680 | 4.0 | 60 |
| 206 | 12-(67) | 700 | 690 | 3.0 | 15 |
| 207 | 13-(67) | 700 | 690 | 4.0 | 65 |
| 208 | 14-(68) | 700 | 685 | 3.8 | 65 |
| 209 | 15-(71) | 700 | 690 | 3.0 | 60 |

EXAMPLE 210

10 g of Compound Example 1-(37) which was a charge-transporting substance and 10 g of a polycarbonate resin (weight average molecular weight 30,000) were dissolved in 120 g of monochlorobenzene, and the resultant solution was applied onto an aluminum sheet by a Meyer bar to form a charge-transporting layer having a dry thickness of 12 μm.

Next, 2 g of a pigment used in Example 196 was dispersed in a solution prepared by dissolving 1 g of a butyral resin (butyralization degree 75 mol %) in 40 ml of cyclohexanone for 15 hours by means of a sand mill to obtain a coating liquid.

This coating liquid, after dilution, was applied onto the above-mentioned charge-transporting layer by the Meyer bar so that the dry thickness of a charge-generating layer might be 0.5 μm, whereby the charge-generating layer was formed.

The charging characteristics of the thus prepared electrophotographic photosensitive member were evaluated in the same manner as in Example 1 except that corona charging was carried out under −5 KV.

The results are as follows.

$V_0$=−675 V; $V_1$=−660 V;

$E_{1/2}$=3.9 lux-sec; $V_R$=−80 V

EXAMPLE 211

The same procedure as in Example 210 was effected except that a charge-transporting substance was Compound Example 16-(70), the amount of a polycarbonate resin was 9 g, the amount of monochlorobenzene was 90 g, the butyralization degree of a polyvinylbutyral resin was 70 mol %, the amount of cyclohexanone was 45 ml, and a dispersing time was 20 hours, thereby preparing an electrophotographic photosensitive member. In this case, the thickness of a charge-transporting layer was 15 μm and that of a charge-generating layer was 0.4 μm.

The thus prepared photosensitive member was evaluated in the same manner as in Example 210.

The results are as follows:

$V_R$=−60 V; $V_0$=−680 V; $V_1$=−675 V; $E_{1/2}$=3.7 lux.sec

EXAMPLE 212

5 g of Compound Example 2-(77) which was a charge-transporting substance and 5 g of a polycarbonate resin (weight average molecular weight 80,000) were dissolved in 70 g of chlorobenzene, and the resultant solution was applied onto an aluminum sheet by a Meyer bar to form a charge-transporting layer having a dry thickness of 15 μm.

Next, 2 g of a disazo pigment represented by the formula

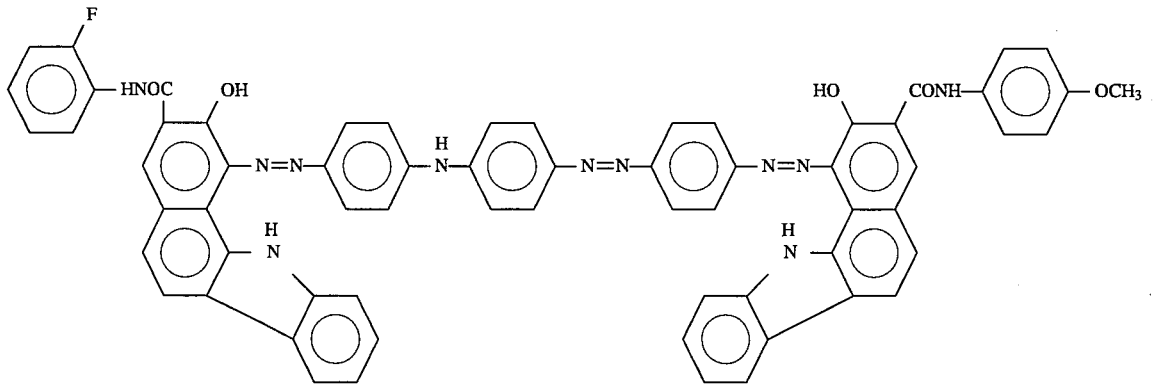

was dispersed in 50 ml of a solution prepared by dissolving 1.5 g of a polyvinylbutyral resin (butyralization degree 80 mol %) in 50 ml of cyclohexanone for 20 hours by means of a sand mill to obtain a coating liquid. This coating liquid, after dilution, was applied onto the above-mentioned charge-transporting layer by the Meyer bar so that the dry thickness of a charge-generating layer might be 0.5 μm, whereby the charge-generating layer was formed.

The charging characteristics of the thus prepared electrophotographic photosensitive member were evaluated in the same manner as in Example 210.

The results are shown in Table 38.

EXAMPLE 213

The same procedure as in Example 212 was effected except that a charge-transporting substance was Compound Example 3-(6), the weight average molecular weight of a polycarbonate resin was 100,000, and the amount of a polyvinylbutyral resin was 1 g, thereby preparing an electrophotographic photosensitive member. In this case, the thickness of a charge-transporting layer was 18 μm.

The thus prepared photosensitive member was evaluated in the same manner as in Example 210.

The results are shown in Table 35.

EXAMPLE 214

The same procedure as in Example 212 was effected except that a charge-transporting substance was Compound Example 4-(33) and a dispersing time was 50 hours, thereby preparing an electrophotographic photosensitive member. In this case, the thickness of a charge-generating layer was 0.3 μm.

The thus prepared photosensitive member was evaluated in the same manner as in Example 210.

The results are shown in Table 38.

EXAMPLE 215

The same procedure as in Example 212 was effected except that a charge-transporting substance was Compound Example 5-(95), its amount was 3 g, and the weight average molecular weight of a polycarbonate resin was 50,000, thereby preparing an electrophotographic photosensitive member. In this case, the thickness of a charge-transporting layer was 20 μm and that of a charge-generating layer was 0.6 μm.

The thus prepared photosensitive member was evaluated in the same manner as in Example 210.

The results are shown in Table 38.

EXAMPLE 216

The same procedure as in Example 212 was effected except that a charge-transporting substance was Compound Example 6-(15), thereby preparing an electrophotographic photosensitive member. In this case, the thickness of a charge-transporting layer was 18 μm and that of a charge-generating layer was 0.3 μm.

The thus prepared photosensitive member was evaluated in the same manner as in Example 210.

The results are shown in Table 38.

EXAMPLE 217

The same procedure as in Example 212 was effected except that a charge-transporting substance was Compound Example 7-(79), the weight average molecular weight of a polycarbonate resin was 70,000, and its amount was 6 g, thereby preparing an electrophotographic photosensitive member. In this case, the thickness of a charge-transporting layer was 20 μm.

The thus prepared photosensitive member was evaluated in the same manner as in Example 210.

The results are shown in Table 38.

EXAMPLE 218

The same procedure as in Example 212 was effected except that a charge-transporting substance was Compound Example 8-(50), the amount of a polycarbonate resin was 6 g, the butyralation degree of a polyvinylbutyral resin was 75 mol %, and its amount was 0.9 g, thereby preparing an electrophotographic photosensitive member. In this case, the thickness of a charge-transporting layer was 20 μm and that of a charge-generating layer was 0.4 μm.

The thus prepared photosensitive member was evaluated in the same manner as in Example 210.

The results are shown in Table 38.

EXAMPLE 219

The same procedure as in Example 212 was effected except that a charge-transporting substance was Compound Example 9-(88) and the weight average molecular weight of a polycarbonate resin was 100,000, thereby preparing an electrophotographic photosensitive member. In this case, the thickness of a charge-transporting layer was 12 μm.

The thus prepared photosensitive member was evaluated in the same manner as in Example 210.

The results are shown in Table 38.

EXAMPLE 220

The same procedure as in Example 212 was effected except that a charge-transporting substance was Compound Example 10-(49), the weight average molecular weight of a polycarbonate resin was 50,000, and the amount of a polyvinylbutyral resin was 2 g, thereby preparing an electrophotographic photosensitive member. In this case, the thickness of a charge-transporting layer was 17 μm and that of a charge-generating layer was 0.7 μm.

The thus prepared photosensitive member was evaluated in the same manner as in Example 210.

The results are shown in Table 38.

EXAMPLE 221

The same procedure as in Example 212 was effected except that a charge-transporting substance was Compound Example 11-(31), the weight average molecular weight of a polycarbonate resin was 50,000, and its amount was 7 g, thereby preparing an electrophotographic photosensitive member.

The results are shown in Table 38.

EXAMPLE 222

The same procedure as in Example 212 was effected except that a charge-transporting substance was Compound Example 12-(77), thereby preparing an electrophotographic photosensitive member. In this case, the thickness of a charge-generating layer was 0.3 μm.

The thus prepared photosensitive member was evaluated in the same manner as in Example 210.

The results are shown in Table 38.

EXAMPLE 223

The same procedure as in Example 212 was effected except that a charge-transporting substance was Compound Example 13-(69), the weight average molecular weight of a polycarbonate resin was 100,000, and the amount of a bisazo pigment was 3 g, thereby preparing an electrophotographic photosensitive member. In this case, the thickness of a charge-transporting layer was 18 μm and that of a charge-generating layer was 0.3 μm.

The thus prepared photosensitive member was evaluated in the same manner as in Example 210.

The results are shown in Table 38.

EXAMPLE 224

The same procedure as in Example 212 was effected except that a charge-transporting substance was Compound Example 14-(75), thereby preparing an electrophotographic photosensitive member. In this case, the thickness of a charge-transporting layer was 20 μm.

The thus prepared photosensitive member was evaluated in the same manner as in Example 210.

The results are shown in Table 38.

EXAMPLE 225

The same procedure as in Example 212 was effected except that a charge-transporting substance was Compound Example 15-(90), the weight average molecular weight of a polycarbonate resin was 35,000, and the amount of a polyvinylbutyral resin was 1 g, thereby preparing an electrophotographic photosensitive member. In this case, the thickness of a charge-transporting layer was 14 μm and that of a charge-generating layer was 0.3 μm.

The thus prepared photosensitive member was evaluated in the same manner as in Example 210.

The results are shown in Table 38.

TABLE 38

| Example | Compound Example | $V_0$ (+V) | $V_1$ (+V) | $E_{1/2}$ (lux · sec) | $V_R$ (+V) |
|---|---|---|---|---|---|
| 212 | 2-(77) | −700 | −680 | 3.4 | −55 |
| 213 | 3-(6) | −700 | −695 | 2.8 | −40 |
| 214 | 4-(33) | −700 | −680 | 3.2 | −40 |
| 215 | 5-(95) | −700 | −670 | 3.6 | −50 |

TABLE 38-continued

| | | | | | |
|---|---|---|---|---|---|
| 216 | 6-(15) | −700 | −690 | 2.9 | −50 |
| 217 | 7-(79) | −700 | −670 | 3.5 | −45 |
| 218 | 8-(50) | −700 | −690 | 3.6 | −50 |
| 219 | 9-(88) | −700 | −690 | 3.6 | −50 |
| 220 | 10-(49) | −700 | −690 | 2.9 | −45 |
| 221 | 11-(31) | −700 | −680 | 3.6 | −50 |
| 222 | 12-(77) | −700 | −680 | 3.1 | −30 |
| 223 | 13-(69) | −700 | −690 | 3.1 | −45 |
| 224 | 14-(75) | −700 | −685 | 2.6 | −40 |
| 225 | 15-(90) | −680 | −675 | 3.6 | −55 |

EXAMPLE 226

An aluminum substrate was coated with a 5% methanol solution of an alcohol-soluble copolymerized nylon resin (weight average molecular weight 80,000), so that a subbing layer having a dry thickness of 1 μm was formed thereon.

Next, 4 g of a pigment used in Example 212 was dispersed in 45 ml of tetrahydrofuran by means of a sand mill.

Afterward, 5 g of Compound Example 1-(30) which was a charge-transporting substance and 10 g of a polycarbonate resin (weight average molecular weight 25,000) were dissolved in 50 g of a monochlorobenzene (60 parts by weight)/dichloromethane (40 parts by weight) solution, and the solution was then added to the previously prepared dispersion, followed by further dispersing for 3 hours by the sand mill.

The dispersion was applied onto the previously formed subbing layer by a Meyer bar and dried so that a dry thickness might be 18 μm.

The thus prepared photosensitive member was evaluated in the same manner as in Example 1.

The results are as follows.

$V_0$=+693 V; $V_1$=+687 V;

$E_{1/2}$=4.2 lux.sec; $V_R$=+75 V

EXAMPLE 227

An aluminum substrate was coated with a 5% methanol solution of an alcohol-soluble copolymerized nylon resin (weight average molecular weight 100,000), so that a subbing layer having a dry thickness of 1 μm was formed thereon.

Next, 4 g of a pigment represented by the formula

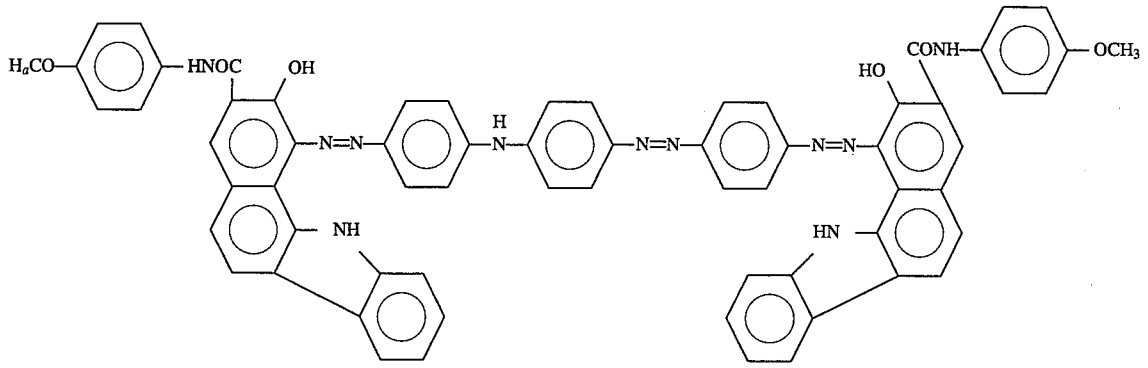

was dispersed in 40 ml of tetrahydrofuran by means of a sand mill.

Afterward, 5 g of Compound Example 16-(55) which was a charge-transporting substance and 5 g of a polycarbonate resin (weight average molecular weight 30,000) were dissolved in 45 g of a chlorobenzene (70 parts by weight)/dichloromethane (30 parts by weight) solution, and the solution was then added to the previously prepared dispersion, followed by further dispersing for 10 hours by the sand mill.

The dispersion was applied onto the previously formed subbing layer by a Meyer bar and dried so that a dry thickness might be 17 μm.

The charging characteristics of the thus prepared photosensitive member was evaluated in the same manner as in Example 1.

The results are as follows.

$V_0$=+695 V; $V_1$=+690 V;

$E_{1/2}$=4.4 lux.sec ; $V_R$=+65 V

What is claimed is:

1. An electrophotographic photosensitive member comprising an electroconductive support and a photosensitive layer on said electroconductive support, said photosensitive layer containing a charge-generating substance and a charge-transporting substance with electron-transporting ability, said charge-transporting substance represented by formula (1)

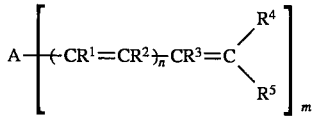

(1)

wherein A is an aromatic ring group derived from an aromatic compound having a reduction potential of −1.05 V or more; each of $R^1$, $R^2$, $R^3$, $R^4$ and $R^5$ is a hydrogen atom, a substituted or unsubstituted alkyl group, a substituted or unsubstituted aralkyl group, or a substituted or unsubstituted aromatic ring group, and $R^1$, $R^2$, $R^3$, $R^4$ and $R^5$ may be different or identical, provided that $R^4$ and $R^5$ are not hydrogen atoms at the same time; n is an integer of 0 or 1; and m is an integer of 1 or 2.

2. The electrophotographic photosensitive member according to claim 1 having a subbing layer between said electroconductive support and said photosensitive layer.

3. The electrophotographic photosensitive member according to claim 1 having said electroconductive support, said photosensitive layer and a protective layer in this order.

4. The electrophotographic photosensitive member according to claim 1, wherein said photosensitive layer is a single layer.

5. The electrophotographic photosensitive member according to claim 1, wherein said photosensitive layer has a charge-generating layer containing a charge-generating substance and a charge-transporting layer containing said charge-transporting substance.

6. The electrophotographic photosensitive member according to claim 5, having said electroconductive support, said charge-generating layer and said charge-transporting layer in this order.

7. The electrophotographic photosensitive member according to claim 5, having said electroconductive support, said charge-transporting layer and said charge-generating layer in this order.

* * * * *

UNITED STATES PATENT AND TRADEMARK OFFICE

CERTIFICATE OF CORRECTION

PATENT NO. : 5,484,673

DATED : January 16, 1996

INVENTOR(S) : TOSHIHIRO KIKUCHI ET AL.

It is certified that error appears in the above-identified patent and that said Letters Patent is hereby corrected as shown below:

ON THE TITLE PAGE

AT [56] REFERENCES CITED

Other Publications, "AN 221832" should read --AN 228132--.

AT [57] ABSTRACT

Line 2, "lazer" should read --laser--.

In the Drawings

SHEET 1 OF 1

FIG. 1, "READIND" should read --READING--.

COLUMN 1

Line 45, "has" should read--have--.

COLUMN 2

Line 18, "measures" should read --measure--.

COLUMN 12

Line 49, "$R_{12-5}$" (second occurrence) should read --$R_{12-6}$--.

UNITED STATES PATENT AND TRADEMARK OFFICE

CERTIFICATE OF CORRECTION

PATENT NO. : 5,484,673

DATED : January 16, 1996

INVENTOR(S) : TOSHIHIRO KIKUCHI ET AL.

It is certified that error appears in the above-identified patent and that said Letters Patent is hereby corrected as shown below:

COLUMN 13

Line 39, "$R_{14-3}$Formula (14)" should read --$R_{14-3}$ Formula (14)--.

COLUMN 23

Compound 1-(31), "=C" (first occurrence) should be deleted.
Compound 1-(32), "=C" (first occurrence) should be deleted.

COLUMN 27

Compound 1-(46), "CH-CH=" should be deleted.

COLUMN 35

Compound 2-(39), "-CH=C" should read -- -CH=CH-CH=C--.

COLUMN 36

Line 40, "-$R_{2-1}$:" should read --$R_{2-1}$:--.

UNITED STATES PATENT AND TRADEMARK OFFICE

CERTIFICATE OF CORRECTION

PATENT NO. : 5,484,673

DATED : January 16, 1996

INVENTOR(S) : TOSHIHIRO KIKUCHI ET AL.

It is certified that error appears in the above-identified patent and that said Letters Patent is hereby corrected as shown below:

COLUMN 37

Compound 2-(44), " 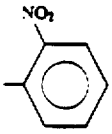 " should read -- 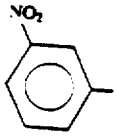 --.

COLUMN 125

Compound 7-(13), "-CH=CH=$NO_2$" should read -- -CH=CH-$NO_2$--.

COLUMN 146

Compound 8-(12), "-CH=CH--$NO_2$" should read -- -CH=CH-$NO_2$--.

Compound 8-(13), "-CH=CH--$NO_2$" should read -- -CH=CH-$NO_2$--.

COLUMN 151

Compound 8-(32), " 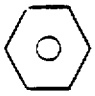 " should read -- 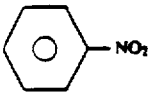 --.

COLUMN 156

Compound 8-(53), " 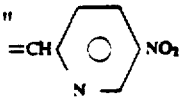 " should read -- 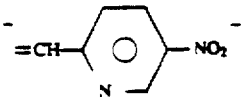 --.

UNITED STATES PATENT AND TRADEMARK OFFICE

CERTIFICATE OF CORRECTION

PATENT NO. : 5,484,673

DATED : January 16, 1996

INVENTOR(S) : TOSHIHIRO KIKUCHI ET AL.

It is certified that error appears in the above-identified patent and that said Letters Patent is hereby corrected as shown below:

COLUMN 165

Compound 9-(4), "$-CH=CH=NO_2$" should read -- $-CH=CH-NO_2$--.

Compound 9-(5), "$-CH=CH=NO_2$" should read -- $-CH=CH-NO_2$--.

Compound 9-(6), "$-CH=CH=NO_2$" should read -- $-CH=CH-NO_2$--.

Compound 9-(7), "$-CH=CH=NO_2$" should read -- $-CH=CH-NO_2$--.

COLUMN 166

Compound 9-(8), "$-CH=CH=NO_2$" should read -- $-CH=CH-NO_2$--.

Compound 9-(9), "$-CH=CH=NO_2$" should read -- $-CH=CH-NO_2$--.

Compound 9-(10), "$-CH=CH=NO_2$" should read -- $-CH=CH-NO_2$--.

Compound 9-(11), "$-CH=CH=NO_2$" should read -- $-CH=CH-NO_2$--.

COLUMN 167

Compound 9-(12), "$-CH=CH=NO_2$" should read -- $-CH=CH-NO_2$--.

Compound 9-(13), "$-CH=CH=NO_2$" should read -- $-CH=CH-NO_2$--.

UNITED STATES PATENT AND TRADEMARK OFFICE

CERTIFICATE OF CORRECTION

PATENT NO. : 5,484,673

DATED : January 16, 1996

INVENTOR(S) : TOSHIHIRO KIKUCHI ET AL.

It is certified that error appears in the above-identified patent and that said Letters Patent is hereby corrected as shown below:

COLUMN 182

Compound 9-(73), "$-CH=CH)_2-NO_2$" should read -- $-(CH=CH)_2-NO_2$--.

COLUMN 193

Compound 10-(30), " 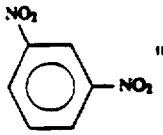 " should read -- 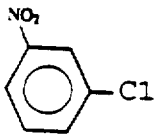 --.

COLUMN 195

Compound 10-(36), "$-CH=CH)_2$" should read -- $-(CH=CH)_2$--.

COLUMN 199

Compound 10-(50), "-CH=CH-CH-C" should read -- -CH=CH-CH=C--.

COLUMN 202

Compound 10-(61), " 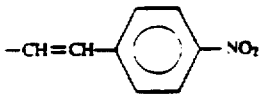 " should read

--$CH_2$ 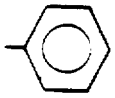 --.

UNITED STATES PATENT AND TRADEMARK OFFICE

CERTIFICATE OF CORRECTION

PATENT NO. : 5,484,673

DATED : January 16, 1996

INVENTOR(S) : TOSHIHIRO KIKUCHI ET AL.

It is certified that error appears in the above-identified patent and that said Letters Patent is hereby corrected as shown below:

COLUMN 256

Compound 13-(75), " 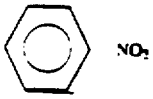 " should read -- 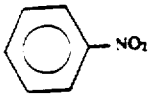 --.

COLUMN 266

Compound 14-(29), "$R_{14-3}$:" should read --$R_{14-3}$: -H--.

COLUMN 271

Compound 14-(48), " 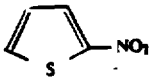 " should read -- 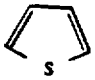 --.

COLUMN 278

Compound 14-(74), "$R_{14-4}$: $CH_3$" should read --$R_{14-4}$: $-CH_3$--.

COLUMN 294

Compound 15-(30), " 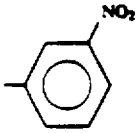 " should read -- 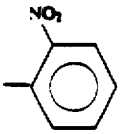 --.

UNITED STATES PATENT AND TRADEMARK OFFICE

CERTIFICATE OF CORRECTION

PATENT NO. : 5,484,673

DATED : January 16, 1996

INVENTOR(S) : TOSHIHIRO KIKUCHI ET AL.

It is certified that error appears in the above-identified patent and that said Letters Patent is hereby corrected as shown below:

COLUMN 300

Composition 15-(45), "$O_2N$" should read --$NO_2$--.

COLUMN 302

Composition 15-(49), " 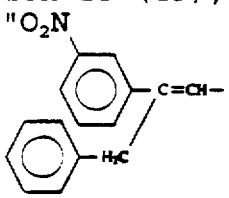

" should read --$O_2N$- 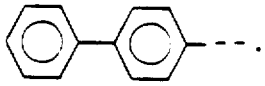 --.

COLUMN 348

Line 59, "1%" should read --71%--.

COLUMN 355

Line 27, "dissolved" should read --dissolving--.

COLUMN 357

Line 48, "after" should read --after being--.

UNITED STATES PATENT AND TRADEMARK OFFICE

CERTIFICATE OF CORRECTION

PATENT NO. : 5,484,673

DATED : January 16, 1996

INVENTOR(S) : TOSHIHIRO KIKUCHI ET AL.

It is certified that error appears in the above-identified patent and that said Letters Patent is hereby corrected as shown below:

COLUMN 358

Line 7, "100 Lux.sec," should read --100 lux.sec,--.

COLUMN 376

Line 49, "TABLE 22" should read --TABLE 21--.

COLUMN 377

Line 2, "TABLE 22" should read --TABLE 21--.

COLUMN 395

Line 3, "diluted," should read --dilution,--.

UNITED STATES PATENT AND TRADEMARK OFFICE

CERTIFICATE OF CORRECTION

PATENT NO. : 5,484,673

DATED : January 16, 1996

INVENTOR(S) : TOSHIHIRO KIKUCHI ET AL.

It is certified that error appears in the above-identified patent and that said Letters Patent is hereby corrected as shown below:

COLUMN 404

Line 8,

"

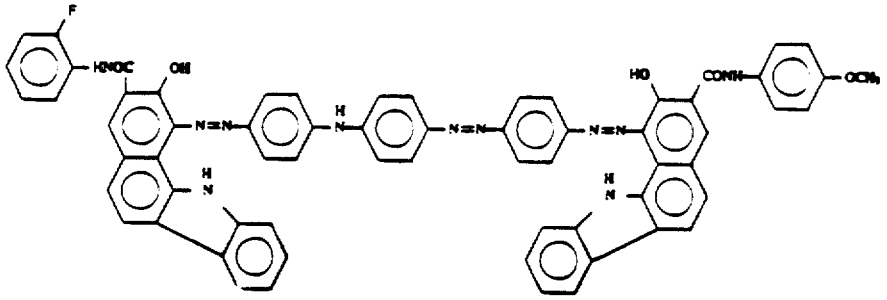

"

should read

--

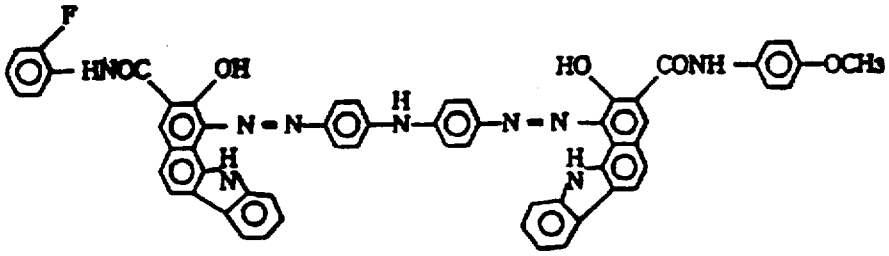

--.

Line 48, "Table 35." should read --Table 38.--.

UNITED STATES PATENT AND TRADEMARK OFFICE

CERTIFICATE OF CORRECTION

PATENT NO. : 5,484,673

DATED : January 16, 1996

INVENTOR(S) : TOSHIHIRO KIKUCHI ET AL.

It is certified that error appears in the above-identified patent and that said Letters Patent is hereby corrected as shown below:

COLUMN 407

Line 48,

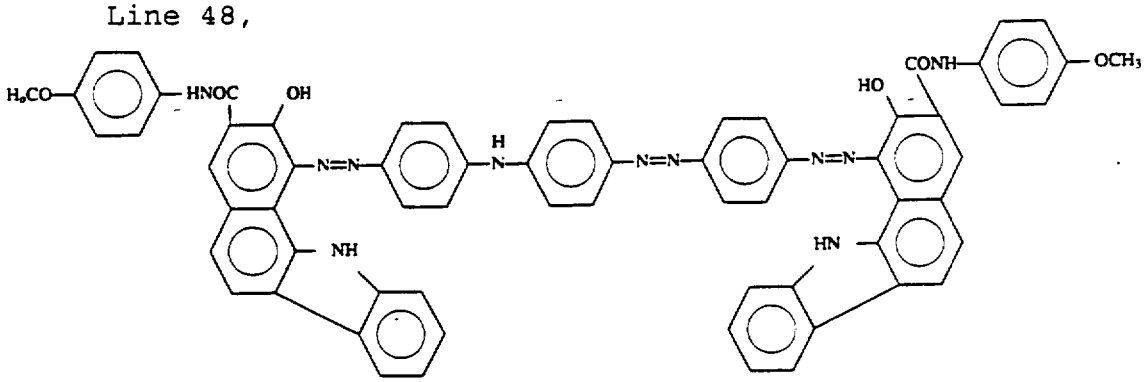

should read

--

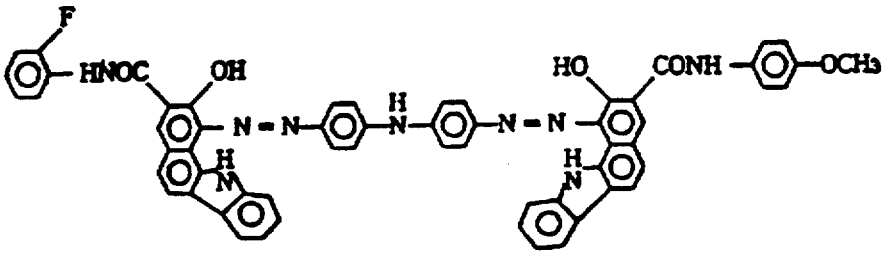

--.

UNITED STATES PATENT AND TRADEMARK OFFICE

CERTIFICATE OF CORRECTION

PATENT NO. : 5,484,673

DATED : January 16, 1996

INVENTOR(S) : TOSHIHIRO KIKUCHI ET AL.

It is certified that error appears in the above-identified patent and that said Letters Patent is hereby corrected as shown below:

COLUMN 408

Line 9, "was" should read --were--.

COLUMN 409

Line 5, "claim 1" should read --claim 1,--.
Line 8, "claim 1" should read --claim 1,--.

Signed and Sealed this

Nineteenth Day of November, 1996

*Attest:*

Bruce Lehman

BRUCE LEHMAN

*Attesting Officer*

*Commissioner of Patents and Trademarks*